US005870484A

United States Patent [19]

Greenberger

[11] Patent Number: 5,870,484

[45] Date of Patent: Feb. 9, 1999

[54] LOUDSPEAKER ARRAY WITH SIGNAL DEPENDENT RADIATION PATTERN

[76] Inventor: Hal Greenberger, 182 Laurelwood Dr., Hopedale, Mass. 01747

[21] Appl. No.: 711,686

[22] Filed: Sep. 5, 1996

Related U.S. Application Data

[60] Provisional application No. 60/003,246, Sep. 5, 1995.

[51] Int. Cl.[6] ..... H04R 5/00

[52] U.S. Cl. ..... 381/300; 391/17

[58] Field of Search ..... 381/24, 1, 28, 381/2, 120, 17, 300, 303

[56] References Cited

U.S. PATENT DOCUMENTS 3,104,729 9/1963 Olson ..... 381/24
3,627,948 12/1971 Nichols ..... 381/24
3,754,618 8/1973 Sasaki ..... 381/24
4,596,034 6/1986 Moncrieff ..... 381/24
5,764,777 6/1998 Goldparb ..... 381/300

*Primary Examiner*—Minsun Oh Harvey
*Attorney, Agent, or Firm*—Brian M. Dingman

[57] ABSTRACT

This invention features a sound reproduction system in which both signals of a stereo pair of signals are radiated with a directional radiation pattern having a first order gradient characteristic over the frequency range where interaural time difference cues dominate localization in the human auditory system. The directional radiation patterns have main radiation lobes pointing in different directions.

49 Claims, 50 Drawing Sheets

Two Transducer
Embodiments

Single Transducer Delay
Gradient Embodiments

Dipole Configurations

Single Transducer Dipole MD-Grad Embodiment

Three Element Embodiments

Higher order acoustical filter on rear of diaphragm output

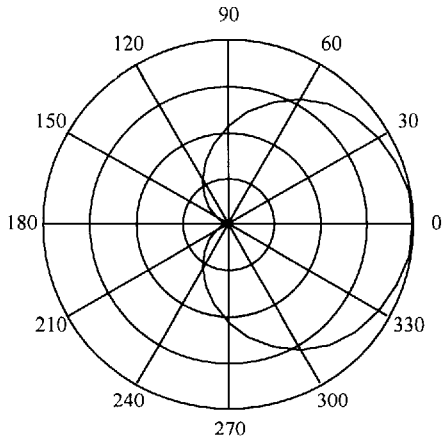
150 Hz
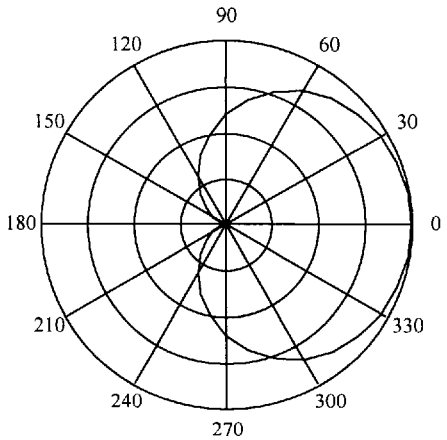
600 Hz
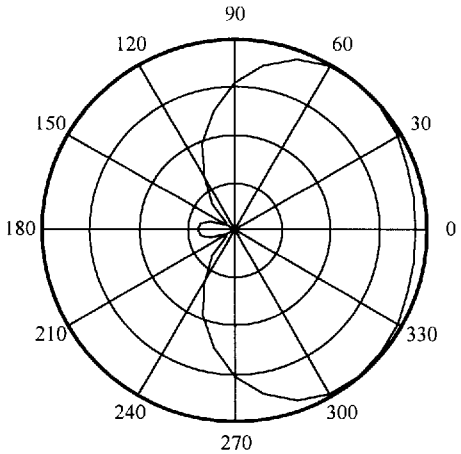
1200 Hz
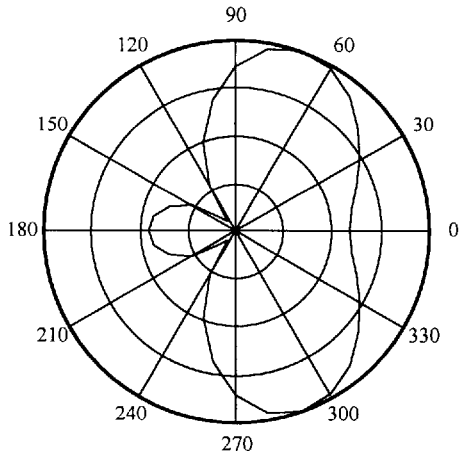
1800 Hz
Figure 14a

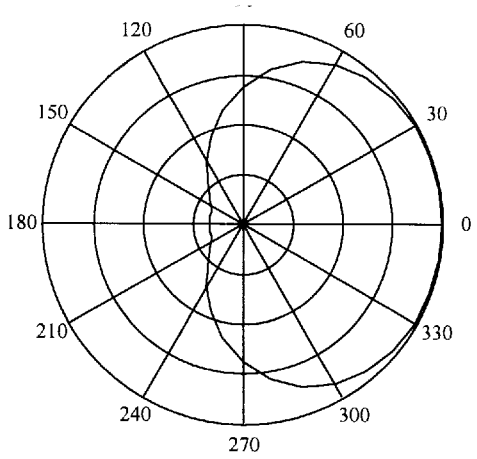
150 Hz
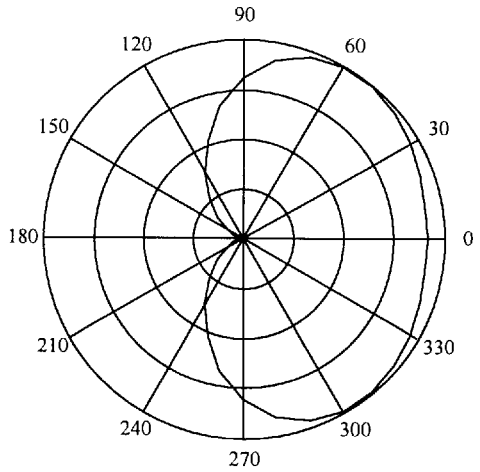
600 Hz
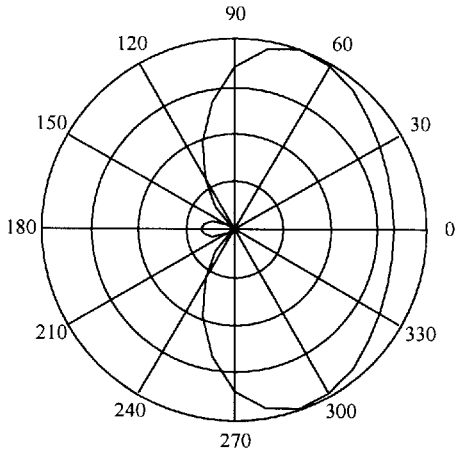
1200 Hz
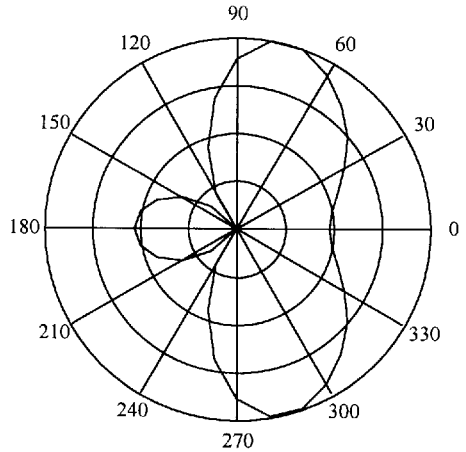
1800 Hz
Figure 14b

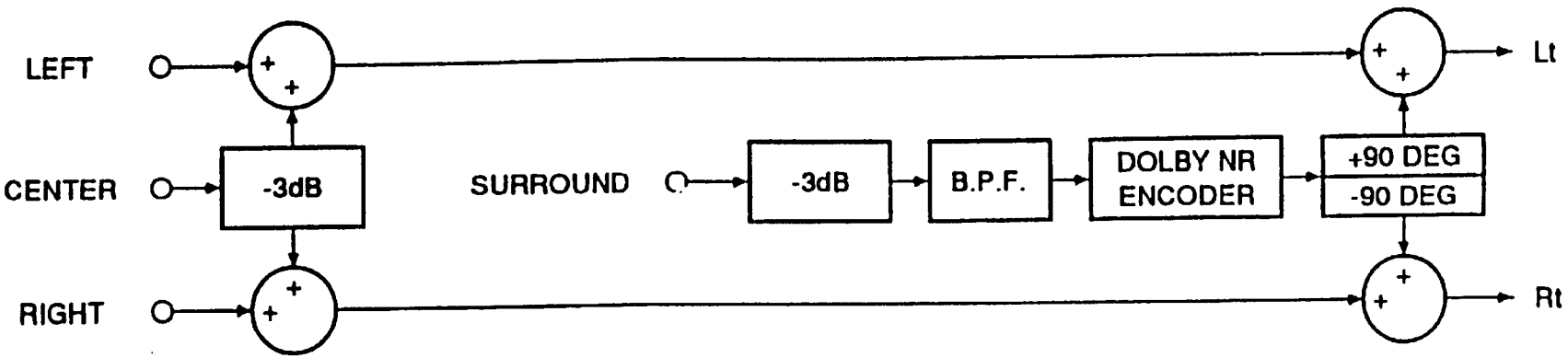
Fig. 19 Conceptual Dolby Stereo/Dolby Surround Encoder

Top View

Top View

LOUDSPEAKER ARRAY WITH SIGNAL DEPENDENT RADIATION PATTERN

CROSS-REFERENCE TO RELATED APPLICATION

This application is a continuation-in-part of copending provisional patent application No. 60/003,246, filed on Sep. 5, 1995.

BACKGROUND OF THE INVENTION

1. Technical Field

This invention relates to apparatus and methods for reproducing two channel or multi-channel audio signals from a loudspeaker array. The invention is useful for stereo music reproduction and for reproducing surround sound audio program material that accompanies movies and television. The invention is an optimized configuration for the reproduction of two channel audio program material from closely spaced sources. The current invention includes an array of loudspeaker elements, generally (but not limited to being) centrally located with respect to a listening area, where the array is generally displaced toward the front of the listening area, and associated signal processing circuitry that allows the array to generate a spacious sound field while maintaining left(right imaging ability and a solid center image. The invention is capable of generating perceived sound source locations that are located far outside the array physical location. The perceived sound source locations are stable and do not degenerate as a listener turns his head or moves about the listening room. A user control is provided that allows the spatiousness and localization characteristics of the system to be adjusted by the end user.

2. Discussion

Typical stereo reproduction systems use two loudspeakers that are displaced to the left and right of a center listening axis for reproduction of a left and right stereo pair of audio signals. These systems are capable of generating virtual sound source locations that are generally limited to areas located between the two speakers. This is accomplished by adjusting the relative amplitude of a signal simultaneously presented to both channels. The virtual sound sources generated by controlling the relative amplitudes of the loudspeaker outputs do not remain stable throughout the listening environment. The images tend to collapse toward the near loudspeaker location as a listener moves off the center line between the two speakers.

Other systems have been constructed (Shivers[1], Hafler[2], Klayman[3], and others) in an attempt to generate a more spacious sound field by adding various configurations of loudspeakers fed some form of difference signal (the difference between the left and right channel signals). It is generally acknowledged that the difference signal contains ambiance information, and that adding loudspeakers to the system that reproduce this signal can enhance the sense of spaciousness generated by the system. The addition of separate sources reproducing the L−R signal usually increases the sense of spaciousness, but it is often at the expense of left/right localization ability. The prior art systems do not attempt to control the radiation pattern of the different speaker systems in any way. The directions in which left and right channel signals, and difference signals, are radiated into space by systems that include these extra sources are random and un-controlled. These systems also require the use of additional loudspeakers to reproduce these difference signals, which increases their cost.

Still other inventors have tried to develop a centrally located loudspeaker array that is capable of generating an increased sense of spaciousness (Klayman[3], Holl, Short et al.[4]). These systems are designed primarily for use with video systems. These systems are capable of generating a spacious sound field but are not capable of achieving a strong left/right localization capability. They do not take into account the effect of element spacing, relative level, and relative phase between the array elements on the radiation pattern of the array. The net overall radiation pattern of these systems is not controlled and the ability of these systems to generate localization cues to simulate stable virtual sound sources located outside the physical array position is minimal. The effect of the interaction between the different array elements on the total radiated power of the array is not taken into account in these systems. The total power response of these systems is not controlled in any way.

Still other prior art systems have tried to extend the range of possible virtual sound source locations that can be generated by a stereo pair of loudspeakers by introducing interaural crosstalk cancellation. The intent is to obtain direct control over the signals presented to each ear of a listener and adjust them in such a way that the signals represent what would actually be at the listeners ears if a real source were located at the position of an intended location of a virtual source. Systems have been constructed to attempt this electrically using signal processing (Atal and Schroeder[5], Cooper[6], and others), or through the use of particular geometrical arrangements of loudspeakers (Polk[7]). These systems rely on the canceling of signals at a particular point in space that are generated by different physical sources. The cancellation that occurs is strongly dependent on the listening position and the orientation of the listeners head. The effect generated by all of these systems occurs for a single "sweet spot". The improved spatial performance degenerates rapidly with small changes in listener position or orientation. This degeneration does not occur for the present invention.

The crosstalk cancellation systems work by adding a slightly delayed and inverted version of the left channel signal to the right channel signal. By symmetry, a slightly delayed and inverted right channel signal is added to the left channel signal as well. The delay is calculated to be the time difference between the arrival of the signal at the ear closer to the source and the arrival of that same signal at the farther ear. Each signal is also equalized to take into account the effect of head diffraction. The intent of the processing is to cause the delayed left channel signal to arrive at the listener's right ear with exactly the same shape and at exactly the same time as the crosstalk signal from the left speaker, but inverted in polarity so that the two signals cancel. The same is intended for the left ear. It can be seen that the system relies on the precise timing of signal arrivals, along with the orientation and position of the listeners head, in order for the cancellation to work. The cancellation can only work over a relatively small area because of the precise timing of signal arrivals required.

There are some embodiments discussed in Cooper[6] that superficially resemble some embodiments of the invention of this disclosure. Upon closer examination, they are found to be significantly different. In one embodiment, Cooper uses a monopole and a dipole speaker where the monopole is fed an equalized L+R (sum) signal and the dipole is fed an equalized L−R (difference) signal. The combination of a monopole and dipole speaker, where the monopole is fed an equalized sum signal and the dipole is fed an equalized difference signal also appears in the present invention. However, the equalization used in the present invention and that used in Cooper differ significantly. As a result, the behavior of the two systems differ significantly.

The equalization described by Cooper and others depends on the spacing between a listeners ears, and the angle of the loudspeakers with respect to the listeners head, and is designed solely to compensate for the diffraction of signals around the listeners head. The equalization used in the present invention however, depends solely on the physical spacing between the loudspeaker array elements. There is no dependence on the geometry of the listeners head whatsoever. As a result, the form of the equalization is different in the present invention than that required by the cross talk cancellation schemes, and the behavior of the systems is different as well.

The equalization used in the crosstalk cancellation systems is only concerned with the control of the direct sound arrival from the loudspeakers, at a particular point in space, to generate specific frequency responses at the location of the listeners ears. The crosstalk cancellation schemes are not concerned with radiation from the loudspeakers in any direction other than directly at the listener. The crosstalk cancellation systems do not attempt to deal with listening locations distributed throughout a listening room. The crosstalk cancellation systems are not concerned with the total power radiated by the combined loudspeaker elements. The crosstalk cancellation systems do not consider the effect of loudspeaker element spacing on the radiation pattern and total radiated power of the combined loudspeaker elements. The equalization shown in Cooper and described by others will cause significant coloration of sound, because of their failure to consider the radiated power and radiation pattern of the complete system.

The intent of the present invention is to use particular array configurations, and equalization that directly depends on the array configuration, to control the overall radiation pattern of the array in a specific fashion (which will be described later). The present invention is concerned with controlling the sound radiated in all directions from the loudspeaker array, not just directly at a specific listening position. The primary intent of the invention is to radiate different signals in different directions, to alter the reflected to direct energy ratio heard by listeners throughout the listening room. The reflected to direct energy ratio is controlled in an attempt to steer the localization of signals to the location of the reflections, away from the source of direct sound. It is also the intent of the current invention to provide a system that has a flat power response as a function of frequency over the frequency range where the radiation pattern of the array is being controlled. Controlling the radiated power of the system helps minimize frequency response aberrations throughout the listening area. The system radiated power remains flat, regardless of the adjustment of the spatial controls. (Spatial controls are described later as part of the overall discussion of the different embodiments of the invention. The function of the spatial controls is to alter the radiation patterns generated by the array in a useful manner, which is also described later.)

It will be shown later that the choice of element spacing is a trade off between efficiency at low frequencies and radiation pattern control at high frequencies. There are different embodiments that will use different element spacing for operation over different frequency ranges. The frequency response of the equalization required in the present invention will be shown to directly depend on desired operating frequency range of the array, which is directly determined by the array element spacing. This direct dependence of equalization on the orientation of the individual loudspeaker elements is of key importance in the present invention, and is not known in the prior art.

Still other prior art systems attempt to alter the reflected to direct sound ratio of the sound radiated from a single loudspeaker by using multiple radiating elements, where the majority of the elements are faced away from the primary listening position. An example of such a system is the Bose 901 loudspeaker, marketed by Bose Corporation. This loudspeaker uses a total of nine full range 4.5 inch transducers, where one transducer is pointed at the listening area and the other eight are faced away from the listening area. This system will be capable of increasing the reflected to direct sound ratio, but only at higher frequencies. At low frequencies, the loudspeaker will radiate omni directionally, as the sources are small compared to the wavelength of sound at low frequencies. The relative magnitude and phase of the different element outputs are not manipulated in any way in an attempt to control the radiation pattern at low frequencies. All the elements operate in phase over their entire operating frequency range. It will be shown later that the low frequency range is precisely the frequency range where the reflected to direct sound ratio needs to be controlled in order to generate localization cues that are displaced away from the physical location of the loudspeaker. It is precisely the directivity pattern of the loudspeaker array at low frequencies that is controlled in the present invention.

OBJECTS OF THE INVENTION

It is an object of this invention to create a combination of a loudspeaker array and associated signal processing that is capable of generating a signal dependent radiation pattern, for a pair of stereo audio signals applied to the array.

It is a further object of the invention to generate its signal dependent radiation pattern over the approximate frequency range where interaural time differences are used as primary cues for localization of sound sources.

It is a further object of the invention to create a signal dependent radiation pattern from a centrally placed array in such a way that a first channel signal is radiated primarily in a first direction, a second channel signal is radiated primarily in a second direction that is different from the first direction.

It is a further object of the invention to create a signal dependent radiation pattern, where the total radiated power of each stereo channel signal radiated is constant as a function of frequency, over the frequency range where directivity pattern control is maintained.

It is a further object of the invention to generate a spacious sound field for all listeners throughout a listening room, while maintaining a strong center image and realistic left/right imaging capability, from a single loudspeaker array.

It is a further object of the invention to accomplish its signal dependent radiation pattern using a minimum of loudspeaker elements and amplifier channels. The preferred embodiments can achieve their signal dependent radiation performance using only two channels of amplification and two transducer elements.

It is a further object of the invention to create its signal dependent radiation behavior using a minimum of separate speaker boxes to minimize the intrusion of the system into the living space.

It is a further object of the invention to create a system that gives the user the capability to control the radiation patterns and spaciousness of the system using simple controls.

It is a further object of the invention to create a system that achieves its performance in a simple and straightforward manner that is easy for the end user to set up and operate.

It is a further object of the invention to create a system that can be easily integrated into numerous audio applications such as home theater, portable stereo, multimedia audio, and automotive sound systems.

It is a further object of the invention to create a signal dependent radiation pattern loudspeaker array that can be used in identical pairs to form enhanced stereo loudspeaker systems.

SUMMARY OF THE INVENTION

The invention is a sound reproduction system that consists of an array of loudspeaker transducer elements and associated signal processing circuitry that work together to tightly control the radiation pattern of the loudspeaker array. The system is designed to radiate multiple independent signals in different desired directions simultaneously. The individual signals fed to the loudspeaker array elements are manipulated in a particular manner by the signal processing circuitry so that the signals are each radiated in their desired directions. The ability of the system to achieve its signal dependent radiation pattern (SDR) behavior relies on the physical positioning of the array elements, the individual array element frequency responses and directivity characteristics, and signal processing applied to the incoming signals that maintains specific magnitude and phase relationships between the outputs of the different array elements. The radiation behavior of the system is controlled in an effort to manipulate the ratio of reflected sound to direct sound (reflected/direct sound ratio) heard by a listener. The reflected/direct sound ratio is manipulated in an effort to improve spatiousness, widen the stereo sound stage, and generate virtual auditory images that are significantly displaced away from the location of the loudspeaker array while maintaining a strong center image.

The primary anticipated use of the system is for reproduction of two channel stereo signals, although multichannel signals can also be accommodated. Use with multichannel signals is discussed in the Home Theater application section with respect to Dolby Pro-Logic decoding systems. The invention is of particular value in reproducing 4 to 2 channel encoded signals that are typical of movie sound tracks. The invention will also find use in computer multimedia systems, portable stereos, automotive sound systems, and any other applications where the available spacing between traditional left and right stereo loudspeakers is limited in some way. The system is designed so that a first channel signal of a stereo pair is radiated with a directional radiation pattern, whose main radiation lobe is pointed in a first direction, and the second channel signal is similarly radiated with a directional radiation pattern where the main radiation lobe is pointing in a second direction, different from the first direction. A directional radiation pattern, as generated for the first and second channel signals in the present invention, has a beam width, where beam width is defined in Beranek[13] as the angular distance between the two points on either side of the principal axis, where the sound pressure level is down 6 dB from its value at $\theta=0°$ (where 0° here refers to the direction of the principal axis of radiation).

A particularly useful condition will be shown to have the origins of the first and second directional radiation patterns coincident in space, and further arranged so that their main radiating directions are 180° opposed to each other. When this configuration is used, the same physical array elements used to radiate the first channel signal can also be used to radiate the second channel signal. (This is true when gradient loudspeakers are used as the directional loudspeakers. Gradient loudspeakers will be discussed in more detail later.) This configuration will be shown to use a minimum number of array elements and amplification channels, and is the form of the preferred embodiments.

The invention is not limited to radiating the two channels in directions 180° opposed to each other, however. There are useful system configurations where the angle between the main radiating directions of the two channels is something other than 180°. These configurations are effective in situations where it is desired to further increase or decrease the reflected/direct sound ratio at the listening position over what is possible using the 180° angle embodiment. Configurations where the main radiation axes of the two channels are not 180° opposed to each other may require an additional channel or channels of amplification, and additional transducers, over that required by the preferred embodiments. There are numerous methods for constructing a system where two signals are each radiated with directional radiation patterns, where the principal axes of radiation can be oriented at an arbitrary angle with respect to each other. These will be discussed in more detail later.

The invention is also not limited to having the origins of the first and second channel radiation patterns coincident in space. There are some applications where some separation of the origins may be beneficial. The separation in space of the origins of the radiation patterns will require additional transducers and channels of amplification to accomplish.

The fundamental technology that all of the embodiments to be described shortly rely on are: 1) The use of techniques to radiate first and second channel signals with directional radiation patterns, 2) The main radiation directions of at least one, and for most applications both, of the first and second channel signals are directed away from the primary listening position. The preferred embodiments also rely on having the origins of the directional radiation patterns coincident in space.

In some applications of the invention of this disclosure, the directional radiation patterns of the SDR array are oriented so that the first channel signal (which can be the left channel of a stereo pair) has its main radiation axis pointed to the left of the array, for a listener facing the array, and the second channel signal (which can be the right channel signal of a stereo pair) has its main radiation axis pointed to the right of the array. Other applications will reverse that pattern. Still other configurations will point the main radiation axis of one channel directly at the listening position while the second channel is pointed away from the listening position. The applications where these different array orientations are used will be described later.

The embodiments of the present invention are able to generate the required localization cues for a listener to perceive sound sources located at various positions throughout a listening room by controlling the level of sound directly radiated at the listener vs. the level of sound reflected off of wall surfaces in specific directions over specific frequency ranges. The localization created by the present invention is stable over a much larger space than is possible using crosstalk cancellation schemes, because the current invention creates actual secondary sources of sounds, not modified frequency responses at fixed points in space where an individual listener's ears are located. A listener will perceive a stable sound source location with the present invention for any orientation of his head. The location does not change as the listener turns or moves about the room. The system uses what will be called directional loudspeakers to accomplish this controlled radiation pattern. A directional loudspeaker is defined as a loudspeaker that radiates more sound in one direction than in other directions over a substantial frequency range. Directional loudspeakers that we will be concerned with have a defined beam width (where the beam width definition was given earlier). A directional loudspeaker can be made up of one transducer element or an array of elements. The primary frequency range over which the directional loudspeaker must achieve its controlled radiation, for most of the possible applications of the current invention, is described shortly in the psychoacoustic theory section. Other applications of the current invention where the desired operating frequency range is different from that described in the psychoacoustics section will described individually in later sections.

Directional loudspeakers can be created in a number of ways. One common method is to use what will be referred to as wave type loudspeakers, whose directivity pattern depends in some manner upon wave interference of the sound emanating from the elements of the radiating surface. (A horn loudspeaker is one example of a wave type device). The size of the radiating surface of these devices must be comparable to a wavelength if any appreciable directivity control is to be maintained. This implies that wave type devices must become very large if directivity control is desired at low frequencies, where the wavelengths of sound are large. (The wavelength of a sound wave at 150 Hz, which will be shown to be a reasonable low frequency limit for maintaining directivity pattern control for the present invention to achieve its desired localization performance, is approximately 7.5 ft.) Wave type devices large enough to have the required directivity pattern control down to the low frequency limit required by the present invention cannot usually be accommodated in the average listening room. However, wave type devices can be effectively used at higher frequencies. There are some embodiments discussed where wave type devices will be used for directivity control at higher frequencies in combination with some other type of device that provides directivity pattern control at low frequencies.

Directional behavior at low frequencies can also be achieved by the use of multiple sources of sound displaced in space, where the relative magnitude, phase, and/or time delay of the outputs of the elements are controlled in a particular manner. Gradient loudspeakers depend on the phase difference, or powers of the phase difference, between two or more elements distributed in space, to achieve directivity pattern control. The preferred embodiments of the current invention use gradient loudspeaker technology in a novel fashion to accomplish radiation pattern control at low frequencies. The invention of this disclosure is not, however limited to the use of gradient type loudspeakers for directivity pattern control. The invention pertains to the use of directional loudspeakers, where any method that can be used to generate a directional loudspeaker is included.

The following sections of this disclosure will first describe the psychoacoustic theory that is exploited by the invention to generate sound source locations distributed throughout the listening space. Next, the theory of gradient loudspeaker operation is given. This is followed by a description of how the preferred embodiments of the invention use gradient loudspeaker technology. The use of other types of directional loudspeakers is also discussed. Finally, a number of embodiments and applications are described.

Psychoacoustic Theory

In an anechoic environment (an environment where there is no reflected sound energy), humans determine the location of a sound source by the characteristics of the direct arrival of energy from the source to the listener. The human auditory system relies on the difference between signals arriving at the two ears to determine the location of a sound source. The differences are due to the fact that the ears are displaced in space and that a large object (the head) is located physically between the ears.

The differences in the ear signals arise in the following manner. Assume that a sound source is located in front of a listener and displaced away from center to the left. The sound emitted from that source will reach the left ear of the listener slightly before it reaches the right ear. This is because the left ear is located slightly closer to the sound source than the right ear. This is the source of what is referred to as interaural time difference (ITD). The ITD also gives rise to a phase difference between the signals at the ears. This phase difference is unambiguous as long as the wavelength of sound at the frequency of interest is larger than twice the spacing between the two ears. This is the case for low frequencies (below the range of 1–2 Khz. An exact transition frequency has not been determined.). The brain uses the ITD (or interaural phase difference) as a localization cue for frequencies below 1–2 Khz. At very low frequencies, where the wavelength of sound is much larger than the spacing between the two ears, there will be very little phase difference between the signals at the ears, which makes the localization cue difficult to detect. This is one reason why it becomes difficult for listeners to localize sounds at low frequencies. The low frequency limit below which localization in rooms becomes difficult is approximately 150 Hz. The proliferation of subwoofer systems that is seen in the consumer audio market today exploits this very fact. Sub woofers that operate below 150 Hz are useful because they can be located almost anywhere in the listening room without detrimental effects on the imaging performance of the system (listeners are not able to tell where the bass comes from). Exploiting this characteristic of human hearing allows the largest physical component of an audio system (the part that makes bass) to be located wherever it can be fit in the room. The lack of localization ability below 150 Hz is also exploited by the present invention.

The ITD cue is not reliable at frequencies above 1–2 Khz, yet it is still possible for the auditory system to localize high frequency information. The presence of the head creates additional differences between the two ear signals which the brain uses for localization. In the situation described above, the sound that reaches the right ear will diffract around the head. This occurs without much alteration in the signal for low frequencies where the wavelengths are large compared to the size of the head. However, at higher frequencies the head will cast a "shadow" that blocks or attenuates some of the high frequency signal from reaching the right ear. This head shadowing causes the level of high frequency information to be less, on average, at the far ear with respect to the near ear. The brain can use this interaural level difference (ILD) as a localization cue for high frequencies. (The actual behavior is more complicated than this. The sound wave diffracts around the head and a complex frequency response that has a series of peaks and dips due to the different path lengths around the front and back of the head is generated at the far ear with respect to the near ear. It is sufficient for our purposes here to use the simpler approximation of a high frequency level difference.)

The conventional theory used to explain localization in human beings (known as the duality theory of localization) states that ITD cues are used for localization of low frequencies and ILD cues are used for localization of high frequencies. However, some interesting experiments have been performed recently to try to improve the understanding of the mechanisms used for localization. The purpose of the experiments was to determine the relative importance of the two different localization cues discussed above.

The experiments were set up (see Wightman[8]) so that test signals could be presented to subjects where the researchers had the ability to alter interaural time difference cues of the signals independently from the interaural level difference cues. The researchers then manipulated signals so that the ITD cues were preserved for a particular location but the ILD cues were modified to mimic other sound source locations. When full bandwidth test signals were so modified and listened to by test subjects, the subjects judgments of sound source location were consistent with the location expected from the ITD cues, regardless of the manipulation of the ILD cues. Only when the test signals had their low frequency content removed (so that there was no longer an interaural time difference cue to use) did localization judgments move to the position consistent with the ILD cues.

What the results of this study imply is that ITD cues are the dominant localization cue used by the auditory system. It should therefore be possible to sufficiently simulate different sound source locations solely by generating the appropriate ITD cues. It should not be necessary to generate ILD cues to obtain realistic sound source locations. This implies that the array will only need to control radiation up to the 1–2 Khz frequency range, although increasing the frequency range over which the proper localization cues are generated provides further improvement in overall performance. Increasing the frequency range to generate ILD cues can help for signals that do not have any energy below 2 Khz. However, a sufficient system can be developed that only operates in the frequency range where the ITD cues are dominant.

Another characteristic of human spatial hearing that is exploited by this invention is referred to in the psychoacoustics literature as time intensity trading. Localization was described above with respect to a single sound source in an anechoic environment. The presence of reflections adds additional complexity to the situation. It has been shown that in the presence of reflected energy, the perception of the location of a sound source will depend on the amount of time delay between the arrival of direct sound at the ears and the arrival of reflected sound, along with the relative level of the reflected sound with respect to the direct sound. When the delay between direct and reflected sound is held constant, the perceived sound source location will move from the location of the direct arrival to the location of the reflection as the level of the reflected sound relative to the direct sound is increased. Shorter delays require less level difference between direct and reflected energies to shift localization than do longer delays. In localization, there is a trade off between the time delay of reflected sound and the intensity of that reflected sound. This is the origin of the term "time intensity trading".

The psychoacoustic theory described so far has the following implications for a system designed to generate virtual sound sources distributed throughout the listening space. Since localization is primarily determined by ITD cues, and ITD cues operate in the low frequency range (approximately 150 Hz on the low end up to the 1–2 Khz range at the high end), the system needs to provide the proper localization cues in this frequency region. Localization in the presence of reflections can be made to follow the location of the reflection if the relative level of the reflected energy is sufficiently higher than the energy of the direct sound and the time delay between the direct and reflected energy is not to large. Therefore, perceived sound sources displaced from a loudspeaker physical position can be generated if sound in the frequency range of 150 Hz to 1–2 Khz can be reflected off wall surfaces in the listening room so that the level of reflected energy that arrives at the listening location is sufficiently large with respect to the level of the direct energy radiated from the speaker. This is the basic premise on which the invention is based.

The majority of the preferred embodiments of this invention are oriented so that a first channel signal is directed to reflect off walls on one side of a listening room, and a second channel signal is simultaneously directed to reflect off walls on the other side of the listening room. When a system is so oriented, it will be generating what is known in the literature as lateral reflections. There are numerous psychoacoustic studies that have been carried out in the architectural acoustics field that have found a strong correlation between the presence of lateral reflections and the sense of spaciousness. The invention, by generating significant amounts of lateral reflected energy, will have increased spaciousness as compared to traditional sound reproduction systems. This is an additional benefit of the present system over other prior art systems.

Gradient Loudspeaker Technology

It can be seen from the above analysis that a directional loudspeaker can be used to generate sound source locations displaced from the physical position of the directional loudspeaker if the speaker is oriented so that it radiates a sufficiently higher amount of energy towards reflecting wall surfaces than it does directly at the listening position, over at least the frequency range between 150 Hz and 1–2 Khz. The invention of this disclosure makes use of directional loudspeakers, oriented in a particular manner, to alter the reflected/direct energy ratio of a loudspeaker array over the required frequency range in the manner required for listeners to perceive realistic sound sources distributed throughout the listening environment. The preferred embodiments use specific element geometry along with specific signal processing that depends on the element geometry to generate first order gradient radiation patterns at low frequencies, which are used as basic building blocks of the overall system. First order gradient loudspeakers depend on the first power of the relative phase between the outputs of multiple elements displaced in space. The preferred embodiments use first order gradient loudspeakers as directional loudspeakers at low frequencies.

There are two basic methods of creating a first order gradient loudspeaker that are described below. There are also third and fourth methods that can be thought of as different combinations of the first two. The first method uses two monopole acoustic sources displaced in space with the signal applied to one source inverted in polarity with respect to the other, and with a time delay placed in the signal path of one of the sources. The second method combines the outputs of a monopole and dipole acoustic sources, with signal processing designed to generate desired magnitude and phase relationships between the outputs of the monopole and dipole sources, to create first order gradient radiation behavior. The combination methods use the physical arrangement of sources of the first method with signal processing that is similar to that required by the second method. Each of these methods is described fully below.

Although these methods are described in detail here, the invention is not limited to using these particular methods for achieving a loudspeaker with a first order gradient directivity characteristic. Any other method that can be created to generate first order gradient behavior is construed to be incorporated in this disclosure. It should also be noted that higher order gradient loudspeakers could be used in the invention as well. The directivity of higher order gradient loudspeakers depends on higher powers of the relative phase between multiple sources displaced in space. Higher order gradient loudspeakers are capable of generating radiation patterns that have narrower beam widths than first order gradient loudspeakers. Unfortunately, higher order gradient loudspeakers also tend to be less efficient, require larger numbers of transducers, more signal processing, and additional channels of amplification, as compared to first order gradient systems.

Delay Gradient Loudspeakers (D-Grad embodiment)

A first order gradient loudspeaker can be generated by using two loudspeaker drive elements (typically, but not limited to, dynamic moving coil transducers) displaced in space by a distance D/2 (the reason for the divisor of two is so that the frequency response graphs of this D-Grad system and the MD-Grad systems to be described later are related properly). A time delay, $T_d$, is inserted in the signal path of one of the elements and it is connected with its polarity reversed with respect to the un-delayed element. (Note that the inverted or the non-inverted signal can be delayed. The directivity pattern shape does not change, only the orientation and polarity of the radiation pattern change.) The amount of delay used affects the specific characteristics of the gradient behavior. The relative levels of the delayed and undelayed element outputs also affects the gradient behavior. The element spacing and the amount of delay determine the efficiency of the system at low frequencies. The spacing and delay are also inversely proportional to the frequency range over which first order gradient behavior is maintained.

The behavior of the combination of the two elements is that of a bi-directional source for the condition of zero delay and equal element output levels (the system is a dipole). As the delay is increased from zero, the level of one of the bi-directional lobes decreases while the level of the other lobe increases. A particularly useful condition is when the delay $T_d$ is equal to the delay due to the time it takes a sound wave to travel the distance between the array elements $T_D$ ($T_d=T_D=D/(2*c)$, where c is the speed of sound). This condition generates a cardioid directivity characteristic. The radiation behavior in this case is uni-directional. This technique for generating a first order gradient loudspeaker is described in Olsen[9]. The directivity pattern of the system will be constant as a function of frequency as long as the relative magnitude and phase of the elements are constant as a function of frequency. An analysis of a delay gradient loudspeaker is included in the appendix of this disclosure.

The delay can be implemented in a number of ways, the first being a pure time delay (using digital techniques for example). It can also be done using complementary all pass filters in the signals applied to the array elements. The all pass filters are adjusted to generate a phase difference between the signals applied to each element that varies linearly as a function of frequency over the frequency range of interest. (Time delay is equivalent to a linear phase shift as a function of frequency.) Changing the slope of that linear phase difference changes the time delay. Finally, the delay can be accomplished by physical positioning of the elements. The invention is not limited in the method used for achieving the required time delay. Any method that can implement the required relative time delay over the frequency range of interest may be used.

Various physical arrangements of dual element D-Grad gradient loudspeaker embodiments are shown in FIG. 2*a*. FIG. 13*c* shows a preferred embodiment of the signal processing required to accomplish a D-Grad gradient loudspeaker with variable control over the directivity pattern.

The main radiation lobe of a first order D-Grad gradient loudspeaker will be oriented along the line joining the centers of the two radiating elements. The direction of maximum radiation will be pointing from the midpoint of the line joining the centers of the elements toward the non-delayed element for any condition of non-zero delay. The array will have a frequency response that decreases at a rate of 6 dB per octave below the frequency $f_s$, where the formula for $f_s$ is shown below. (An equation for $f_s$ is derived in the appendix and is given as equation (28)):

$$f_s=c/[(d+D)^* \sin(\theta)], \tag{28}$$

where d/2 is the distance sound travels in time $T_d$. When $T_d=T_D$, d=D, and for θ=90°, $f_s=c/2D$.

The frequency response at low frequencies is given by equation (23) in the appendix:

$$P_{gda}=(j\omega d)/2c)^*P_m^*[(1+(D/d)\sin(\theta))] \tag{23}$$

where $P_m$ is the pressure response of a monopole source, the first term in parenthesis multiplying $P_m$ determines the frequency response of the system and the term in square brackets determines the directivity pattern of the system.

The term multiplying $P_m$ shows the dependence of the magnitude of the pressure output at low frequencies on the delay d. This term also has a jω dependence that gives the system a frequency response that rises 20 dB per decade as frequency increases. The response and directivity pattern for the case where the delay is adjusted to obtain a cardioid radiation pattern are shown in FIG. 1*b*.

This frequency response requires equalization if flat acoustic power output at low frequencies is desired. This equalization can consist of a filter with a magnitude response that has a first order integrating response characteristic at low frequencies. The transfer function of an ideal integrator has a pole at zero frequency and a zero at infinite frequency and has the following form:

$$H(j\omega)=A/j\omega,$$

where A is a frequency independent gain term. A filter with an integrating response has a frequency response that decreases 20 dB per decade as frequency increases. The filter can be placed in the signal path before the delay element so that only one filter is required. This is shown in FIG. 13*b* (separate filters could also be placed in the signal path of each array element). The phase response of the equalization used here is not critical (this will not be the case for the Monopole/Dipole embodiment discussed later where both the magnitude and phase response of equalization used will be important).

The frequency response curve in FIG. 1*b* shows deep nulls in the frequency response at high frequencies. This is referred to as comb filtering. The frequency range where comb filtering effects begin to occur depends on the element spacing and the amount of delay. The system is no longer exhibiting first order gradient behavior in the frequency range where comb filtering is occurring.

The complete expression for the pressure response of a single channel D-Grad gradient loudspeaker array is derived in equation (20) in the appendix.

$$P_{gd}=P_m*[2j*\ \mathrm{Sin}\ (kd/4+(kD/4)*\ \sin\ (\theta))] \tag{20}$$

The argument of the first sin function increases as frequency increases so the sin function alternates from +1, through zero, to −1 and back. The magnitude of $P_{gd}$ (where $P_{gd}$ represents the output of the D-Grad array) will be a maximum of twice the monopole output when the sin function is equal to ±1, and will be zero when the sin function is zero. This cyclical variation in magnitude response is the behavior referred to as comb filtering. The frequencies where the maxima and minima occur also depend on the observation angle θ.

The equalizer with an integrating response described earlier was used to compensate for the low frequency behavior of the delay gradient loudspeaker. At higher frequencies, the behavior of the gradient loudspeaker deviates from first order gradient behavior as shown above. The magnitude response of the equalization applied is not required to have an integrating response in the region where comb filtering is occurring. However, there will be some applications where the integration behavior of the equalizer will extend into the high frequency region. There are also applications where it will be desirable to flatten out the response of the equalizer above the frequency where the radiation behavior deviates from gradient behavior. One method that can be applied to flatten out the response above the corner frequency $f_s$ calculated in equation (28) above, is to move the transfer function zero of the ideal integrator that occurs at infinite frequency, down to the frequency $f_s$. There may be applications where it is desirable to move the zero of the ideal integrator down in frequency as described above, but not move it as far as the frequency $f_s$. The invention is not limited in the equalization that can be applied to the a D-Grad gradient loudspeaker at high frequencies.

The behavior of the applied equalization will need to deviate from that of an ideal integrator at low frequencies. The response of the ideal integrator discussed above has infinite gain at DC, which is not realizable. In practical applications, a low frequency limit below which the integrating response will not be needed can be determined. This frequency will depend on the intended application. This limit will be approximately 150 Hz for most applications, as was discussed in the psychoacoustic sections, although there is a sub woofer application that requires extension down to lower frequencies. There are also some applications, such as in a automotive application that is described in the application section, where the cut off frequency is considerably higher than 150 Hz.

It should be noted that the frequency response of the gradient loudspeaker described applies in the far field of the array. The low frequency response may show a rising characteristic in the near field. The near field response behavior can be important in applications where the user may be close to the array, as might be the case when the invention is used as a multimedia computer audio system. The frequency response variation in the near field can be compensated for using standard linear filtering techniques if needed. This is not shown as it is assumed that those skilled in the art will be capable of employing the required filtering for near field use.

It can be seen from equation (23) above that the directivity pattern at low frequencies depends on the ratio between the element spacing and the time delay. (The derivation of equation (23) assumed that the levels of the two array elements were equal.) The amount of delay can be used to vary the directivity pattern of D-Grad gradient loudspeaker. The radiation pattern can be varied from a dipole pattern (zero delay), to a cardioid pattern where the delay is equal to the path length delay associated with the element spacing ($T_d=T_D$, d=D). The different radiation patterns have different beam widths. The availability of user variable delay, which can be made into a spatial control in the complete systems described in this disclosure, will allow the user to adjust the system to accommodate different room conditions and individual tastes. It should be noted that the delay could be increased further than what was mentioned above. The radiation pattern at low frequencies would approach a monopole, but other effects occur as delay is increased that make this less desirable. There are other ways the system behavior can be adjusted to achieve radiation patterns that range between monopole and cardioid.

It is also possible to vary the directivity pattern of a D-Grad first order gradient loudspeaker by varying the relative level of the non-delayed and delayed signals. This too can be turned into a spatial control. The level of the delayed signal can be used to vary the radiation pattern of the array between a cardioid pattern and an omni-directional pattern. The combination of variable delay, and variable relative level of the delayed and non-delayed elements, allow the two element D-Grad loudspeaker array to realize the full range of first order gradient directivity characteristics. A user control that varies the relative delay and relative level of signals applied to the array elements of a first order gradient loudspeaker is not taught in the prior art. A gradient loudspeaker system with a variable radiation pattern as described above will be called poly-directional. The preferred embodiments of the present invention will use poly-directional loudspeakers for each channel of a stereo pair of channels.

The amount of delay used in the system has an effect on the frequency response of the system at low frequencies. The corner frequency $f_s$ described above in equation (28), below which the low frequency approximations hold, is inversely proportional to the amount of delay used. The corner frequency moves up in frequency as the delay is decreased and moves down in frequency as the delay is increased. The dependence of the efficiency at low frequencies on the delay d is also shown in equation (23). As the delay is increased, the efficiency at low frequencies increases, and as the delay is decreased the efficiency decreases. Increasing the delay reduces the frequency range where gradient behavior occurs, and increases the efficiency of the array in this reduced range.

If it is desired to have the overall response of the complete loudspeaker array be as flat as possible above the frequency where gradient behavior begins to deteriorate, then some type of variable equalization will be needed to compensate for the changes in system behavior as the delay is adjusted. It was mentioned earlier that the zero in the transfer function of the ideal integrator could be moved down to the frequency $f_s$ to flatten out the response. It can be seen from the above discussion that $f_s$ depends on the delay used. Therefore, the zero of the equalization must vary with the delay setting if flat response is to be maintained. One way to accomplish this is to use a voltage controlled filter in the equalizer with a variable zero location in its transfer function, where a control voltage that depends on the amount of delay is used to change the frequency of the transfer function zero. A block diagram is shown in FIG. 13*c* that includes a voltage controlled filter block for accomplishing this. The exact configuration of such a filter is not shown. It is assumed that those skilled in the art will be capable of synthesizing the voltage controlled filter and control voltage required. The variable filter is not limited to being implemented as a voltage controlled filter. Any method that changes the zero location of the filter as a function of the delay with the correct relationship can be used.

A single transducer can also be used to generate a first order gradient radiation pattern. The outputs from the front and back of a traditional dynamic cone transducer are of opposite polarity. It is not possible to electrically delay the output from one side of a transducer with respect to the other. However, the output from one side can be delayed physically by having the speaker mounted in an enclosure or tube that is open at the far end. FIG. 2*b* shows a number of geometrical arrangements that can be used for a single transducer gradient loudspeaker. The open end of the enclosure and the front of the transducer are then separated in space. The enclosure acts as an acoustical delay element for sound from the back side of the transducer. (It takes a finite amount of time for a sound wave to travel from the rear of the transducer diaphragm to the enclosure opening.) This will generate the same condition as above where there are two sources displaced in space and one source is delayed and inverted in polarity with respect to the other. One drawback to this configuration is that the delay and level of the delayed signal are no longer easily adjustable by the end user. Another drawback is the enclosure can have an effect on the frequency response of the system at frequencies where the enclosure dimensions begin to be an appreciable fraction of a wavelength. For these reasons, single element gradient loudspeakers are not used in the preferred embodiments.

Monopole/Dipole Gradient Loudspeaker (MD-Grad embodiment)

Another configuration that can be used to make a first order gradient loudspeaker is to combine the outputs of a monopole acoustic source and a dipole acoustic source, that are located physically close to each other. The elements are chosen and the signal processing is designed so that the acoustic outputs of the monopole and dipole sources are either in phase or 180° out of phase with each other, depending on the angle of observation, over the frequency range where it is desired to maintain directivity pattern control. The processing is also designed to make the frequency response magnitude shapes of the monopole and dipole source acoustic outputs the same over the above mentioned frequency range. The power response over the same frequency range can be made flat as a function of frequency if the individual magnitude response shapes of the monopole and dipole sources are flat as a function of frequency, and they have the required phase relationship described above.

The spacing of the array elements that are used as the monopole and dipole sources determines the efficiency of the array at low frequencies. The element spacing is also inversely proportional to the frequency range over which first order gradient behavior can be maintained. FIG. 3 shows the resulting directivity patterns for a gradient loudspeaker so constructed for various relative levels of the monopole and dipole sources. A bidirectional radiation pattern is obtained when the monopole output is zero. A monopole radiation pattern is obtained when the dipole source output is zero. A unidirectional radiation patterns result for cases where there is output from both sources. A particularly useful condition is achieved when the outputs of the monopole and dipole sources are equal in level (looking at the magnitude of the dipole source output in the direction of its maximum output). This condition generates a cardioid directivity characteristic. The directivity pattern of the MD-Grad first order gradient loudspeaker is constant as a function of frequency, at low frequencies, when the relative magnitude and phase of the monopole and dipole source outputs are constant as a function of frequency.

A dipole can be formed from two monopole loudspeaker elements separated by a fixed distance D, where the output of the one loudspeaker element is inverted in polarity with respect to the other. A dipole can also be formed by using the outputs from the front and back of a single loudspeaker. These outputs are inherently inverted in polarity. It should be understood that the invention is not limited by the method in which a dipole acoustic source is constructed. Some various dipole configurations are shown in FIG. 4. There is a cost advantage to using a single loudspeaker dipole source. There are, however, some performance advantages to using a two loudspeaker dipole source. The single loudspeaker dipole requires some type of geometry separating the front and back sides of the transducer to obtain the correct element spacing for use with this invention. This geometry can cause frequency response aberrations of its own. Also, the single loudspeaker dipole will have one half the power handling capability of a two loudspeaker dipole, if the same loudspeaker elements are used for both types of dipole sources. For these reasons, the two loudspeaker dipole is preferred and will be assumed for the following discussions. However, all of the embodiments shown that use a two loudspeaker dipole source could also be constructed using a single loudspeaker dipole source, and are incorporated in this disclosure.

A mathematical analysis of a dipole source made from two direct radiator loudspeaker elements is given in the appendix. The frequency response and directivity pattern of a dipole source at a number of frequencies are shown in FIG. 1*a*. Equation (12) in the appendix gives the expression for the pressure output of a dipole constructed from two monopole sources at low frequencies:

$$P_d = P_m * (j\omega D/c) * \sin(\theta) \tag{12}$$

The expression derived for the dipole output contains a term that represents the output of a monopole source ($P_m$) modified by a term that contains the directivity and frequency response information. The sin(θ) term gives the dipole directivity pattern, where D and c are both constants (D is the dipole element spacing and c is the speed of sound). The direct dependence of the efficiency of the dipole output at low frequencies on the element spacing D can clearly be seen here. The jω term contains the frequency response magnitude and phase information. The jω term has a differentiator type response that has 90° of phase lead with respect to a monopole output, and a magnitude response that is increasing with frequency at a 20 dB per decade rate.

First order gradient behavior is obtained when a monopole and dipole source are located essentially coincident in space and the outputs of the monopole and dipole sources are either in phase or 180° out of phase (depending on the observation angle). The above formula for the output of a dipole source at low frequencies shows a 90° (or 270°) phase difference between the dipole source output and the monopole source output (as evidenced by the jω term and the sign of the sin term), as well as a 20 dB per decade difference in the magnitude of the frequency response between the dipole and monopole sources. The signal applied to the dipole source could be equalized by an ideal integrator that has the following response characteristic:

$$H(j\omega)=A/j\omega$$

(where A is a frequency independent gain term).

The transfer function of the ideal integrator has a pole at zero frequency and a zero at infinite frequency. The response of the combination of a dipole source an integrating equalizer is derived in equation (59) of the appendix:

$$P_d=A*(D/c)*\sin(\theta) \tag{59}$$

Notice that the jω terms have canceled. This response is flat as a function of frequency (no frequency dependence) and now will be either in phase or 180° out of phase with the output of the monopole source, depending on the observation angle θ. The output of the equalized dipole source and the monopole source now have the correct magnitude and phase relationships to generate first order gradient directivity characteristics when their outputs are combined. The radiation pattern of the combined sources will remain constant as a function of frequency if the relative magnitude and phase responses of the monopole and dipole sources are constant with frequency. The power response will also be flat over the frequency range where this behavior is maintained.

An expression valid for low frequencies for the case where the output of an equalized dipole source is combined with the output of a monopole source to generate an MD-Grad first order gradient loudspeaker is derived in the appendix as equation (61):

$$P=P_m*[1+(A*D/c)*\sin(\theta)] \tag{61}$$

The constant A represents the gain of the filter in the difference signal path. A spatial control can be constructed that adjusts the value of A. Varying the value of A changes the directivity characteristics of the gradient source. It is also possible to use a balance control, capable of varying the relative gain in the monopole and dipole signal paths, as a spatial control.

The relative levels of the monopole and dipole source outputs controls the radiation pattern of the gradient loudspeaker. Looking again at equation (61), this pattern can vary anywhere between a monopole (where A=0), through a cardioid (where A=c/D), to approach a dipole (where A>>c/D). A dipole pattern is possible if a balance control is used as described in the previous paragraph and it is adjusted to set the signal applied to the monopole source equal to zero. The different radiation patterns have different beam widths. A gradient loudspeaker system with a variable radiation pattern as described above will be called poly-directional. The preferred embodiments of the present invention will use poly-directional loudspeakers for each channel of a stereo pair of channels. Some examples of the different radiation patterns that can be generated by varying the relative level of the monopole and dipole sources for a single MD-Grad gradient loudspeaker are shown in FIG. 3.

A control that varies the relative level of the monopole and dipole outputs, which can be used as a spatial control in the complete systems described in this disclosure, allows the user to adjust the directivity of the system to accommodate different room conditions, program material variations, and individual tastes. The inclusion of a user control that varies the relative levels of signals applied to monopole and dipole sources to alter the radiation pattern of a first order gradient loudspeaker is not taught in the prior art.

The operation of this spatial control does not alter the overall low frequency efficiency of the array, as was the case for the D-Grad system when delay was varied. This is a benefit of this embodiment The corner frequency $f_s$, below which ideal first order gradient radiation characteristics are maintained, does not depend on the spatial control setting as it did for the D-Grad system (where spatial control adjusted the delay). The formula for this limiting frequency, $f_s$, is derived in the appendix as equation (67).

$$f_s=c/(2*D*\sin(\theta)) \tag{67}$$

Note the direct dependence of this corner frequency on the element spacing D and the absence of the dipole element gain term A. The radiation behavior of the dipole source formed from two loudspeaker elements will deviate from ideal dipole radiation behavior at frequencies above $f_s$ calculated above. The first order gradient behavior of the combination of monopole and dipole sources also deviates from ideal behavior above the same frequency. The element spacing directly determines the high frequency limit to first order gradient behavior. Comb filter effects begin to occur above the frequency $f_s$.

The complete expression for the pressure response of a single channel MD-Grad gradient loudspeaker array with an ideal integrator equalizer in the dipole signal path is given in equation (61b) in the appendix.

$$P_{mdg}=P_m*\{1+(2A/\omega))*\sin[(kD/2)*\sin(\theta)]\} \tag{61b}$$

The argument of the first sin function increases as frequency increases so the sin function alternates from +1, through zero, to −1 and back. The magnitude of the first sin function will be a maximum when its argument is equal to ± multiple of 90 degrees, and will be zero when the argument is zero or a multiple of 180 degrees. This cyclical variation in magnitude response is the behavior referred to as comb filtering. It can also be seen that the sin function is multiplied by a term that is inversely proportional to frequency. This implies that the overall output of the equalized MD-Grad gradient loudspeaker approaches a monopole response at high frequencies, as the output from the dipole is rolled off by the ideal integrator equalizer.

It is clear from the above discussion that there is a limit to the frequency range over which gradient radiation behavior occurs. There are some applications where the high frequency behavior of the ideal integrator (that was described in association with the low frequency approximation equations shown earlier) will be beneficial to use with a complete system. There are also applications where it will be desirable to flatten out the response of the equalizer above the frequency where the radiation behavior deviates from gradient behavior. One method that can be applied to flatten out the response above the corner frequency $f_s$ calculated in equation (67), is to move the transfer function zero of the ideal integrator that occurs at infinite frequency, down to the frequency $f_s$. It should be noted that the invention is not limited in the equalization that can be applied to an MD-Grad gradient loudspeaker at high frequencies. There may be applications where it is desirable to move the zero of the ideal integrator down to a frequency other than $f_s$.

It must be noted that the integrating equalization is applied here to the dipole signal. Obtaining gradient radiation behavior at low frequencies depends on maintaining particular relationships between the monopole and dipole source outputs. Altering the magnitude of the high frequency equalization (for frequencies above $f_s$) applied to the dipole will change the phase relationship between the monopole and dipole outputs at frequencies below $f_s$. This change in relative phase must be compensated for if gradient radiation behavior is to be maintained over as wide a frequency range as possible. This behavior is different from the behavior described for the D-Grad gradient loudspeaker, where the high frequency equalization did not affect the radiation behavior.

The relative phase of the monopole and dipole outputs can be altered arbitrarily by the use of all pass filters, where the filters can be placed in both the monopole and dipole signal paths. The all pass filters adjust phase response without changing magnitude response. By adjusting the relative resonance frequency of the all pass filters, the filter orders, and filter Q's if second order filters are used, the relative phase between the monopole and dipole source outputs can be adjusted over a wide range. The use of complimentary all pass filters in the monopole and dipole signal paths can be used to restore the desired phase relationship between the monopole and dipole outputs when the dipole equalization is changed from an ideal integrating behavior. The use of complimentary all pass filters allows the relative phase response between the monopole and dipole source outputs to be adjusted independently of the relative magnitude responses. It should be noted that that a more general case is applicable, where non minimum phase filters (as opposed to all pass filters) are placed in both the monopole and dipole signal paths. These filters can simultaneously provide both the phase compensation described above along with some magnitude response correction. The invention is not limited in the types of filter techniques used in order to achieve its desired magnitude and phase response characteristics.

In some applications, it may be desirable to move the zero frequency that is at infinite frequency for an ideal integrator down to some other frequency $f_n$, where $f_n$ is less than infinity and greater than $f_s$, without adding in the all pass filters to adjust the relative phase. This configuration will have a radiation behavior that deviates from ideal first order gradient at a lower frequency than would otherwise be desirable, but it will also have lower cost and complexity, and can provide sufficient performance in some applications.

The behavior of the applied equalization will need to deviate from that of an ideal integrator at low frequencies. The response of the ideal integrator discussed above has infinite gain at DC, which is not realizable. In practical applications, a low frequency limit below which the integrating response will not be needed can be determined. This frequency will depend on the intended application. This limit will be approximately 150 Hz for most applications, as was discussed in the psychoacoustic section, although there is a sub woofer application that requires extension down to lower frequencies. There are also some applications, such as in a automotive application that is described in the application section, where the cut off frequency is considerably higher than 150 Hz.

This implies that some form of high pass filter will need to be applied to the dipole signal path. In order to maintain the correct phase relationships between the monopole and dipole outputs, a compensating filter must be applied to the monopole signal path. This filter can either be the same high pass filter as was applied to the dipole path, or it could be an all pass filter that had the same phase response shape as the high pass filter used in the dipole path. This can be accomplished, for example, if a critically damped $2^{nd}$ order high pass filter were used in the dipole path and a first order all pass filter were used in the monopole signal path.

Again, it should be noted that the form of equalization used is not unique. Any equalization can be applied that gives rise to a system that maintains the desired magnitude and phase relationships between the monopole and dipole outputs.

It is possible to provide a good match in the magnitudes of the monopole and dipole source outputs up to the frequency where $D/\lambda=0.5$. The magnitudes will begin to deviate from each other above this frequency, where the deviation will differ depending on the angle of observation. It is possible to match the phase over a much larger range, and this is desirable. The phase can be matched almost completely up to the frequency where $D=\lambda$. This was accomplished in the prototype system that was developed and will be described later.

It can clearly be seen that the equalization directly depends on the element spacing of the dipole. Both the output of the dipole at low frequencies, and the frequency range where an integrating equalizer is required are determined by the element spacing.

To summarize, the overall equalization applied to the monopole and dipole signals used in an MD-Grad loudspeaker array must allow the following system behavior:

A) The magnitude response shapes of the acoustic outputs of the equalized monopole and equalized dipole sources must be matched over at least the frequency range where directivity control is desired. This is typically the range of 150 Hz to 1–2 Khz for embodiments other than sub woofers. Sub woofers require operation down to lower frequencies.

B) The acoustic outputs of the equalized monopole and equalized dipole sources must be in phase (or 180 degrees out of phase depending on the observation angle) over at least the frequency range where directivity control is desired.

Note that the relative level of the dipole source with respect to the monopole source is used as a control which the user can vary to alter the directivity of the MD-Grad gradient loudspeaker in most of the embodiments. It is only necessary for the fixed equalization used to match magnitude response shapes of the monopole and dipole source outputs, because the relative levels are controlled by the user.

The equalization used can consist of a combination of minimum phase and all pass filter sections (if needed), or it can consist of non-minimum phase filters, as long as the requirements above are met. It should be noted that the equalization required to meet the above conditions is not unique. Any form that meets the above requirements will be sufficient and is understood to be incorporated by this disclosure.

Additional equalization can also be used to adjust the overall frequency response magnitude of the complete array. This final magnitude equalization is applied equally in the monopole and dipole signal paths to change the overall frequency response of the entire gradient loudspeaker. It will generally be preferable for the overall response to be flat as a function of frequency, but there may be instances where some other response shape is desired. This additional equalization allows the overall response of the system to be varied while the directivity characteristics remain unchanged. It can also be used to compensate for frequency response deficiencies of the individual loudspeaker array elements.

It should be noted that the frequency response of the MD-Grad gradient loudspeaker described applies in the far field of the array. The low frequency response may show a rising characteristic in the near field. The near field response behavior can be important in applications where the user may be close to the array, as might be the case when the invention is used as a multimedia computer audio system. The frequency response variation in the near field can be compensated for using standard linear filtering techniques if needed. This is not shown as it is assumed that those skilled in the art will be capable of employing the required filtering for near field use.

Combination Embodiments

The third method of generating a first order gradient loudspeaker can be thought of as either a modification of an MD-Grad system, a modification of a D-Grad system, or as a combination of both embodiments, as it has aspects of both. This embodiment uses a two loudspeaker element array configuration, as is used in the D-Grad embodiment, where each element is used as a monopole source. In addition, the signal processing is constructed so that the two elements are simultaneously used as a dipole source. The signal processing takes a form similar to that described for the signal processing of the MD-Grad embodiment.

When the same elements are used as both monopole and dipole sources, it gives rise to a particular configuration for the signal processing. An input signal is split into two signal paths, one for radiation by the monopole and one for radiation by the dipole. Each path is equalized appropriately, according to the A and B requirements described above for the MD-Grad gradient loudspeaker embodiment equalization. The equalized dipole signal is then added to the equalized monopole signal, and this signal is presented to one of the array elements. At the same time, the equalized dipole signal is also subtracted from the equalized monopole signal. This signal is then applied to the other array element. A block diagram describing this arrangement is shown in FIG. 17*a*.

The directivity pattern of this embodiment can be varied by varying the relative level of the monopole and dipole signals (the relative signal levels before the final sum and difference operations). When the gain of the dipole signal is zero, the array is a doublet source where both elements radiate in phase. This approximates a single monopole source at low frequencies. When the monopole signal is set to zero, the system has a dipole radiation character. Different relative levels give first order gradient radiation patterns between these two extremes.

This system is similar to the MD-Grad system in the form of the signal processing. The same requirements discussed earlier for the magnitude and phase of the monopole and dipole source outputs for the MD-Grad embodiment also apply here for the combination system. The same basic form of equalization described for the MD-Grad embodiment is also applied here. This embodiment differs from the MD-Grad embodiments in that two elements, rather than one separate element, are used as monopoles sources. The combination of the output of these two elements is essentially the same as a single monopole element at low frequencies. However, the behavior of the system differs from the MD-Grad system at higher frequencies. This difference is due to the fact that the combination embodiment has two monopole sources displaced in space, while the MD-Grad system has only a single monopole source.

Yet another combination embodiment is possible. This embodiment also uses a two loudspeaker element array configuration, as is used in the D-Grad embodiment. In this combination embodiment, one of the array loudspeaker elements is used as a monopole source, and both loudspeaker elements are used as a dipole source. The signal processing topology is similar to that described for the first combination embodiment above. A signal is split into two signal paths, one for radiation by the monopole source and one for radiation by the dipole source. Again, the same basic form of equalization described for the MD-Grad embodiment is also applied here. The equalization is designed to maintain the same magnitude and phase relationships as were described in the A and B requirements given above for the MD-Grad gradient loudspeaker embodiment equalization. The behavior of this embodiment is similar to the previously described combination embodiment at low frequencies. This second combination embodiment is shown in FIG. 17*b*.

The major differences between this combination embodiment and the other embodiments occur at higher frequencies. It can easily be seen that some of the symmetry present in the other embodiments is lost here. The monopole source will not appear to have the same origin in space as the dipole. It will be offset from the center of the dipole source by ½ the amount of the dipole element spacing. This will cause asymmetries in the relative phase response of the monopole and dipole source outputs at higher frequencies. This will cause the system to deviate from ideal first order gradient behavior at a slightly lower frequency than the other embodiments will. It can also be seen that there is no comb filtering of the radiated monopole signal here, as there is only one physical monopole source.

Array Geometry

There are many possible geometric arrangements of array elements for gradient loudspeaker embodiments. Arrangements of the different two element array configurations are shown in FIG. 2*a*. An additional two element MD-Grad embodiment, and various other possible three element arrangements are shown in FIGS. 5*a, b,* and *c*. It is possible to mount the transducers used in different orientations. Changing the orientation has an affect when real sources are used, as opposed to ideal sources, due to the deviation from omni-directional radiation behavior exhibited at high frequencies by real sources. Real transducers become wave type directional devices at higher frequencies. The different orientations are useful in steering the higher frequency radiation lobes in different directions. In some cases, it may be useful to be able to steer the radiation forward or back, up or down, relative to the listening position. The invention is not limited in the orientation of any of the array elements.

The preferred embodiments attempt to maintain a directivity pattern that is constant as a function of frequency over as large a frequency range as possible. The majority of these embodiments endeavor to radiate less energy from the array directly to the listener than they radiate from the array in the main radiation direction (when the main radiation direction is pointed away from the main listening location, as is the case for most of the embodiments that will be discussed). The reflected/direct energy ratio is controlled to create the perception of sound sources located at the source of the reflections. This can also be accomplished by a directional loudspeaker whose directivity does not remain constant as a function of frequency. All that is required is that the directional loudspeaker maintain a sufficient reflected/direct energy ratio over the necessary frequency range. Such a system could be made using many of the described configurations with slightly altered equalization, or other configurations not specifically mentioned. The invention of this disclosure is not limited to systems that maintain constant directivity patterns as a function of frequency at low frequencies. However, the preferred embodiments of this invention do attempt to maintain a constant directivity pattern, and a constant power response, at low frequencies. Systems that use directional loudspeakers where the directivity pattern as a function of frequency does not remain constant will have different frequency responses at different listening positions throughout the listening environment. The systems will sound different depending on the location of the listener in the room. This is not generally desirable.

Comparison of Different Gradient Loudspeaker Embodiments

There are various trade offs between the different embodiments that may cause one form to be preferable to another in certain applications. All of the embodiments behave similarly at low frequencies as far as their directivity behavior is concerned. The D-Grad and first combination embodiment are essentially the same at low frequencies. They differ from the MD-Grad embodiment in that two array elements are used for reproducing the monopole signal for the D-Grad and first combination embodiment, whereas the MD-Grad and second combination embodiments use a single monopole element. The use of both elements as monopoles does have an advantage. The power handling and maximum output level of the monopole portion of the D-Grad and $1^{st}$ combination embodiments will be doubled over that of the MD-Grad and $2^{nd}$ combination embodiments.

The major differences between the systems occur at higher frequencies. The MD-Grad and $2^{nd}$ combination embodiments only radiate the monopole signal from one physical element for all frequencies. This means that there will be no comb filtering of the radiated monopole signal (this feature becomes important when multiple gradient loudspeakers are combined to radiate more than one signal simultaneously, as is done in the two channel systems that will be discussed later. The D-Grad and first combination embodiments both radiate the monopole signal from two sources separated in space. As a result, both embodiments will exhibit comb filtering of the monopole signal output at higher frequencies. (The nature of the combing will be slightly different between the two embodiments, however.)

Another difference arises in the form of signal processing required. The signal processing for the MD-Grad and combination embodiments can be easily realized using linear filtering techniques, whereas the D-Grad embodiment requires generation of a time delay, which can more difficult and costly to generate. The D-Grad embodiments also require a more complicated control function for varying the directivity behavior of the array. All that is required in the MD-Grad and combination embodiments is the varying of the relative level of the monopole and dipole signals to alter the array directivity.

It should also be noted that the element spacing for the D-Grad embodiments is D/2, and the dipole element spacing for MD-Grad embodiments is D, for systems that operate over the same frequency range. The D-Grad system has one half the element spacing of an MD-Grad system, assuming both systems are adjusted for similar radiation patterns. This is an important difference and can be made use of in different applications. Some applications will benefit from the reduced the element spacing requirements of the D-Grad embodiment (applications where space is at a premium or where very low frequency operation is required, as is the case with sub woofers) whereas other applications will benefit from the increased element spacing of the MD-Grad embodiments (applications where the ability to revert to normal stereo operation is desirable, such as in portable stereo systems that may be used outdoors).

Gradient Loudspeaker Limitations

Gradient loudspeakers have some limitations on the frequency range over which they can be easily made to work. The efficiency of the gradient loudspeaker at low frequencies depends on the spacing between the loudspeaker array elements (and the amount of delay for D-Grad embodiments). A larger spacing (and longer delay) increases the efficiency of the array at low frequencies. Gradient loudspeakers also have a high frequency limitation related to loudspeaker element spacing and delay. The maximum frequency up to which first order gradient behavior can be maintained (assuming the loudspeaker elements used behave as ideal monopole sources) occurs for D-Grad systems when $(d+D)/\lambda=1$, and for MD-Grad and combination systems when $D/\lambda=0.5$ (the dipole element spacing is ½ a wavelength). Comb filtering effects begin to occur above this frequency and radiation pattern control is lost. Increasing the element spacing and/or the delay lowers this maximum frequency. There is a trade off that must be made in choosing the loudspeaker array element spacing between low frequency efficiency and high frequency radiation pattern control.

We can define a frequency $f_1$, where $f_1$ is the lowest frequency where pattern control is required to be maintained. We can initially set $f_1$=150 Hz. This was the low frequency limit described in the psychoacoustics section where ITD localization cues are effective. (It should be noted that there are some applications of the invention that require operation at frequencies lower than 150 Hz. They are discussed in the sub woofer application section.)

The maximum frequency for first order gradient behavior is defined as $f_h$, which occurs when $D/\lambda=0.5$. (This formula holds for D-Grad embodiments where the delay $T_d=T_D$ and for MD-Grad and combination embodiments.) A formula can be developed based on array low frequency efficiency considerations to determine D: let $f_1$ occur when $D/\lambda=0.09375$. This formula gives an element spacing that requires a maximum of 6 dB of electrical boost at $f_1$ with respect to $f_h$ above, to obtain a system with flat response. (This is an arbitrary choice but is reasonable in the amount of low frequency boost required by the system.) Using an $f_1$ of 150 Hz would give a value for D of 0.22 meters. This formula for D along with the formula for $f_h$ can be combined to give the following: $f_h=5.33\times f_1$. This gives an $f_h$=800 Hz for an $f_1$ of 150 Hz. Above $f_h$, the array radiation pattern is no longer uni-directional, but it still can be useful for controlling the level of direct and reflected energy. Useful radiation patterns are maintained up until approximately $D/\lambda=0.8$. This gives $f_{hu}=8.53 * f_1$ or $f_{hu}$=1,280 Hz for $f_1$=150 Hz, where $f_{hu}$ is the maximum frequency of useful directivity pattern control. This range is sufficient for the array to generate realistic sound sources distributed throughout the listening space, as was described in the psychoacoustics section. The formulas basically state that one array of simple monopole sources can be designed to maintain sufficient directivity pattern control over a frequency range of approximately three octaves. These formulas apply for D-Grad and MD-Grad, and combination embodiments.

It is desirable, although not absolutely necessary, to increase the frequency range of directivity pattern control over the three octaves achieved above. One way to accomplish this is to decrease the element spacing and allow more low frequency boost in the equalization applied. This will reduce the maximum sound pressure output of the gradient loudspeaker before clipping of the system electronics occurs, however.

Another way to extend the frequency range without adding additional transducer elements is to use ported enclosures for the individual loudspeaker array elements, where the ports are spaced wider apart than the transducers. The output from a port has a bandpass characteristic centered around the tuning frequency of the port/enclosure combination. The resonance of the port and enclosure is usually tuned near the desired low frequency cut off of the loudspeaker to extend the loudspeaker output lower in frequency. The port can be viewed as an additional array element that operates at low frequencies. The ports can be spaced farther apart than the transducers because they do not operate at high frequencies. There will not be any detrimental effects due to comb filtering from the output of the ports of their restricted bandwidth. The transducers can be spaced closer together because they are not operating as low in frequency as they would if a port were not used. The transducers do not need as much low frequency efficiency because of the presence of the ports with their increased spacing. This arrangement essentially allows a larger element spacing at low frequencies and a smaller element spacing at higher frequencies, which extends the overall range of operation of the array. FIG. 6*a* depicts a three element MD-Grad array using the port spacing technique described, but the same technique is also applicable to all other gradient loudspeaker embodiments. This method is capable of extending the frequency range of pattern control by approximately one additional octave. This geometry is used in the prototype embodiment that will be described later.

Yet another way to increase the frequency range of directivity control is to use more than one array, where each array is designed to operate over a specific frequency range. A high frequency array could be used (where the elements are spaced very close together) along with a low frequency array (where the elements are spaced farther apart), together with a crossover network that sends the appropriate frequencies to the corresponding array elements. A combination of a low frequency array and a high frequency array is shown in FIG. 6*c*. Reducing the element spacing at high frequencies extends the frequency range of radiation pattern control. It is understood that the signal processing used with these dual array embodiments must compensate for the different element spacing of each array by modifying the signal processing applied. The elements in FIG. 6*c* are shown facing out to the sides of the array. It is also understood that this is not a limitation of this method for extending the frequency range of directivity pattern control. Any of the array element orientations that that are discussed for full range gradient loudspeaker arrays can also be used here for the multi-way systems.

For the case of a D-Grad embodiment, a frequency dependent delay would be needed. The delay would be larger at lower frequencies and lower at higher frequencies. In addition, equalization that is more complicated than an integrating magnitude response would be needed to provide flat overall power response. For the case of MD-Grad and combination embodiments, a shelving equalizer would be needed in the dipole path, where the order of the shelf would depend on the order of the acoustic rolloff of the low and high frequency arrays in the crossover region (which depends on the crossover network and the individual element characteristics). The corner frequencies of the shelf are determined by the spacing of the array elements. The shelf is required because the efficiency of the dipole directly depends on the element spacing. The low frequency devices with larger element spacing would have higher efficiency than the high frequency elements with smaller element spacing. In addition, all pass filters may be required in either or both of the monopole and dipole signal paths to account for the phase response effects of the crossover network. The same requirements A and B discussed earlier for the outputs of the monopole and dipole sources for an MD-Grad gradient loudspeaker apply here for multi-way MD-Grad and multi-way combination embodiments.

A fourth method that extends the frequency range of directivity pattern control makes use of the natural directivity of the transducer elements. This method will be illustrated with an example using a D-Grad embodiment. FIG. 6*b* shows a two element D-Grad array, but the same technique is also applicable to all the other first order gradient loudspeaker array configurations mentioned. The figure shows the array elements facing outward. At higher frequencies where the spacing starts to have an effect on the overall radiation pattern, the natural directivity characteristic of the transducers used as array elements are narrowing the angle over which the individual elements are radiating. The elements are no longer acting like simple monopole sources with omni-directional radiation patterns. At higher frequencies where the wavelengths are comparable to the size of the transducer elements used, the array elements become wave type directivity control devices. For a signal that is supposed to be radiated to the left, the left element can be faced out to the left. The right element orientation does not matter for the case where a single signal is radiated by the array. If multiple signals are to be radiated by the same array elements simultaneously, as will be the case for the preferred embodiments to be discussed shortly, the optimum orientation of the right element will be faced out to the right as shown.

At low frequencies, the signal to be radiated to the left is sent to the left element and a delayed and inverted version of the same signal is sent to the right element. At high frequencies, the signal sent to the right element is rolled off so that only the left element is radiating. This filtering is depicted as the optional low pass filter block shown in the delayed channel signal path for the two element D-Grad directional loudspeaker shown in FIG. 13*b*. The natural directivity of the left element will continue to maintain a directional characteristic pointed to the left up to much higher frequencies. Additional all pass filtering placed in the left element signal path is required to compensate for the change in the phase response in the right element due to the low pass filter, to maintain desired directivity pattern control in the crossover region. This is also shown in FIG. 13*b*. For example, a second order low pass filter has a phase response that can be exactly matched by a first order all pass filter, assuming the second order filter is critically damped. Comb filtering effects can be reduced or eliminated through the proper choice of array element directivity, array element spacing and low pass filter cut off frequency. The directional loudspeaker here is relying on a gradient type loudspeaker to obtain directivity control at low frequencies and wave type loudspeaker to maintain directivity control at high frequencies. Directional radiation can be maintained over the full frequency range of operation of the system using this type of configuration.

This same technique can be used with the MD-Grad and combination type gradient loudspeakers described earlier as well. One method to accomplish this is to use an ideal integrator for equalization. The ideal integrator has an inherent rolloff of high frequencies of 6 dB per octave. The output of the system at high frequencies reduces to the output from the monopole source. In another method, additional low pass filtering would be placed in the dipole signal path, and a compensating all pass filter would be added to the monopole signal path. The all pass filter is required to maintain the proper phase relationships between the monopole and dipole outputs over the frequency range where gradient behavior is desired. A first order all pass filter can compensate for a second order critically damped low pass filter.

The low pass filtering discussed above can be electrical, mechanical, or acoustical in nature. Electrical filtering, which is the preferred method of filtering, is the easiest to accomplish and is shown in FIG. 13*b*. Mechanical filtering can be done by modifying the characteristics of the right transducer element (by adding mass for example) to reduce its high frequency output. Acoustical filtering can be done by placing acoustical filter elements in the path of the right element to act as a low pass filter. Neither the mechanical nor acoustical filtering options are optimal when the gradient loudspeaker building block is used in the preferred embodiments to be described that radiate multiple signals simultaneously from the same array elements. The altered element response would require the use of additional transducer elements when a complete system were configured. The acoustical filtering can be used for some single element gradient loudspeaker configurations (for the single element D-Grad embodiment and single element dipole of MD-Grad embodiments). These are shown in FIG. 7. The order of the low pass filter can be adjusted by changing the number of filter elements used. The phase response of the low pass filter still needs to be compensated for in the left element equalization. This compensation needs to be electrical, as it is difficult to synthesize mechanical or acoustical all pass filters.

One further method to increase the frequency range over which directional radiation behavior is maintained crosses over from a low frequency gradient loudspeaker to a tweeter with a controlled directivity characteristic. The system crosses over to a directional tweeter so that only the tweeter facing in the desired direction radiates at high frequencies. Horn loaded tweeters can have a controlled directivity characteristic over their entire operating range. The directional loudspeaker here is relying on a gradient type loudspeaker to obtain directivity control at low frequencies and wave type loudspeaker to maintain directivity control at high frequencies. Directional radiation can be maintained over the full frequency range of operation of the system using this type of configuration. This configuration is shown in FIG. 6*d*. The ideal solid angle of radiation of the horn tweeter can vary depending on the desired application of the overall array. The combination of a gradient loudspeaker at low frequencies and a directional tweeter at high frequencies has a similar behavior to the situation described above that used the natural directivity of the loudspeaker array element to extend the frequency range of radiation pattern control. The signal processing requirements would also be similar to those described above. The benefit to using a separate directional tweeter is that it is possible to obtain a smoother frequency response and more consistent radiation pattern control than is possible using the natural directivity of a full range array element.

An additional concern with the use of gradient loudspeakers has to do with distortion. The signal processing required to achieve gradient directivity behavior can apply significant levels of out of phase signals to the array elements. The large signal behavior of the loudspeaker elements when fed these large out of phase signals will have an effect on the perception of system distortion. Symmetrical distortion products generated by the loudspeakers will also be out of phase. They will tend to cancel to the same degree as the fundamental signal is reduced by the out of phase radiation from the combined array elements. However, asymmetric distortions will be different in the different array elements and will be radiated. They become more audible due to the cancellation of the fundamental that occurs. In addition, the harmonics are at higher frequencies and can occur above the range where radiation pattern control is maintained. A good design criteria is to minimize even order distortion products in the array transducer elements. These usually arise from things like asymmetries in the magnetic field in the loudspeaker gap and non-symmetrical spiders. The design also requires high excursion capability of the array transducers for optimum performance.

This system shows the combination of an MD-Grad gradient loudspeaker array and a dipole array. Two input signals are presented to the signal processing circuits. The input signals are split into two paths. In the first path, the input signals are summed together. The output of the summer is passed through equalization designed for signals to be radiated by a monopole element of an MD-Grad gradient loudspeaker, which is shown as the center element of the three element array.

In the second path for the inputs, the signals are subtracted from each other to form a difference signal. This difference signal is then split into two paths. The first path has a level control that is user adjustable. This control varies the directivity pattern of the MD-Grad loudspeaker. The output of the level control is fed to equalization designed for signals to be radiated by the dipole portion of an MD-Grad gradient loudspeaker. The output of the equalization is amplified and fed to the two outside elements of the three element array, with one element having a reversed polarity connection.

The second path for the output of the difference amplifier has the same processing blocks as the first path. The difference signal is passed through a level control, dipole equalization, and amplification. This amplifier then feeds the two elements of the separate dipole source.

Figure 10A:
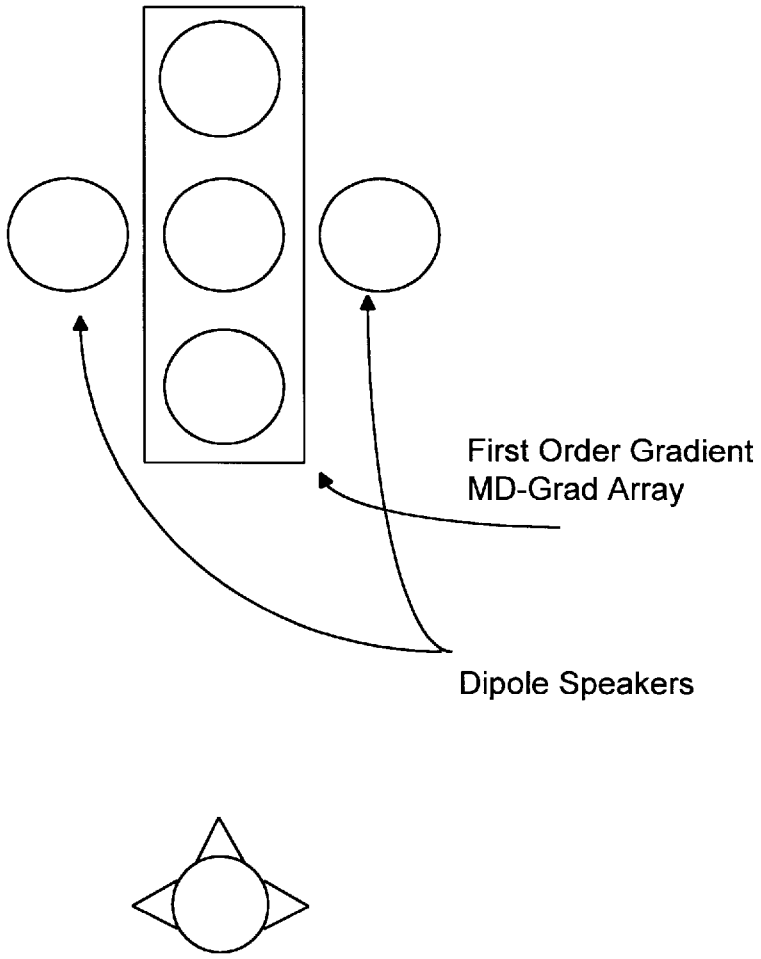
FIG. 10*a* shows a configuration consisting of a two element dipole and a three element MD-Grad gradient loudspeaker arrayed so that with the proper associated electronics, the main radiation axes of left and right channel radiation patterns can be rotated arbitrarily with respect to each other.
Figure 10B:
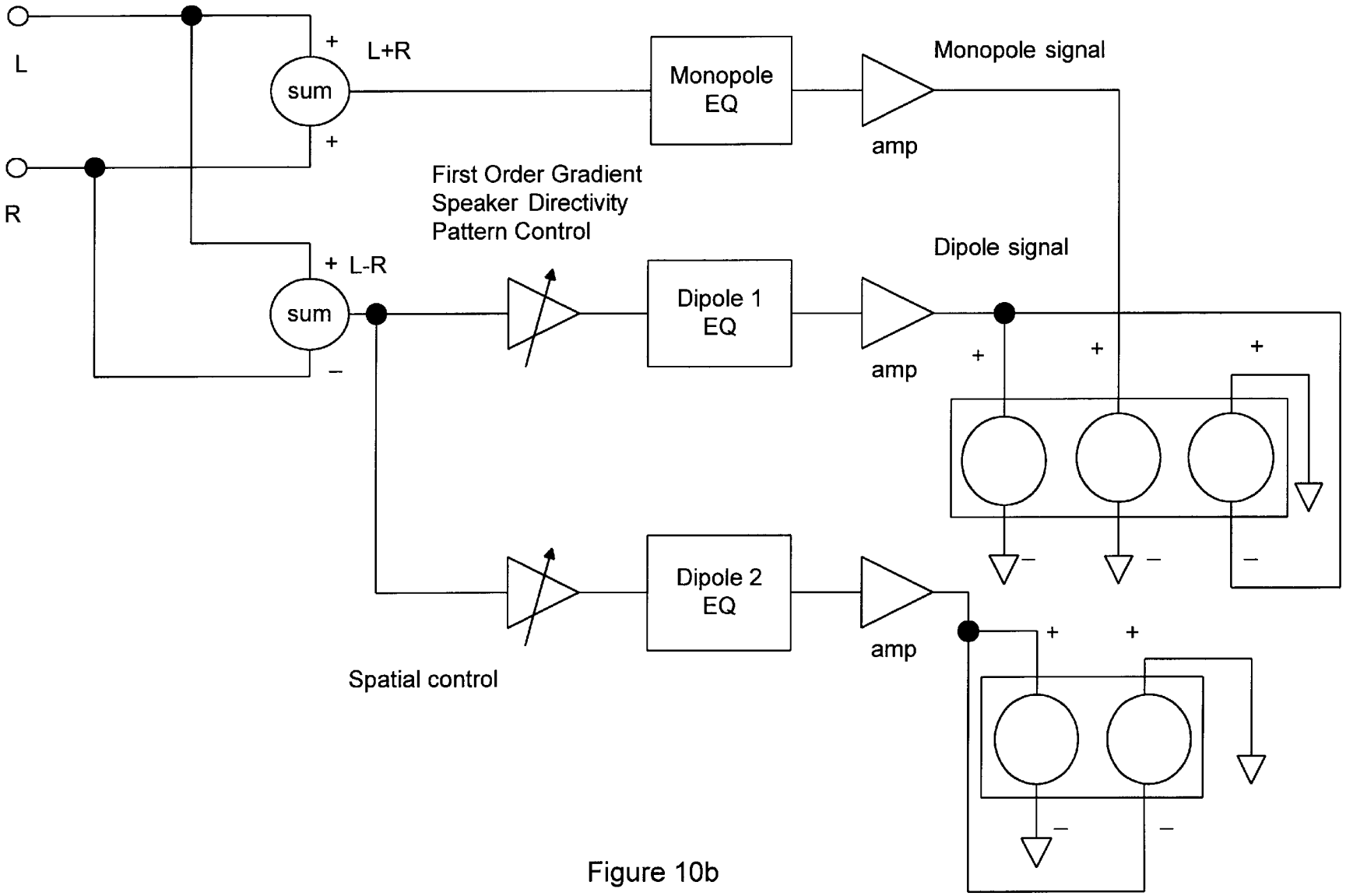
FIG. 10*b* shows loudspeaker arrays and associated signal processing capable of radiating first and second input channel signals with first order gradient directivity characteristics, where the main radiation axes can have an arbitrary angle with respect to each other.
Figure 10C:
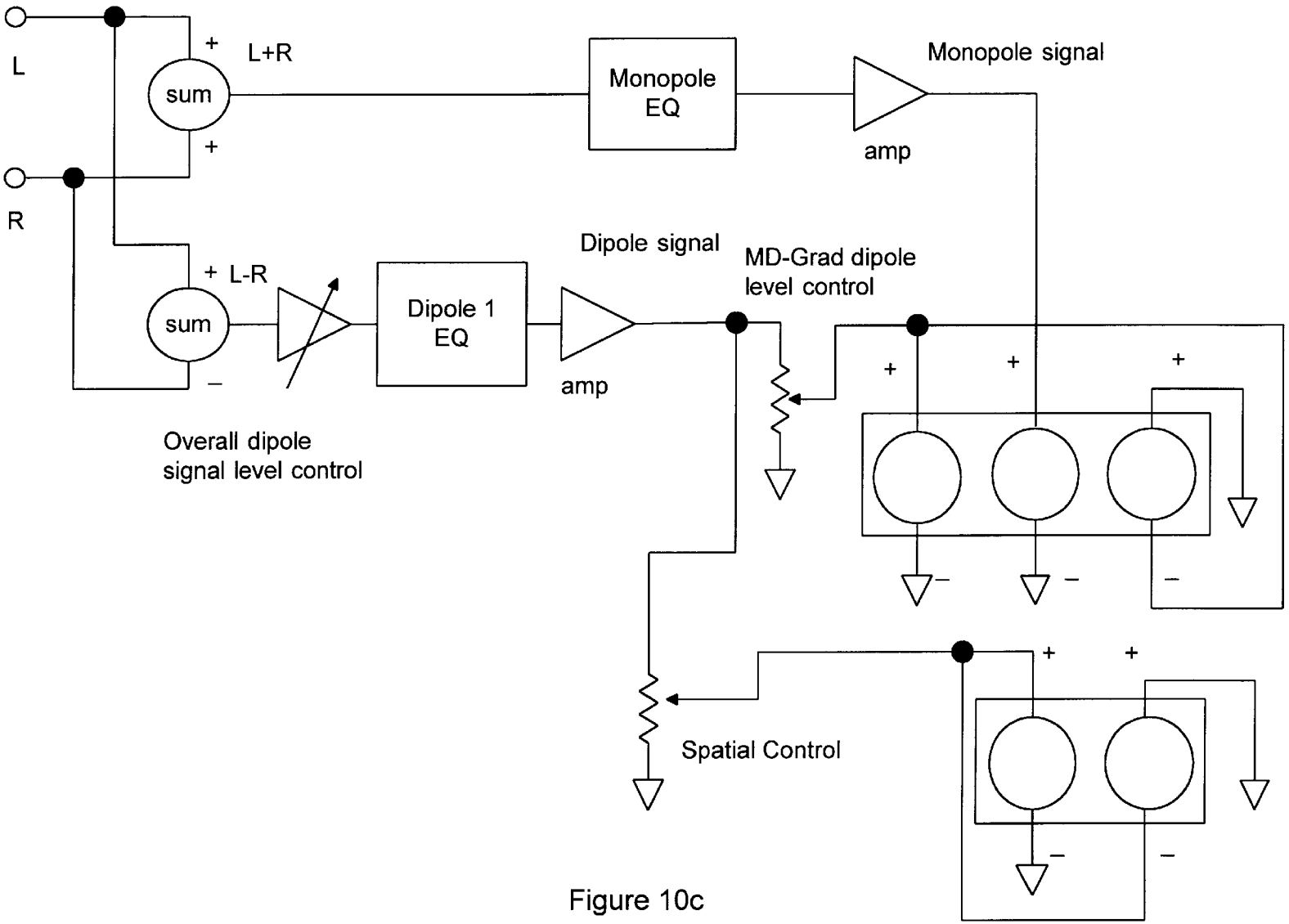

FIG. 10*c* shows an alternative signal processing method for accomplishing the same rotation as shown in FIG. 10*b*. This embodiment eliminates some function blocks in the second path for the output of the difference amplifier that was described above for FIG. 10*b*. This arrangement is possible when the characteristics of the separate dipole source match those of the dipole source used to form the MD-Grad gradient loudspeaker.

Figure 11A:
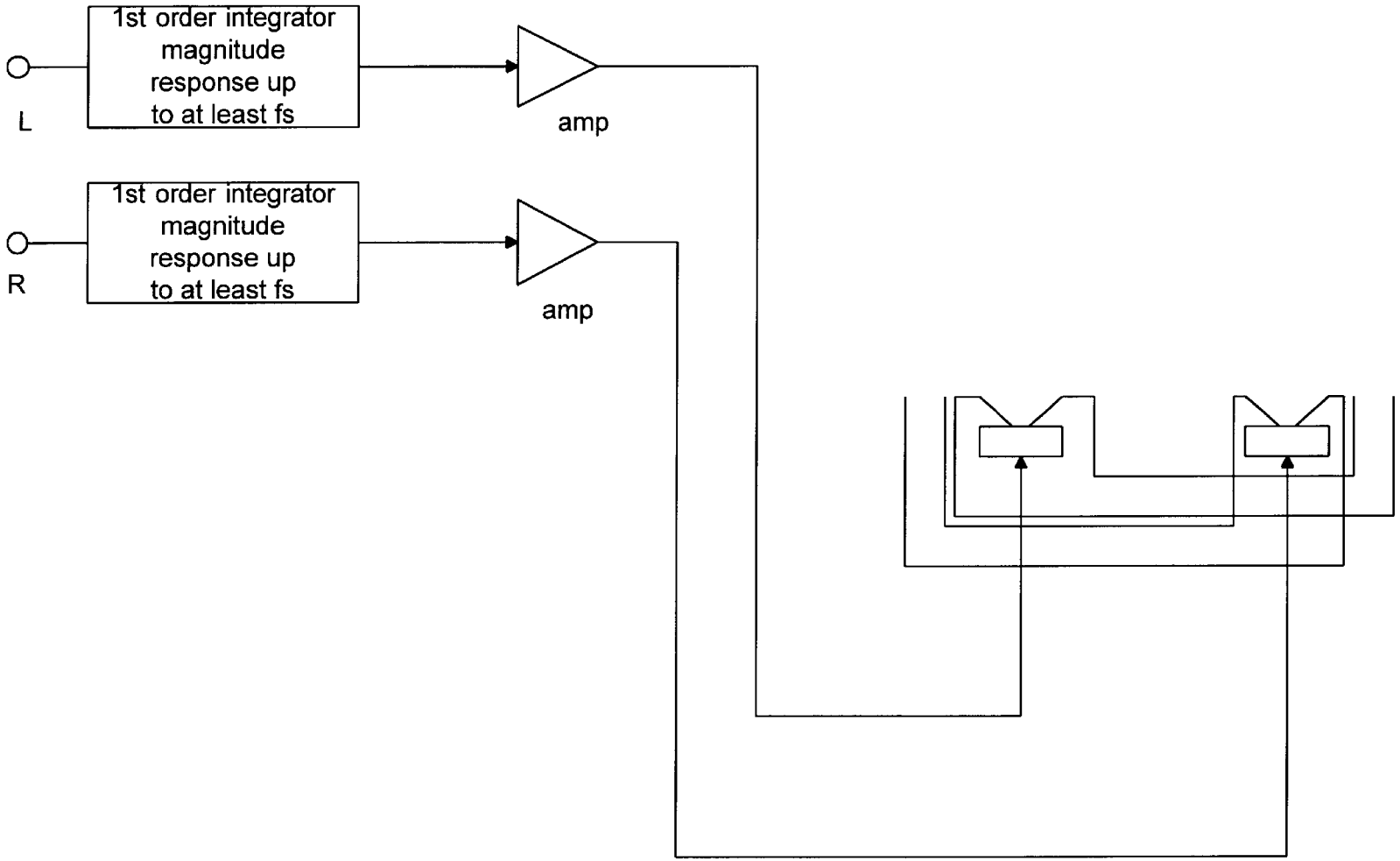

FIG. 11*a* shows a D-Grad SDR array using single element D-Grad gradient loudspeaker elements. The delay is provided by the construction geometry of the single element enclosure.

Figure 11B:
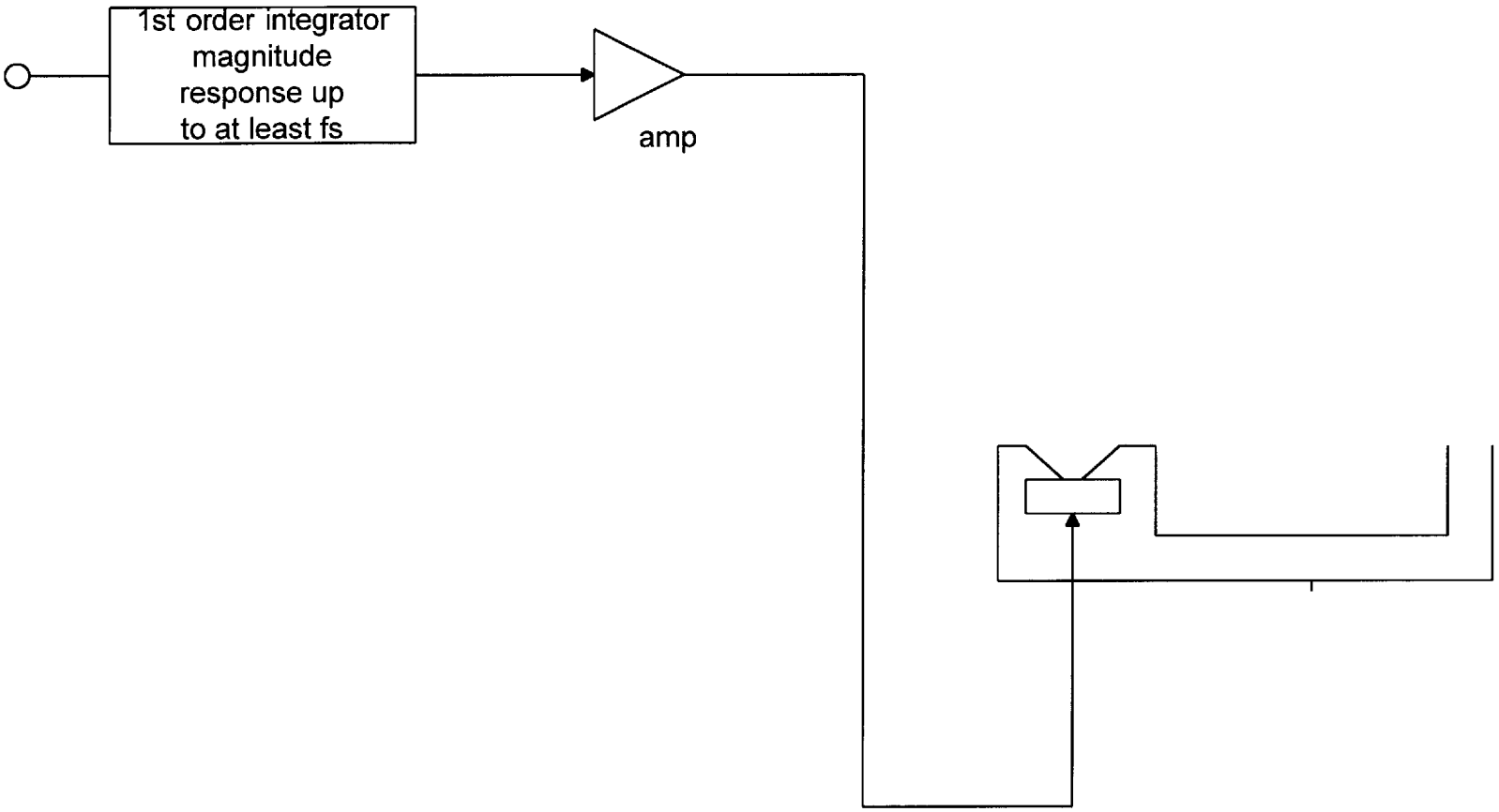

FIG. 11*b* shows a single channel single element D-Grad gradient loudspeaker configuration. The delay is provided by the construction geometry of the single element enclosure.

Figure 12:
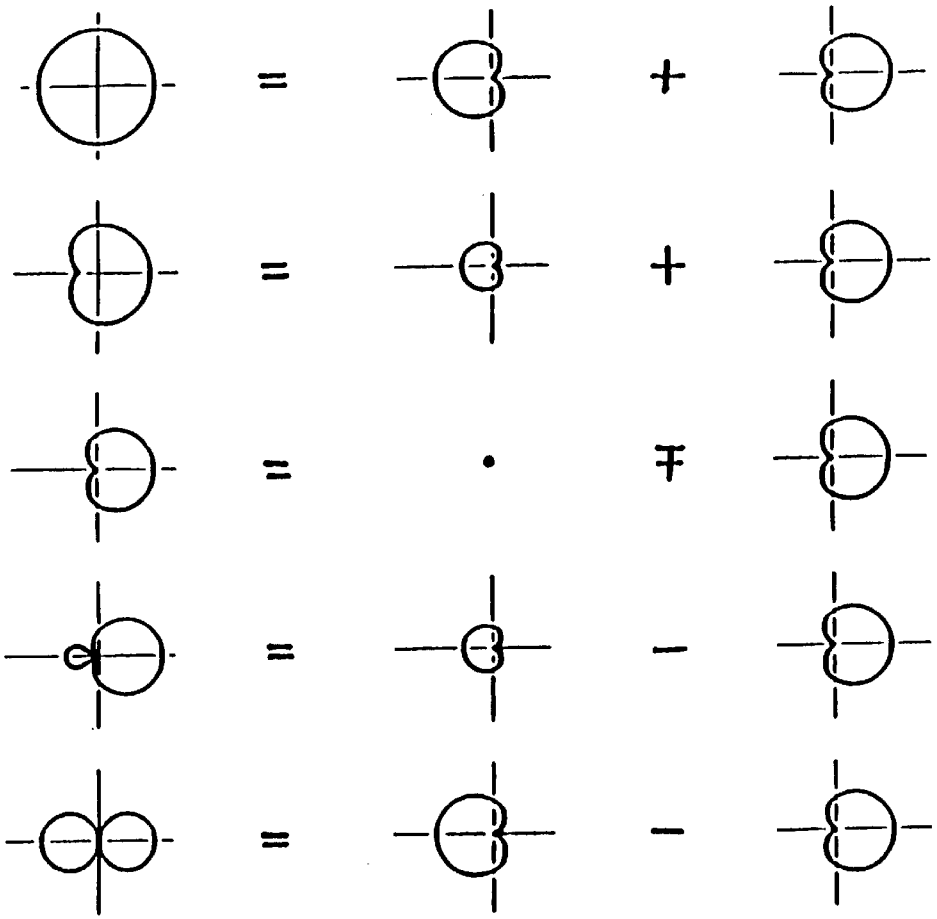

FIG. 12 shows the resultant radiation pattern when two first order gradient radiation patterns are combined with various level and phase relationships.

Figure 13A:
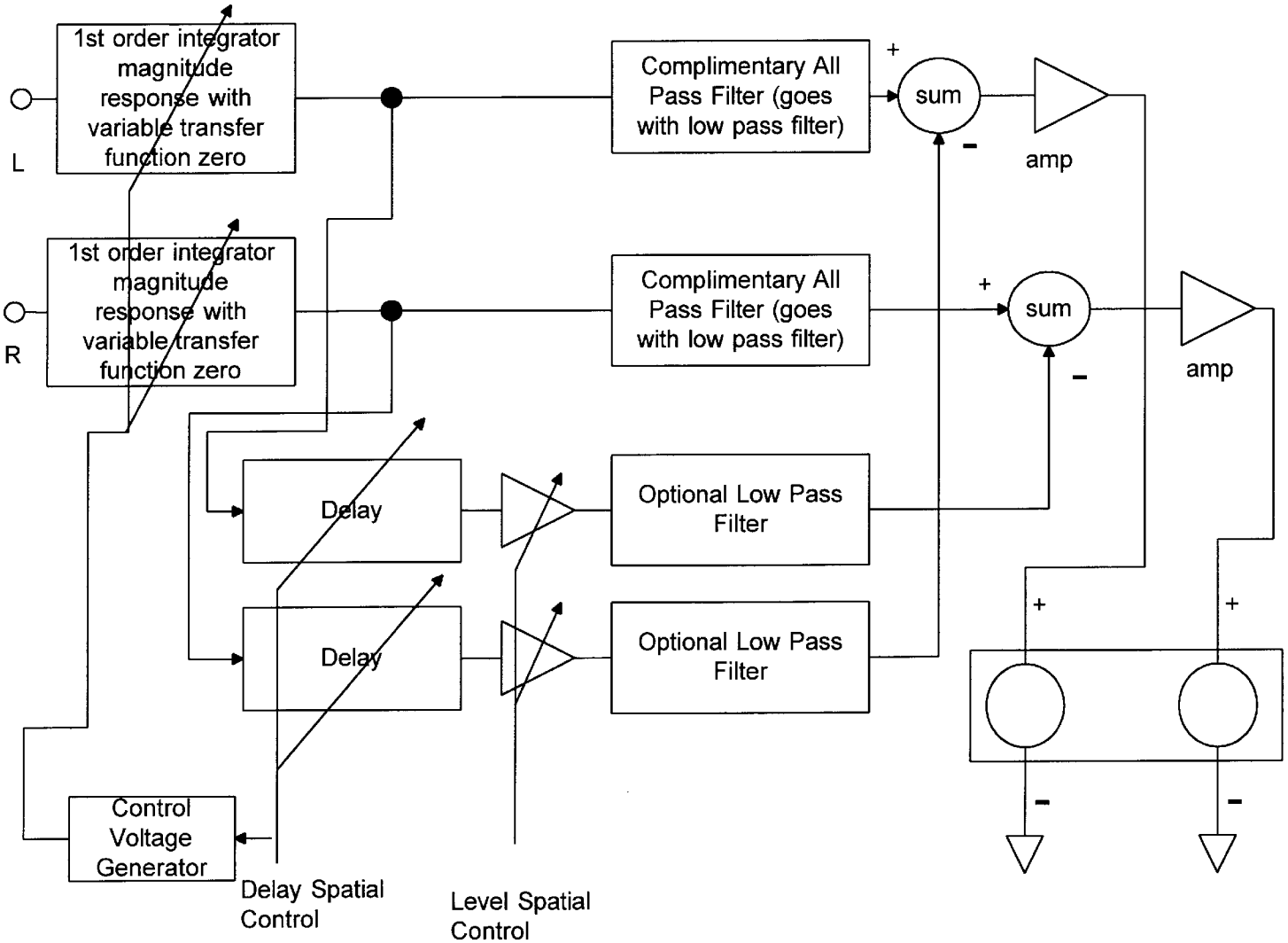

FIG. 13*a* shows a two channel D-Grad based SDR array with its associated signal processing. The signal processing receives left and right input signals. Each signal is passed through equalization that has an integration magnitude characteristic. The equalization also has a variable transfer function zero location, where the location of the zero is controlled by the setting of the delay control. Each output of the equalization is then split into two signal paths. One path feeds a delay block where the amount of delay can be controlled by the user. The user control varies the delay of both channels simultaneously. The output of the delay feeds a user operated level control. The level control operates on both channels simultaneously. The output of the level controls pass through optional low pass filters. These filters are used when it is desired to roll off these delayed signals at high frequencies, as may be desired in some applications. The outputs of the low pass filters feed summing amplifiers. These delayed signals feed into the opposite channel summers, so that the delayed left channel signal feeds the right summing amplifier, and the delayed right channel signal feeds the left summing amplifier.

The outputs of the integrator equalization also feed directly into a pair of optional all pass filters. These filters are designed to have the same phase response as the low pass filters used in the delayed signal paths. They are only used when the low pass filters are also used. The outputs of the all pass filters feed the summing amplifiers. The left signal here feeds the left summing amp and the right signal feeds the right summing amp. The outputs of the summing amps are then fed to the left and right array speaker elements.

Figure 13B:
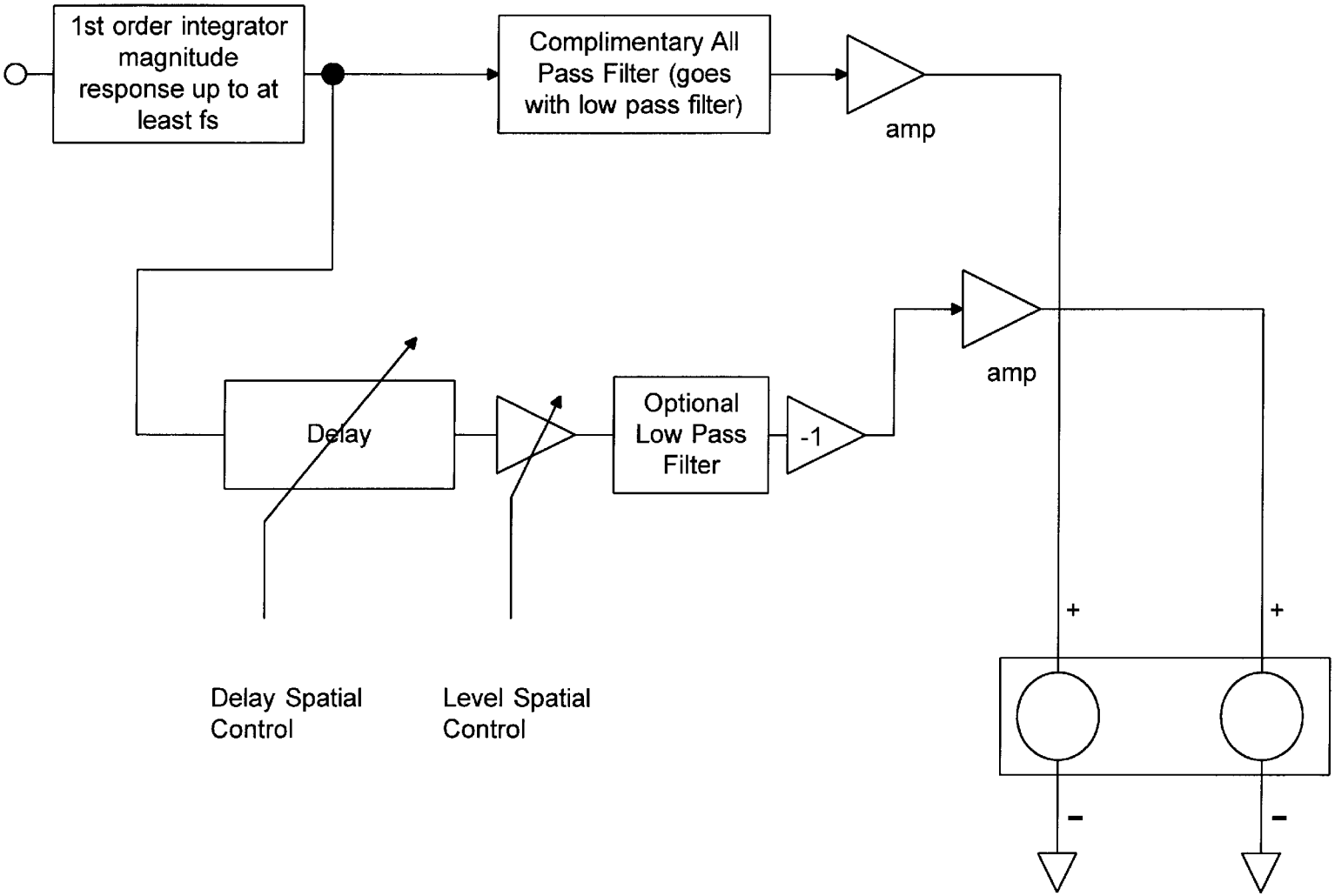

FIG. 13*b* shows a single channel D-Grad gradient loudspeaker array with its associated signal processing. The signal processing receives an input signal. The signal is passed through equalization that has an integration magnitude characteristic. The output of the equalization is then split into two signal paths. One path feeds a delay block where the amount of delay can be controlled by the user. The output of the delay feeds a user operated level control. The output of the level controls pass through an optional low pass filter. These filters are used when it is desired to roll off these delayed signals at high frequencies, as may be desired in some applications. The outputs of the low pass filter is inverted and then fed into the right amplifier which feeds the right loudspeaker array element.

The output of the integrator equalization also feeds directly into an optional all pass filter. This filter is designed to have the same phase response as the low pass filter used in the delayed signal path. It is only used when the low pass filter is also used. The output of the all pass filter feeds the left amplifier, which then feeds the left loudspeaker array element.

Figure 13C:
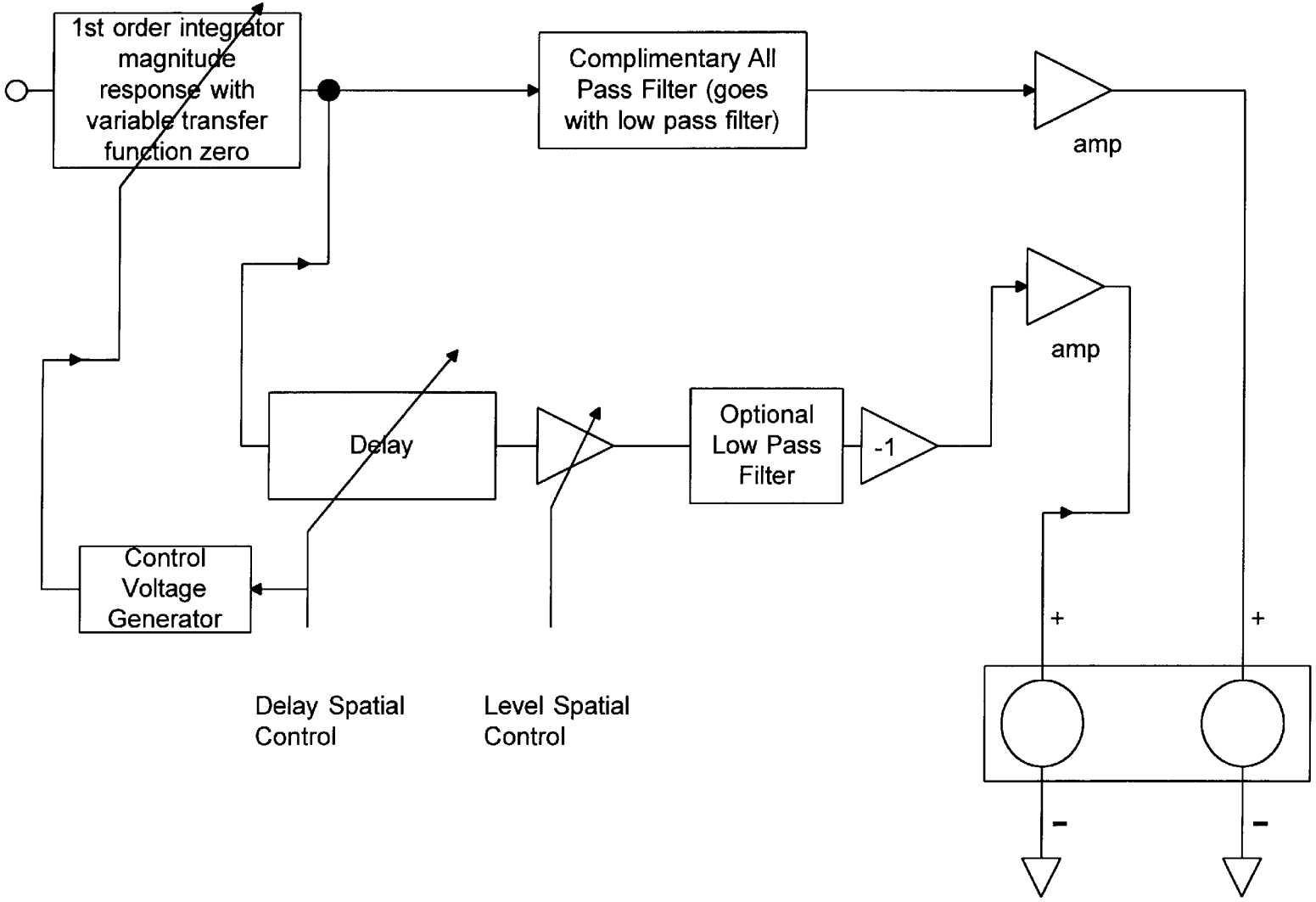

FIG. 13*c* shows a single channel D-Grad gradient loudspeaker array with its associated signal processing. The signal processing receives an input signal. The signal is passed through equalization that has an integration magnitude characteristic. The equalization also has a variable transfer function zero location, where the location of the zero is controlled by the setting of the delay control. The output of the equalization is then split into two signal paths. One path feeds a delay block where the amount of delay can be controlled by the user. The output of the delay feeds a user operated level control. The output of the level controls pass through an optional low pass filter. These filters are used when it is desired to roll off these delayed signals at high frequencies, as may be desired in some applications. The outputs of the low pass filter is inverted and then fed into the right amplifier which feeds the right loudspeaker array element.

The output of the integrator equalization also feeds directly into an optional all pass filter. This filter is designed to have the same phase response as the low pass filter used in the delayed signal path. It is only used when the low pass filter is also used. The output of the all pass filter feeds the left amplifier, which then feeds the left loudspeaker array element.

FIG. 14*a* shows the resulting directivity patterns generated by a model of the first prototype SDR system when a single right channel signal is fed to the system.

FIG. 14*b* shows the resulting directivity, patterns generated by a model of the second prototype two way SDR system when a single right channel signal is fed to the system.

Figure 15A:
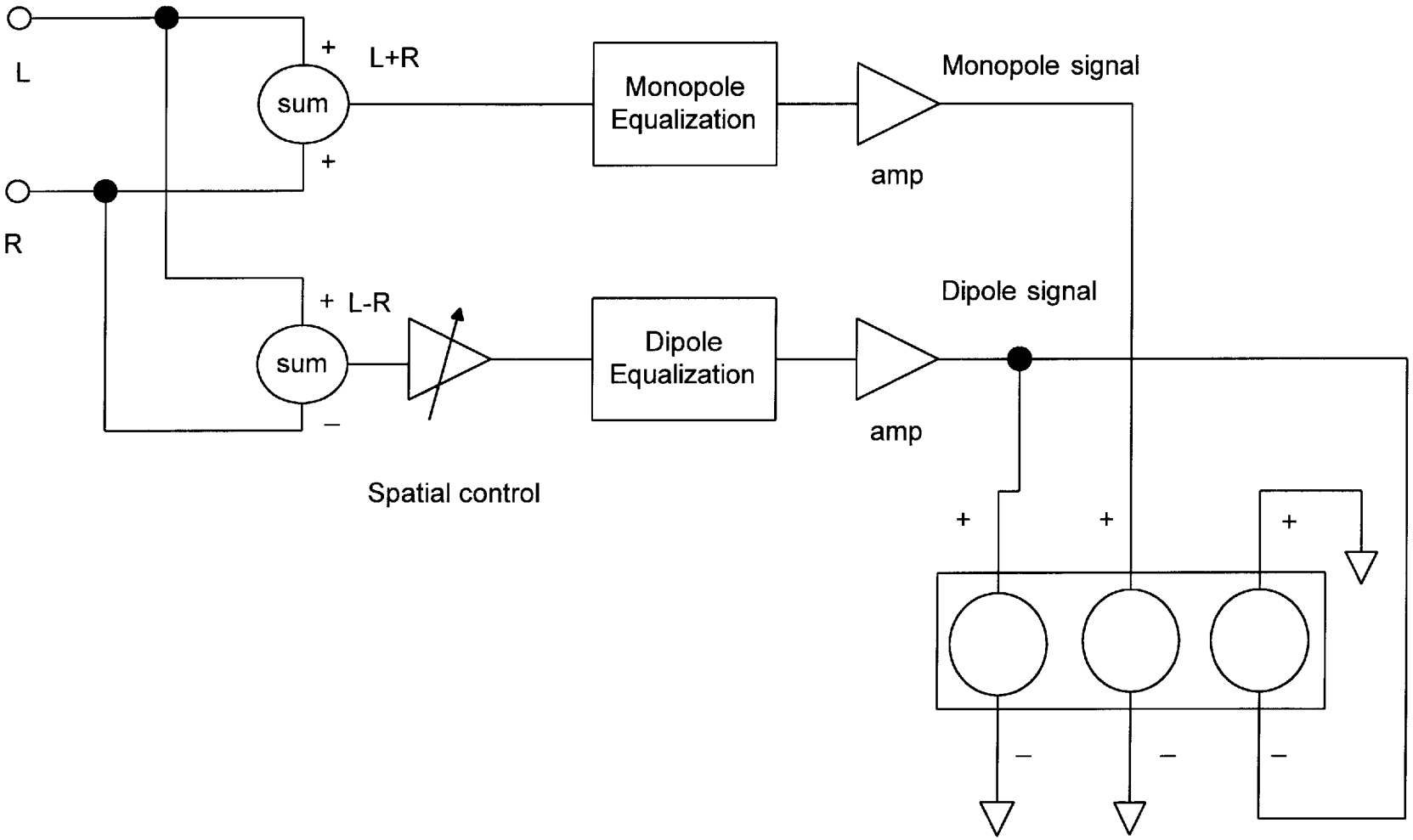

FIG. 15*a* shows the signal processing required for a three element MD-Grad based SDR array. Two input signals are presented to the signal processing circuitry. The signals are first summed together to form an L+R signal, and subtracted from each other to form an L−R signal. The L−R signal is then passed through a user variable level control which acts as a space control. It then passes through equalization required for the signal to be radiated by a dipole. The signal is then amplified, and fed to the two outside array elements, where the polarity of the connection to one of the elements is inverted.

The sum signal is fed into equalization required for the signal to be radiated by the center element monopole. It is then amplified and passed to the center array element. The equalization in the monopole and dipole signal paths are designed so that the magnitude response shapes of the monopole and dipole outputs are the same, and the relative phase is either 0 or 180 degrees, over the frequency range where radiation pattern control is desired.

Figure 15B:
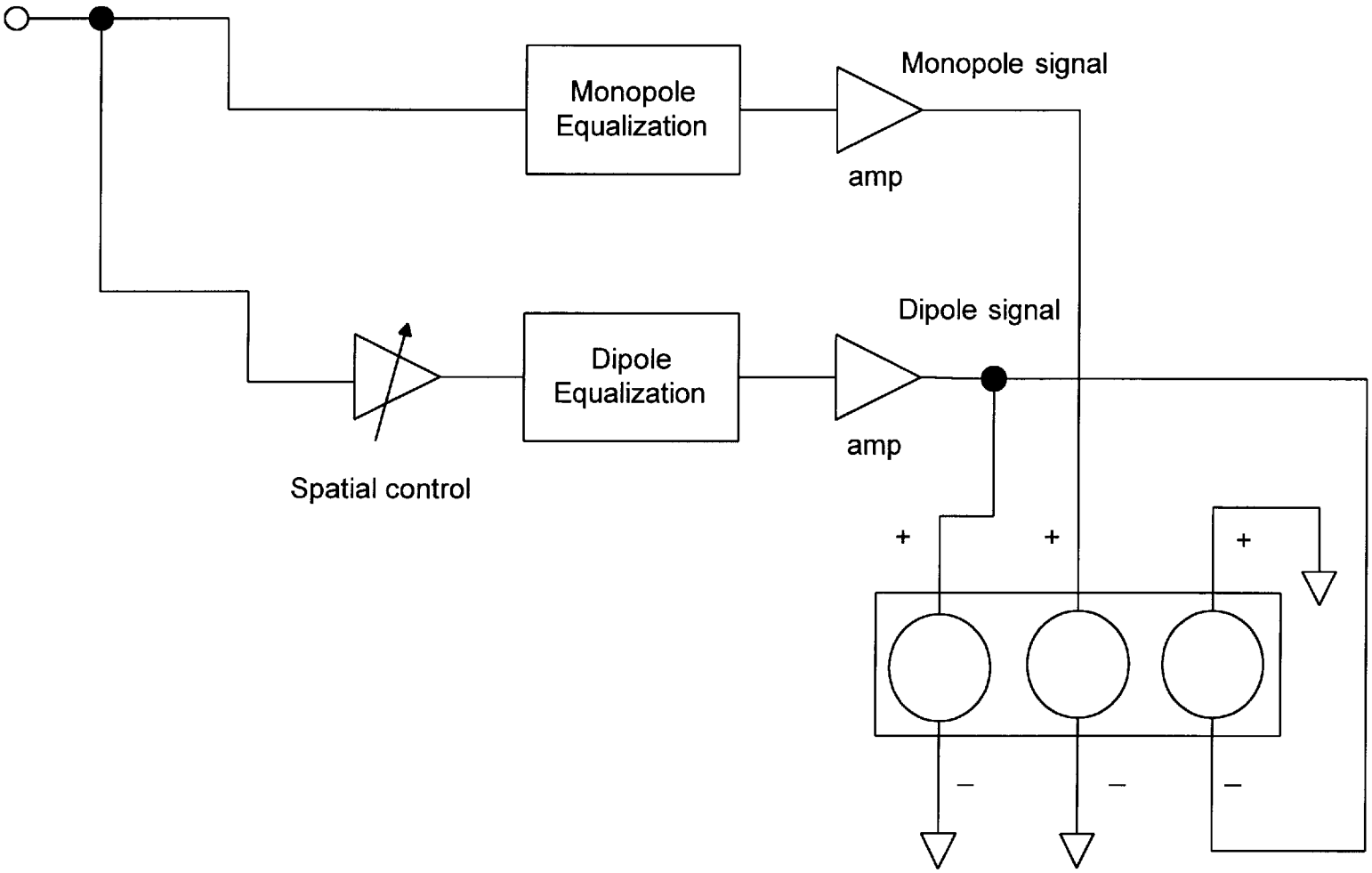

FIG. 15*b* shows the signal processing required for a three element MD-Grad based gradient loudspeaker. One input signal is presented to the signal processing circuitry. The signal is split into two paths. One path feeds into a user variable level control which acts as a directivity pattern control. It then passes through equalization required for the signal to be radiated by a dipole. The signal is then amplified, and fed to the two outside array elements, where the polarity of the connection to one of the elements is inverted.

The second path feeds into equalization required for the signal to be radiated by the center element monopole. It is then amplified and passed to the center array element. The equalization in the monopole and dipole signal paths are designed so that the magnitude response shapes of the monopole and dipole outputs are the same, and the relative phase is either 0 or 180 degrees, over the frequency range where radiation pattern control is desired.

Figure 16A:
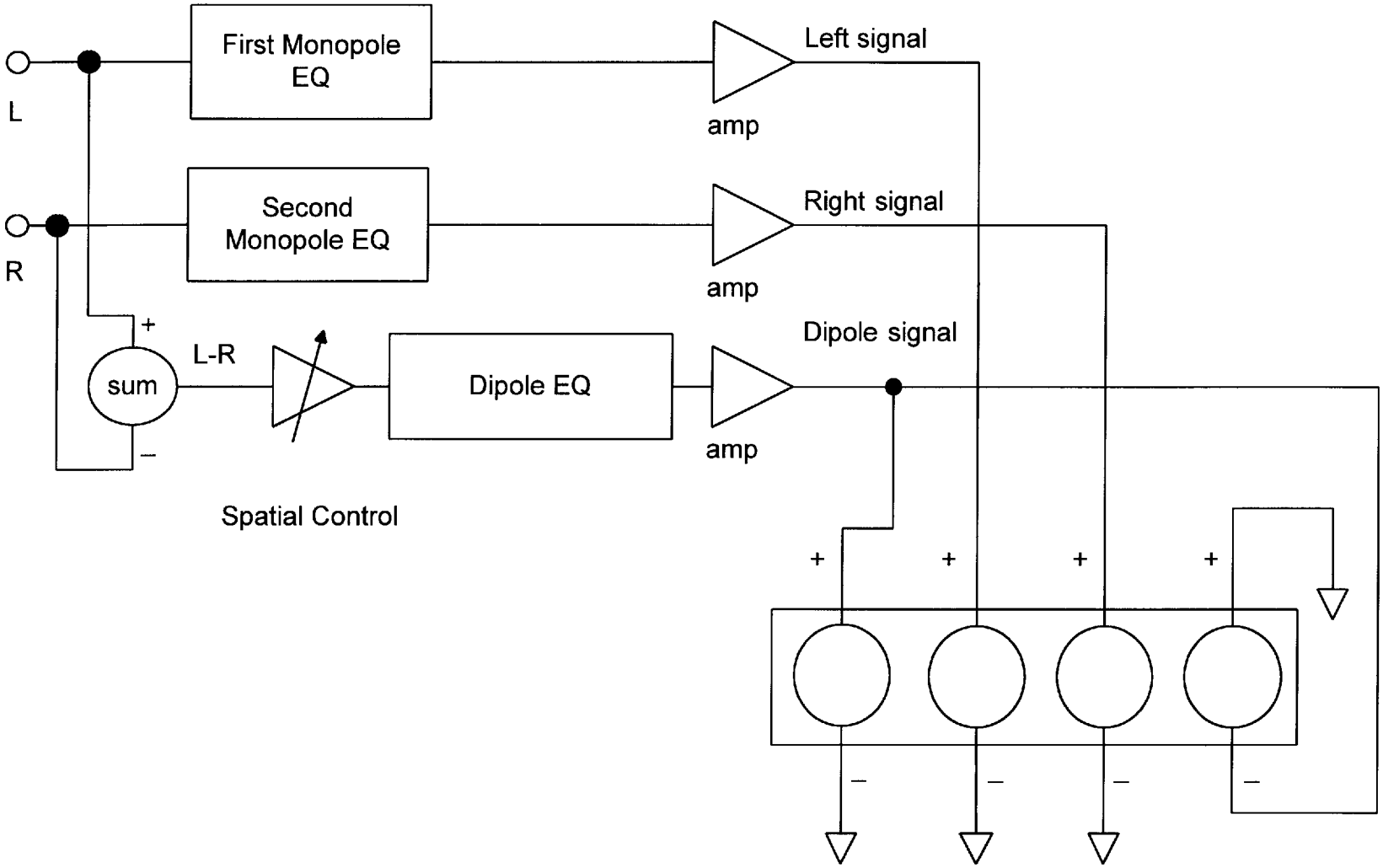

FIG. 16*a* shows the signal processing required for a four element MD-Grad based SDR array. Two input signals are presented to the signal processing circuitry. The input signals are split into two separate paths. The signals traverse a first path where they are subtracted from each other to form an L−R signal. The L−R signal is then passed through a user variable level control which acts as a space control. It then passes through equalization required for the signal to be radiated by a dipole. The signal is then amplified, and fed to the two outside array elements, where the polarity of the connection to one of the elements is inverted.

Each input signal also traverses a second path. Each signal is fed into equalization required for the signal to be radiated by a monopole element. The output of the left channel monopole equalization is then amplified and fed to the left channel monopole element. The output of the right channel monopole equalization is then amplified and fed to the right channel monopole element. The equalization in the monopole and dipole signal paths are designed so that the magnitude response shapes of the monopole and dipole outputs are the same, and the relative phase is either 0 or 180 degrees, over the frequency range where radiation pattern control is desired.

Figure 17A:
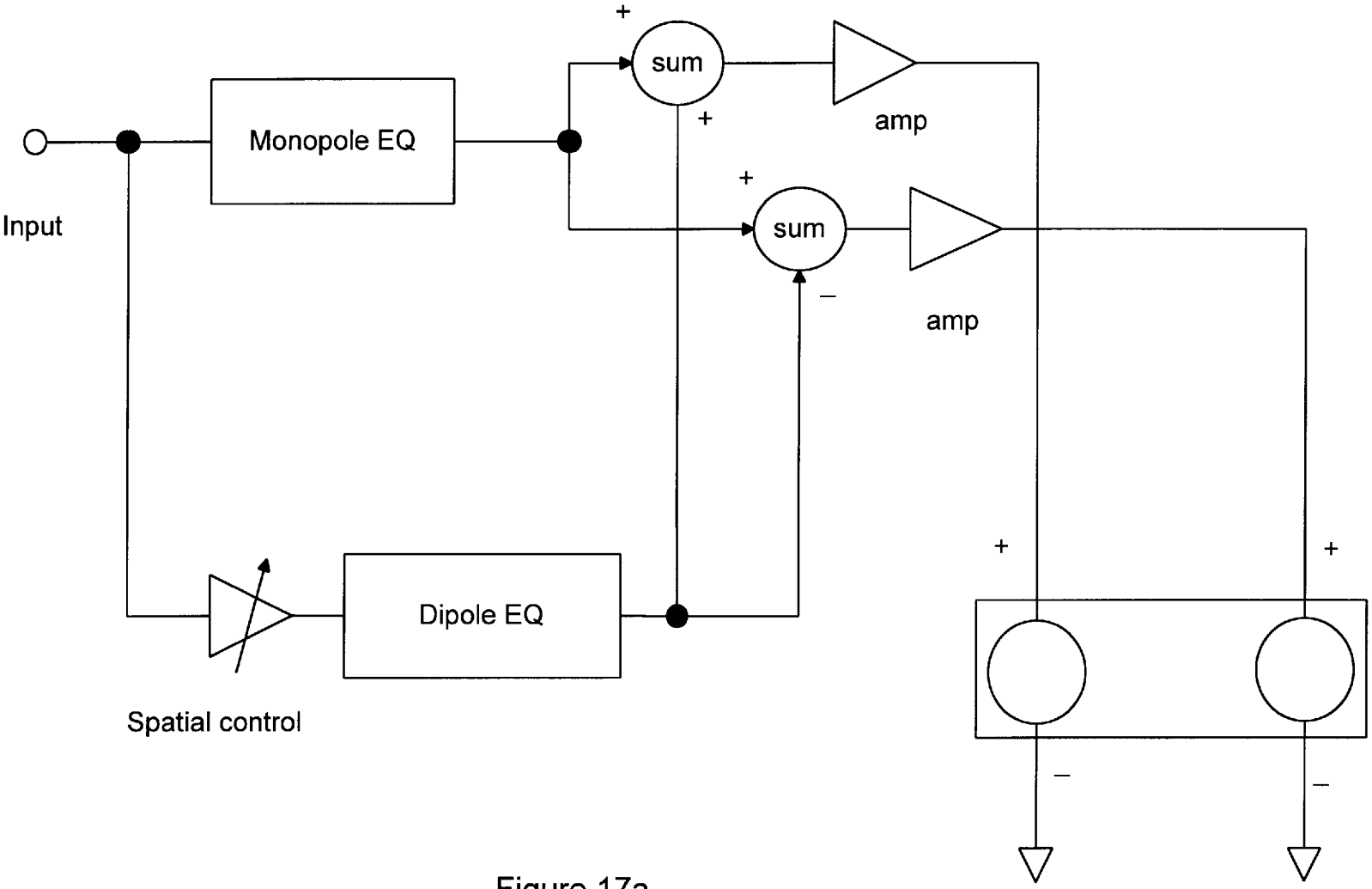

FIG. 17*a* shows the signal processing required for a two element single channel first combination type gradient loudspeaker. An input signal is presented to the signal processing circuitry. The signal is split into two paths. One path feeds into a user variable level control which acts as a directivity pattern control. It then passes through equalization required for the signal to be radiated by a dipole. The signal then feeds into a pair of summing amplifiers, where the polarity of the signal input to one of the summers is inverted.

The second path feeds into equalization required for the signal to be radiated by both array elements acting as monopoles. The signal then feeds into the same pair of summing amplifiers described above, where this signal has the same polarity connection to both summing amplifiers.

The outputs of the summing amplifiers are then amplified and fed to the left and right loudspeaker array elements. The equalization in the monopole and dipole signal paths are designed so that the magnitude response shapes of the monopole and dipole outputs are the same, and the relative phase is either 0 or 180 degrees, over the frequency range where radiation pattern control is desired.

Figure 17B:
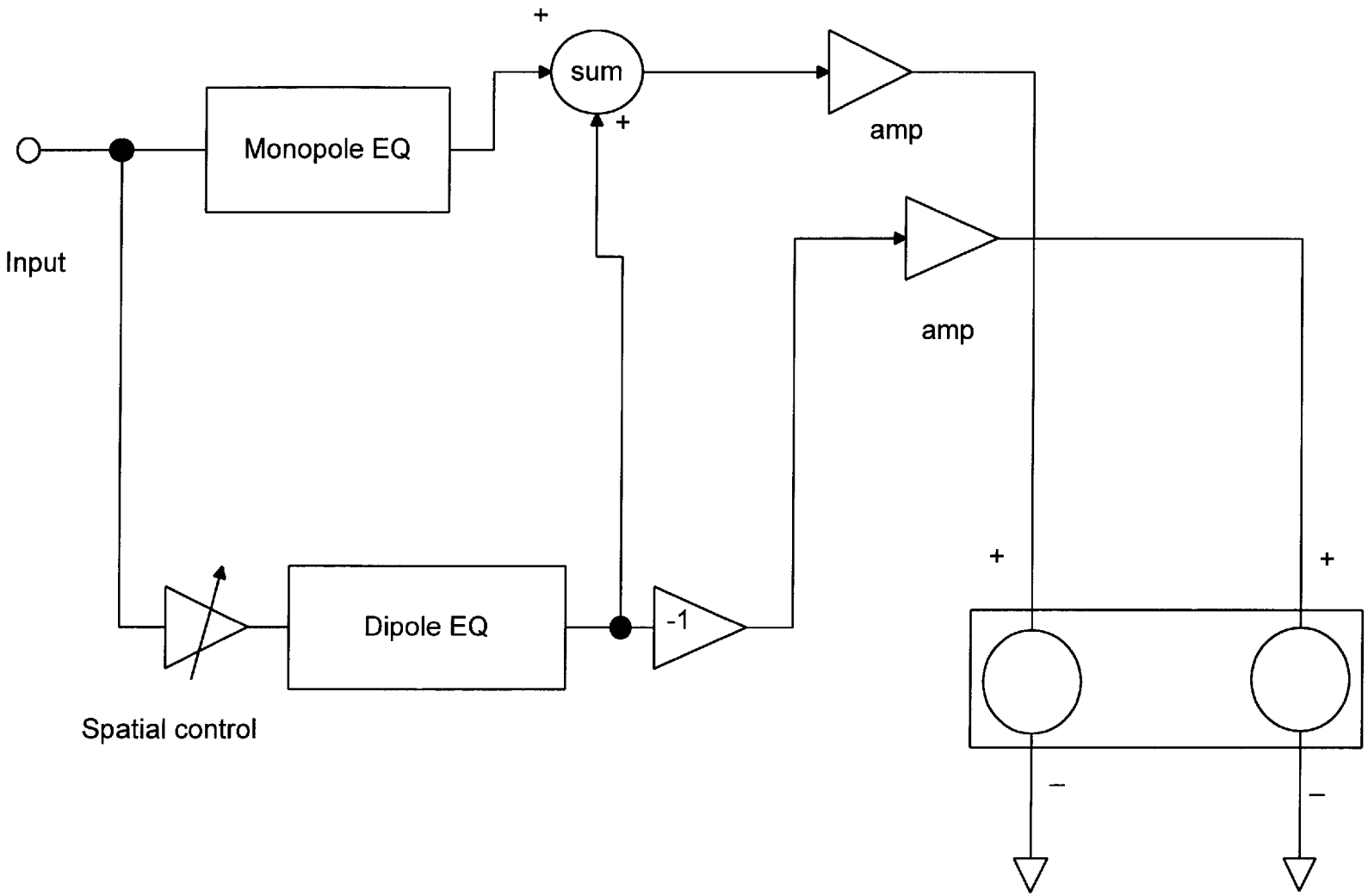

FIG. 17*b* shows the signal processing required for a two element single channel second combination type gradient loudspeaker. An input signal is presented to the signal processing circuitry. The input signal is split into two paths. One path feeds into a user variable level control which acts as a directivity pattern control. It then passes through equalization required for the signal to be radiated by a dipole. The signal is then split in two paths, the first path feeds into a summing amplifier and the second path feeds one power amplifier of a stereo pair of amplifiers.

The second input path feeds into equalization required for the signal to be radiated by one of the array elements acting as a monopole. The output of the monopole equalization then feeds into the same summing amplifier described above. The output of the summing amplifier feeds the other power amplifier of the stereo pair of power amplifiers. The output of the power amplifiers are then fed to the left loudspeaker array elements.

The equalization in the monopole and dipole signal paths are designed so that the magnitude response shapes of the monopole and dipole outputs are the same, and the relative phase is either 0 or 180 degrees, over the frequency range where radiation pattern control is desired.

Figure 17C:
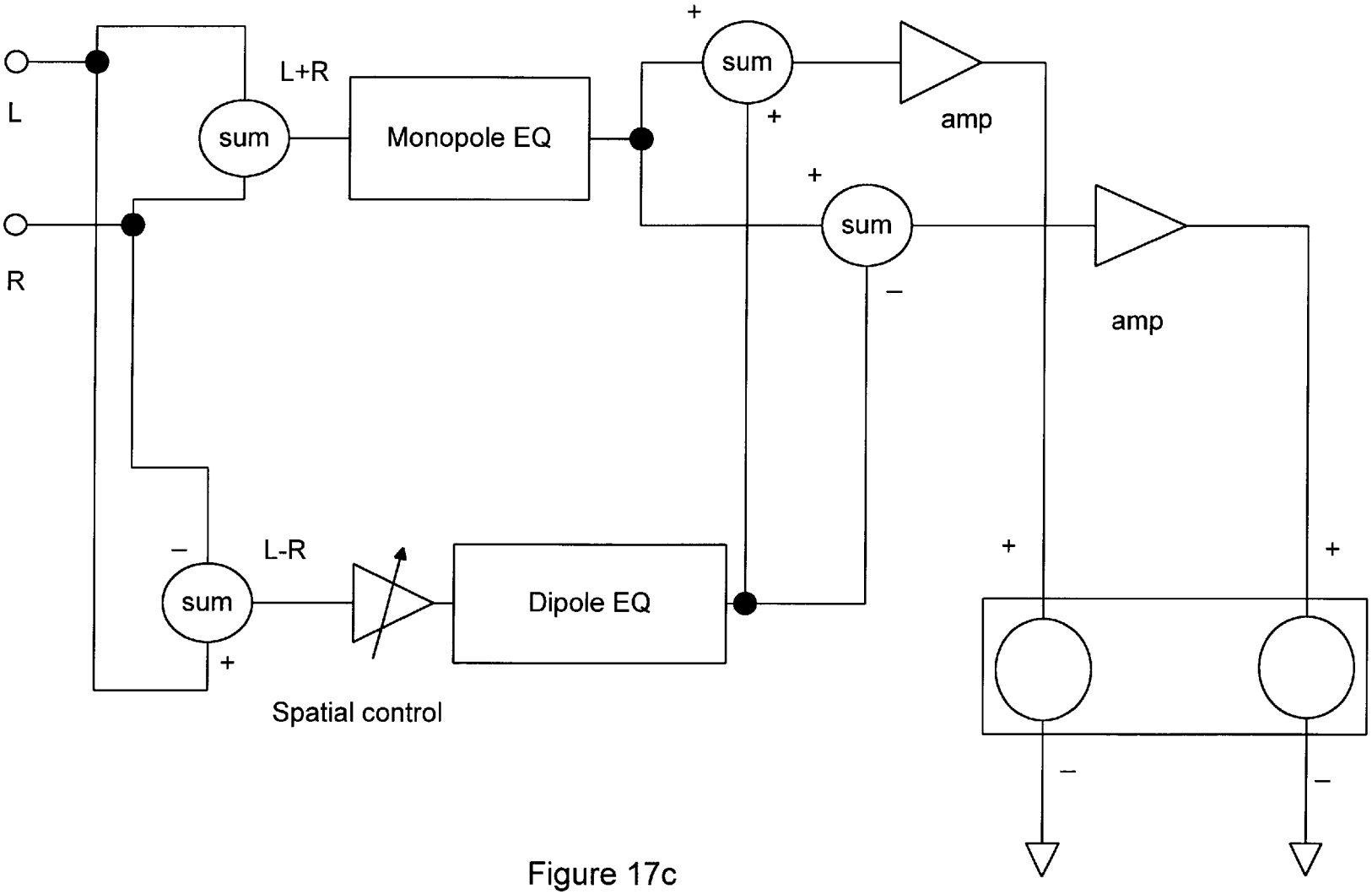

FIG. 17*c* shows the signal processing required for a two element two channel first combination type gradient loudspeaker SDR array. Two input signals are presented to the signal processing circuitry. The signals are split into two paths. One path feeds into a difference amplifier, where one signal is subtracted from the other. The output of the difference amplifier feeds a user variable level control which acts as a directivity pattern control. It then passes through equalization required for the signal to be radiated by a dipole. The signal then feeds into a pair of summing amplifiers, where the polarity of the signal input to one of the summers is inverted.

The second input signal path feeds into a summing amplifier that adds the two input signals together. The output of this summing amplifier then feeds equalization required for the signal to be radiated by both array elements acting as monopoles. The output of the equalization then feeds into the same pair of summing amplifiers described above, where these signals have the same polarity connection to both summing amplifiers.

The outputs of the summing amplifiers are then amplified and fed to the left and right loudspeaker array elements. The equalization in the monopole and dipole signal paths are designed so that the magnitude response shapes of the monopole and dipole outputs are the same, and the relative phase is either 0 or 180 degrees, over the frequency range where radiation pattern control is desired.

Figure 17D:
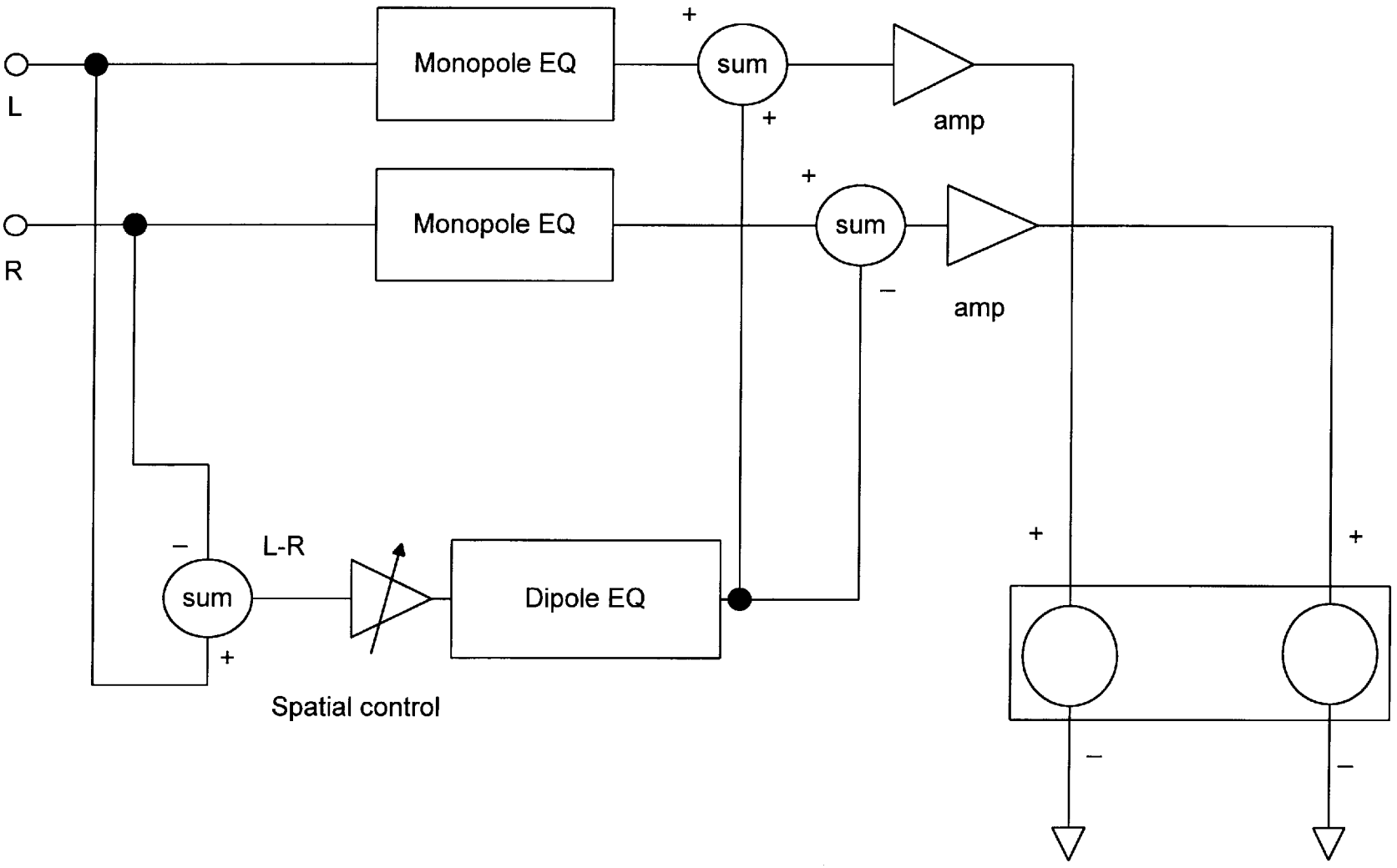

FIG. 17*d* shows the signal processing required for a two element two channel second combination type gradient loudspeaker SDR array. Two input signals are presented to the signal processing circuitry. The signals are split into two paths. One path feeds into a difference amplifier, where one signal is subtracted from the other. The output of the difference amplifier feeds a user variable level control which acts as a directivity pattern control. It then passes through equalization required for the signal to be radiated by a dipole. The output of the equalization then feeds into a pair of summing amplifiers, where the polarity of the signal input to one of the summers is inverted.

The second input signal paths feed both input signals into their own respective equalization blocks, where the equalization has the required form for radiation by the loudspeaker array elements as monopoles. The output of the equalization then feeds into the same pair of summing amplifiers described above, where these signals have the same polarity connection to both summing amplifiers.

The outputs of the summing amplifiers are then amplified and fed to the left and right loudspeaker array elements. The equalization in the monopole and dipole signal paths are designed so that the magnitude response shapes of the monopole and dipole outputs are the same, and the relative phase is either 0 or 180 degrees, over the frequency range where radiation pattern control is desired.

Figure 17E:
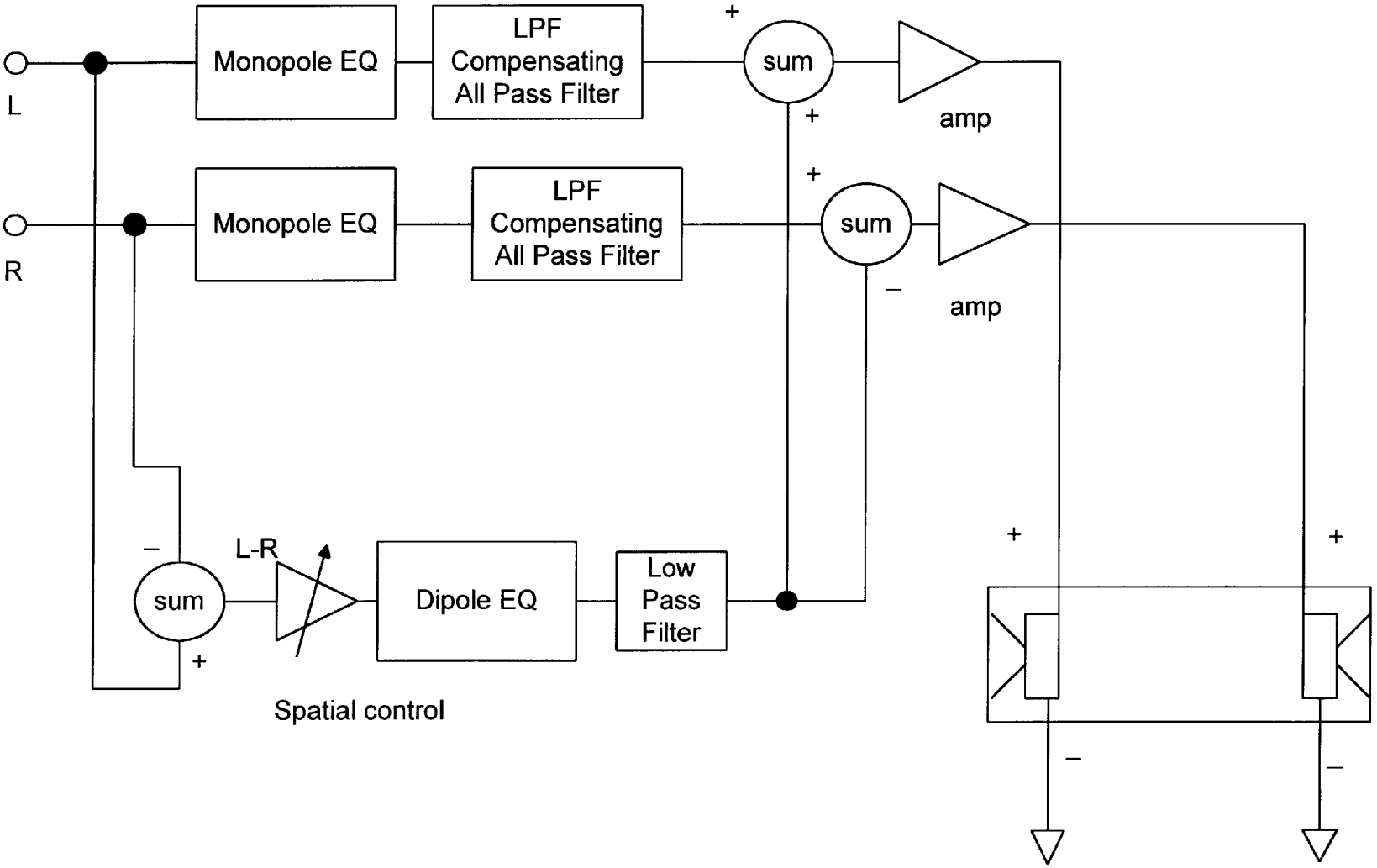

FIG. 17*e* shows a configuration similar to what is shown in FIG. 17*d*, with the addition of a low pass filter in the difference signal path, and compensating all pass filters placed in the monopole signal paths. The low pass filter rolls off the difference signal at higher frequencies, so that the signal applied to the left and right array elements at high frequencies only consist of the left and right input signals respectively (no opposite channel information is present at high frequencies).

The loudspeaker elements are shown facing out to the sides of the array. This embodiment is set up to make use of the wave type directivity behavior at high frequencies of real transducers used as array elements.

Figure 17F:
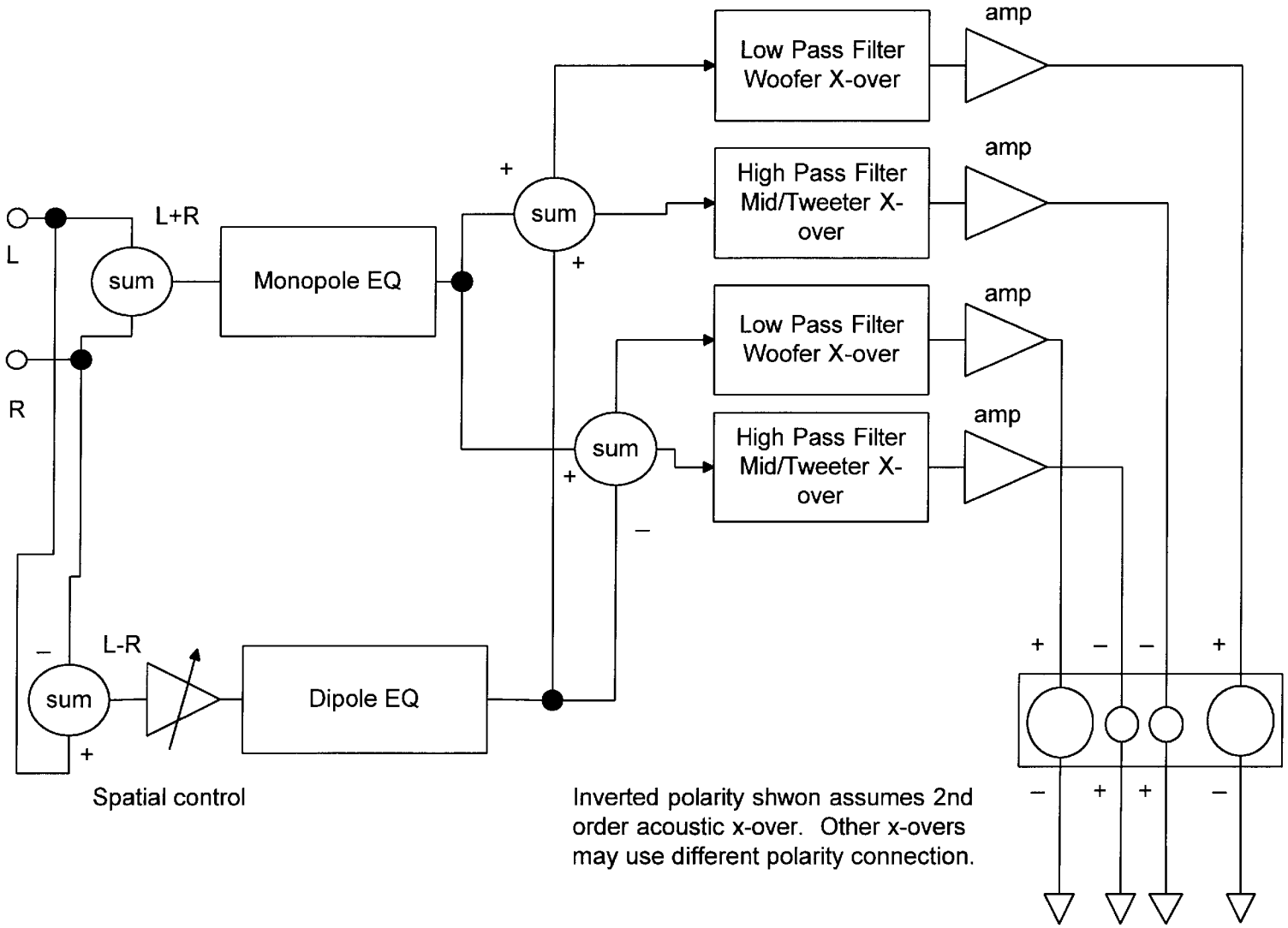

FIG. 17*f* shows a two way two channel SDR system that uses the form of the two element first combination type gradient loudspeakers. The processing shown is similar to the processing in FIG. 17*c* with the addition of crossover networks to split the output of the SDR processing into low and high frequency bands. The low and high frequency portions of the SDR output are then amplified and fed to the separate woofers and mid/tweeters shown. The loudspeaker array has the woofers spaced farther apart than the mid/tweeters.

Figure 18A:
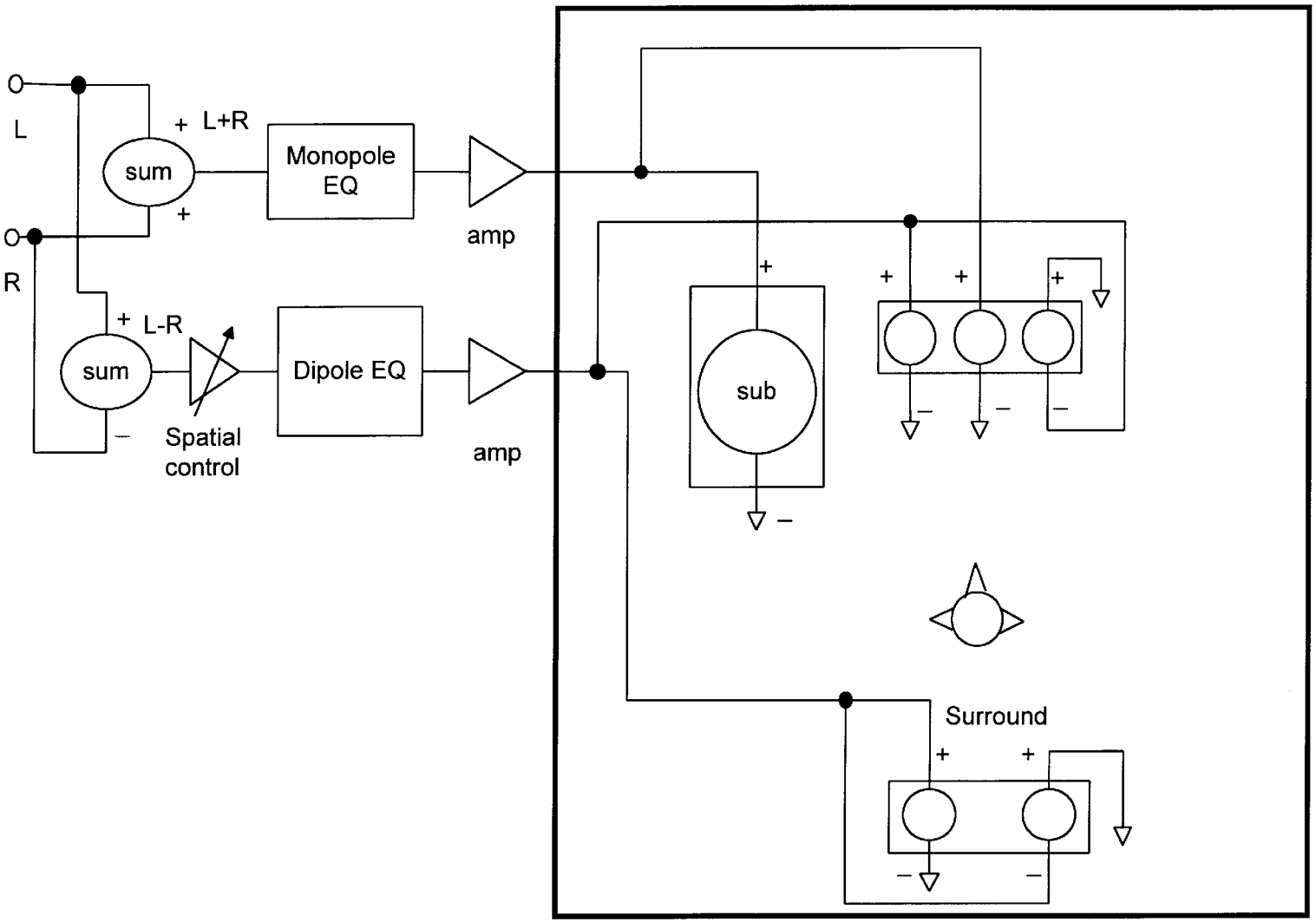

FIG. 18*a* shows an example Home Theater system setup using a three element MD-Grad gradient loudspeaker SDR array, a single rear dipole surround loudspeaker, and a sub woofer. Left and right input signals are applied to the SDR signal processing. The input signals are split into two paths. In the first path, the input signals are summed together. The output of this summer is applied to equalization designed to be radiated by the center array element acting as a monopole source. The output of this equalization is fed to a power amplifier. The output of this power amplifier is connected to the SDR array center element. It is also connect to the sub woofer.

The second path for the input signals feeds into a difference amplifier, where one signal is subtracted from the other. The output of the difference amplifier feeds a user adjustable level control that acts as a space control. The output of this control is fed to equalization designed for applying the signal to the outside SDR array elements to be radiated as a dipole. The output of this equalization is fed to a power amplifier. The power amplifier output is connected to the outside loudspeaker array elements, where the polarity of one of the connections is reversed. This amplified difference signal is also fed to the surround speaker, which in this case is also constructed as a dipole, where the null in the dipole response pattern is pointed at the listening location.

Figure 18B:
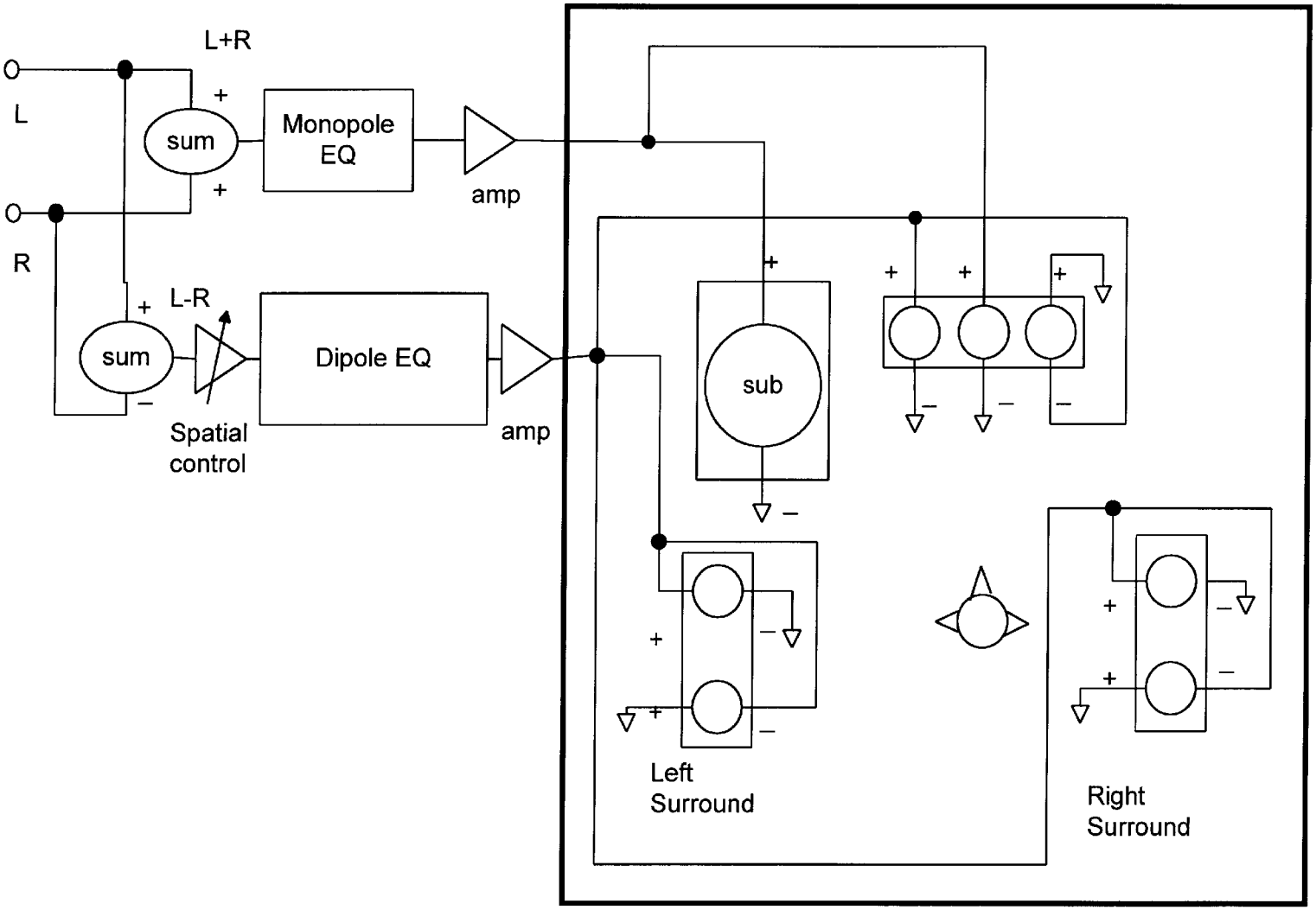

FIG. 18*b* shows a configuration similar to FIG. 18*a*, where a second surround loudspeaker has been added, which is also shown constructed as a dipole, where the surround speakers are placed on the sides of the listening area with the nulls in their radiation patterns facing the listening area.

Figure 18C:
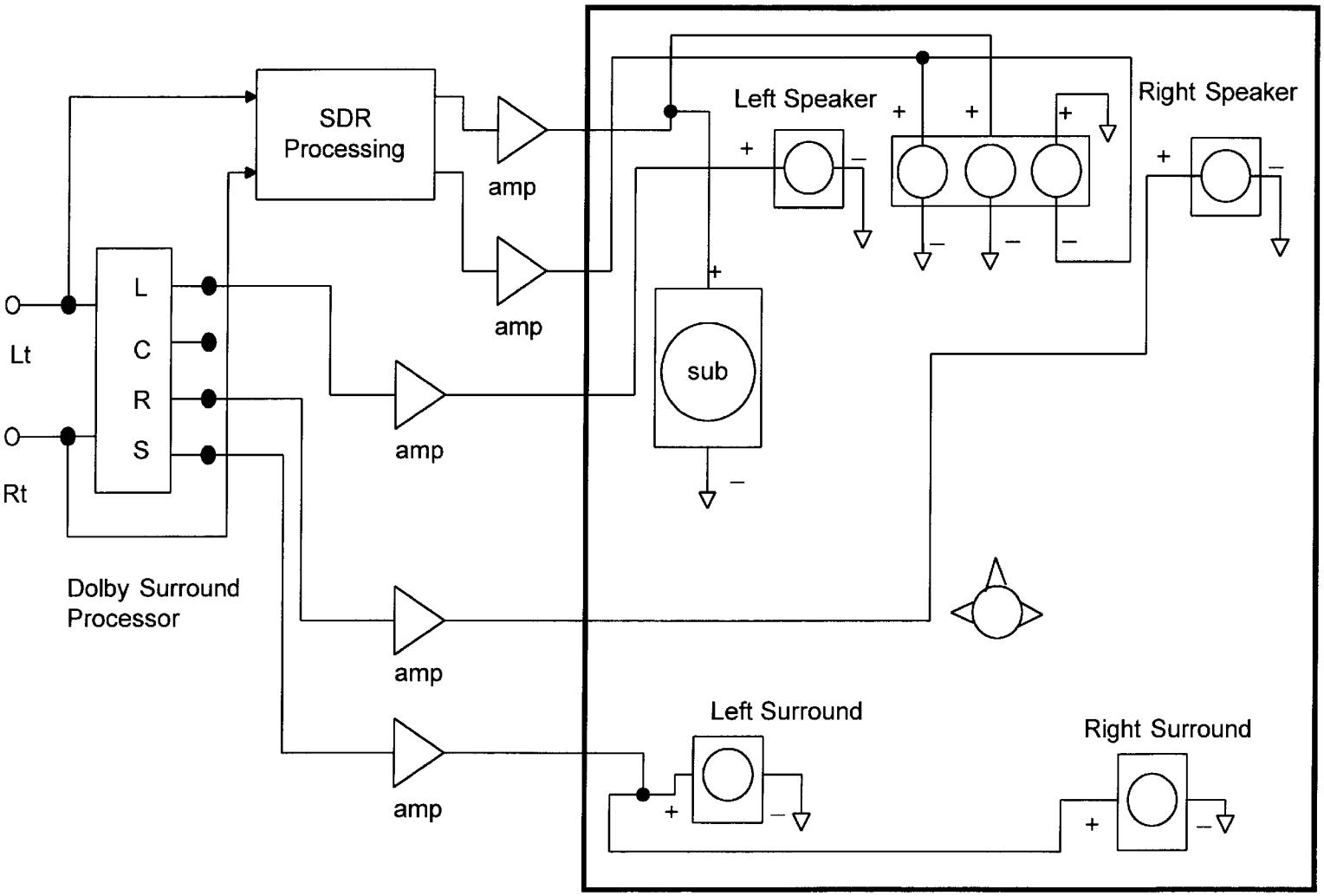

FIG. 18*c* shows the use of an MD-Grad based SDR array as an enhanced center channel speaker system used with a Dolby Surround home theater system. In this application, the SDR processing is fed directly from the left and right inputs that also feed the Dolby processing. The left and right front speakers and surround speakers are used as is common in home theater set ups. The sub woofer is shown driven by the sum signal generated within the SDR processing.

Figure 18D:
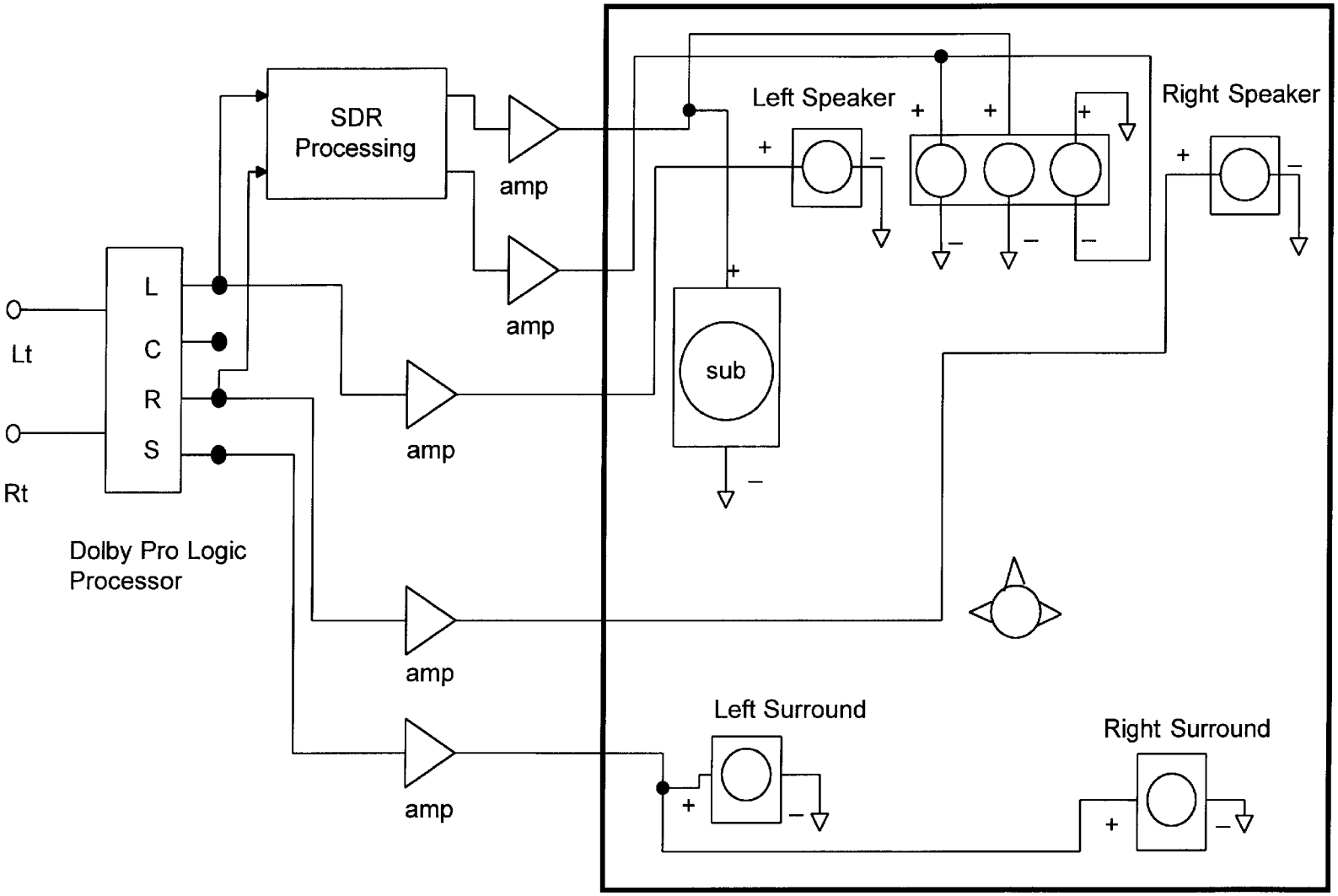

FIG. 18*d* shows the use of an MD-Grad based SDR array as an enhanced center channel speaker system used with a Dolby Pro Logic home theater system operated in phantom center channel mode. In this application, the SDR processing is fed from the left and right outputs of the Dolby processing. The left and right front speakers and surround speakers are used as is common in home theater set ups. The sub woofer is shown driven by the sum signal generated within the SDR processing.

Figure 18E:
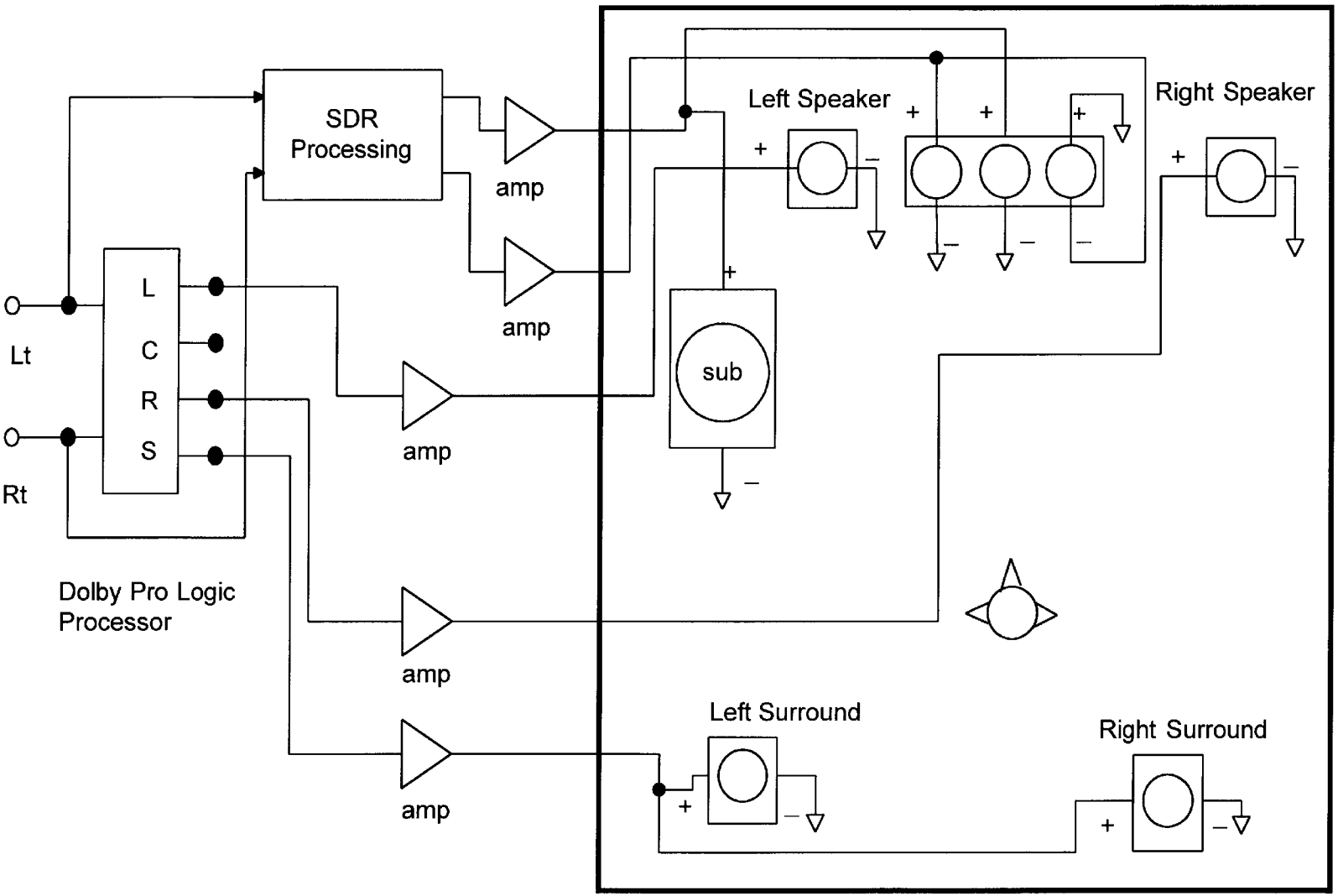

FIG. 18*e* shows the use of an MD-Grad based SDR array as an enhanced center channel speaker system used with a Dolby Pro Logic home theater system operated in normal center channel mode. In this application, the SDR processing is fed from the left and right inputs that also feed the Dolby processing. The left and right front speakers and surround speakers are used as is common in home theater set ups. The sub woofer is shown driven by the sum signal generated within the SDR processing.

Figure 18F:
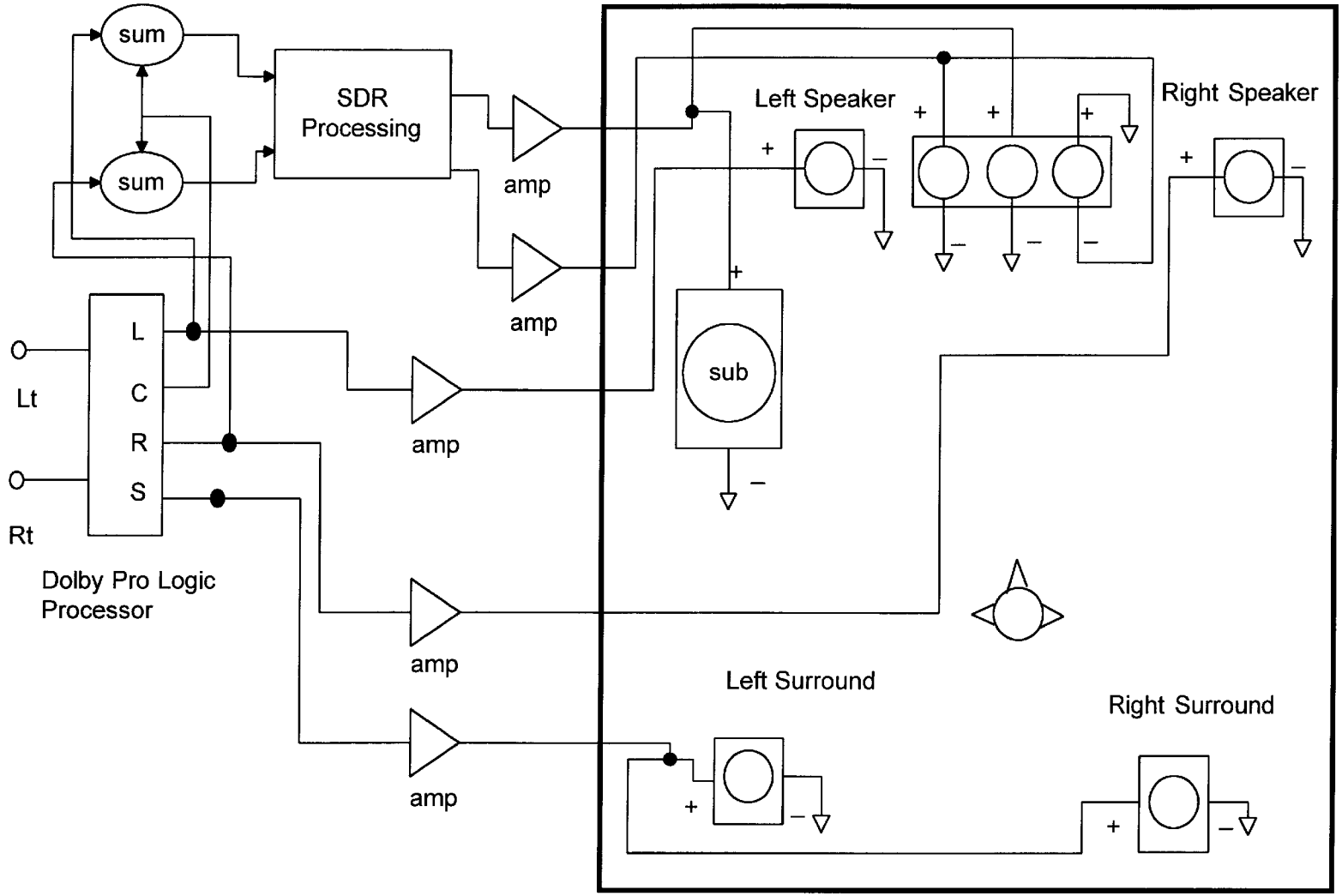

FIG. 18*f* shows the use of an MD-Grad based SDR array as an enhanced center channel speaker system used with a Dolby Pro Logic home theater system operated in normal center channel mode. In this application, the left, center, and right outputs of the Dolby processing are re-combined into two channels, which are then fed to the SDR processing. The left and right front speakers and surround speakers are used as is common in home theater set ups. The sub woofer is shown driven by the sum signal generated within the SDR processing.

FIG. 19 shows the a block diagram of the signal processing that is typically performed on material that is encoded for use with Dolby surround/Dolby Pro Logic systems.

Figure 20A:
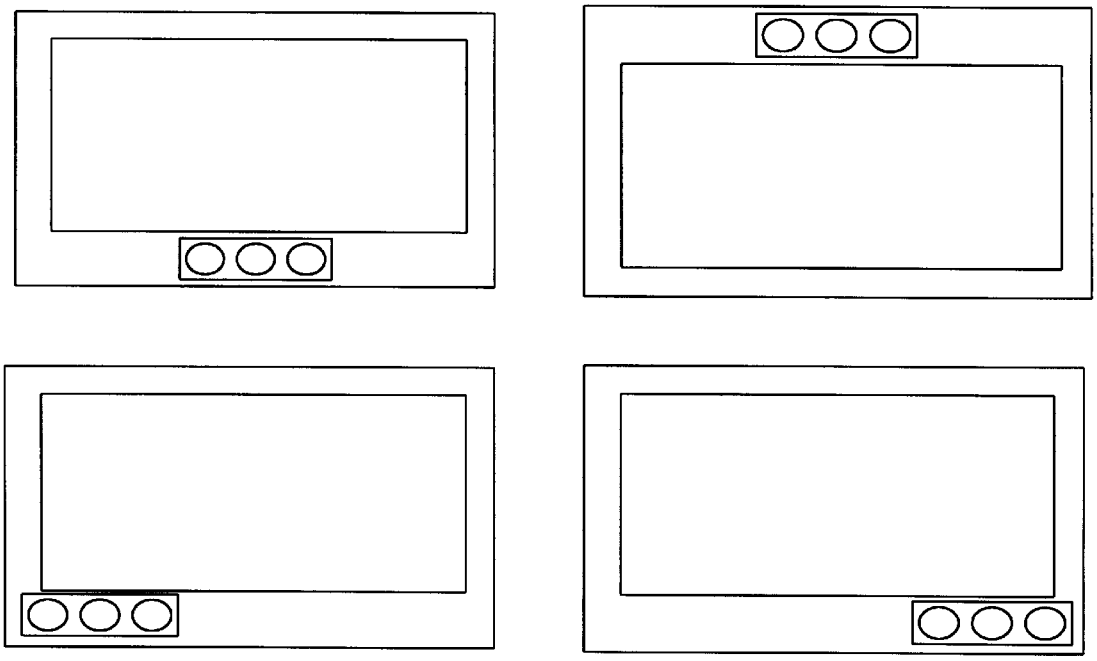

FIG. 20*a* shows various possible locations within a television cabinet for an SDR array.

Figure 20B:
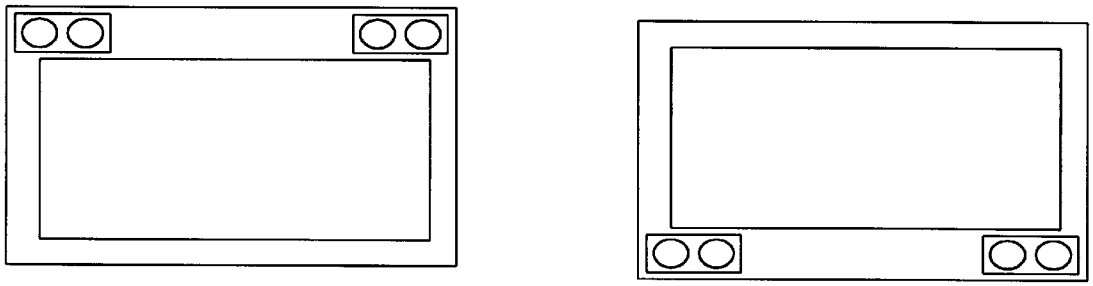

FIG. 20*b* shows various possible locations within a television cabinet for a pair of SDR arrays.

Figure 20C:
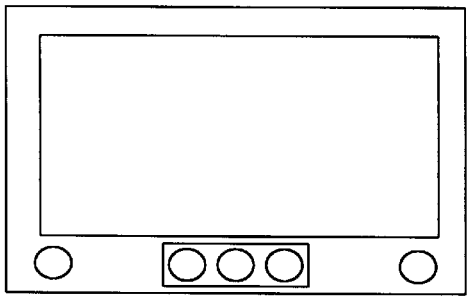

FIG. 20*c* shows a configuration for a television set that uses a centrally placed SDR array along with high frequency devices that are located in the traditionally available corner locations.

Figure 21B:
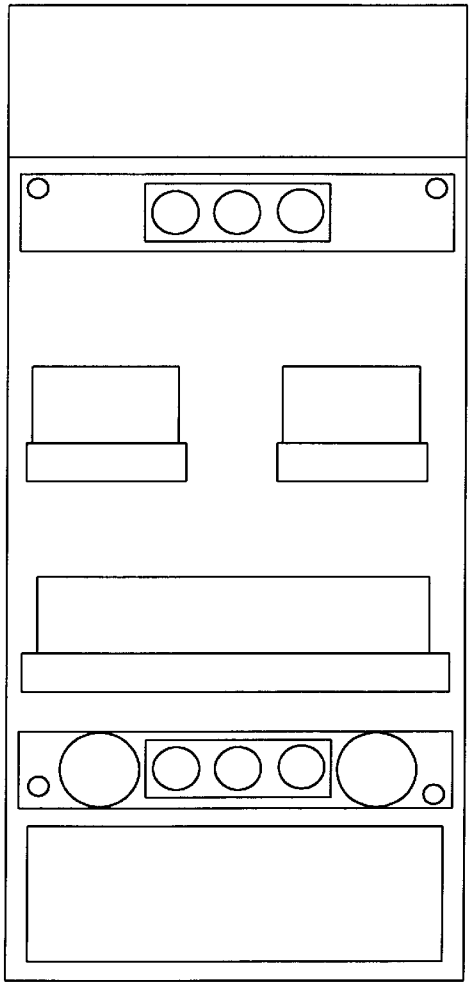
Figure 21A:
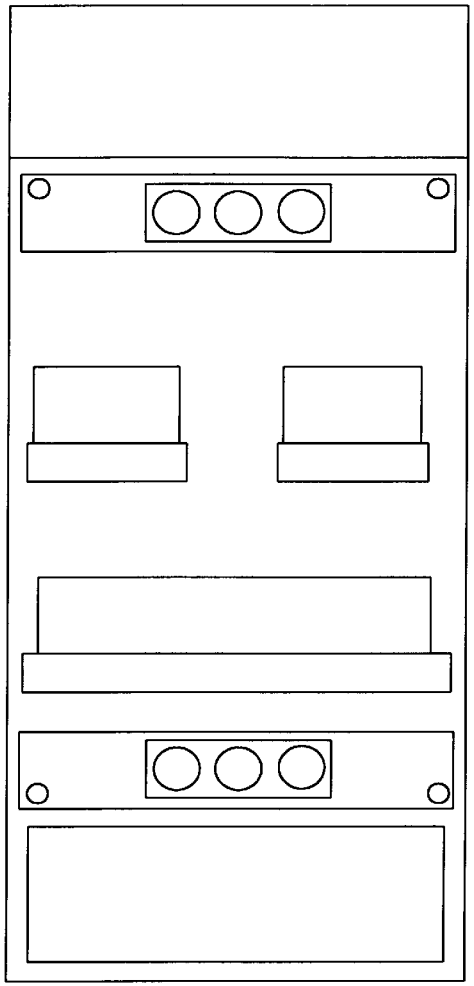

FIG. 21*a* shows an automotive application where two SDR arrays are shown. One array is located on the centerline of the vehicle in the front dashboard, the other SDR array is located on the centerline in the rear package shelf. In addition, left and right high frequency devices are shown in the comers of the front dash and rear package shelf FIG. 21*b* shows an automotive application of SDR arrays similar to that shown in FIG. 21 a, where additional low frequency sources have been added to the rear package shelf.

Figure 21D:
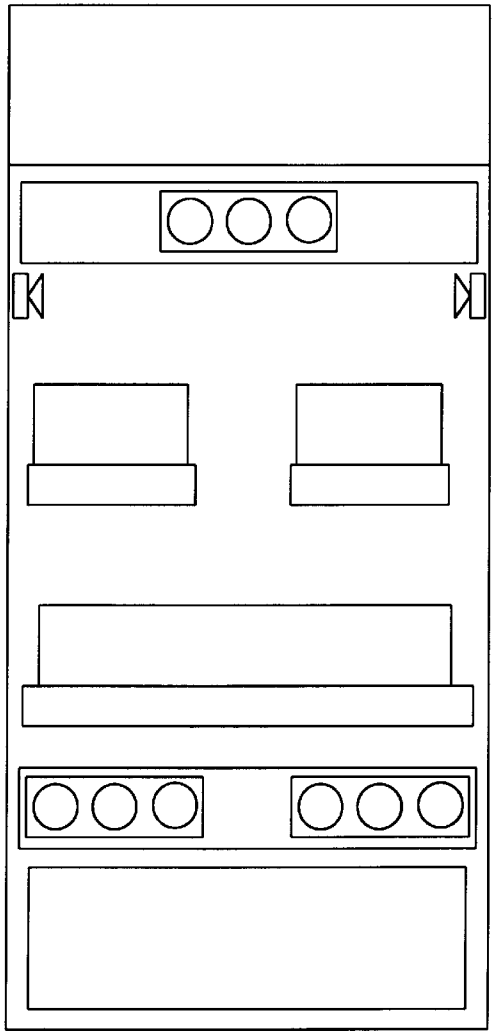
Figure 21C:
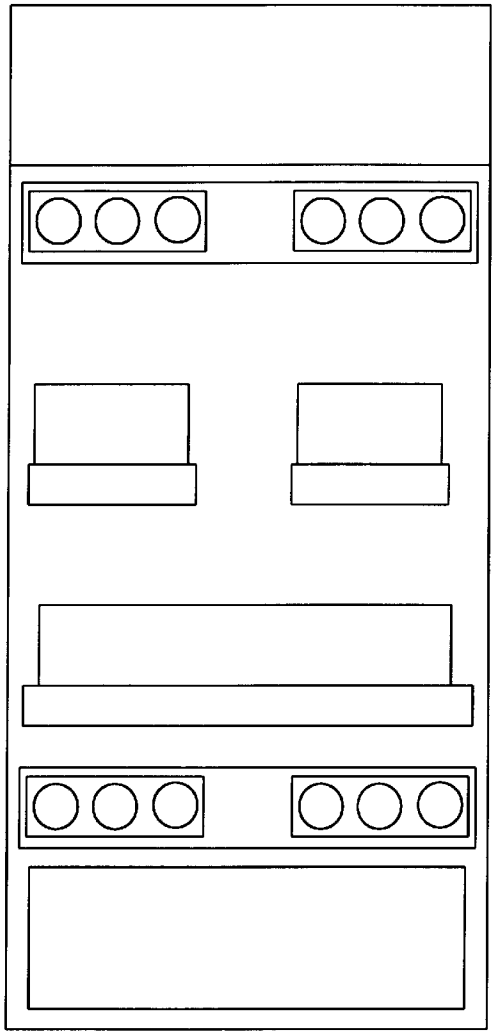

FIG. 21*c* shows an automotive application of SDR arrays where each passenger is provided with their own SDR array. Each array provides stereo for each occupant.

FIG. 21*d* shows an automotive application of an SDR array where it is used as a centerfill device located on the centerline of the vehicle in the front dash. Rear package shelf SDR arrays are also shown.

Figure 21E:
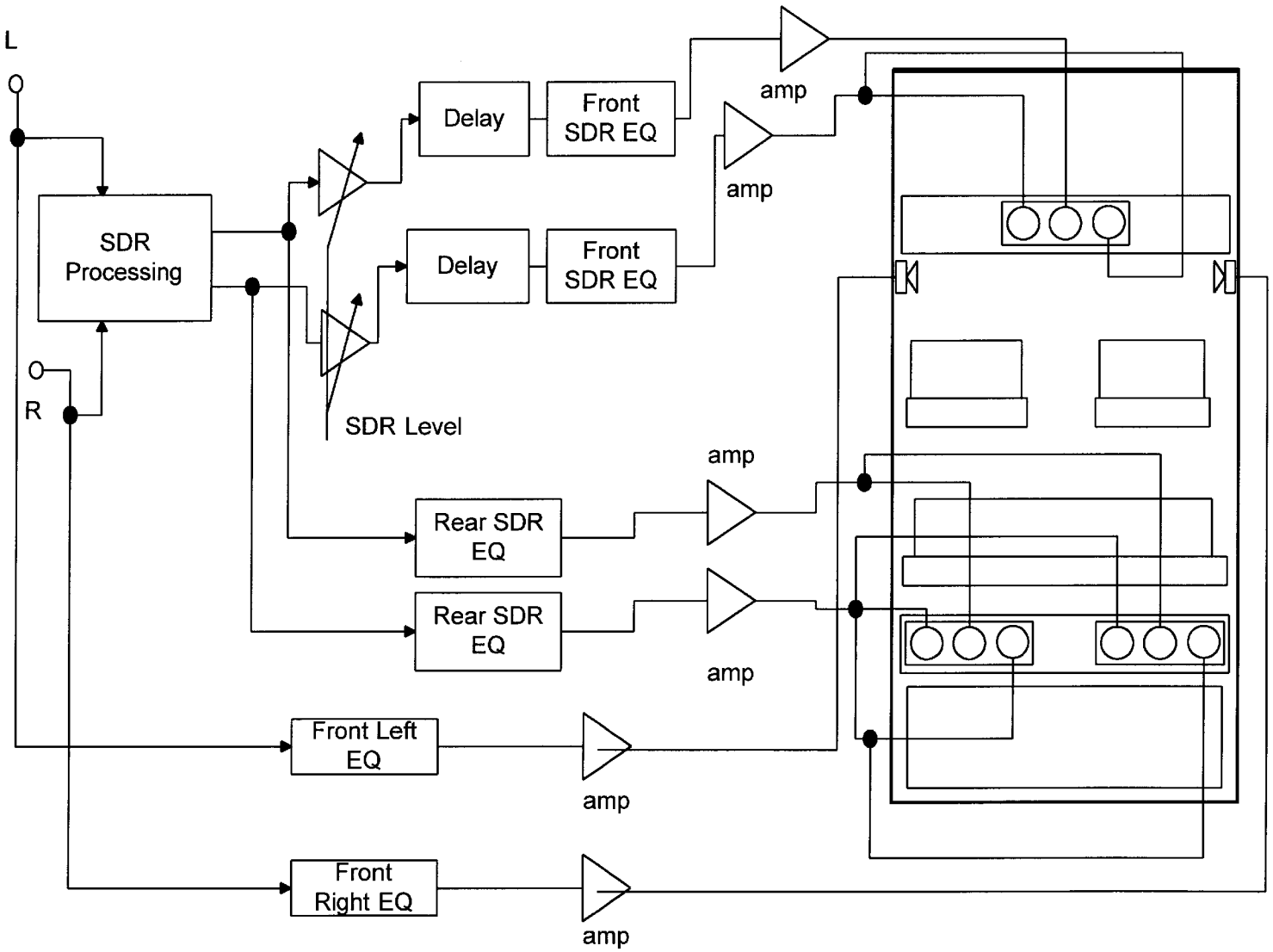

FIG. 21*e* an automotive application of an SDR array, where the SDR array in the front of the vehicle is used as a centerfill, and the SDR arrays in the rear package shelf provide stereo for each rear seat occupant.

Two input signals are presented to the signal processing. The input signals are split into two signal paths. The first path feeds into the SDR processing. The output of this processing is then split into two paths, one that feeds the front centerfill SDR array, the other that feeds the rear SDR arrays. The output of the SDR processing that feeds the front SDR array next passes through a level control, delay circuits, equalization and amplification before being fed to the front SDR array transducer elements. The level control allows the adjustment of the relative level of the SDR array output with respect to the rest of the system. The delay allows the signals fed to the front SDR array to be delayed with respect to other loudspeaker signals. This provides another degree of freedom in adjustment of the system spatial performance. The front EQ is designed to compensate for frequency response anomalies in the individual transducer elements and/or the automotive environment.

The output of the SDR processing is also fed to rear equalization that compensates for frequency response anomalies in the individual transducer elements and/or the automotive environment. The output of the equalization is amplifier and applied to the rear SDR array elements.

The input signals also feed through a second path. This path also includes equalization for transducer or automotive environment anomalies, and amplification. The output of these amplifiers then feed left and right front traditional loudspeakers.

Figure 22:
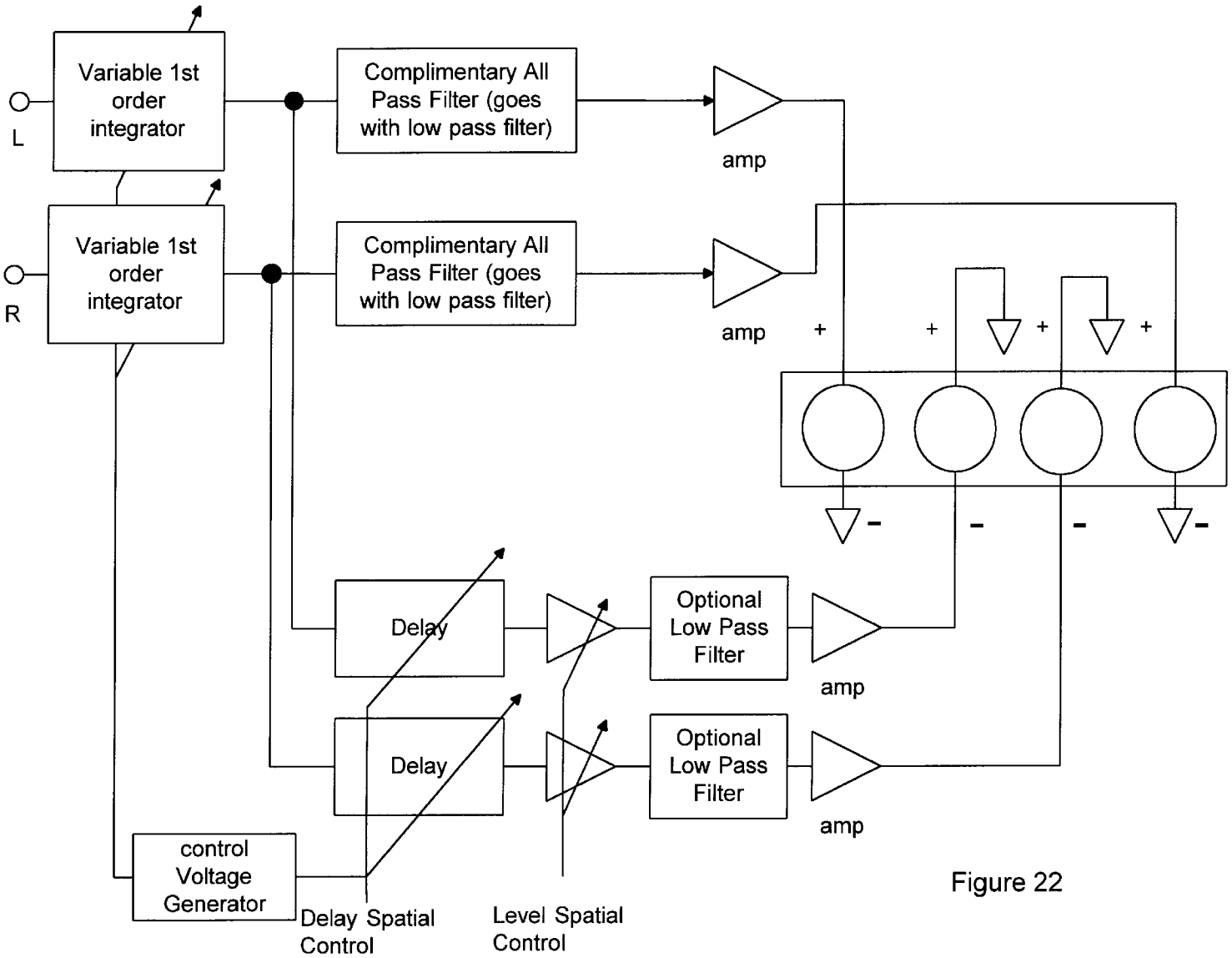

FIG. 22 shows a four element two channel D-Grad gradient loudspeaker array. This figure shows a completely separate D-Grad gradient loudspeaker used for each input signal. The signal processing used is the same as shown in FIG. 13*a*, except that the summers of FIG. 13*a* have been removed and four power amplifier channels are used to drive the four array elements.

Figure 24A:
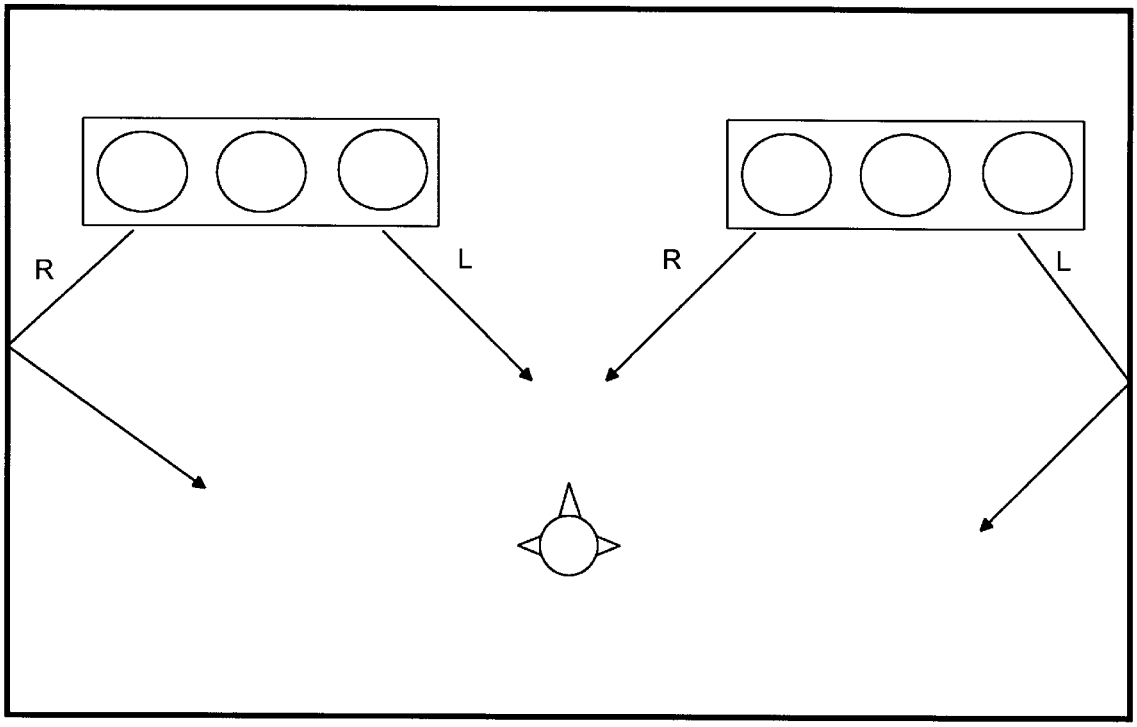

FIG. 24*a* shows a configuration that uses a pair of SDR arrays arranged in a traditional stereo speaker geometry where there is a left array and a right array. The arrays have the same orientation and are fed identical signals.

Figure 24B:
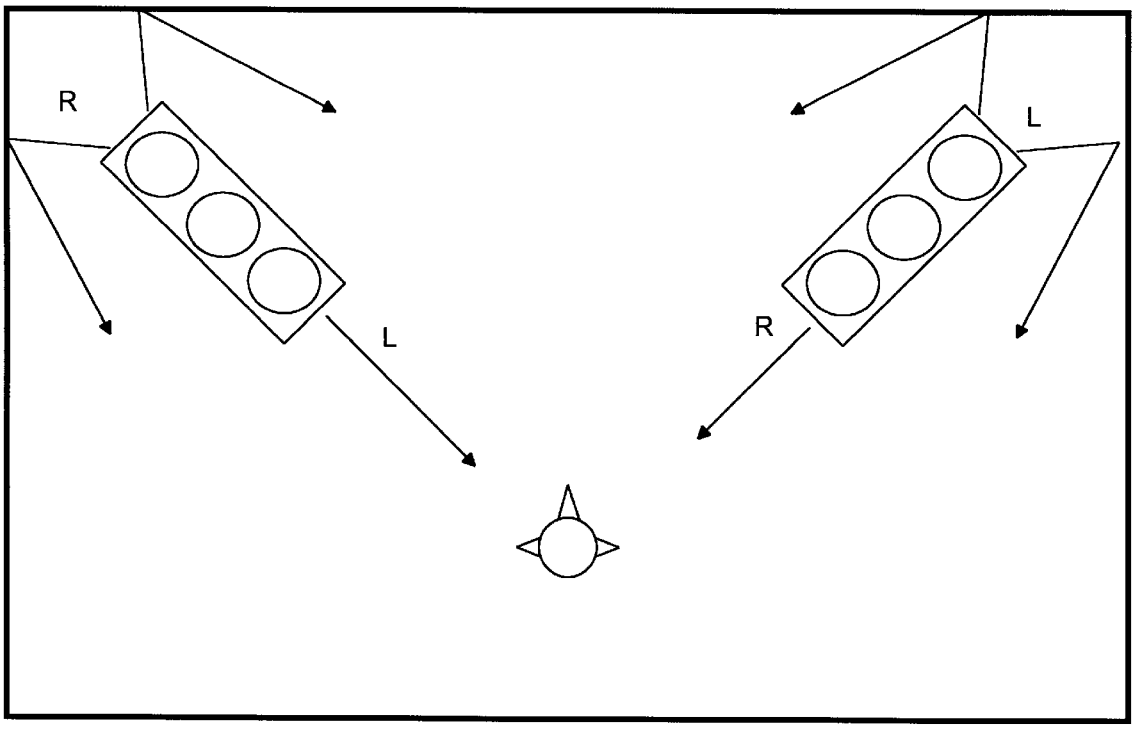

FIG. 24*b* shows another configuration that uses a pair of SDR arrays arranged in a traditional stereo speaker geometry. In this case, the arrays are rotated from their orientation in FIG. 24*a*. The arrays are still fed identical signals.

Figure 26:
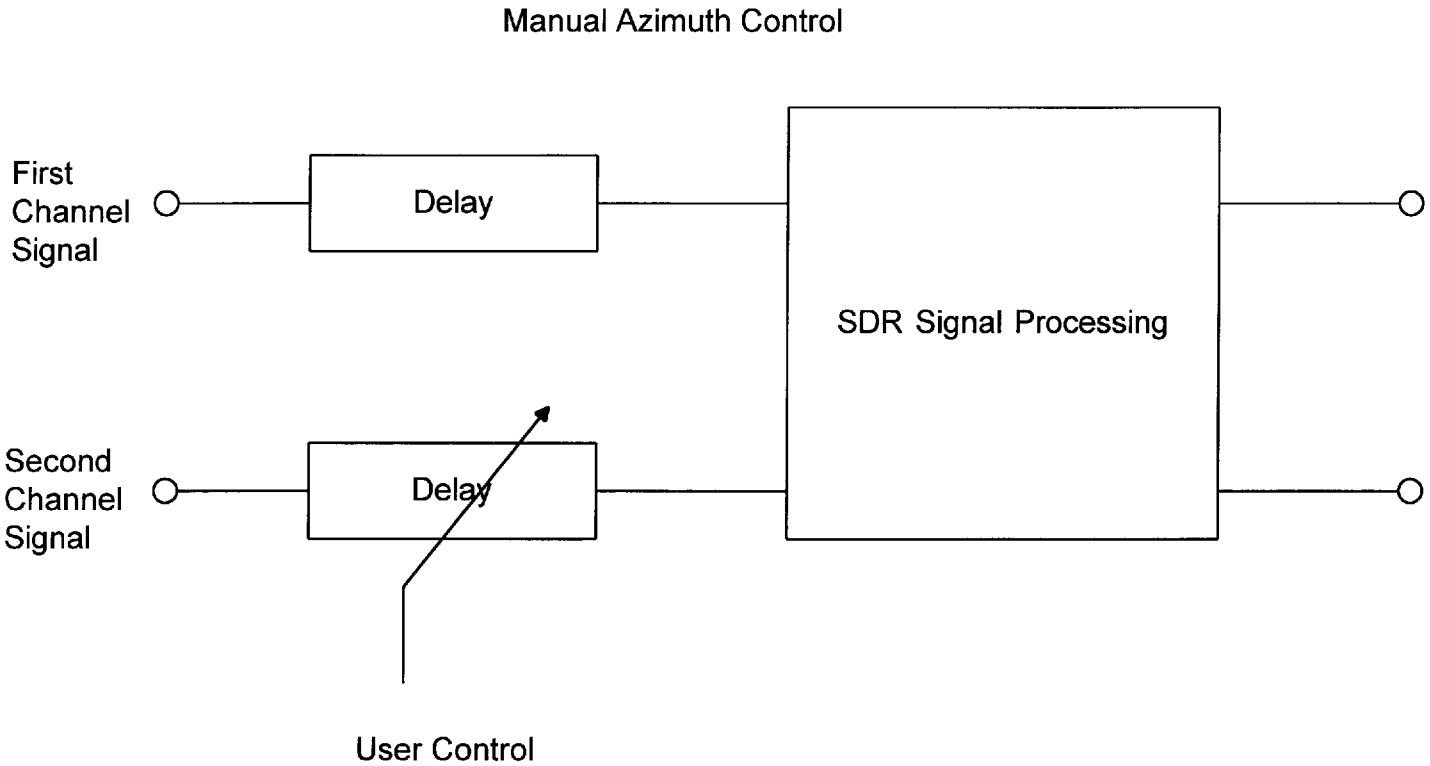

FIG. 26 shows a block diagram of how a manual user control for azimuth offset compensation can be implemented.

Figure 27A:
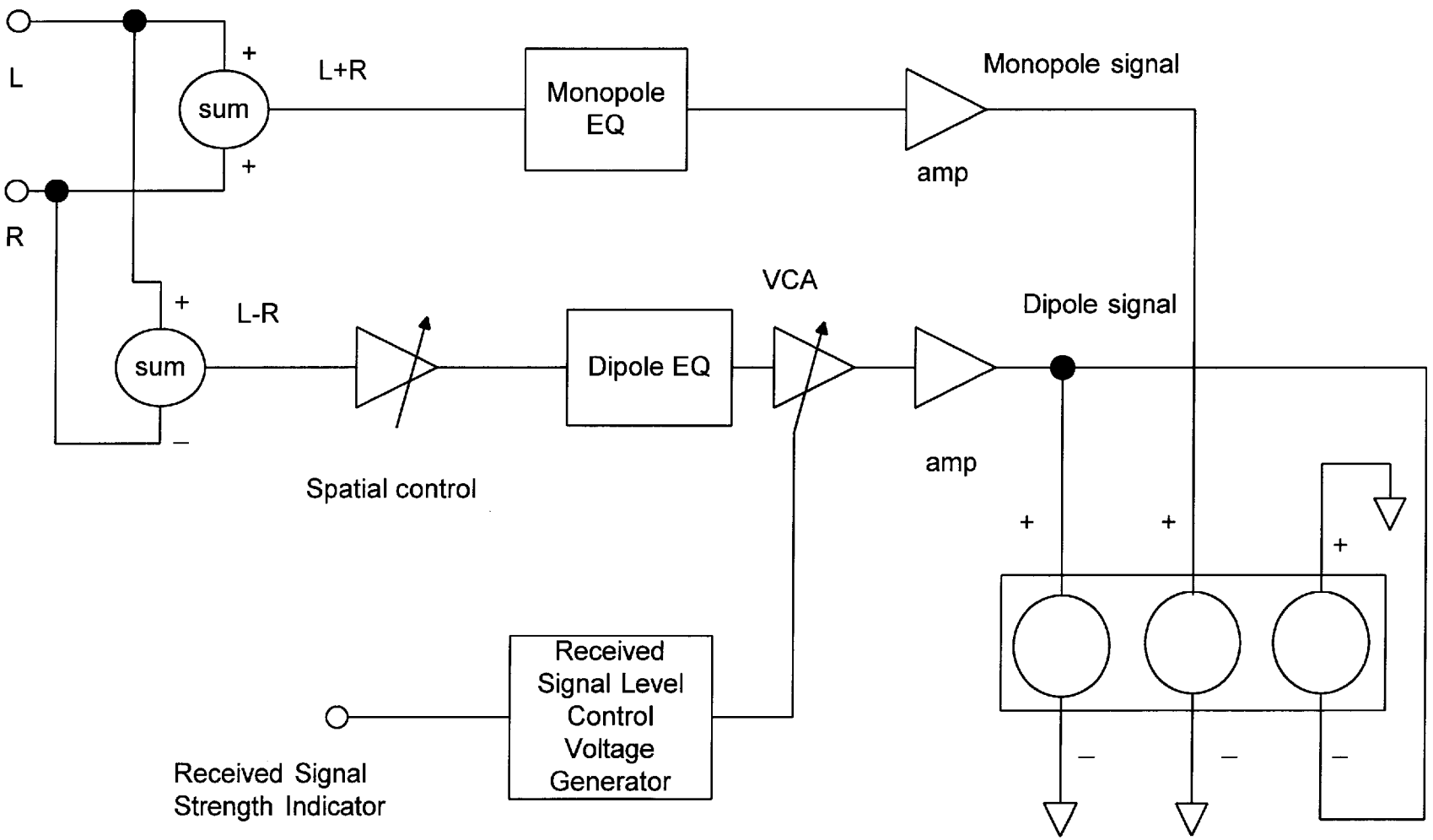

FIG. 27*a* shows a three element two channel MD-Grad gradient loudspeaker SDR array. It has the same signal processing and loudspeaker configuration as shown in FIG. 15*a* with one addition. Mono blend circuitry has been added. This function places a voltage controlled amplifier (VCA) in the dipole signal path. A control voltage generator is also included. The control voltage generator generates a control signal that controls the gain of the voltage controlled amplifier. The control voltage generator is designed to vary the control voltage as a function of the received signal strength (for the case where the input signals used by the system are received from some broadcast medium). The general operation will be to reduce the gain of VCA under low received signal strength conditions.

Figure 27B:
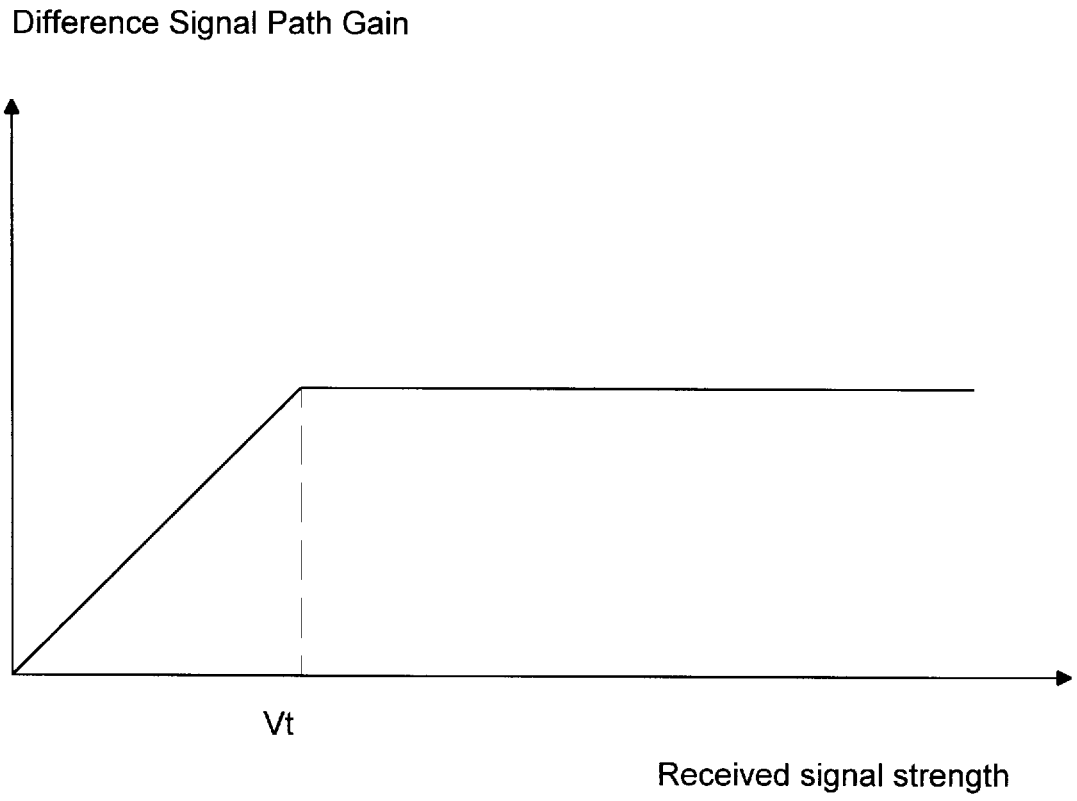

FIG. 27*b* shows one possible relationship between received signal strength and difference signal level to be used in an SDR system for implementing a monophonic blend function that lowers perceived noise under low signal strength conditions.

Figure 28:
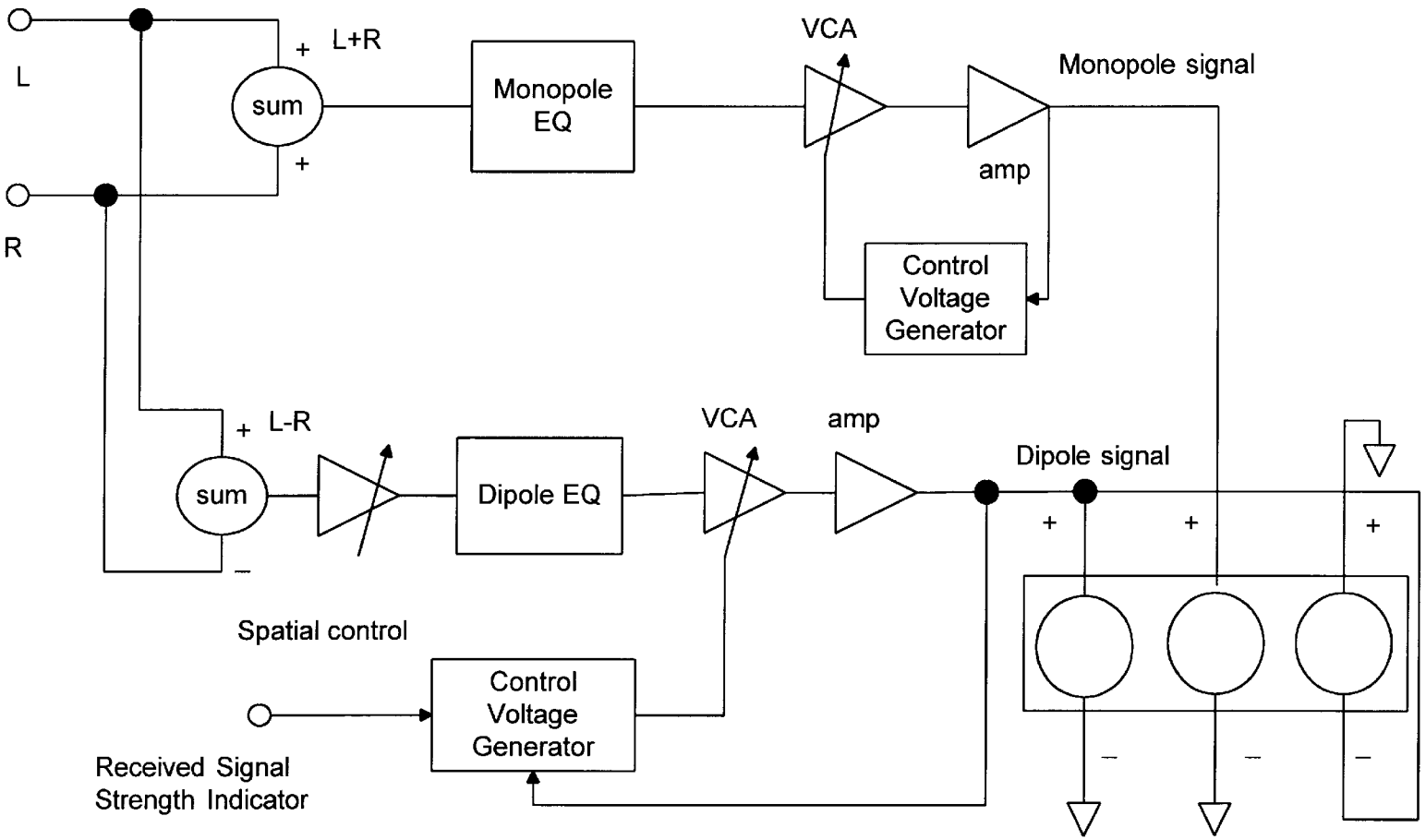

FIG. 28 shows an MD-Grad based SDR array with the addition of dynamic signal processing circuitry. The basic SDR signal processing is the same as shown in FIG. 15*a*, with the addition of the dynamic signal processing functionality. Voltage controlled amplifiers have been added to the monopole and dipole signal paths. Control voltage generators have also been added in each signal path that drive each VCA. The primary function of the control voltage generator is to monitor the signal level at a point in the circuit (shown as being after the power amplifier), and reduce the gain of the voltage controlled amplifier when the monitored signal exceeds a set threshold.

A second control input to the control voltage generator that drives the VCA located in the dipole signal path is also shown. This input can be used to drive the dipole signal path VCA in a way to provide the mono blend noise reduction function shown in FIG. 27*a*.

Figure 29:
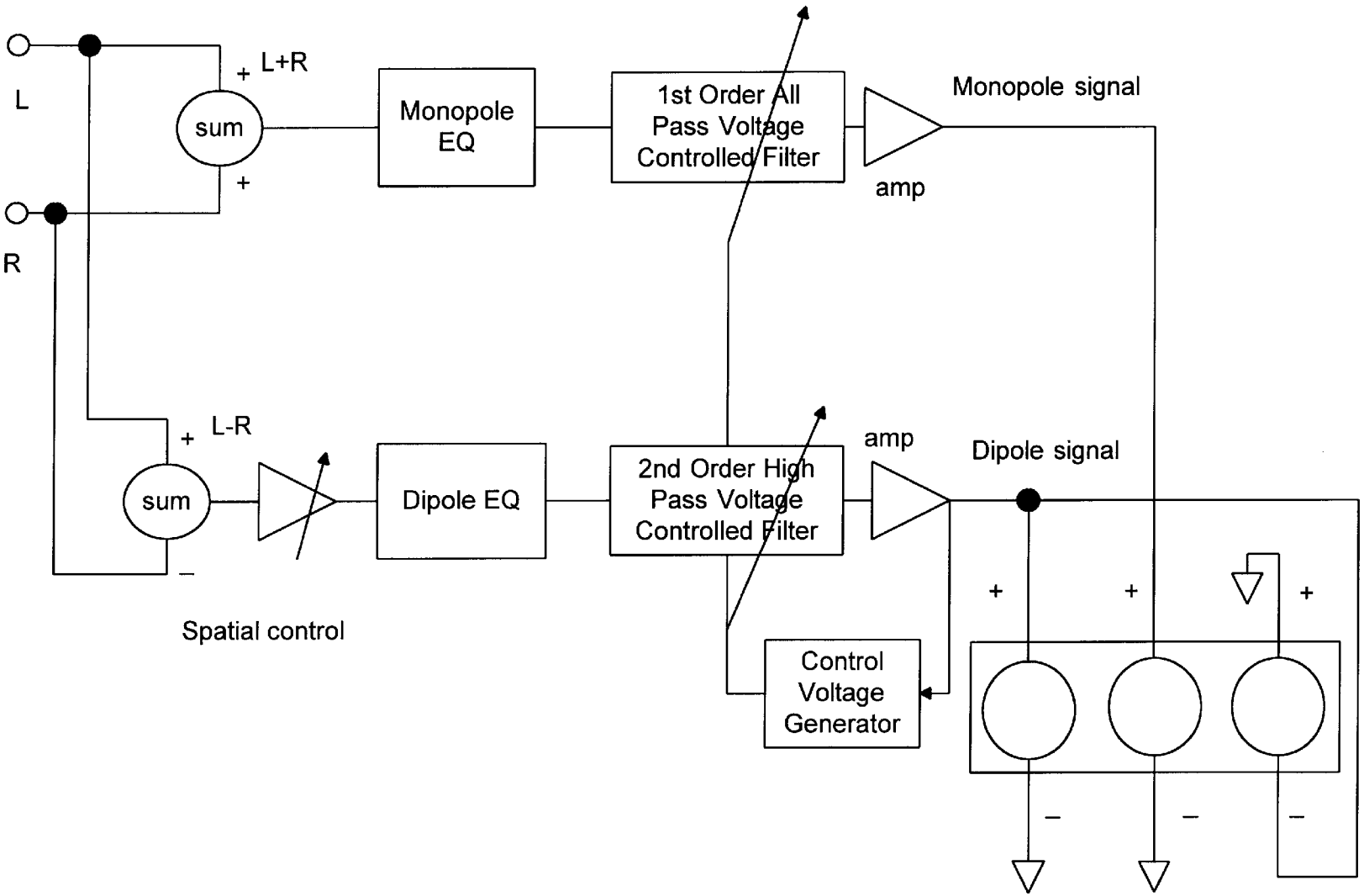

FIG. 29 shows an MD-Grad based SDR array with the addition of dynamic filter distortion reduction circuitry. The basic SDR signal processing is the same as shown in FIG. 15*a*, with the addition of the voltage controlled filters (VCF's). Voltage controlled filters have been added to the monopole and dipole signal paths. A control voltage generator has been added that senses the signal level in the dipole signal path and generates a control voltage that drives each VCF. The primary function of the control voltage generator is to monitor the signal level at a point in the circuit (shown as being after the power amplifier), and provide a signal that raises the cutoff frequency of the low pass filter in the dipole signal path and the all pass filter in the monopole signal path when the monitored signal exceeds a set threshold. Raising the cut off frequency of the low pass filter reduces the low frequency signal boost and allows the system to play louder before clipping occurs.

The filter topologies are chosen so that they have the same phase response shape. The control voltage generating circuitry is responsible for making sure the corner frequencies of the low pass filter and all pass filter track each other closely.

DETAILED DESCRIPTION OF THE PREFERRED EMBODIMENTS

Figure 8A:
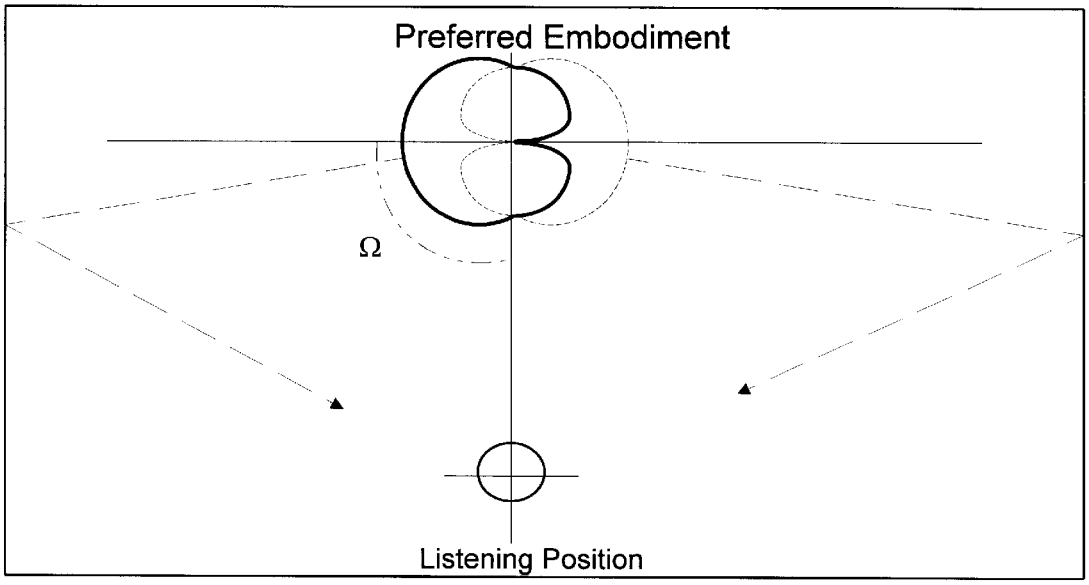
FIG. 8*a* shows the preferred embodiment geometry for a two channel SDR system. A radiation pattern is shown for each of the two audio channels that make up the system. The radiation patterns shown are first order gradient, the origins of the radiation patterns are coincident in space, and the main radiation directions are 180 degrees opposed to each other.

The novel aspects of this invention consist of a loudspeaker array and associated signal processing capable of generating directional radiation patterns for multiple channel signals simultaneously, and the method in which these patterns are oriented and combined. The primary use of the invention is with a stereo pair of audio signals, although it can be made to function with multi-channel systems as well. The invention is capable of generating a spacious sound field while maintaining left/right imaging ability along with a solid center image. The invention is capable of generating perceived sound source locations that are located far outside the array physical position. The perceived sound source locations are stable and do not degenerate as a listener turns his head or moves about the listening room. The invention radiates individual channel signals in an orientation where at least one or both of the main radiation directions are pointed away from the main listening position. Various possible orientations are shown in FIGS. 8*a, b, c,* and *d*. The reflected/direct sound ratio in the listening area is manipulated by controlling the specific orientation of the radiation patterns of each channel signal with respect to the listening area. The invention achieves its localization performance through the control of the reflected/direct energy ratio. A loudspeaker array that is capable of generating the desired reflected/direct sound ratios will be referred to as an SDR (signal dependent radiation) array.

The preferred embodiments of the invention use first order gradient loudspeaker technology as the preferred method of generating a controlled directivity pattern at low frequencies. However, the invention is not limited to the use of first order gradient loudspeakers to generate directional loudspeakers. The invention can also use higher order gradient loudspeakers and/or wave type directivity control devices to construct the directional loudspeakers used by the invention. The arrays of the present invention are designed to generate radiation patterns that reduce the level of the direct sound with respect to the level of reflected energy heard by a listener, for sounds that are supposed to be localized away from the array physical position. The complete arrays to be described can use any of the methods described earlier for extending the frequency range of operation.

In its primary application, a first channel signal representing a left channel signal of a stereo pair of signals is radiated to the left of the array for a listener facing the array. This signal reflects off walls on the left side of the room so that reflected sound will reach the listener coming predominately from the left. A second channel signal that represents the right channel signal of a stereo pair of signals is radiated to the right of the array to reflect off walls on the right side of the listening area, so that this signal will reach the listening area coming predominately from the right. There are other applications where this radiation behavior will be reversed. There are still other applications where the main radiation direction of one channel will be directed at the primary listening position while the second channel main radiation direction is pointed away from the main listening position. These will be described later.

Each signal of a stereo pair of signals is radiated with a directional radiation pattern at low frequencies. (The directional radiation pattern is a first order gradient radiation pattern for the preferred embodiments at low frequencies.) The use of separate directional loudspeakers for each signal allows the origins of the radiation patterns for each signal to be placed anywhere throughout the listening space, with any relative angle between their main radiating directions. This is the most flexible case. It is also the most complex and costly (in the case where gradient loudspeakers are used) as it requires separate loudspeaker elements, signal processing, and amplification for each channel of information.

Simplification and reduction of the hardware required is realized when the origins of the radiation patterns of gradient loudspeakers are coincident in space. A further simplification and reduction of hardware can be realized if the main radiation directions for each gradient loudspeaker are constrained to be opposed by 180°. This leads to embodiments with the minimum hardware requirements, and is the form of the preferred embodiments.

The rest of the discussion of the invention will assume that the origins of the first and second channel radiation patterns are coincident in space, unless otherwise noted. However, it should be noted that the invention of this disclosure is not limited in the separation distance of the origins of the first and second channel radiation patterns.

The preferred embodiments place the origins of the radiation patterns for the first and second channel signals coincident in space with their main radiating directions oriented to be 180° opposed to each other. In the primary application of SDR arrays, the main listening position is perpendicular ($\Omega$=90° in FIG. 8*a*) to the main radiation directions. This configuration allows the use of the minimum number of array elements and amplification channels. Only two power amplifier channels are needed. The preferred embodiment configurations described are capable of radiating the first and second channel signals simultaneously from the same loudspeaker elements.

Figure 8B:
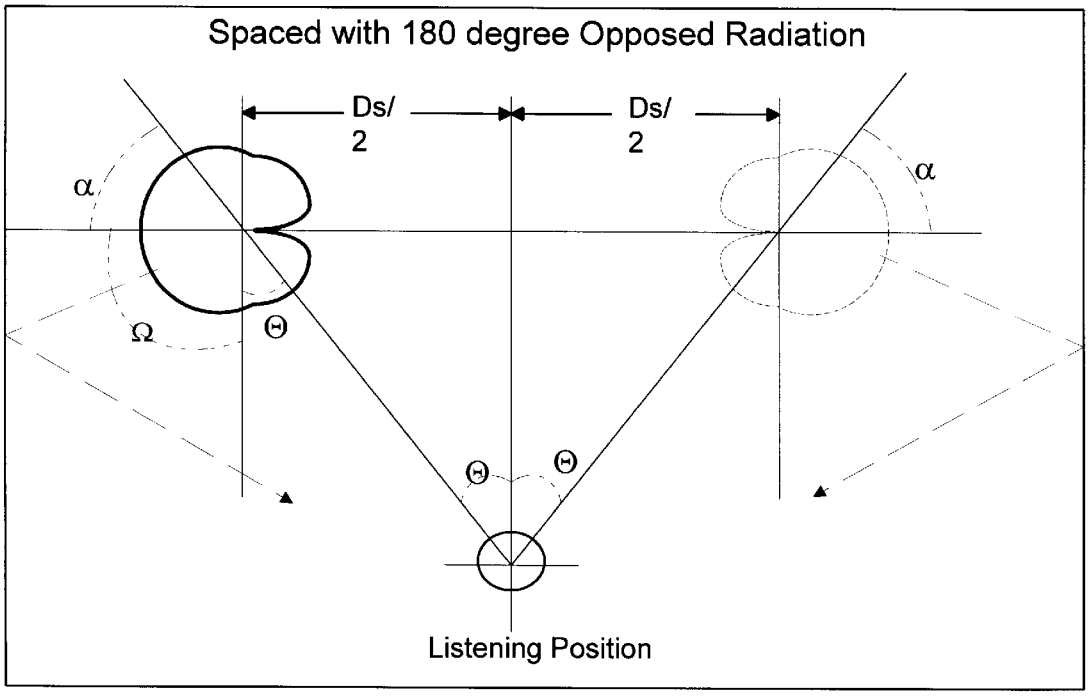
FIG. 8*b* shows an alternative embodiment geometry for a two channel SDR system. A radiation pattern is shown for each of the two audio channels that make up the system. The radiation patterns shown are first order gradient, the origins of the radiation patterns are displaced in space, and the main radiation directions are 180 degrees opposed to each other.
Figure 8C:
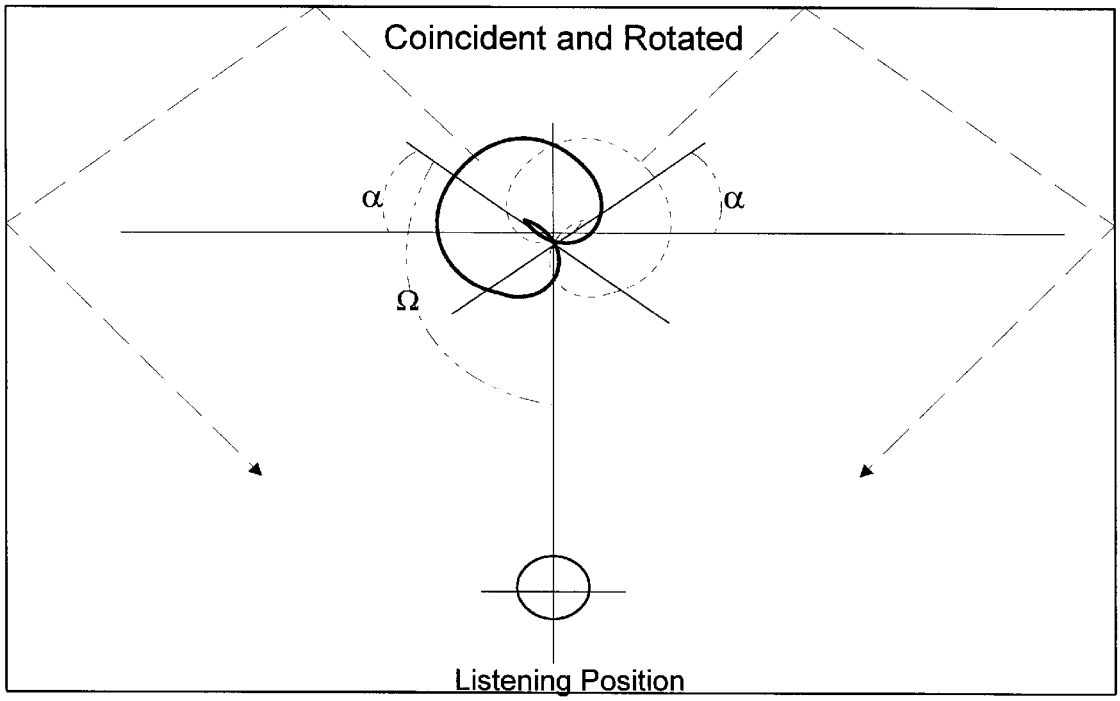
FIG. 8*c* shows an alternative embodiment geometry for a two channel SDR system. A radiation pattern is shown for each of the two audio channels that make up the system. The radiation patterns shown are first order gradient, the origins of the radiation patterns are coincident in space, and the main radiation directions are rotated at an arbitrary angle with respect to each other.
Figure 8D:
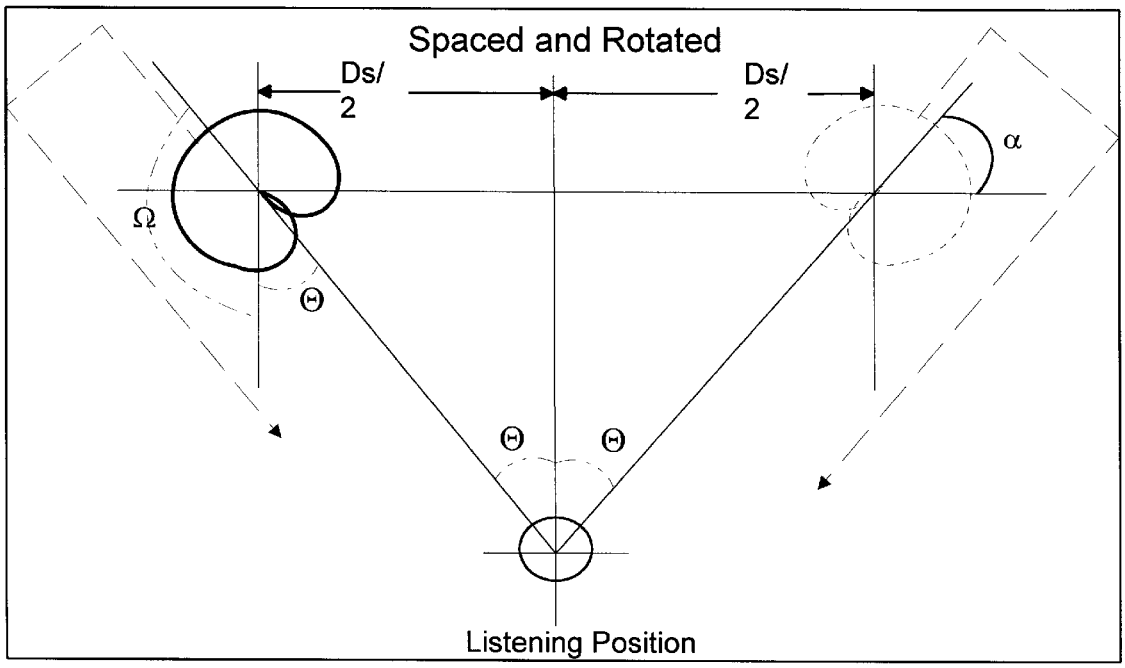
FIG. 8*d* shows an alternative embodiment geometry for a two channel SDR system. A radiation pattern is shown for each of the two audio channels that make up the system. The radiation patterns shown are first order gradient, the origins of the radiation patterns are displaced in space, and the main radiation directions are rotated at an arbitrary angle with respect to each other.

Other embodiments are possible where the origins of the first and second channel radiation patterns are coincident in space but the main radiating directions are oriented with $\Omega \neq 90°$. These embodiments are shown in FIGS. 8*c* and 8*d*.

Rotation of the main radiation directions can be useful when the difference between the direct sound and reflected sound generated by the array needs to be increased over what is possible using the preferred embodiments. Allowing relative angles other than 180° increases the range of off axis listening positions that maintain good left/right localization behavior.

Rotation of the main radiation directions can be accomplished in a number of ways. The invention is not limited in the way in which the main radiation axes of the directional loudspeakers are rotated with respect to each other. The easiest method uses physically separate directional loudspeakers for each signal channel, and they are physically rotated with respect to each other. This method is applicable to all possible forms of directional loudspeakers. Physical rotation of wave type directional loudspeakers is easily accomplished. Physical rotation of gradient type directional loudspeakers uses a maximum number of elements and signal processing channels. This is not an optimum method when gradient loudspeakers are used, however, it is construed to be incorporated in this disclosure.

A second method for rotating the main radiation directions of gradient loudspeakers becomes obvious when one looks at the mathematical relationships that describe the case where first order gradient radiation patterns are coincident in space and have arbitrary angles between their main radiation directions. These relationships are derived below. The analysis shows that the combined behavior of two coincident gradient radiation patterns with an arbitrary angle between the main radiating axes is equivalent to a combination of a dipole and a first order gradient pattern, where the main axes of the first order gradient and dipole patterns are 90° opposed to each other. Rotation of the main radiation directions of the first and second channel radiation patterns is equivalent to simultaneously changing the directivity pattern of the first order gradient radiation pattern and the level of the (perpendicularly oriented) dipole it is combined with.

If we assume for this discussion that the first order gradient loudspeaker uses an MD-Grad embodiment, then rotation of the individual channel radiation patterns can be accomplished by simultaneously changing the level of the dipole that makes up part of the MD-Grad first order gradient loudspeaker, and the level of the (perpendicular) dipole with which it is combined to form the individual channel radiation patterns. The levels should change in opposite directions with a sin/cos relationship (sin/cos pan pots are common in audio signal processing devices) if it is desired to rotate the radiation patterns without changing the individual radiation pattern shapes. Although they will not be explicitly described here, rotation controls can be developed that allow the user to rotate the main radiation axes of the first and second channel signals for embodiments that use any of the other methods for generating a gradient loudspeaker described earlier.

The rotation control described above allows the main radiation axes of the individual channel radiation patterns to be varied anywhere from ±90° to 0° (or 180°). Each individual channel pattern is only rotated by a maximum of 90°. In order to be able to rotate the patterns a full 180° each, the main radiation direction of the first order gradient loudspeaker must be able to be either 0° or 180°. This can be done with an MD-Grad embodiment if the polarity of the signal applied to the dipole (that is part of the first order gradient MD-grad speaker) can be inverted. A user controllable switch can be added to the system that reverses the polarity of the signal applied to this dipole to allow complete freedom in the rotation of the individual channel radiation patterns. A polarity inverting switch is not shown in the accompanying figures. It is assumed that this could be created by someone skilled in the art.

An array configuration for use in a system where rotation of individual channel signal radiation patterns is possible is shown in FIG. 10*a*, and block diagrams showing forms of signal processing capable of achieving this rotation are shown in FIG. 10*b* and FIG. 10*c*. FIG. 10*b* shows separate equalization and amplification for the perpendicularly oriented dipole source. This may be needed if the perpendicular dipole characteristics differ from the characteristics of the dipole used in the MD-Grad gradient loudspeaker. FIG. 10*b* shows level controls in the dipole signal path of the MD-Grad gradient loudspeaker and the perpendicular dipole speaker. The level controls are not shown tied together. In FIG. 11*b,* the user can control the rotation and shape of the radiation pattern using only two level controls, although there is interaction between rotation and pattern in this implementation. These two controls, along with a polarity control not shown, allow the user complete freedom to adjust the shape and orientation of the individual channel radiation patterns. If a rotation control using a sin/cos pan pot between the level of the two dipole signals were used, it would function as a rotation control, but an additional control would need to be added to control the radiation pattern of the individual channel signals.

It is also possible to construct an implementation that does not require an additional channel of amplification for the perpendicular dipole source. This is shown in FIG. 10*c*. Separate level controls are placed on the output of the dipole amplifier, so that the relative level of the signal applied to each dipole can be varied arbitrarily. The level control located ahead of the dipole EQ allows the overall level of signal applied to the two dipoles to be adjusted relative to the monopole signal. This combination of level controls allows the radiation patterns to be adjusted over the full range of possible first order gradient patterns, and allows the main radiation axes of the two signals radiated with first order gradient patterns to be rotated with any arbitrary angle between them.

FIGS. 10*a*, 10*b*, and 10*c* show the use of an MD-Grad type first order gradient loudspeaker in combination with a dipole loudspeaker. The invention is not limited to this particular configuration. Any method capable of generating a first order gradient loudspeaker, where the radiation pattern of the first order gradient loudspeaker can be varied by the user can be used here. Also, any arrangement of elements that can be used to form a dipole loudspeaker can be used here as well.

Mathematical Analysis

The following sections give two mathematical derivations of the combined performance of two ideal first order gradient loudspeakers. In the first case the main radiation axes are 180° opposed to each other, and in the second case the main radiation axes have arbitrary relative angles with respect to each other. The ideal gradient loudspeakers maintain their gradient behavior for all frequencies. They also maintain constant power response as a function of frequency, as there is no frequency dependent term. This behavior is approximated by the present invention over a frequency range sufficient to steer localization, as described in the psychoacoustics section, through the use of specific signal processing that depends on the array element geometry.

Coincident Gradient Loudspeakers with Main Radiation Directions Opposed 180°

An expression that describes the pressure response of an ideal first order gradient loudspeaker can be written as:

$$P_1(r,\theta)=P_m*[A-B*\sin(\theta)] \quad (100)$$

Where $P_1(r,\theta)$ is the pressure response of a gradient speaker as a function of distance from the origin, r, and the observation angle, θ. $P_m$ is the pressure response of a monopole source. The term in brackets on the right side of the expression contains the directivity information. The relative levels of the A and B gain terms control the directivity pattern of the gradient loudspeaker.

The preferred embodiments of the invention combine two gradient loudspeakers, where the second gradient loudspeaker has its origin coincident in space with the origin of the first gradient loudspeaker, and its direction of maximum radiation is 180° opposite the first gradient loudspeaker.

The expression for the second gradient loudspeaker can be written as:

$$P_2(r,\theta)=P_m*[A+B*\sin(\theta)] \quad (101)$$

Assume that the first gradient loudspeaker is fed a left channel signal and the second gradient loudspeaker is fed a right channel signal. The relative level of A and B for each gradient loudspeaker are adjusted simultaneously to give a particular radiation pattern for each gradient speaker.

The array is generally oriented so that the left channel signal is radiated with its main radiation direction pointing to the left (θ=−90°), for a listener facing the array, and the right channel signal is oriented with its main radiation direction pointing to the right (θ=90°). The listener is located in the θ=0° direction for most applications.

We can look at the case where the left channel and right channel signals are equal. This is often referred to as a sum signal. In this case:

$$P_1(r,\theta)+P_2(r,\theta)=P_m*[A-B*\sin(\theta)]+P_m*[A+B*\sin(\theta)]=2A*P_m \quad (102)$$

The combined array has an omni-directional radiation pattern when the signals in the left and right channels are equal. There is no 0 dependence. The level of the sum signal is proportional to the A gain term.

Now lets look at the case where the left channel signal is equal to the right channel signal but has opposite polarity. This is often referred to as a difference signal. In this case we get:

$$P_1(r,\theta)+P_2(r,\theta)=P_m*[A-B*\sin(\theta)]-P_m*[A+B*\sin(\theta)]=2B*P_m*\sin(\theta) \quad (103)$$

This expression gives dipole radiation behavior. Furthermore, the null in the radiation pattern is facing the main listening direction. (The null occurs for θ=0°, 180°. The main listening direction is θ=0°) Difference signal information is radiated with a dipole radiation pattern, where the null of the dipole faces the listening position. The level of the difference signal radiated is proportional to the B gain term.

The radiation patterns for sum and difference signals do not depend on the form of the first order gradient radiation patterns for the individual channel signals. The relative levels of sum and difference signals radiated do depend on the individual channel radiation patterns. This dependence shows up as the A and B gain terms in the expressions for the sum and difference signals.

Coincident Gradient Loudspeakers with Main Radiation Directions Rotated with an Arbitrary Angle Between Them An expression that describes the pressure response of an ideal first order gradient loudspeaker with an arbitrary angle of the main axis of radiation can be written as:

$$P_1(r,\theta)=P_m*[A-B*\sin(\theta+\alpha)] \quad (104)$$

Where $P_1(r,\theta)$ is the pressure response of the gradient speaker as a function of distance from the origin, r, and the observation angle, θ. $P_m$ is the pressure response of a monopole source. The term in brackets on the right side of the expression contains the directivity information. The relative levels of the A and B gain terms control the directivity pattern of the gradient loudspeaker. The angle a rotates the radiation pattern.

The preferred embodiments of the invention combine two gradient loudspeakers, where the second gradient loudspeaker has its origin coincident in space with the origin of the first gradient loudspeaker.

The expression for the second gradient loudspeaker can be written as:

$$P_2(r,\theta)=P_m*[A+B*\sin(\theta-\alpha)] \quad (105)$$

Assume that the first gradient loudspeaker is fed a left channel signal and the second gradient loudspeaker is fed a right channel signal. The relative level of A and B for each gradient loudspeaker are adjusted simultaneously to give a particular radiation pattern for each gradient speaker.

We can look at the case where the left channel and right channel signals are equal. This is referred to as a sum signal. In this case:

$$P_1(r,\theta)+P_2(r,\theta)=P_m*[A-B*\sin(\theta+\alpha)]+P_m*[A+B*\sin(\theta-\alpha)] \quad (106)$$

This can be re-written using trigonometric identities as:

$$P_1(r,\theta)+P_2(r,\theta)=2P_m*[A-B\sin(\alpha)*\cos(\theta)] \quad (107)$$

The combined array has a first order gradient radiation pattern when the signals in the left and right channels are equal. The main radiation axis of this first order gradient loudspeaker is rotated 90° from the first order gradient speakers described in the case of coincident and opposite directed gradient loudspeakers (as evidenced by the cos(θ) rather than a sin (θ) term) described above. The radiation pattern of the sum signal depends on the radiation patterns of the individual channels and the relative angles of their main radiation directions. It can be seen that when the main radiating angles are 180° opposed to each other (α=0°), the expression degenerates to that derived earlier. It can be seen that the amount of rotation will affect the directivity pattern of the sum signal, but will not affect the maximum level as a function of observation angle. The rotation affects directivity, not overall level.

Now lets look at the case where the left channel signal is equal to the right channel signal but has opposite polarity. This is often referred to as a difference signal. In this case we get:

$$P_1(r,\theta)-P_2(r,\theta)=P_m*[A-B*\sin(\theta+\alpha)]-P_m*[A+B*\sin(\theta-\alpha)] \quad (108)$$

This can be re-written using trigonometric identities as:

$$P_1(r,\theta)-P_2(r,\theta)=2BP_m*\cos(\alpha)*\sin(\theta) \quad (109)$$

This expression gives dipole radiation behavior. Furthermore, the null in the radiation pattern is facing the main listening direction. (The null occurs for θ=0°.) Difference signal information is radiated with a dipole radiation pattern where the null of the dipole faces the listening position. The radiation pattern for difference signal information does not change as the individual channel radiation patterns are rotated. The level of difference signal radiated does directly depend on the amount of rotation and the individual channel radiation patterns (as evidenced by the cos(α) term and the B gain term). It can be seen that the main radiation axes of the sum signal (radiated with a first order gradient radiation pattern) and the difference signal (radiated with a dipole radiation pattern) are perpendicular to each other.

The above relationships directly lead the use of a combination of a first order gradient loudspeaker and a dipole loudspeaker rotated 90° with respect to the main axis of the first order gradient loudspeaker, to create a system capable of generating first order gradient radiation patterns for two input signals simultaneously, where the main radiation axes of the two signal radiation patterns can have an arbitrary angle with respect to each other.

SDR Array Performance

When a system has two input channels of information, we are concerned with the behavior of the system as the relative correlation of the signals in the two channels varies. We will analyze the cases where the correlation coefficient between the two channel signals is +1, 0, and −1. When the correlation is +1, the signals in the two channels are equal and in phase with each other. We refer to this case as having a sum signal applied to the complete array. When the correlation coefficient is -1, the signals in the two channels are equal but opposite in polarity. We refer to this case as having a difference signal applied to the array. When the correlation coefficient is zero, the signals in the two channels are independent of each other and there is no interaction between them. The behavior of each channel signal can be dealt with independently. Each of the cases shown in FIGS. 8*a* and 8*c* will be discussed for the three types of stereo signals input to the system. The performance of systems where the origins of the radiation patterns are separated in space (FIGS. 8*b* and 8*d*) have already been mentioned. They will not be explicitly discussed further.

Independent Channel Signals (Interchannel Correlation Coefficient=θ)

In this case, the signals in the two input channels are uncorrelated and are therefore independent. We can discuss the behavior of a single channel by itself. The other channel will have a symmetric behavior.

Coincident and 180°

The preferred embodiment aligns the main radiation axes of the two signal channels (which use the same physical array elements to radiate both channels) in 180° opposite directions, where the main radiating axes are typically perpendicular to the listening position, and places the origins of the first and second channel radiation patterns coincident in space. This geometry is shown in FIG. 8*a*. This orientation gives a particular relationship for the reflected/direct energy ratio at the listening position that depends on the beam width of the radiation pattern. The beam width is varied by adjustment of the spatial control that adjusts the directivity pattern of each channel simultaneously.

Sound will be localized to the array physical location when the spatial control is adjusted to give a channel signal a monopole radiation pattern. As the spatial control is adjusted to give a unidirectional radiation characteristic, more sound will be radiated in the main radiation direction than at the listening position. In the case where the spatial control is set to generate a cardioid radiation pattern, sound radiated in the main radiating direction will be 6 dB higher than sound radiated perpendicular to that direction (which is the main listening direction). Localization will begin to shift toward the wall surfaces of the listening room at which the main radiating axes are pointed. As the spatial control is adjusted further, the reflected/direct energy ratio continues to increase. In addition, a second radiation lobe appears directed in the opposite direction of the main radiation direction. When the spatial control is fully adjusted, radiation has a dipole character, and sound radiates equally in both directions perpendicular to the listener. Localization for this signal will no longer be well defined. The sound source will be difficult to localize on and will have a diffuse character when the spatial control is adjusted for a dipole radiation pattern for an individual channel signal.

Coincident and Rotated

The reflected/direct energy ratio can also be changed if the main radiation axes of the first and second channel signals are allowed to have angles other than 90° with respect to the main listening direction. As the directional speaker is rotated so that the angle between its main radiation axis and the listener is increased from 90° (Ω>90°), the listening position will in general receive less direct sound and more reflected sound, than the case where Ω=90° (when the spatial controls are adjusted so there is only a single lobe to the individual channel radiation pattern). FIG. 8*c* shows this for the case where the directional loudspeakers are coincident in space. This orientation can increase the reflected/direct sound ratio which improves the ability of the directional speaker to steer localization to the location of the reflections. The system will begin to use the back wall as a reflection surface, in addition to the side wall. The sound source locations that the array will be able to generate will move from the side walls toward the location of the speaker along the back wall. However, as the spatial control is adjusted further, a second radiation lobe opposite the main radiation direction is formed which may begin to provide more direct energy to the listening location. This effect will lower the reflected/direct sound ratio. Increasing Ω beyond 90° increases the reflected/direct sound ratio for a constant radiation pattern (where the pattern has a single lobe).

It is desirable to have the first channel signal radiated in a particular direction so reflected energy will reach the listening area from one side of the listening room. When a second channel signal is introduced, it should be radiated so that reflected energy arrives at the listening position from the other side of the room in order to create a stereo stage that has reasonable width.

The angle Ω between the main radiation direction and the listener can also be reduced below 90°. However, these configurations will tend to have less spatiousness and a narrower stereo image. The case for Ω<90° will not be examined further. It should be noted, however, that the invention is not limited to systems where Ω is ≧90°.

Sum Signals (Interchannel Correlation Coefficient=+1)

When the correlation between the first and second channel signals is +1, the first and second channel signals are identical and in phase (which we defined earlier as a sum signal). Signals that are present equally in both channels of a stereo pair of signals are usually intended to be localized in the middle of the stereo stage. Dialog recorded on audio tracks that accompany video program material is one example of signals that are recorded equally on each channel of a stereo pair of channels. Traditional two loudspeaker stereo setups generate a centered image for sum signals when the listener is centered between the two speakers. However, if the listener is located off the center line of the stereo pair of loudspeakers, the change in the relative distance between the listening position and each speaker will cause the perceived location of the sum signal to move toward the near speaker and away from center. It is a goal of this invention for the localization of sum signals to remain centered in the stereo stage for all listening positions throughout a room.

Coincident and 180°

The preferred embodiments of the invention where the first and second channel signal radiation patterns are coincident in space and directed in 180° opposite directions will radiate sum signals with an omni-directional radiation pattern at low frequencies. (The expression for the combined radiation pattern of coincident ideal first order gradient radiation patterns directed in 180° opposite directions with identical signals applied was derived earlier.) This is an optimum situation for signals that are supposed to be localized to the physical position of the array. The sum signals will be localized to the physical location of the array for all listening locations. This will provide a solid center image (when the array is centrally placed). There are some differences in how the different embodiments behave at higher frequencies. These will be discussed later.

Coincident and Rotated

When the angle Ω between the main radiation direction and the listening direction for each directional loudspeaker is changed from 90°, the radiation pattern of the sum signal will change from omni-directional. Rotation is depicted in FIG. 8*c*. The combination of the two channels takes the form of a first order gradient directional loudspeaker where the main axis of radiation is now either at an angle of 0° or 180° with respect to the main listening direction, depending on whether the angle a is positive or negative. (The expression describing the combined radiation pattern for ideal coincident first order gradient radiation patterns with an arbitrary angle between the main radiation directions was derived earlier.)

Localization will tend to remain in the direction of the array as the individual channel radiation patterns are rotated. This is because of the orientation of the main radiation axis for sum signals (which was shown earlier to be either in the direction of the main listening direction or 180° opposed to this direction). The primary application of the invention locates the array in the front of the listening space, where a wall is typically found behind the array. As the individual channel radiation patterns are rotated, the radiation pattern of the sum signal will tend to reflect more energy off this back wall. The reflections will come from the same general direction as the direct sound, so there will not be a significant change in localization of the sum signal until a significant amount of rotation has been introduced.

Difference Signals (Interchannel Correlation Coefficient=−1)

When the correlation between the first and second channel signals is −1, the first and second channel signals are identical and 180° out of phase (which we defined earlier as a difference signal). Signals that are present equally in both channels of a stereo pair of signals with opposite phase are usually intended to not be directly localizable. The difference signal usually contains ambiance or surround sound information. This signal is used to provide a sense of spaciousness and envelopment. It is desirable to avoid generating strong localization cues for difference signal information.

A system that generates a diffuse field when it radiates a signal will generate minimal localization cues. It is therefore desirable to radiate the difference signals using a system capable of generating a diffuse sound field. Traditional two speaker stereo setups do not do a good job of generating a diffuse sound field for difference signal information, especially for off axis listening positions. As a listener moves off axis, they become closer to one loudspeaker than the other, and localization of difference signal information will tend to collapse to the near speaker location.

Coincident and 180°

The preferred embodiment radiates difference signal information with a dipole radiation pattern. The dipole radiation pattern is oriented so that the null in the radiation pattern faces the main listening position, for most applications. This implies that there will be very little direct sound radiated at the listening area. (The expression for the combined radiation pattern of ideal coincident first order gradient radiation patterns, directed in 180° opposite directions with identical magnitude but opposite polarity signals applied was derived earlier.) The main radiation lobes of the dipole are directed out to both sides of the listening room simultaneously. The dipole has the minimum beam width possible of a first order gradient loudspeaker. This pattern maximizes the reflected/direct sound ratio. Sound is radiated equally in both directions with inverted relative polarity. The difference signal reflects off the side walls and arrives at the listening position from the sides of the room. There will be a number of reflections spread out in time arriving with random phases. This behavior generates a diffuse sound field with minimal localization cues.

Reflections that arrive from the side of the listening space are referred to as lateral reflections. There have been numerous studies of sound in concert halls that have correlated the presence of lateral reflections with the sense of spaciousness. The majority of energy radiated by the dipole that arrives at the listening position is composed of lateral reflections. The diffuse nature of the field generated combined with the large proportion of lateral reflected energy combines to maximize the sense of spaciousness and envelopment generated by the system for the difference signals. This is exactly the desired behavior.

Coincident and Rotated

A dipole pattern is also generated for the embodiments where the radiation patterns of each channel signal are coincident in space but the main radiation axes are at angles other than ±90° with respect to the main listening direction. The mathematical relationship describing this behavior was derived earlier. The dipole pattern is evidenced by the sin (θ) term in equation (109) derived earlier. The radiation pattern of difference signals does not depend on the individual channel radiation patterns or on the rotation of the main radiation axes of the individual channels. The level of difference signal radiated does depend on the amount of rotation and the individual channel radiation patterns (as evidenced by the B gain term and cos(α) terms). The difference signal radiated is a maximum when α is 0° (which is the preferred embodiment where the main radiation axes are 180° opposed, which was discussed previously). As α approaches 90°, the level of difference signal radiated goes to zero. The condition of $\alpha=90°$ rotates each main radiating direction by 90°, so that the main radiation axes of the first and second channel signals face the same direction. The channels have equal output levels and opposite polarities. The output of the combined system will be zero due to complete cancellation when this occurs.

SDR Systems Using Other Types of Directional Loudspeakers

In most of the above discussions the operation of the system was described assuming gradient loudspeakers were used for radiation pattern control at low frequencies. It was mentioned earlier that other methods exist for controlling radiation patterns at low frequencies, such as the use of wave type directivity devices. The operation of the invention when these types of devices are used will be similar to what has already been described for systems that use first order gradient loudspeakers. The directional loudspeakers will be used in the same way, such as in the primary application where a first channel signal is applied to one directional loudspeaker whose main radiation axis is pointed to the left, and a second channel signal is applied to a second directional loudspeaker whose main radiation axis is pointed to the right, for a listener facing the array. The differences arise in the type of signal processing required, and the differences in the directivity patterns of wave type (or other) devices from those of the first order gradient loudspeakers.

Wave type directional devices do not need to use multiple sources of sound to obtain their directivity control. As a result, the signal processing does not need to apply a particular channel signal to more than one device. The signal processing will only require linear filtering in each channel signal path to correct for any non-flatness in the response characteristics of the wave type directional devices.

The way in which sum signals are radiated by the combined array will depend on the individual radiation patterns and the relative positions of the two directional loudspeakers. When the directional loudspeakers are arrayed so that their radiation pattern origins are coincident in space (or as close to coincident as possible) and directed in 180° opposite directions, the combined pattern will be some approximation to omni directional. The actual difference between the combined pattern and an omni directional pattern will depend on the difference between the directivity pattern of an individual wave type device and a first order gradient radiation pattern. Localization will still be to the location of the array, even if the individual pattern are not exactly first order gradient. The wave device patterns would need to be considerably narrower than a cardioid pattern for localization to shift away from the location of the array.

The combined radiation pattern for difference signals will have a null in the radiation pattern facing the main listening direction, even if the individual patterns are not first order gradient. The effect on system behavior from the radiation pattern of the individual wave devices will have less effect on difference signals than sum signals. Patterns narrower that first order gradient will not cause any problems. However, patterns wider than first order gradient will affect difference signals. The level of difference signal radiated will be affected and may need to be adjusted.

It is possible to construct a "space" control that can be used to alter the spatial performance of an array constructed from wave type directional loudspeakers. Space controls are described in more detail with regard to gradient loudspeakers in the sections that follow. In the case of an array of wave type devices, signal processing can be constructed to alter the relative level of difference signal to sum signal. This level control will function to change the spatial character of the array. The processing would simply involve summing the left and right channels together to create an L+R signal, and subtracting the signals to create an L−R signal. A balance control is then used to vary the relative level of the sum and difference signals. The sum signal is then added back to the difference signal to create a modified left channel signal and the difference signal is subtracted from the sum signal to create a modified right channel signal. The modified left and right channel signals are then presented to the left and right directional loudspeakers.

This signal processing is similar in form to the signal processing that will be described for some of the preferred embodiments. The major difference is that there is no frequency dependent equalization required when wave type directivity control devices are used. This is because the wave type devices already have controlled directivity, and do not need equalization to change the relative phases of different element outputs, as is needed in the different gradient embodiments.

SDR Array Performance Issues

Characteristics of Reflection Sources

Sound sources that are generated by reflecting energy off wall surfaces do not behave exactly the same as a physical source (such as a loudspeaker) placed at the reflecting wall. The reflection source will only be localized to a general area, not a specific location. The reflection source is more diffuse than an actual source, as the wavefront generated by the array diverges as it propagates away from the array and it impacts the wall surface over a large physical area. This is in general a desirable property for the invention to possess, especially for its primary intended application of use in conjunction with a video display. A diffuse sound stage spread out in front of the viewing area is to be preferred. The presence of individual loudspeakers as separate sources displaced from the screen, as is common in current practice, can call attention to themselves and become distracting.

Balance Control

The systems of the present invention also work well with a balance control. Balance controls will usually be included in the equipment that the invention will be used with (televisions, portable or fixed stereo systems, automobile radios, etc.). Balance controls work by adjusting the relative level of the left and right channel signals. In a normal stereo setup where the listener is located in between two traditional stereo speakers, adjusting the balance control will cause the virtual sound source to move in the direction of the speaker with the larger signal. If a listener is located off axis to the center line, when the two signals are equal, the virtual sound source location will be shifted toward the near speaker. Adjusting the balance control to increase the level of the far speaker with respect to the near speaker will cause the image to shift back toward the middle. This system is relying on time intensity trading to adjust the perceived location of the virtual sound source.

Operation of a balance control with the current invention will have a similar effect. Adjustment of the balance control will alter the proportions of energy radiated to the sides of the array. The balance control can be useful in situations where there is a significant asymmetry in the listening environment. If, for example, the system were located closer to one side wall than another, the overall balance of the system may seem to be biased toward the near wall. The balance control can be adjusted so that the signal radiated toward the far wall is increased in level with respect to the signal radiated toward the near wall. This shifts the overall sonic image back to the center. This is exactly the effect one would like a balance control to have.

The balance control, if used in an SDR system, should occur ahead of the SDR signal processing (for systems using gradient directional loudspeakers) in order to function properly. A balance control located after the SDR processing affects the relative outputs of the array elements, which is not desired. A balance control is not explicitly shown in the drawings. It is assumed that someone skilled in the art will be capable of constructing such a control for use in an SDR system. A balance control used with an SDR array that uses wave type loudspeakers as directional loudspeakers would also want the balance control ahead of the signal processing, but could also work with the control after the processing. The exact behavior of the control will be different in the two situations, but both conditions cab be useful.

Spatial Control

It is easy to implement a spatial control. The spatial control is used to vary the way in which the array radiates energy into the listening environment. Methods for controlling the radiation pattern of a single gradient loudspeaker were discussed previously. Those methods can be adapted to simultaneously control the radiation patterns of a pair of gradient loudspeakers, and examples of this will described shortly. A spatial control was also described previously for a system using wave type directional loudspeakers. The spatial control allows the user to control the radiation pattern of the array in a symmetric fashion. This is opposed to the operation of the balance control that allows directivity pattern control in an asymmetrical manner. The combination of a balance control and a spatial control allows the user considerable flexibility in adjusting the parameters of the system to account for variations in listening environment and program source material. Spatial controls are shown in the various figures describing single channel gradient loudspeaker configurations and two channel SDR systems.

Rotation Control

It was mentioned previously that rotation of the principal radiating axes of two signal channels with first order gradient directivity characteristics can be accomplished by a system that is a combination of a dipole and a first order gradient loudspeaker, where the main radiating axes of the dipole and first order gradient loudspeaker are perpendicular to each other. It is possible to rotate the main radiation axes of the first and second channels by varying the directivity of the first order gradient loudspeaker and level of the perpendicular dipole with a sin/cos relationship.

Controls for accomplishing this are shown in FIG. 10*b*. FIG. 10*b* shows independent controls for the two dipole signal paths. These controls allow complete variation in the rotation of the radiation patterns, as well as control over the shape of the radiation patterns. FIG. 10*a* shows the use of an MD-Grad first order gradient loudspeaker, but any of the types of first order gradient loudspeakers that have been previously described can be used here.

Compensation for Transmission Channel Errors

There are situations where the available audio channels can be degraded during transmission. Auto balance and auto azimuth correction circuitry, and noise reduction circuitry can be included if desired to correct for many of these transmission errors. These circuits act to restore and maintain the proper relative channel level and phase relationships, and reduce the effects of noise under low signal strength conditions. The usual types of problems encountered tend to be level mismatches between the two channels. These can arise when broadcasters do not monitor their transmission signals properly or when levels are not set correctly during recording. Circuits can be designed that monitor the two channels and adjust the relative levels to compensate for this. This type of circuitry is currently included in Dolby Pro Logic processing hardware. The auto balance function in Dolby Pro Logic systems takes place before any signal decoding is performed. Automatic balancing circuits already exist in the prior art and will not be described in detail here. The automatic balance control, if used in a system with a manual balance control, must be placed in the signal chain ahead of the manual balance control. The automatic control would negate any manual adjustments made by the user if the automatic control occurred after the manual control in the signal chain.

The operation of the invention of this disclosure is relatively insensitive to small errors in channel balance. This is in contrast to current home theater playback decoding circuits that employ active steering logic circuits (such as a system market by Dolby Laboratories called Dolby Pro Logic). Small level mismatches can cause exceedingly large errors in the decoding of directional information due to the methods used to accomplish active steering. These decoding systems require the use of an auto balance feature for proper decoding. An auto balance feature is not required for satisfactory use of the current invention, but it can be of benefit if included.

Auto azimuth correction compensates for inter-channel phase errors. These can arise, as the name implies, from recordings made on tape machines where the recording head azimuth was not properly adjusted or from machines where the playback heads are not properly aligned. This miss-adjustment would cause one channel to lead the other in time by some small fixed amount. Processing can be included that automatically adjusts the relative time delay between the two channels to correct for these azimuth errors. This function is currently available in a Dolby Pro Logic decoder made by Lexicon. The azimuth adjustment can work by monitoring the correlation between the two channels and the level of the sum and difference signals. The sum signal level will be a maximum and the difference signal will be a minimum when the two channels have the correct time relationship. The system can use a control loop to adjust the relative time delay between the two channels to obtain the above relationship between the two channels. Azimuth errors tend to be stationary over time and usually require adjustment only when the program material changes. A manual control could be made available to adjust for azimuth errors if desired. This control is accomplished by providing a manual control over an independent delay line or lines included in either one or both of the first and second channel signal paths. A block diagram of a manual azimuth control is shown in FIG. 26. An amount of delay equal to the largest amount of azimuth error expected is placed in the first channel signal path. A user controllable delay is also placed in the second channel signal path. This delay is variable between zero and twice the delay in the first channel signal path. This configuration allows the system to compensate for situations where the first channel signal is delayed with respect to the second channel signal, or where the second channel signal is delayed with respect to the first channel signal. Automatic azimuth compensation is already known in the prior art and will not be further described here.

The signals can also be degraded by noise when transmitted. Signal to noise ratios decrease as the received signal strength of a desired broadcast signal decreases. The mechanisms that act to reduce signal to noise ratios in most broadcast systems (whether TV or FM) tend to have larger levels of noise show up in the difference signal component than in the sum component as received signal strength decreases. This situation is particularly common in automotive radio receivers as a vehicle moves in and out of range of the broadcast antenna. A method commonly employed in automotive receivers to reduce the perceived level of noise is to gradually blend the left and right channel signals to mono as the received signal strength decreases. Mono blending usually starts to occur when the received signal level drops below a set threshold. The amount of blending is gradually increased as the received signal strength continues to decrease.

A similar blending type of function can be of use with the present invention. In MD-Grad and combination embodiments specifically, the left and right channel signals are already converted into sum and difference signals. In these cases, the noise reducing blend circuitry would be designed to gradually reduce the level of the difference signal when the received signal strength drops below a preset threshold. This can easily be accomplished by the use of a voltage controlled amplifier placed in the signal path of the difference signal, where the control voltage depends on the received signal strength. This function is shown in FIG. 27*a*, for an MD-Grad embodiment. One possible function relating the gain of the L−R signal path to the received signal strength is shown in FIG. 27*b*. Above the received signal strength threshold voltage Vt, the gain of the difference signal channel is not changed as received signal strength changes. When the received signal strength is below the threshold Vt, the gain of the difference signal path is gradually reduced. FIG. 27*b* shows a linear relationship between received signal strength and difference signal gain, but other relationships are also possible. These circuits are known in the prior art and will not be described further here. It is understood that any relationship between received signal strength and difference signal level that acts as a blending circuit to reduce perceived noise is construed to be included in this disclosure. Mono blending can be done for any of the embodiments, whether or not they specifically generate sum and difference signals.

Dynamic signal Processing

The use of some form of dynamic gain control circuitry is useful in an SDR system. One use was described in the previous section for obtaining a reduction in perceived noise as a function of received signal strength. The primary purpose of the gain control circuitry described here is to monitor the signal level at a particular point in the signal path and adjust a variable gain element as a function of the signal level at the monitoring point. This gain control circuitry is capable of performing dynamic range compression functions and signal limiting functions. There are various situations where one or the other, or both, of these functions can be useful in an SDR system. The primary purpose of including a dynamic signal limiting function is to ensure that a particular signal level is not exceeded in the electronics. This will essentially prevent what is known as clipping distortion from occurring, when the limiting voltage threshold is set at a level less than the clipping level. Compression can be used for the same purpose, or it can be used to achieve other effects, such as increasing the perceived level of a signal or optimally squeezing a wide dynamic range signal into a channel that has less dynamic range.

There are multiple ways in which this gain control circuitry can be implemented. There are many methods known in the prior art for performing signal dynamic range compression or limiting which can be applied here. These methods usually use a voltage controlled amplifier (VCA) and some type of signal processing to generate a control voltage. The control voltage for the VCA can be derived from a point in the circuit path ahead of the VCA (a feedforward topology), or after the VCA (a feedback topology). There are differences in the overall system performance that will occur depending on the topology used, the specific points in the signal path where the control voltage is derived, and the location in the signal path of the gain control element (VCA). The selection of different topologies is usually based on signal noise and dynamic range considerations. The invention is not limited in the topology of the gain control circuitry, the location of the gain control elements in the circuit, or the locations in the circuit from which the control voltage is derived.

A preferred placement will be described for the MD-Grad and combination embodiments. An arrangement can also be made to perform the processing in a similar manner for D-Grad arrays if desired. Both the MD-Grad and combination embodiments explicitly derive sum and difference signals from the two input signals. A preferred placement for the gain control elements for use with an SDR array is in the sum and difference signal paths. A diagram showing this preferred method of dynamic gain control is shown in FIG. 28. FIG. 28 shows a feedback topology, where the monitoring point in the circuit occurs after the variable gain amplifier. The monitoring point is shown after the power amplifier, but it could be directly after the variable gain element as well. A feedforward topology is also possible.

The sum and difference signals can be thought of as a reformatting of the two input signals into a non-directional component and a directional component. In the signal processing included in the preferred SDR embodiments, there can be considerable electrical boost applied to the difference signal as compared to the sum signal. The specific amount of boost depends on the actual array element geometry used. The maximum perceived volume generated by the system is determined primarily by the non-directional signal component (sum signal). By placing independent variable gain elements in the sum and difference signal paths, limiting of the directional signal can occur without affecting the non-directional signal (and vice versa).

The effect that occurs when the directional signal limits before the non-directional signal is that the spaciousness of the sound field is gradually reduced. It turns out that this action is not generally detectable until the relative gain difference becomes quite significant. The ability to perceive the modulation in spaciousness tends to decrease as the overall listening level increases. It is also possible that the sum channel could limit before the difference channel. The effect here would be a modulation of the spaciousness of the array as before, but in this case the spaciousness would increase at high signal levels as the sum signal limits. This effect has also been found to be difficult to detect at loud listening levels unless the gain difference becomes significant. It is possible to make a further modification to the system to allow the individual gain control elements to be independent up until a certain amount of relative gain reduction has occurred. After this threshold, the two gain elements can be tied together so that no additional relative gain differences in excess of this set threshold are possible. This would allow the system to achieve a maximum perceived loudness level without generating any perceptible spatial modulation.

Another benefit to this configuration is that it can be tied to the noise reduction scheme described earlier. The gain control element in the difference signal path can have an additional control voltage input that is tied to received signal strength. The control voltage would be designed to cause the voltage controlled amplifier in the difference signal path to reduce gain when the received signal strength drops below a certain set threshold. This is shown in FIG. 28 as well.

The actual dynamics of the system in terms of thresholds and time constants for gain reduction and gain restoration will depend on aspects of the complete system in which the SDR array is used and cannot be exactly defined here. Methods for altering gain reduction or restoration time constants and setting thresholds for dynamic processing behavior are know in the prior art and will not be described further. It is assumed that those skilled in the art will be capable of designing the appropriate circuitry to generate control voltages with the required characteristics.

A more traditional configuration for dynamic gain control can also be used with an SDR system. The gain control elements can be placed either before or after the SDR signal processing. The control voltage can be derived from either just before power amplifiers, or from the power amplifier outputs. Dynamic range compression and limiting schemes with these types of configurations are known in the prior art and will not be described further. Whenever the signal level would exceed the clipping threshold, the gain reduction circuitry would act to reduce the level of the left and right channel signal simultaneously, until the gain is reduced sufficiently to keep the system from clipping. These configurations are not shown.

There is another type of dynamic signal processing that can be applied to an SDR system that can increase the overall sound pressure level the system can generate before clipping. It was mentioned previously that the signal processing for SDR systems can have significant electrical boost applied in the difference signal. This boost is usually frequency dependent and is larger at lower frequencies. It is possible to place a voltage controlled high pass filter in line with the difference signal. The control voltage for the high pass filter is designed to raise the cutoff frequency of the high pass filter at higher signal levels. This will reduce the electrical boost at low frequencies in the difference signal dynamically as a function of the overall signal level.

However, this sliding high pass filter has a phase response that will change as its corner frequency is changed. The desired phase relationships that must be maintained for SDR embodiments between the monopole and dipole outputs were described earlier. In order for the sliding high pass filter technique to work properly, its changing phase response as a function of signal level must be compensated for in the sum signal path. This can be done in two ways. The first method is to place the same voltage controlled high pass filter circuitry in both the monopole and dipole source signal paths. This will ensure that the dynamic filter does not change the relative magnitude or phase relationships. This method is not explicitly shown in the drawings.

A second method can place a voltage controlled high pass filter in the dipole source signal path, and a compensating voltage controlled all pass filter in the monopole source signal path. The high pass filter and all pass filter must be chosen so that they have the same phase response when they have the same cut off frequency. This can be done, for example, if a second order critically damped voltage controlled high pass filter is used in the difference signal path, and a voltage controlled first order all pass filter is placed in the sum signal path. The control path circuitry is designed so that the corner frequency of the all pass filter closely tracks the corner frequency of the high pass filter. This close tracking is required to make sure the directivity patterns of the individual channel signals do not vary as the voltage controlled filters are varied. FIG. 29 shows an MD-Grad embodiment that incorporates these variable filters. Note that the sense point shown from which the control voltage is derived is the same for both the $2^{nd}$ order voltage controlled high pass filter and the voltage controlled first order all pass filter. The control voltage generator circuitry is also shown as being the same in FIG. 29 for both filters. This may not always be the case. The topology of the all pass filter may be different from the high pass filter, and may require a different control voltage generator in order for the corner frequencies of the all pass and high pass filters to track each other. The invention is not limited in the method used to generate the control voltages. However, the goal is to ensure that the phase response of the all pass filter closely tracks the phase response of the high pass filter.

The net effect of this sliding filter signal processing is that there will be a small reduction in the overall spaciousness of the system at high signal levels, and a slight change in the perceived frequency balance. This is traded off by a significant increase in system output level before clipping.

This sliding high pass filter circuitry can be combined with the dynamic gain reduction circuitry described above if desired. The combination of these circuits is not explicitly shown, but is construed to be incorporated in this disclosure.

Very Low Frequency Reproduction

The basic array described so far is designed to work for frequencies above approximately 150 Hz. This implies that some method is required to reproduce low frequency information below 150 Hz. The prototype system that is described later discuss two different ways in which low frequency response can be dealt with. In the prototype electronics, a high pass filter is placed in the dipole signal path (of a combination embodiment) and a corresponding all pass filter is placed in the monopole signal path. In this way, the monopole signal is full range while the dipole signal is only available above 150 Hz. This arrangement preserves the directivity control above 150 Hz. Systems that use this approach need a monopole source that reproduces full range signals adequately. In this case, the monopole source will reproduce the low frequency information.

The rolloff of the response of the entire SDR array is also described. In this case, high pass filters can be placed either ahead of the SDR processing in both channels, after the SDR processing in both output channels of the processing, or directly incorporated in the SDR processing. In this last case, high pass filters are placed in both the monopole and dipole signal paths. The input signals that are sent to a sub woofer need to be split off in parallel with the input signals to the SDR processing, to be fed to a powered sub woofer that incorporates its own low pass filter. It is also possible to take the drive signal for the sub woofer from a point within the SDR processing, and will be beneficial in some cases.

The above approaches can be made to work with all of gradient loudspeaker embodiments.

Specific Embodiments of the Invention

D-Grad, MD-Grad, and combination embodiments tend to operate in a similar manner at low frequencies. The different system behaviors deviate at higher frequencies. The differences in system operation are described in the following sections. The application section discusses some situations where one embodiment is desired over another.

Two Channel D-Grad Array

A directional loudspeaker, employing a D-Grad type gradient loudspeaker for low frequency pattern control, combines the outputs from two transducer elements where the output of one element is delayed and inverted with respect to the other to create a first order gradient directivity characteristic. Methods of creating single channel D-Grad directional loudspeakers were described earlier. The individual channel arrays can be combined in numerous ways to form two channel arrays. The simplest configuration uses the same elements for both signal channels. This embodiment is the form of the preferred embodiment and will be discussed in detail shortly. There are numerous other possible embodiments.

The two directional loudspeakers could use completely independent transducer elements and electronics. Any of the possible D-Grad embodiments can be used in any combination (two element, single element, different forms of generating delay, etc.). The origins of the radiation patterns can be separated and/or rotated with respect to each other. Embodiments where completely independent directional loudspeakers are used for each channel are the most expensive option. The preferred will use either some or all of the array elements simultaneously for both channels.

The preferred embodiment D-Grad array consists of two loudspeaker elements and operates as follows. The left element of the array is fed the first channel signal. It is also fed a delayed and inverted second channel signal. The right array element is fed the second channel signal. It is also fed a delayed and inverted first channel signal. This two element loudspeaker array is capable of generating first order gradient directivity patterns where the first channel is radiated in one direction, along the line joining the centers of the two array elements, and the second channel is simultaneously radiated in a 180° opposite direction. The block diagram showing the required signal processing of a two element D-Grad SDR array is shown in FIG. 13*a*. The signal processing provides the required delay and equalization for a stereo pair of signals. The equalization shown is required to achieve a flat power response from the combined system in the frequency range where directivity control is maintained. (Also shown in FIG. 13*a* are blocks for accomplishing a space control, automatic frequency response compensation for the action of the space control, and optional low pass filtering with compensating all pass filters. These functions will be described in more detail later.) The complete mathematical description of an SDR embodiment using D-Grad configurations for directivity control is given in the appendix. Equations 23, 25, 43 and 46 from the appendix give the pressure response at low frequencies for the individual channel signals independently, as well as the response when sum and difference signals are applied.

| | | |
|---|---|---|
| $P_1(r,\theta) = P_m(r) * [(j\omega d)/2c] * [1 + (D/d) * \sin(\theta)]$ | (23) | (first channel signal) |
| $P_2(r,\theta) = P_m(r) * [(j\omega d)/2c] * [1 - (D/d * \sin(\theta)]$ | (25) | (second channel signal) |
| $P_{sum}(r,\theta) = P_m(r) * [(j\omega d)/c]$ | (43) | (sum signal applied) |
| $P_{diff}(r,\theta) = P_m(r) * [j\omega D)/c] * \sin(\theta)$ | (46) | (difference signal applied) |

In the above equations, $P_m(r)$ is the pressure response of an ideal monopole source (there is no θ dependence in the monopole response as a monopole radiates omnidirectionally), jω is the complex frequency variable, D/2 is the array element spacing, d represents time delay, and θ is the observation angle.

It can clearly be seen that these equations have the same form as those derived earlier for the ideal case of the preferred embodiment. One difference that shows up, however, is the jω dependence that is present in every equation. This gives a differentiating frequency response that rolls off at 6 dB per octave at low frequencies. This response can easily be equalized out. This behavior was described earlier for a single channel D-Grad directional loudspeaker. The same frequency dependence shows up in the sum and difference signals radiated by the combined array. These will also be equalized out when the equalization is applied as shown in FIG. 13*a*. The equalized array will behave in the same manner at low frequencies as was described earlier for the ideal gradient loudspeaker case.

Figure 1B:
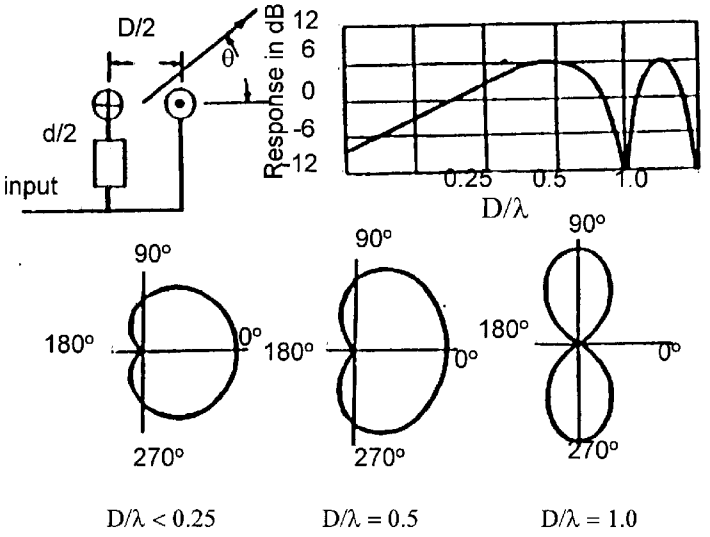
FIG. 1*b* shows the frequency response magnitude and directivity pattern of a delay type uni-directional first order gradient loudspeaker where the delay is equal to the path length delay.
Figure 1A:
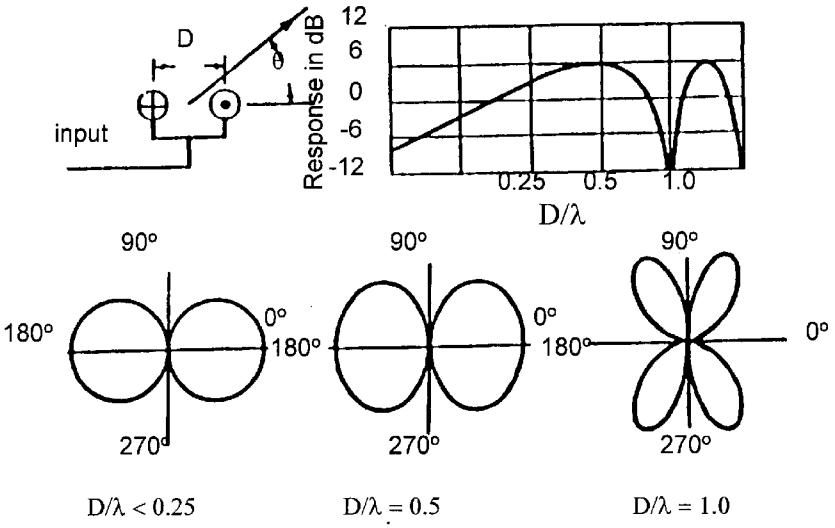
FIG. 1*a* shows the frequency response magnitude and directivity pattern for a dipole formed from two monopole sources with spacing D.
Figure 2A:
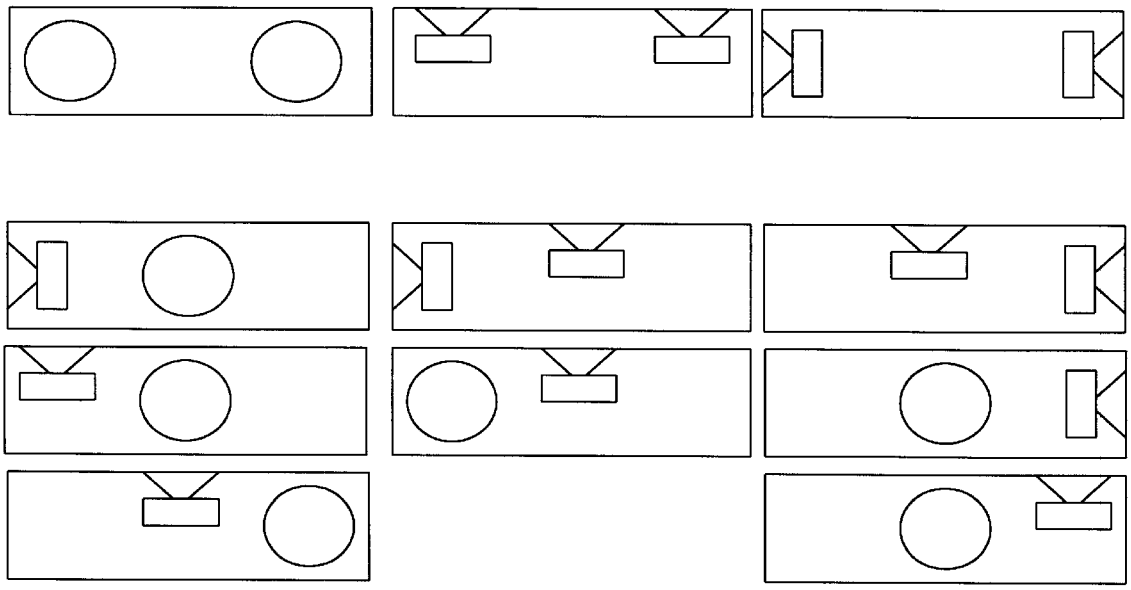
FIG. 2*a* shows various ways two loudspeaker elements can be configured for use as a gradient loudspeaker.
Figure 2B:
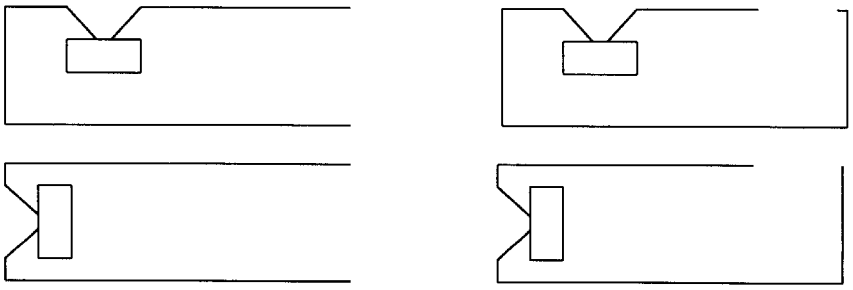
FIG. 2*b* shows various configurations to configure a single loudspeaker element as a gradient loudspeaker.
Figure 3:
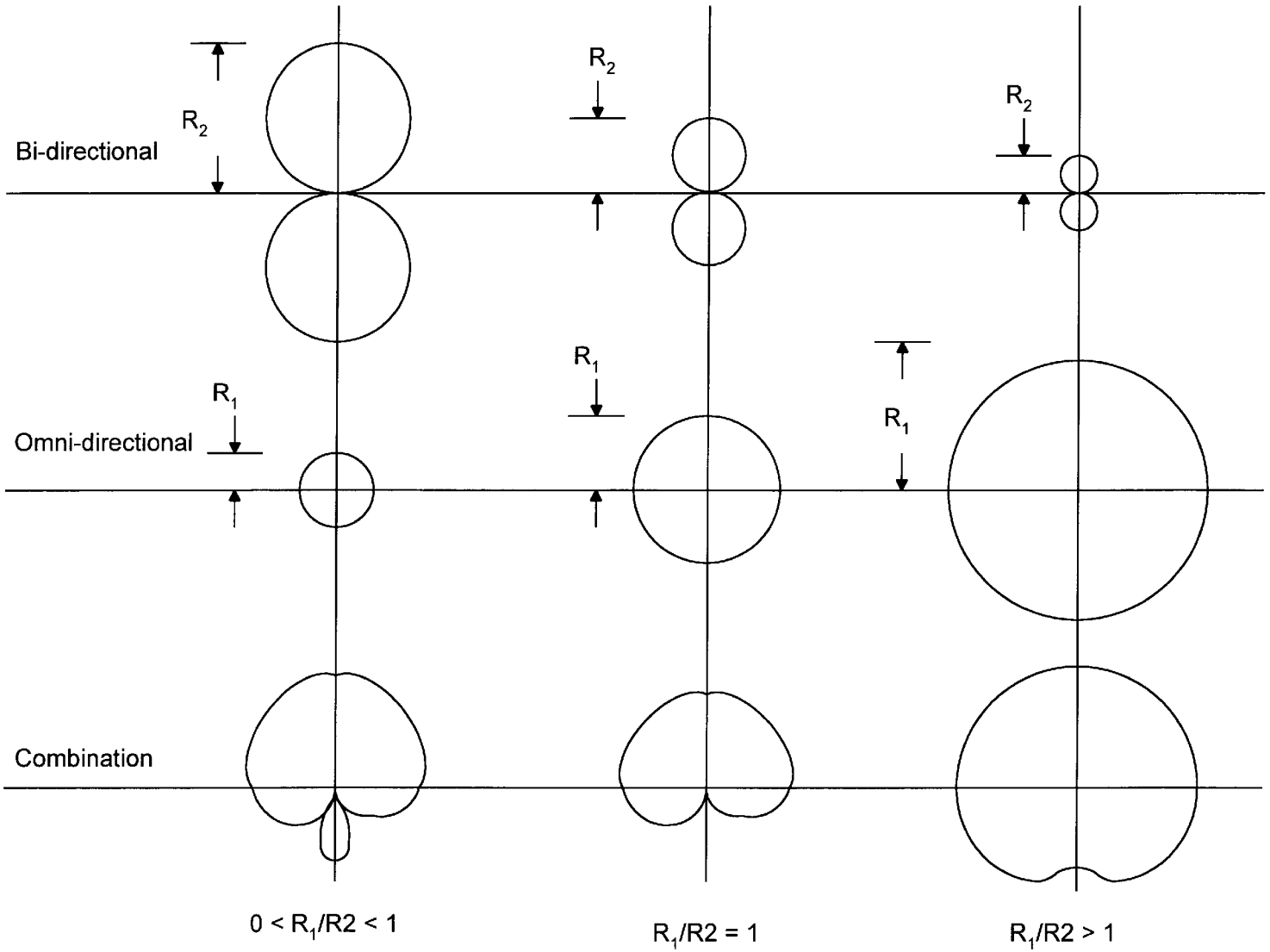
FIG. 3 shows the resulting directivity patterns for the combination of various relative levels of monopole and dipole sources
Figure 4:
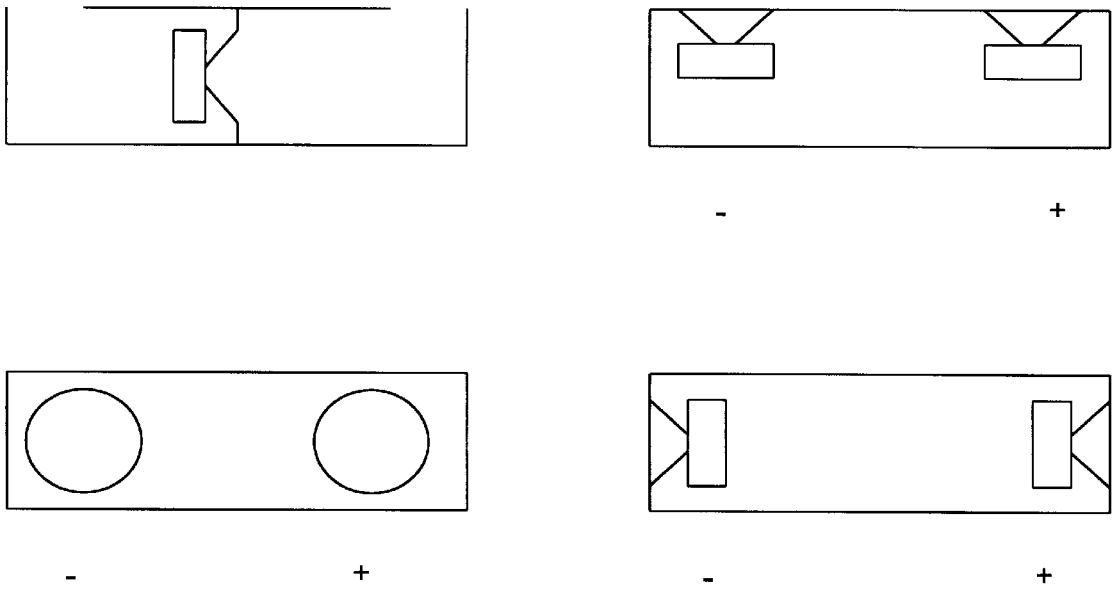
FIG. 4 shows various configurations of transducer elements arranged to form a dipole source.
Figure 5A:
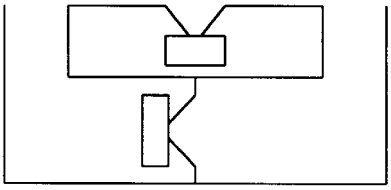
FIG. 5*a* shows an arrangement of transducers used to form an MD-Grad gradient loudspeaker that uses a single transducer as a monopole source and a single transducer as a dipole source.
Figure 5B:
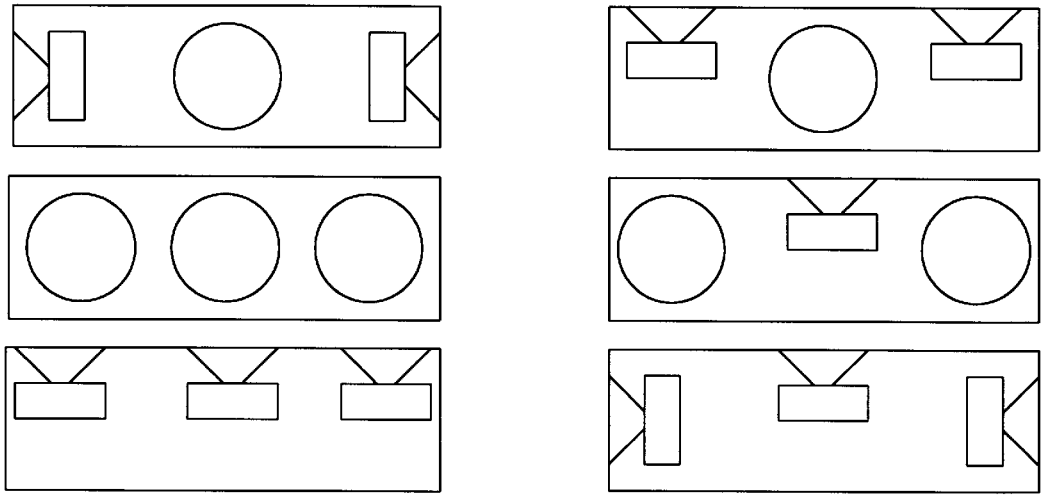
FIG. 5*b* shows various arrangements of three transducer elements to form gradient loudspeakers.
Figure 5C:
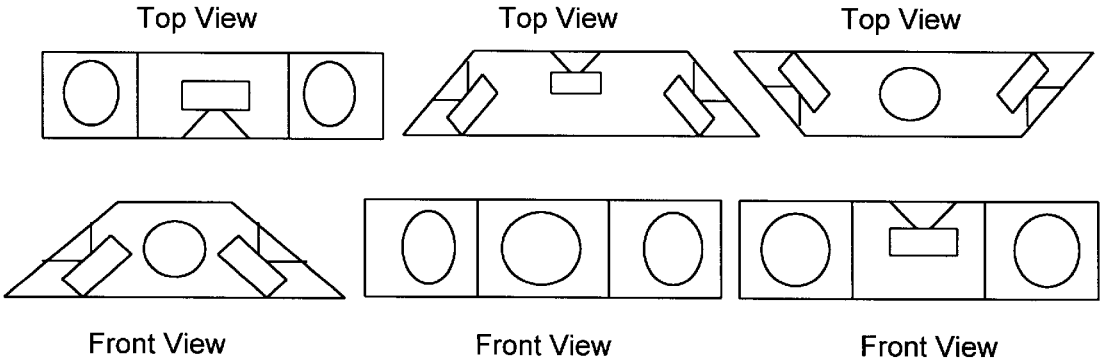
FIG. 5*c* shows various arrangements of three transducer elements to form gradient loudspeakers.
Figure 6A:
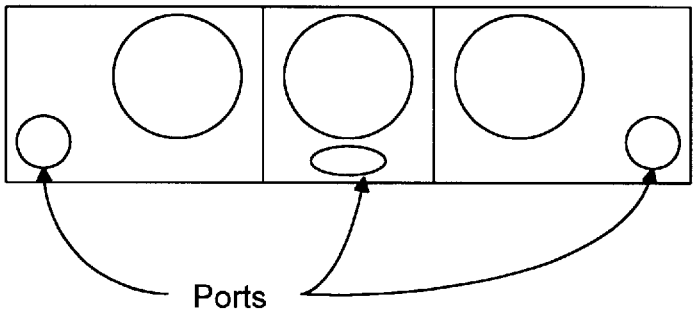
FIG. 6*a* shows a three element MD-Grad array configuration where loudspeaker elements are used in ported enclosures and the ports are spaced farther apart than the transducer elements.
Figure 6B:
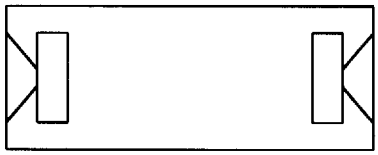
FIG. 6*b* shows a two element D-Grad array where the transducer elements are facing outward, where this arrangement is used with suitable signal processing to increase the frequency range of directivity pattern control by making use of the natural directivity of the transducers at higher frequencies.
Figure 6C:
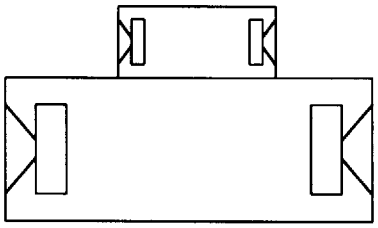
FIG. 6*c* shows the combination of two arrays with different element spacing, where one array operates at low frequencies and the second array with smaller spacing operates at higher frequencies.
Figure 6D:
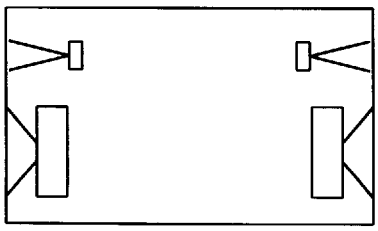
FIG. 6*d* shows a four element array where the transducer elements are facing outward, where this arrangement is used with suitable signal processing to increase the frequency range of directivity pattern control by crossing over to directional tweeters for use at higher frequencies.
Figure 7:
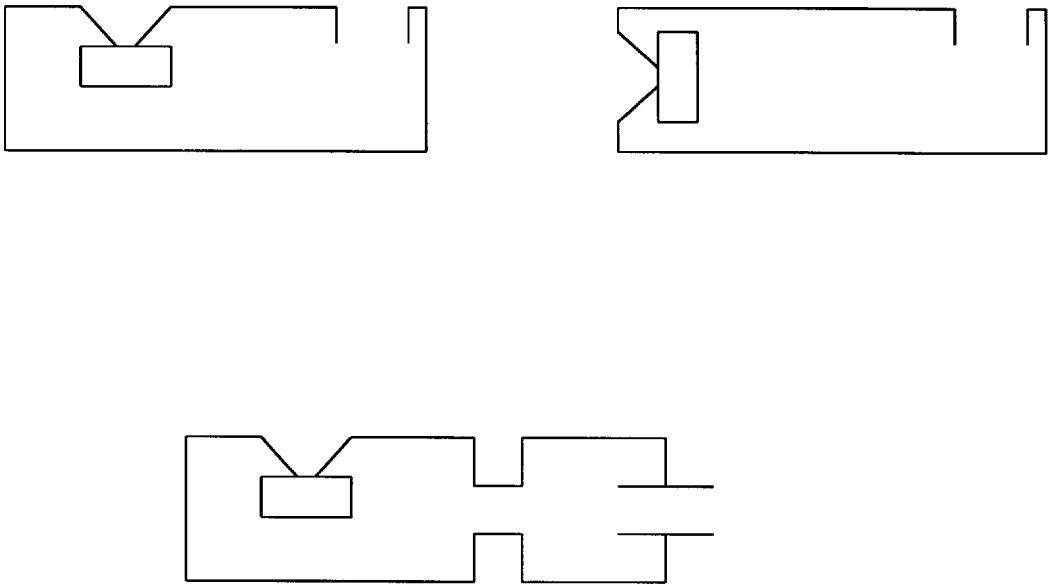
FIG. 7 shows the use of acoustical low pass filters on the output from the rear of a transducer element

Note that the overall phase response of the equalization used here is not critical to achieving a flat power response from the system at low frequencies. The relative phase of the equalization applied to each channel should be the same, however. The equalization is primarily used to correct the magnitude response deviation of the complete array at low frequencies, as shown in FIG. 1*b*. This is opposed to the requirements of the MD-Grad systems where the proper relative magnitude and phase response between the monopole and dipole element outputs must be maintained.

The preferred embodiment using D-Grad configurations for radiating the first and second channel signals is capable of radiating low frequency first channel signals in a first direction with a first order gradient radiation pattern, and low frequency second channel signals in a second direction, 180° opposite the first direction, with a first order gradient radiation pattern. In addition, the D-Grad preferred embodiment array will radiate low frequency sum signals omnidirectionally and low frequency difference signals with a dipole radiation pattern. The system can be used with spatial controls that adjust the amount of delay used and/or the relative levels of the delayed and undelayed signals. The operation of spatial controls is described shortly.

The radiation patterns deviate from the directional behavior described above at higher frequencies. The factors that influence this deviation are the relationship between the element spacing and the wavelength of sound at the frequencies of interest, the amount of delay used, and the deviation from ideal monopole source behavior of the individual array elements. Additional lobes in the radiation pattern and comb filter effects in the frequency response begin to manifest themselves at higher frequencies. The complete expressions for the pressure response of the preferred D-Grad array, for the cases of signal correlation of −1, 0, and +1 are derived in the appendix as equations 20, 21, 42b, and 45b. (In the analysis in the appendix, the individual array elements are still assumed to be monopoles.)

$$P_1(r,\theta)=P_m(r)*2j*\sin[(k*d)/4+(k*D)/4*\sin(\theta)] \quad (20)$$

$$P_2(r,\theta)=P_m(r)*2j*\sin[(k*d)/4-(k*D)/4*\sin(\theta)] \quad (21)$$

$$P_{sum}(r,\theta)=P_m(r)*4j*\sin[(k*d)/4]*\cos[(k*D)/4*\sin(\theta)] \quad (42b)$$

$$P_{diff}(r,\theta)=P_m(r)*4j*\cos[(k*d)/4]*\sin[(k*D)/4*\sin(\theta)] \quad (45b)$$

Notice that comb filtering occurs for all angles of radiation for sum signals. The above equation for the sum signal will be zero whenever the sin (kd/4) or cos[(kD/4)* sin (θ)] terms are equal to zero. The expression can have a maximum value of as much as twice the monopole output depending on the values of d, D, k, and θ (the maximum value may not reach twice the monopole level at any frequency for some combinations of variable values). This is opposed to what happens with MD-Grad embodiments where no comb filtering of sum signals occurs at any angle, as will be described in the MD-Grad section (the sum signal is radiated by a single monopole element in the MD-Grad embodiment). Comb filtering of sum signals also occurs for combination embodiments (as will be shown later), although the character is somewhat different from that of D-Grad embodiments.

Comb filtering also shows up in the radiated difference signal. This also depends on the value of d, D, and θ. One difference between this expression and the expression for the sum output is that the array output will always be zero for θ=0°, for all values of d and D. There is always an on axis null in the radiation pattern for difference signals.

It is possible to reduce the comb filtering effects of the basic D-Grad system at high frequencies. The methods described earlier in the gradient loudspeaker limitations section with respect to extending the frequency range of operation of a gradient loudspeaker (use of a second high frequency array with closely spaced elements and a cross-over network, facing elements out to left and right and using their natural directivity, or crossover to directional tweeters) will also reduce the effects of comb filtering of the two channel D-Grad array.

The equalizer with an integrating response described earlier was used to compensate for the low frequency behavior of the delay gradient loudspeaker. At higher frequencies, the behavior of the gradient loudspeaker deviates from first order gradient behavior as shown above. The magnitude response of the equalization applied is not required to have an integrating response in the region where comb filtering is occurring. However, there will be some applications where the integration behavior of the equalizer will extend into the high frequency region. There are also applications where it will be desirable to flatten out the response of the equalizer above the frequency where the radiation behavior deviates from gradient behavior. One method that can be applied to flatten out the response above at high frequencies is to move the transfer function zero of the ideal integrator that occurs at infinite frequency, down in frequency, as was described in the gradient loudspeaker description section earlier. The invention is not limited in the equalization that can be applied to the a D-Grad gradient loudspeaker at high frequencies.

The behavior of the applied equalization will need to deviate from that of an ideal integrator at low frequencies. The response of the ideal integrator discussed above has infinite gain at DC, which is not realizable. In practical applications, a low frequency limit below which the integrating response will not be needed can be determined. This frequency will depend on the intended application. This limit will be approximately 150 Hz for most applications, as was discussed in the psychoacoustic sections, although there is a sub woofer application that requires extension down to lower frequencies. There are also some applications, such as in a automotive application that is described in the application section, where the cut off frequency is considerably higher than 150 Hz.

Operation of Spatial Control

One embodiment of the spatial control operates by varying the delay of the crossfed signals applied to both array elements simultaneously. This is shown in FIG. 13*a*. The effect of varying the delay on an individual channel signal was described earlier. However, the situation becomes more complicated when the delay for both channels is varied at the same time. The radiation of sum (L+R) and difference (L−R) signals are also affected.

In the analysis of the D-Grad system given in the appendix, equation (43) (which is given above) was derived for the case where a sum signal is presented to the array and the low frequency approximation holds. This equation shows that the array output has a monopole radiation pattern with a level that is proportional to jω*d/c, where d is the value of delay used. It can be seen that the output of the array will be zero when the delay is set to zero. The left element receives the output of a summation of the left channel signal and the inverted and delayed right channel signal. When the left and right channel signals are equal and the delay is zero, these signals cancel and no signal is applied to the left element. The same thing occurs for the right element. The array elements do not receive any sum signal when the delay is zero.

The level of the sum signal radiated will increase as the delay is increased. This increasing output level does not increase without bound. The maximum output the array can have is twice the monopole output level. The proportionality given above is a low frequency approximation. The frequency range where the approximation is valid also depends on the value of the delay. As the value of d increases, the frequency range over which the approximation holds decreases. Also note that the delay does not have any effect on the radiation pattern of the sum signal at low frequencies. The array will radiate low frequency sum signals omni-directionally for all delay settings.

Equation (46) in the appendix (also given above) gives the results of the analysis of the D-Grad system where a difference signal is presented to the array. It shows that the array output has a dipole radiation pattern with a level that is proportional to jω*D/c, where D/2 is the value of element spacing. There is no dependence on the value of delay here. The spatial control (where delay is varied) has no effect on the difference signal radiation pattern or level. It does however have an effect on the frequency range over which the dipole radiation behavior is maintained. Larger values of delay reduce the frequency range of directivity pattern control.

The effect of varying the delay for the individual channel output level and radiation pattern can be seen in equation 23 and 25. As the delay goes to zero, the radiation pattern approaches a dipole (the D/d term becomes large compared to 1 in the terms in brackets). As the delay is increased, the radiation pattern changes. When the delay is equal to the time it takes for sound to travel the distance separating the array elements (d=D), the radiation pattern is cardioid. As the delay continues to increase, the radiation pattern approaches a monopole, but the frequency range over which directivity pattern control is maintained decreases. As was stated earlier in the discussion of single channel D-Grad gradient loudspeakers, adjustment of the radiation pattern between cardioid and monopole is better accomplished by adjusting the relative level of the delayed and non delayed element signals.

A level control to be used for adjusting the radiation pattern of a D-Grad gradient loudspeaker is included in FIGS. 13*a, b,* and *c*. The exact radiation pattern obtained from the complete system depends both on the relative element levels and the amount of delay used. It is difficult to obtain a simple closed form expression for this behavior. A spatial control that is a combination of variable delay and relative level control of the delayed and un-delayed signals can be used to adjust the radiation pattern of individual channels anywhere between omni-directional (monopole) and dipolar.

One interesting characteristic of using the level of the delayed signal as a spatial control occurs when the delayed signal is set to zero. In this condition, the array reverts to normal stereo operation (however the element spacing will tend to be rather small for a D-Grad array that is designed to maintain pattern control up to frequencies in the 1–2 Khz range). There are some applications where this may be useful.

Expressions were given above that describe system behavior at low frequencies. Complete expressions for system behavior at all frequencies were also given. The amount of delay used in the system has an effect on the frequency response of the system at low frequencies. The corner frequency $f_5$ described above in equation (28), below which the low frequency approximations hold, is inversely proportional to the amount of delay used. The corner frequency moves up in frequency as the delay is decreased and moves down in frequency as the delay is increased. The dependence of the efficiency at low frequencies on the delay d is also shown in equation (23). As the delay is increased, the efficiency at low frequencies increases, and as the delay is decreased the efficiency decreases. Increasing the delay reduces the frequency range where gradient behavior occurs, and increases the efficiency of the array in this reduced range.

If it is desired to have the overall response of the complete loudspeaker array be as flat as possible above the frequency where gradient behavior begins to deteriorate, then some type of variable equalization will be needed to compensate for the changes in system behavior as the delay is adjusted. It was mentioned earlier that the zero in the transfer function of the ideal integrator could be moved down to the frequency $f_s$ to flatten out the response. It can be seen from the above discussion that $f_s$ depends on the delay used. Therefore, the zero of the equalization must vary with the delay setting if flat response is to be maintained. One way to accomplish this is to use a voltage controlled filter in the equalizer with a variable zero location in its transfer function, where a control voltage that depends on the amount of delay is used to change the frequency of the transfer function zero. A block diagram is shown in FIGS. 13*a* and *c,* that includes a voltage controlled filter block for accomplishing this. The exact configuration of such a filter is not shown. It is assumed that those skilled in the art will be capable of synthesizing the voltage controlled filter and control voltage required. The variable filter is not limited to being implemented as a voltage controlled filter. Any method that changes the zero location of the filter as a function of the delay with the correct relationship can be used.

Other D-Grad Embodiments

Some other possible embodiments use the D-Grad principal with a three element array configuration. In one embodiment, the left element receives the left channel signal and the right element receives the right channel signal. The center element receives delayed left and delayed right channel signals that have been summed together and inverted. This arrangement would radiate left channel signals to the left and right channel signals to the right. The delay could be accomplished electrically or physically. Rotation of the radiation patterns can be accomplished with this embodiment by changing the physical orientation of the three elements so that they form a triangle.

Figure 9A:
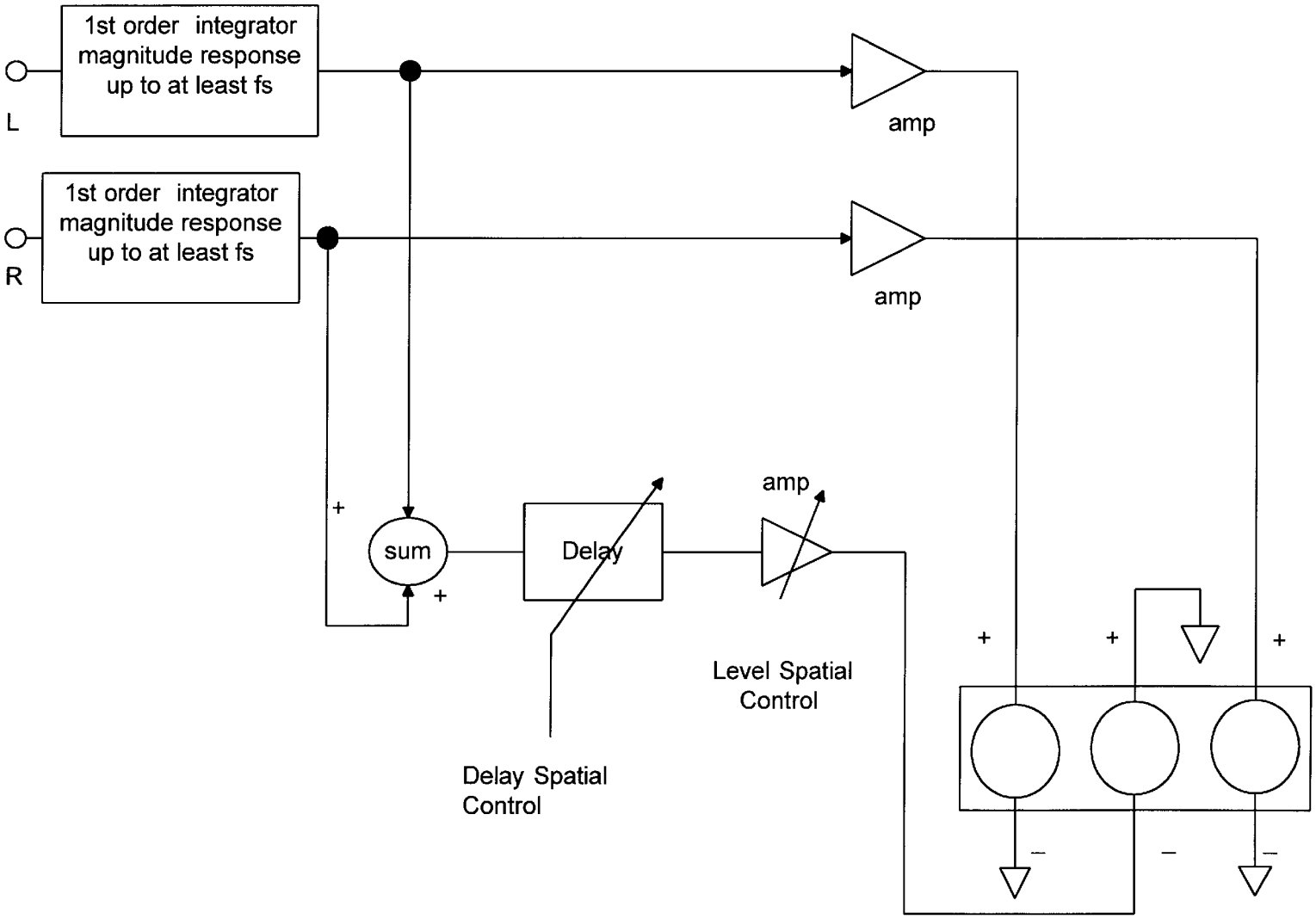
FIG. 9*a* shows a three element D-Grad SDR array configuration. The outputs of the left and right channel integrator equalizers feed a summer. The output of the summer passes through user variable delay and user variable level controls before being fed to the center array element with inverted polarity. The outputs of left and right channel integrator equalizers are fed to the left and right array elements.

Another three element array can be made by applying delay to the left and right elements with respect to the center element. The center element is fed the sum signal L+R. The left element is fed a delayed and inverted right channel signal. The right element is fed a delayed and inverted left channel signal. This configuration will radiate signals in the same directions as the three element embodiment described in the previous paragraph. The delay can be accomplished either electrically or physically. The three element, three amplifier configurations are shown in FIGS. 9*a,* and *b.* Configurations using physical delay are not shown. Rotation of the radiation patterns can be accomplished by changing the physical orientation of the individual array elements as was discussed in the previous paragraph.

Figure 9B:
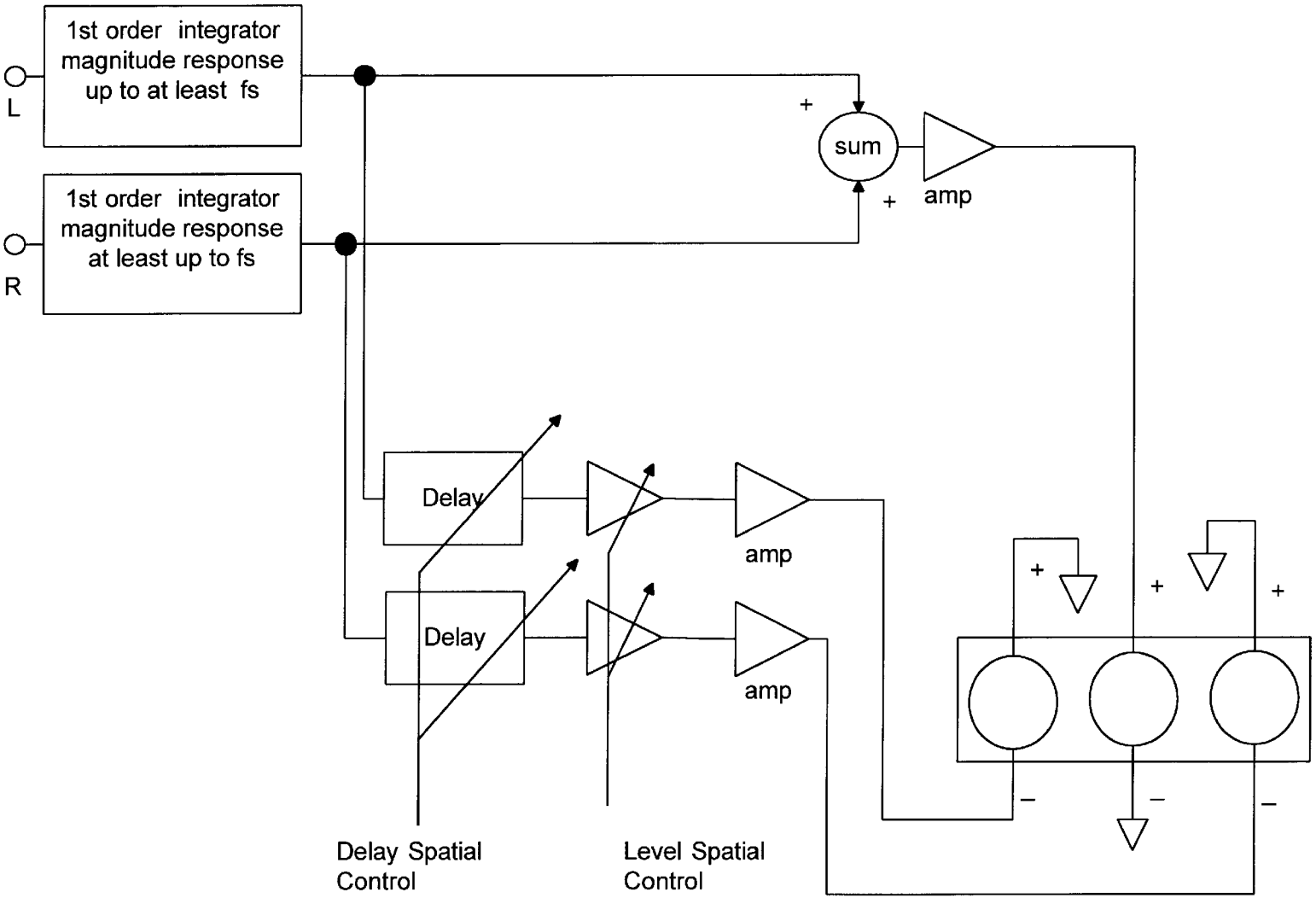
FIG. 9*b* shows a three element D-Grad SDR array configuration. The outputs of the left and right channel integrator equalizers feed a summer. The output of the summer is fed to the center element. The outputs of left and right channel integrator equalizers are also fed through user variable delay and user variable level controls before being fed to the to the left and right array elements with inverted polarity.

Spatial controls where the delay and/or relative levels of delayed and un-delayed signals are varied can also be applied to these embodiments. The signals applied to the outside elements could be reversed in any of the above three element configurations to reverse the directions in which the different channel signals are radiated. In FIG. 9*a*, a level control, which is used as part of a spatial control, is shown placed in the sum signal path. The level control could just as easily be placed in the individual channel signal paths. In FIG. 9*b*, the level controls are shown in the individual delayed signal paths signal path. They could just as easily be replaced by a single level control placed in the sum signal path.

The three element embodiments have degraded directivity pattern control as compared to the two element embodiments. The first order gradient loudspeakers radiating each channel signal are no longer exactly coincident in space. This will reduce the frequency range of directivity pattern control for sum and difference signals presented to the array. Sum and difference signals may exhibit comb filter effects starting lower in frequency than the preferred two element embodiment.

A four element embodiment is shown in FIG. 22. This embodiment uses a completely separate D-Grad array for each channel signal. The array transducers are all shown in the same enclosure, but this is only for convenience. They could be in separate enclosures where they could be separated in space, and/or rotated with respect to each other.

Yet another embodiment makes use of the single element D-Grad loudspeaker. A separate single element gradient loudspeaker is used to reproduce each signal of a stereo pair of signals. The operation of the single element gradient loudspeaker was described earlier, and is shown in FIG. 11*b*. It is difficult to provide a spatial control for this configuration, as the delay and level of delayed signal are no longer independently adjustable. These systems are more difficult to implement because of the effect the physical delay element has on the overall transducer frequency response. Also, the inverted and non-inverted signals are coupled through the diaphragm of the transducer. The acoustical load on either side of the transducer affects the response from both sides of the transducer. Using different transducers for the delayed and non delayed signals breaks this coupling and makes overall system design easier. The single element gradient loudspeaker based system will have less complexity in the electronics and potentially lower cost. A two channel system is shown in FIG. 11*a*.

Two Channel MD-Grad Array

The MD-Grad arrays combine the outputs from a monopole and a dipole source to create a first order gradient directivity characteristic. Different embodiments of single channel arrays were described earlier. Those individual channel arrays can be combined in numerous ways to form two channel arrays. The simplest configuration uses the same monopole and dipole elements for both signal channels. This is the preferred embodiment and will be discussed in detail shortly. There are numerous other possible embodiments. It should be noted that the invention is not limited to the form of the preferred embodiment where the same monopole and dipole elements are used for each signal channel.

The preferred MD-Grad embodiment uses a three loudspeaker element in line configuration where the two outside elements are used to form the dipole source and the center element is used as the monopole source. A preferred active configuration is shown in FIG. 15*a*.

A single transducer dipole where both sides of the transducer radiate into free space could be used in place of the two outside array elements that form the dipole. However, a two element dipole implementation is the form of the preferred embodiment because of the increased power handling possible, and because no structures are required in front of or behind the array transducers to effectively separate the inverted elements in space from each other. It should be noted that the invention is not limited in the manner in which the dipole element is constructed.

In the preferred MD-Grad embodiment of FIG. 15*a,* the fundamental signals used are the sum (L+R) and difference (L−R) signals. The difference signal is first obtained by subtracting the right channel signal from the left channel signal, processed by equalization circuits, and then presented to the two elements that form the dipole radiator. In one embodiment, the left most dipole element receives the processed L−R signal while the right most dipole element receives an inverted version of the processed L−R signal (an R−L signal). The R−L signal is obtained by connecting the L−R signal to the right array element speaker terminals with reversed polarity. Inverting the connection to one of the array elements allows the use of only two amplifier channels for the complete system. The sum signal is generated by summing together the left and right channel signals. It is then processed and sent to the center monopole element.

This three element loudspeaker array is capable of generating first order gradient directivity patterns where the first channel is radiated in one direction, along the line joining the centers of the array elements, and the second channel is simultaneously radiated in a 180° opposite direction. The signal processing provides the required equalization for a stereo pair of signals. The equalization shown is required to achieve the first order gradient radiation characteristic and a flat power response in the frequency range where directivity control is maintained. The complete behavior of the preferred MD-Grad embodiment is derived in the appendix.

Equations 57, 64, 79 and 83 from the appendix give the pressure response at low frequencies for the individual channel signals independently, as well as the response when sum and difference signals are applied to the array. The following equations describe the output of an MD-Grad array for the case where no equalization has been applied.

| | | |
|---|---|---|
| $P_1(r,\theta) = P_m(r) * [1 + (j\omega D/c) * \sin(\theta)]$ | (57) | (first channel signal) |
| $P_1(r,\theta) = P_m(r) * [1 - (j\omega D/c) * \sin(\theta)]$ | (64) | (second channel signal) |
| $P_{sum}(r,\theta) = P_m(r) * 2$ | (79) | (sum signal applied) |
| $P_{diff}(r,\theta) = 2 * P_m(r) * [(j\omega D)/c]* \sin(\theta)$ | (83) | (difference signal applied) |

In the above equations, $P_m(r)$ is the pressure response of an ideal monopole source (there is no θ dependence in the monopole response as a monopole radiates omnidirectionally), jω is the complex frequency variable, c is the speed of sound, D/2 is the array element spacing, and θ is the observation angle.

The above equations do not show first order gradient behavior. The first and second channel signal radiation patterns show a jω dependence on the sin (θ) term. The sin (θ) term represents the contribution from the dipole. The same jω dependence also shows up in the equation for difference signal radiation.

It can be seen that the equations can have first order gradient form and produce flat response at low frequencies if an equalizer were placed in the signal path of the dipole that has a A/jω characteristic. This is the form of an ideal integrator. The transfer function of an ideal integrator has a pole at zero frequency and a zero at infinite frequency. Equalization of this form for the dipole signal was discussed in the section describing a single MD-Grad directional loudspeaker. It can be seen here that the same form of equalization is used for the combined array.

The following equations, valid for low frequencies, result when the difference signal (which is applied to the dipole) is equalized with an equalizer having an A/jω response as described above.

| | | |
|---|---|---|
| $P_1(r,\theta) = P_m(r) * [1 + (AD/c) * \sin(\theta)]$ | (61a) | (first channel signal) |
| $P_1(r,\theta) = P_m(r) * [1 - (AD/c) * \sin(\theta)]$ | (66a) | (second channel signal) |
| $P_{sum}(r,\theta) = P_m(r) * 2$ | (79) | (sum signal applied) |
| $P_{diff}(r,\theta) = 2 * P_m(r) * [(A*D)/c] * \sin(\theta)$ | (83b) | (difference signal applied) |

It can clearly be seen that these equations have the same form as those derived earlier for the case of ideal first order gradient loudspeakers faced in 180° opposite directions, which is the form of the preferred embodiment.

The equalization that was described in the MD-Grad section for a single channel array is exactly the same equalization required here. In this case, the equalization for the dipole channel is applied to the difference signal (L−R). Equalization for the monopole signal is required when realizable (as opposed to ideal) equalization is used in the difference signal path.

The difference between a two channel MD-Grad system and a single channel MD-Grad loudspeaker is that the equalization is applied to the sum and difference signals, rather than to an individual channel signal. By using the sum and difference signals as the inputs to the equalization, the system will simultaneously radiate the left and right channels signals with first order gradient radiation patterns, where each channel is radiated in opposite directions. An example of the equalization required is described in the Prototype System section which is included later. Although the prototype system described actually uses a combination type embodiment, the form of the equalization used is virtually identical to the equalization that would be used for an MD-Grad embodiment.

We can summarize the overall equalization requirements for the equalized monopole and equalized dipole signals used in a two channel MD-Grad loudspeaker array as follows:

A) The magnitude response shape of the output of the monopole array element fed by its electrical equalization, and the magnitude response shape of the output of the dipole array elements fed by their electrical equalization must be matched over at least the frequency range where directivity control is desired. This range is typically between 150 Hz and 1–2 Khz, for embodiments other than sub woofers. Sub woofers require operation down to lower frequencies.

B) The phase response of the output of the monopole array element fed by its electrical equalization and the phase response of the output of the dipole array elements fed by their electrical equalization must either be in phase (have 0° of phase difference between the output of the monopole and dipole) or out of phase (have 180° of phase difference between the output of the monopole and dipole) over at least the frequency range where directivity control is desired. The relative phase (0° or 180°) is determined by the observation angle θ.

For the two channel MD-Grad case, the monopole signal is an equalized sum signal and the dipole signal is an equalized difference signal. Note that the relative level of the monopole and dipole elements is used as a spatial control (that will be described shortly) which the user can vary to alter the directivity of the array. Therefore, it is only necessary for the fixed equalization used to match magnitude response shapes between the monopole and dipole outputs, because the relative levels are controlled by the user.

The equalization used can consist of a combination of minimum phase and all pass filter sections (if needed), or it can consist of non-minimum phase filters, as long as the requirements above are met. It should be noted that the equalization required to meet the above conditions is not unique. Any form that meets the above requirements will be sufficient and is understood to be incorporated by this disclosure.

It is possible to provide a good match in the magnitudes of the monopole and dipole outputs up to the frequency where $D/\lambda >= 0.5$. The magnitudes will begin to deviate from each other above this frequency, where the deviation will differ depending on the angle of observation. It is possible to match the phase over a larger range, and this is desirable. The phase can be matched almost completely up to the frequency where $D=\lambda$. This was done in the prototype system that will developed and will be described later.

The following behavior is obtained by presenting the properly equalized sum and difference signals (in both magnitude and phase) to the array elements in the two channel MD-Grad array. When a left channel only signal is presented, a first order gradient radiation pattern that points to the left is obtained for any non zero monopole and dipole output condition. (This assumes the array is configured so that the left element receives an L−R signal and the right element receives an R−L signal. There are some applications where this may wish to be reversed.) When a right channel only signal is presented, the array will generate a first order gradient radiation pattern oriented in the opposite direction (directed to the right with the signals applied as above). When the left and right channel signals are equal, the two outside elements do not receive any signal (the difference signals L−R, R−L are zero when the two channel signals are equal). Therefore, only the center element will radiate. The radiation pattern is that of a single element. When the left and right channel signals are equal but inverted in polarity with respect to each other, the center element will not radiate any signal (L+R=0 for this condition). This difference signal will be radiated with a dipole radiation pattern where the null of the radiation pattern is directed toward the listener and the main radiation lobes are directed to the left and right of the array.

The radiation patterns deviate from the directional behavior described above at higher frequencies. The factors that influence this deviation are the relationship between the element spacing and the wavelength of sound at frequencies of interest, and the deviation from ideal monopole source behavior of the individual array elements. Additional lobes in the radiation pattern and comb filter effects in the frequency response begin to manifest themselves at higher frequencies. The complete expressions for the pressure response of the preferred MD-Grad array, for the cases of signal correlation of −1, 0, and +1, are derived in the appendix. (In the analysis in the appendix, the individual array elements are still assumed to be ideal monopoles.) The equations below give the response of the array at high frequencies with and without integrating equalization applied in the dipole signal path.

| | | |
|---|---|---|
| $P_1(r,\theta) = P_m(r) * [1+2j*\sin[(k*D)/2 * \sin(\theta)]]$ | (56) | (first channel signal) |
| $P_1(r\theta) = P_m(r) * [1+2(A/\omega)*\sin[(k*D)/2 * \sin(\theta)]]$ | (61b) | (first channel signal, equalized dipole) |
| $P_2(r,\theta) = P_m(r) * [1-2j*\sin[(k*D)/2 * \sin(\theta)]]$ | (63) | (second channel signal) |
| $P_2(r,\theta) = P_m(r) * [1-2(A/\omega)*\sin[(k*D)/2 * \sin(\theta)]]$ | (66b) | (second channel signal, equalized dipole) |
| $P_{sum}(r,\theta) = P_m(r) * 2$ | (79) | (sum signal applied) |
| $P_{sum}(r,\theta) = P_m(r) * 2$ | (79) | (sum signal applied, equalized dipole) |
| $P_{diff}(r,\theta) = 4jP_m(r) * \sin[(k*D)/2 * \sin(\theta)]$ | (82a) | (difference signal applied, no equalization) |
| $P_{diff}(r,\theta) = 4P_m(r) * (A/\omega) * \sin[k*D)/2 * \sin(\theta)]$ | (82b) | (difference signal applied, equalized dipole) |

Notice that comb filtering does not occurs for sum signals. This is opposed to the D-Grad case where comb filtering occurred for all signals. There is no comb filtering here because only one element is radiating. Comb filtering does show up in the radiated difference signal. This depends on the value of D and θ. The nature of the comb filtering can be seen to be different in this embodiment as opposed to that in the D-Grad embodiment (the frequencies of the maxima and minima are different). It can also be seen that additional lobes in the radiation pattern of the dipole show up at higher frequencies. At higher frequencies, k is large and the argument of the sin function in the square brackets will go through multiple rotations.

It is possible to reduce the comb filtering effects of the basic MD-Grad system at high frequencies. The methods described earlier in the gradient loudspeaker limitations section with respect to extending the frequency range of operation of a gradient loudspeaker will also reduce the effects of comb filtering of the MD-Grad array.

It is clear from the above discussion that there is a limit to the frequency range over which gradient radiation behavior occurs. There are some applications where the high frequency behavior of the ideal integrator (that was described in association with the low frequency approximation equations shown earlier) will be beneficial to use with a complete system. There are also applications where it will be desirable to flatten out the response of the equalizer above the frequency where the radiation behavior deviates from gradient behavior. One method that can be applied to flatten out the response above the corner frequency $f_s$ calculated in equation (67), is to move the transfer function zero of the ideal integrator that occurs at infinite frequency, down to the frequency $f_s$. It should be noted that the invention is not limited in the equalization that can be applied to an MD-Grad gradient loudspeaker at high frequencies. There may be applications where it is desirable to move the zero of the ideal integrator down to a frequency other than $f_s$.

It must be noted that the integrating equalization is applied here to the dipole signal. Obtaining gradient radiation behavior at low frequencies depends on maintaining particular relationships between the monopole and dipole source outputs. Altering the magnitude of the high frequency equalization (for frequencies above $f_s$) applied to the dipole will change the phase relationship between the monopole and dipole outputs at frequencies below $f_s$. This change in relative phase must be compensated for if gradient radiation behavior is to be maintained over as wide a frequency range as possible. This behavior is different from the behavior described for the D-Grad gradient loudspeaker, where the high frequency equalization did not affect the radiation behavior.

The relative phase of the monopole and dipole outputs can be altered arbitrarily by the use of all pass filters, where the filters can be placed in both the monopole and dipole signal paths. The all pass filters affect phase response without changing magnitude response. By adjusting the relative resonance frequency of the all pass filters, the filter orders, and filter Q's if second order filters are used, the relative phase between the monopole and dipole source outputs can be adjusted over a wide range. The use of complimentary all pass filters in the monopole and dipole signal paths can be used to restore the desired phase relationship between the monopole and dipole outputs when the dipole equalization is changed from an ideal integrating behavior. The use of complimentary all pass filters allows the relative phase response between the monopole and dipole source outputs to be adjusted independently of the relative magnitude responses. It should be noted that that a more general case is applicable, where non minimum phase filters (as opposed to all pass filters) are placed in both the monopole and dipole signal paths. These filters can simultaneously provide both the phase compensation described above along with magnitude response correction. The invention is not limited in the types of filter techniques used in order to achieve its desired magnitude and phase response characteristics.

In some applications, it may be desirable to move the zero frequency that is at infinite frequency for an ideal integrator down to some other frequency $f_n$, where $f_n$ is less than infinity and greater than $f_s$, without adding in the all pass filters to adjust the relative phase. This configuration will have a radiation behavior that deviates from ideal first order gradient at a lower frequency than would otherwise be desirable, but it will also have lower cost and complexity, and can provide sufficient performance in some applications.

The behavior of the applied equalization will need to deviate from that of an ideal integrator at low frequencies. The response of the ideal integrator discussed above has infinite gain at DC, which is not realizable. In practical applications, a low frequency limit below which the integrating response will not be needed can be determined. This frequency will depend on the intended application. This limit will be approximately 150 Hz for most applications, as was discussed in the psychoacoustic section, although there is a sub woofer application that requires extension down to lower frequencies. There are also some applications, such as in a automotive application that is described in the application section, where the cut off frequency is considerably higher than 150 Hz.

This implies that some form of high pass filter will need to be applied to the dipole signal path. In order to maintain the correct phase relationships between the monopole and dipole outputs, a compensating filter must be applied to the monopole signal path. This filter can either be the same high pass filter as was applied to the dipole path, or it could be an all pass filter that had the same phase response shape as the high pass filter used in the dipole path. This can be accomplished, for example, if a critically damped $2^{nd}$ order high pass filter were used in the dipole path and a first order all pass filter were used in the monopole signal path.

Again, it should be noted that the form of equalization used is not unique. Any equalization can be applied that gives rise to a system that maintains the desired magnitude and phase relationships between the monopole and dipole outputs.

Operation of Spatial Control

Adjustment of a spatial control can be used to vary the ratio of direct and reflected sound in the listening environment. The user can vary the system to accommodate different room characteristics as well as individual tastes. Variation of the relative level of the sum and difference signals applied respectively to the monopole and dipole are used as a spatial control. The preferred embodiment of a spatial control for a dual channel MD-Grad array will vary the gain of the difference signal. The effect of the spatial control on individual channel signals as well as sum and difference signals will be discussed.

Equations 61b and 66b given above show the output of the MD-Grad array for individual channel signals applied to the array at low frequencies, where the equalization needed for first order gradient behavior from the array is applied. The effect of the spatial control here is the same as was described for a single channel MD-Grad array earlier.

The effect of the gain A of the difference signal can clearly be seen. The value of A directly affects the radiation pattern of each individual channel signal. When A=0, the radiation pattern is a monopole. When A=c/D, the radiation pattern is cardioid. As A becomes large compared to one, the radiation pattern becomes a dipole.

Operation of the spatial control does not have any effect on the directivity patterns of the sum and difference signals radiated by the array. The expressions for the output of the array when sum and difference signals are applied were given previously in equations (79) and (83). It can be seen that the sum signal will always be radiated with the directivity characteristic of a single transducer element. The level of the difference signal has no effect on the sum signal radiated by the monopole element. The difference signal will be radiated with a dipole characteristic at low frequencies. The spatial control directly controls the level of difference signal radiated, but does not affect the radiation pattern.

The above behavior for the sum and difference signals is a desirable condition. The sum signal is always radiated exclusively by the center monopole element, so it will be localized to the array physical position under all conditions. One of the primary uses of the invention is for audio reproduction that accompanies video program material. Dialog is typically recorded equally in the left and right channels. The behavior of the MD-Grad array assures that dialog will be reproduced by the single center element. Localization of dialog will remain fixed to the array physical location, which will be centered either above or below the picture in its intended application with video.

The difference signal is always radiated with a dipole pattern which maximizes its spaciousness and minimizes its localizability for all settings of the spatial control. This is also beneficial when the system is used with video. Surround sound information is typically encoded in the difference between the left and right channel signals. This information should be radiated in a manner that creates a diffuse sound field so that it is difficult to localize. This is exactly what is done when it is radiated with a dipole radiation pattern by the array, where the null in the radiation pattern is directed in the main listening direction.

The spatial control used here has a different effect on the overall array frequency response than was the case for the D-Grad systems. In the D-Grad case, varying the delay, in effect, can be thought of as having a similar effect to varying the array element spacing. This is what caused the corner frequency $f_s$ to change as the delay was varied. The element spacing for MD-Grad systems remains constant as the spatial control is varied (the spatial control varies the overall level of the dipole, not the element spacing). The system will have the same general frequency response as the control is varied (only relative levels and directivity patterns will change). The frequency range over which directivity pattern control is maintained does not change as the spatial control is varied. This is a large benefit over the spatial control of D-Grad embodiments.

One other interesting behavior of this embodiment is that the system becomes monophonic (only the L+R signal is radiated) when the spatial control is adjusted so that the gain of the difference signal is zero. This will be one area where the MD-Grad embodiments differ from the D-Grad and some of the combination embodiments that will be discussed shortly.

It should be noted that a balance control could also be used as a spatial control that simultaneously varied the gain of the sum and difference signals in opposite directions (as opposed to the difference signal gain control discussed above). The invention is not limited in the method in which the relative gains between the sum and difference signals are adjusted.

Other MD-Grad Embodiments

There are other ways in which the MD-Grad principal can be used to obtain first order gradient radiation characteristics for two channels of program information simultaneously. Two separate directional loudspeakers could be combined that used completely independent transducer elements and electronics. Any of the possible MD-Grad embodiments can be used in any combination to form the two independent directional loudspeakers. The origins of the radiation patterns can be separated and/or rotated in space with respect to each other. Embodiments where completely independent directional loudspeakers are used for each channel have been mentioned previously. These embodiments also use the most array elements and largest number of independent amplification channels.

The preferred MD-Grad embodiment uses three elements, where the two outside elements are used to form the dipole, but other elements could be used for the dipole elements if desired. For example, the two leftmost (or rightmost) transducers could be used as the dipole, and the right (or left) element used as the monopole. The frequency range over which this embodiment would effectively control radiation would be less than the symmetrical arrangement of the preferred embodiment. There is no particular reason why this embodiment would be preferred over the preferred embodiment. These configurations are not directly shown, but it is assumed that they are incorporated by this disclosure.

Other embodiments are possible where two different dipoles are used with one monopole element. These embodiments could allow physical rotation of the main radiation directions of each individual channel. The dipoles could be arranged in an X pattern. One dipole would be fed equalized L and −L signals, the other dipole could be fed equalized −R and R signals. The monopole element would still receive an equalized L+R signal. This embodiment would rotate the main radiation directions of the individual channel signals by physical orientation of the array elements. Methods for rotating the radiation pattern of the individual channel signals will be discussed in more detail shortly. Again, this particular configuration is not shown explicitly. It is assumed that one skilled in the art would be capable of synthesizing such a system given the information already provided in this disclosure.

Another embodiment shares the same dipole elements between the two signal channels but uses separate monopole elements for each channel. One possible four element arrangement is shown in FIG. 16*a*. The dipole is fed an equalized L−R (and R−L) signal, as in the preferred embodiment, and the two monopole elements are fed an equalized L and an equalized R signal respectively. Another arrangement of a four channel configuration could rearrange the order of the signals presented to the array elements. All of the various combinations of this are not shown. In general, all of these four element configurations will have a reduced frequency range where directivity pattern control is maintained as compared to the preferred three element embodiment. It should also be noted that the embodiment in FIG. 16*a* uses three amplifier channels, rather than the two used in the preferred embodiment.

It is conceivable that other forms of an array using the MD-Grad principal could be developed. It is understood that those embodiments are encompassed by the present disclosure.

Two Channel Combination Array

Combination embodiments have characteristics that are similar to D-Grad and to MD-Grad embodiments. They can generally be though of as having an array element geometry similar to a D-Grad embodiment, and a signal processing topology similar to an MD-Grad embodiment. Complete mathematical descriptions of the operation of the combination embodiments is not necessary. It will be sufficient to compare the differences of these embodiments to the MD-Grad embodiment to fully understand the operation of these embodiments.

The first type of combination embodiment uses a two element configuration. Both of the array elements are used to form a dipole. At the same time, they are also both used as monopoles. The configuration works as follows and is shown in FIG. 17*c*.

A difference signal (L−R) and a sum signal (L+R) are generated from the left and right channel signal inputs. The difference signal will be equalized and fed to each array element with opposite polarity, thus forming a dipole. The sum signal will also be equalized. It is then summed with L−R and R−L (inverted L−R) signals. The left element receives the sum signal equalized by the monopole equalizer plus the L−R (difference) signal equalized by the dipole equalizer. The right element receives the sum signal equalized by the monopole equalizer plus the R−L (inverted difference) signal equalized by the dipole equalizer. The equalization applied is similar to what was done earlier for the preferred MD-Grad embodiment. The same requirements for the radiated magnitude and phase of the sum signal and difference signal (monopole and dipole signals) are required here as were required for the MD-Grad embodiment. The goals of the equalization, to match the magnitude response shapes of the monopole and dipole outputs and to achieve a relative phase of either 0° or 180° between the monopole and dipole outputs over as large a frequency range as possible, are the same as was described for the preferred MD-Grad array earlier.

A spatial control can be constructed for this system by controlling the relative level of the sum and difference signals. The behavior of this system and an MD-Grad embodiment are essentially identical at low frequencies. The spatial control functions as described earlier for the MD-Grad embodiment. It has the same affect on the radiation patterns of the individual channel, sum, and difference signals.

There is a performance penalty for the case where monophonic signals are to be radiated by the two element combination system above. The monophonic signal will be radiated by two sources displaced in space, which will cause comb filtering of the response at higher frequencies. This is opposed to the three element MD-Grad arrays where a single transducer is used for reproducing monophonic information, as was discussed earlier. The high frequency limit up to which directivity pattern control can be maintained by this combination array will be lower than the MD-Grad case, again because of the use of two separate monopole sources.

There is also a performance advantage to using this configuration. The majority of signal energy in most two channel recordings is included in the information that is common to both channels. This combination system will have twice the output capability for these common signals as compared to the MD-Grad embodiments, because of the use of both elements as monopoles. This embodiment also can use fewer array elements than the MD-Grad embodiments (where a two element dipole is used), and as a result will have lower cost.

Another two element combination embodiment is also possible. This embodiment operates on the L and R signals, and the difference signal L−R. The processing is similar to that described above, except that no sum signal is formed. Equalization is applied to the L−R signal as before. Equalization is also independently applied to the left and right channel signals. The equalization applied here is similar to what would have been applied to the sum signal of the previous embodiment. The left element receives the L signal equalized by the monopole equalizer plus the L−R (difference) signal equalized by the dipole equalizer. The right element receives the R signal equalized by the monopole equalizer plus the R−L (inverted difference) signal equalized by the dipole equalizer. The behavior of this embodiment will be similar to the combination embodiment described previously. This embodiment is shown in FIG. 17*d*.

The goals of the equalization used here are again essentially the same as those stated previously. In this case, since there will be an equalizer in the L signal path and the R signal path, as well as in the difference signal path, the goals are applied in a slightly different way. The magnitude response shapes of the output of the left array element fed the equalized left channel signal, and the output of both elements fed the equalized difference signals (L−R and R−L) should be matched, and the relative phase should be either 0° or 180° over as large a frequency range as possible. The same should be true for the case where the right element is fed an equalized right channel signal and both elements are fed equalized difference signals. The symmetry of the configuration will result in the equalization used in the left and right signal paths to be identical. This embodiment is a two channel combination of the second type of combination embodiment described in the section discussing individual gradient loudspeakers.

There are some differences in the way in which this embodiment functions that may be significant in certain applications. The individual directivity patterns for left and right channel signals will be slightly different. This is because in this embodiment when L signal only is present, the left element acts as a monopole element while the left and right elements act as a dipole. In the previous embodiment, both elements acted as monopoles, and as the dipole. This will slightly affect the symmetry of the radiation pattern. Another difference arises when the effect of the spatial control is studied. The spatial control used here is again the same as in the MD-Grad embodiment, where the relative levels of the monopole and dipole elements are varied. In this case, the easiest implementation is to vary the gain of the difference signal path. An interesting feature of this embodiment is that the system reverts to normal stereo when the spatial control is adjusted for minimum spaciousness (the difference signal is set to zero). In the previous combination embodiment, and in MD-Grad embodiments, the system became monophonic when the difference signal was set to zero. The reversion to normal stereo may be useful in some situations.

This embodiment is ideal for the case where the directivity of the individual array elements will be taken into account, or where the system will cross over to a wave type directional device at high frequencies, as was described in the section describing the high frequency limitations of gradient loudspeakers. The methods described involved either facing the array elements out to the sides of the array, or crossing over to high frequency directional devices that are faced out to the sides of the array. The signal processing was also modified to revert to normal L and R signals in the frequency range where wave type directional devices would be used for directivity control in place of gradient techniques.

The above combination embodiment can easily be made to provide this type of processing. The equalized difference signal can be rolled off at high frequencies before it is summed with the equalized left and right channel signals. This can be done most easily by exploiting the first order rolloff characteristic of the ideal integrator used as a starting point for dipole equalization. In this case, it is not necessary to move the zero of the transfer function away from infinity. In this way, at high frequencies, the left and right outputs of the SDR signal processing will be only left and right signals that are input to the SDR processing.

It may be necessary to roll off the difference signal output faster than the first order rolloff used above. In this case, an additional low pass filter can be placed in the difference signal path. In order to maintain the correct phase relationships over the frequency range where directivity pattern control is maintained, a filter with compensating phase response needs to be placed in the left and right (monopole) signal paths. For example, if a second order critically damped low pass filter is placed in the difference signal path, its phase response can be compensated by placing a first order all pass filter with the same cut off frequency in the left and right signal paths. The required processing is shown in FIG. 17*e*. FIG. 17*e* shows the array elements facing outward.

A crossover and additional tweeters are not shown in FIG. 17*e*. The inclusion of tweeters is a straightforward exercise for someone skilled in the art. There may be some type of crossover network required to split the output of the power amplifier between the low and high frequency devices for the cases where a tweeter is used. The overall effect of this network on the low frequency gradient behavior will need to be accounted for (it should not cause a problem, as the difference signal has been rolled off and there is no longer any gradient radiation behavior). Again, the stated requirements for the outputs of the monopole and dipole sources over the desired frequency range for the preferred MD-Grad embodiment still holds here.

Other System Embodiments

The D-Grad and combination embodiments show electrical summing and differencing before signals are applied to the array elements. It is also possible to perform this summing and differencing directly within the array transducers. Dual voice coil transducers can be used to sum signals where one signal is presented to the first voice coil and a second signal is presented to the second voice coil. These signals will sum electromagnetically. The only difference between summing here or in electronics is that the dual voice coil transducer frequency response will depend to some extent on the signals presented to each voice coil. The motor force generated depends on the total current flowing and the number of turns of wire in the voice coil(s) linked by the flux of the permanent magnet, as well as the strength of the permanent magnet. The number of turns of wire being used at one time depends on the signals at each coil. When signals are summed ahead of the transducer, the variation in motor force with applied signal does not occur.

Differencing can be accomplished by using a dual voice coil transducer and reversing the polarity of one of the voice coils, or it can be done by connecting a single voice coil across the left and right amplifier positive output terminals. Connection across the two amplifier positive terminals is a common method for wiring surround sound loudspeakers in a system, and will be discussed more in the applications section. Dual voice coil summing and differencing functions are not explicitly shown in this disclosure. These methods are known in the prior art and it is assumed that someone skilled in the art will be able to implement these summing and differencing methods where applicable.

It can be envisioned that many other system combinations can be formed from the various types of directional loudspeakers described in this disclosure. For example, no mention of systems has been made where one type of directional loudspeaker was used for reproduction of one signal channel and a different type of directional loudspeaker was used for a second channel. No further attempt will be made to describe all these possible combinations. However, it should be understood that all these potential combinations are encompassed by this disclosure.

A prototype two channel first combination type two way gradient loudspeaker SDR array was constructed. The equalization used in the system that was built is discussed in the prototype section. The following relationships were derived for a two way system where the crossover frequency between the low and high frequency arrays is $f_x$, the acoustic crossover between the low and high frequency sections is second order critically damped, and the polarity of the high frequency devices are reversed with respect to the low frequency devices. The following equalization is required to compensate for the use of a two way system as opposed to a full range system. This equalization is used in addition to the normal equalization used in the previously described embodiments (integrating type response) in order for the two way system to meet the overall A and B requirements for the output of the monopole and dipole sources that was first described for MD-Grad embodiments. This extra EQ is also applicable for the various combination embodiments. D-Grad embodiments will need different compensation, which is not developed here, but can easily be derived. The form of the compensating equalization will change depending on the characteristics of the acoustic crossover between the low and high frequency sections.

2-way System Compensation

A shelving network is required in the dipole signal path. It will have a complex pole pair with a Q=0.5 at the frequency:

$$f_p=(d1/d2)^{1/2}(f_x),$$

where d1 is the element spacing of the low frequency elements and d2 is the element spacing of the high frequency elements. The shelving network will have a complex zero pair with Q=0.5 at the frequency:

$$f_z=f_x$$

In addition, all pass filters will be needed in the monopole and dipole signal paths to compensate for the effects of the crossover and element spacing on the total system phase response. A first order all pass filter is required in the monopole signal path with the following corner frequency:

$$f_{map}=f_x*(d1/d2)^{1/2},$$

A first order all pass filter is required in the dipole signal path with the following corner frequency:

$$f_{dap}=f_x$$

The choice of the acoustic crossover frequency used is governed by the efficiency/bandwidth trade offs of the particular element spacing used. Larger woofer spacing increases low frequency efficiency, which lowers low frequency electrical boost requirements, but it also lowers the maximum frequency of directivity pattern control for the woofers. The crossover frequency is chosen so that the signal applied to the woofers is rolled off below the frequency where comb filter effects would begin to show up from the widely spaced woofer outputs. High frequencies are reproduced by the mid/tweeter array which has smaller element spacing and a correspondingly higher cutoff frequency for directivity pattern control.

Two Channel Arrays with Rotation of Main Radiation Axes

Methods were mentioned previously for rotating the main radiation axes of directional loudspeakers. The simplest way is to physically reposition the array elements. This requires that the array configuration be some form other than the form of the minimum hardware preferred embodiments. There are many possible ways to configure a system so that directional loudspeakers are physically oriented so that their main radiation axes are at a relative angle other than 180°. All of the different embodiments for generating gradient loudspeakers, as well as wave type loudspeakers, can be configured so that this is possible. The various possible arrangements will not be developed in any more detail here. Sufficient information has already been presented in this disclosure for someone skilled in the art to be able to construct a variety of such systems.

Another method of constructing a system where first order gradient radiation patterns could have their main radiation axes rotated with respect to each other was also discussed. This system allowed the rotation to be accomplished electrically rather than physically. The system consisted of the combination of a first order gradient loudspeaker and a dipole loudspeaker, where the main radiation axes of the first order gradient speaker and the dipole speaker are perpendicular to each other. Any form of first order gradient loudspeaker can be used here. Any form of dipole loudspeaker can be used here as well. This configuration is actually a superset of the MD-Grad embodiment. When the first order gradient loudspeaker of this rotating configuration is set to be a monopole, the system becomes the same as the MD-Grad embodiment. This embodiment is shown in FIGS. 10*a* and *b,* where an MD-Grad directional loudspeaker is used as the first order gradient loudspeaker.

The basic signal processing of this rotation system applies the L+R signal to the first order gradient loudspeaker and the L−R signal to the dipole. The first order gradient loudspeaker is equalized so that it has a flat response over the frequency range where its directivity pattern is controlled. The dipole is also equalized so that it maintains flat frequency response over the same frequency range. In addition, the relative phase response is adjusted so that when the first order gradient loudspeaker is set to monopole radiation, the same phase relationships described for the MD-Grad system between the monopole and dipole outputs are generated here between the dipole and the first order gradient speaker.

The main radiation axes of the first and second channel signals will be rotated as the radiation pattern of the first order gradient loudspeaker is adjusted. The relative level of the dipole and the first order gradient loudspeaker will vary the overall radiation pattern of the first and second channel signals. This rotation embodiment, where the directivity pattern of the first order gradient loudspeaker and the relative level of the first order gradient loudspeaker and the perpendicularly oriented dipole are user controllable, has the same amount of control over the shape of the first and second channel radiation patterns as is exhibited by the other system configurations, in addition to being able to rotate the main radiation directions. The relative level of the dipole and first order gradient speaker in this configuration is used as a space control, as was done for MD-Grad and combination embodiments previously described.

This rotation embodiment has more extensive hardware requirements than any of the preferred SDR embodiments. The first order gradient loudspeaker uses two separate amplifier channels, and a minimum of two transducers (if it is constructed from a D-Grad or combination gradient loudspeaker). The dipole element also requires its own amplifier. The dipole at a minimum uses one additional transducer, so that the minimum number of transducers for a rotation embodiment is three, although a two element dipole is preferred. In addition, more equalization is needed. Equalization is required in each amplifier channel for the first order gradient speaker, and equalization is needed for the dipole as well.

Prototype Systems

A 2 channel prototype SDR system using 2 element combination type gradient loudspeakers was constructed. The prototype used two 3" full range dynamic moving coil transducers as array elements. Element spacing was set up to be 3.5" center to center. Each element was used in a vented enclosure of approximately 120 in$^3$. Port tuning was 110 Hz. A single enclosure housed the complete loudspeaker array. The enclosure had external dimensions of 15.75" wide by 4.5" high by 5.75" deep, and was internally divided into two separate chambers. The elements were arrayed horizontally and all elements were facing forward. The ports were spaced 0.4 m apart, and exited out the sides of the enclosure. The element spacing was calculated to achieve array pattern control over the frequency range of approximately 150 Hz to 1.5 Khz.

FIG. 17*c* shows the signal processing block diagram for the prototype system. The table shown below gives the equalizer singularities used for the prototype. An ideal integrator is used in the dipole signal path, and a second order high pass filter is placed in both the dipole and monopole signal paths. The singularities shown for the dipole path take into account the fact that an ideal integrator has a pole at zero frequency, and a second order high pass filter has a pair of zeroes at zero frequency. One of these zeroes cancels with the pole of the integrator to give the resulting singularities shown for the dipole path. The purpose of the second order high pass filter in the dipole signal path is to limit the low frequency signal applied to the dipole elements. It was stated previously that the ideal integrator has infinite gain at DC, which is not practically realizable. The use of the high pass filter eliminates the need for this behavior. It should be noted that any order high pass filter (lower or higher) could be used. Higher order filters require additional circuitry to implement, but may be desirable in some circumstances. They may also require different compensation circuitry to be placed in the monopole signal path.

A first order all pass filter is placed in the monopole signal path. In this case, the high pass filter used in the dipole path critically damped second order. The corner frequency of the all pass filter is chosen so that the phase response of the all pass filter will match the phase response of the high pass filter.

The singularities listed in the table below have a frequency and a Q. A singularity is first order (or real) if no Q value is present. A singularity is second order (a complex pair of singularities) if a Q value exists.

TABLE 1

| Monopole Element EQ | | | Dipole Element EQ | | |
|---|---|---|---|---|---|
| | Frequency (Hz) | Q | | Frequency (Hz) | Q |
| Poles | | | Poles | | |
| p1 | 220 | | p1 | 220 | |
| p2 | | | p2 | 220 | |
| Zeroes | | | Zeroes | | |
| z1 | −220 | | z1 | 0 | |
| z2 | | | z2 | infinity | |

The monopole signal path of the prototype system does not show any magnitude response equalization. This type of configuration is well suited to be used full range, without a separate sub woofer. In this case, the monopole sources also reproduced bass information. In an MD-Grad or a first type combination system, this would imply that only a monophonic signal was available below 150 Hz. This is not of great concern, as it is currently common practice to use sub woofers that sum left and right channel signals to mono over their operating range, which usually extends up the 150 Hz cutoff of the dipole signal used here. The loss of stereo information below 150 Hz that occurs with the above embodiment where the difference signal is rolled off, also occurs with typical sub woofer systems.

The above system could easily be used with a separate powered sub woofer as well. In this case, additional high pass filtering would be applied to the complete system. These filters could be located ahead of the SDR signal processing, after the SDR signal processing, or directly incorporated in the SDR processing. In the last scenario, separate high pass filters would be placed in both the monopole and dipole signal paths.

The above SDR array maintains equal magnitude response shape between the outputs of the monopole and dipole sources from approximately 150 Hz up to 1 Khz, even though the singularities are located at 220 Hz. This is due to the way the complete system, with port spacing larger than transducer spacing, behaves. The increased spacing at low frequencies increases the efficiency of the dipole at low frequencies. The extra efficiency is compensated by the extra roll off included in the dipole signal path.

Above approximately 1 Khz, the two array elements that form the monopole start to deviate from ideal monopole radiation behavior. The equalization maintains the relative output phase between the monopole and dipole at either 0° or 180° (depending on the observation angle) from below the cut off frequency up to approximately 1.8 Khz. The system is able to maintain acceptable directivity pattern control up to approximately 1.5 Khz.

FIG. 14*a* shows the directivity patterns of a computer model of the combination array described above, where a right channel only signal is presented to the array. The array model has been adjusted to achieve a cardioid directivity pattern at low frequencies. The polar curves show the directivity pattern of the monopole element, the dipole element, and the total array.

It should be noted that the directivity curves shown were generated from a computer simulation of a real system, not actual measurements. Actual measurements were made that confirmed the prediction of the computer model. The simulation assumes that the array elements are ideal monopole sources (each element radiates omni-directionally at all frequencies). The actual low frequency lumped element behavior for the elements and enclosures described above was included in the model. Ideal monopole radiation behavior was assumed at high frequencies for the individual elements.

Real elements will deviate from ideal behavior at higher frequencies where the wavelength of sound becomes comparable to the dimensions of the radiating surface of the element. This deviation from ideal behavior does not come into play until approximately $k*a=2$, where $k=\omega/c$, $\omega$ is the radian frequency and is equal to $2\pi f$, c is the speed of sound and a is the radius of the transducer element. This translates to a maximum frequency f=1.7 Khz, up to which the ideal monopole radiation approximation holds for the 3" transducers used as array elements. This also happens to approximately be the highest frequency where radiation pattern control needs to be maintained by the array, as was discussed in the psychoacoustics section. Therefore, the computer analysis using ideal monopole element behavior provides a reasonable approximation to actual behavior of real elements in the primary frequency range of interest.

A second two channel SDR prototype system has been constructed. This system uses a first combination type gradient loudspeaker form. It is configured as a two way system. The low frequency array uses 5 ¼" woofers in 450 $in^3$ enclosures that are ported at 50 Hz. The woofers are spaced 17" apart, the ports are spaced 27" apart. The high frequency array uses 2 ½" mid/tweeter transducers in 60 $in^3$ sealed enclosures, where the mid/tweeters are spaced 4" apart.

FIG. 17*f* shows the signal processing block diagram for this prototype system. The table shown below gives the equalizer singularities used for the prototype.

TABLE 2

| Monopole Element EQ | | | Dipole Element EQ | | |
|---|---|---|---|---|---|
| | Frequency (Hz) | Q | | Frequency (Hz) | Q |
| Poles | | | Poles | | |
| p1 | 100 | .5 | p1 | 100 | |
| p2 | 928 | | p2 | 100 | |
| | | | p3 | 450 | |
| | | | p4 | 928 | |
| | | | p5 | 100 | |
| | | | p6 | 100 | |
| Zeroes | | | Zeroes | | |
| z1 | −100 | .5 | z1 | 0 | |
| z2 | −928 | | z2 | infinity | |
| | | | z3 | −450 | |
| | | | z4 | 450 | |
| | | | z5 | 0 | |
| | | | z6 | 0 | |

The acoustic crossover of the system is at 450 Hz, and is designed to be critically damped. The frequency of the different singularities required to compensate for the crossover behavior are calculated using the equations given earlier. The singularities for the electrical filters used in the crossover networks are not shown.

The above equalization has the following behavior. Singularities p1, p2, z1, and z2 in the dipole path provide the dipole part of the basic SDR EQ function. These singularities work in conduction with one half of the second order all pass filter formed by p1 and z1 in the monopole path. Singularities p5, p6, z5, and z6 in the dipole path form an additional second order critically damped high pass filter. This filter is used to limit the low frequency signal boost applied in the dipole signal path. The phase response of this filter is compensated for by the second half of the second order all pass filter formed by p1 and z1 of the monopole path EQ. Singularities p3, z3, p4, and z4 of the dipole path EQ are required to compensate for the crossover behavior and the element spacing difference between the woofer and mid/tweeter transducers. Singularities p3 and z3 of the dipole path form a first order all pass filter at 450 Hz, and p4 and z4 form a second order critically damped high pass shelving filter. Singularities p2 and z2 of the monopole path form a first order all pass filter at 928 Hz, which is the other part of the required compensation for the crossover behavior.

It should be noted that crossovers of forms other than $2^{nd}$ order critically damped can be used in a two way SDR system. There is no fundamental limitation on the characteristics of the acoustic crossover response used in multi-way SDR systems. However, some crossover forms are easier to implement and require less compensation hardware than others.

The two way system described is designed to operate as a full range system. The system can be used with a separate sub woofer if desired, but there is no requirement to do so.

The above two way SDR array maintains equal magnitude response shape between the outputs of the monopole and dipole sources from below 50 Hz up to approximately 1 Khz. This is due to the way the complete system, with port spacing larger than transducer spacing, and woofer spacing larger than midrange spacing behaves. The increased spacing at low frequencies increases the efficiency of the dipole at low frequencies. The extra efficiency is compensated by the shelving filter included in the dipole signal path. The above processing maintains the desired phase relationship between the monopole and dipole source outputs up to approximately 1.7 Khz.

Above approximately 1 Khz, the two high frequency array elements that are operating as monopoles start to deviate from ideal monopole radiation behavior. The equalization maintains the relative output phase between the monopole and dipole at either 0° or 180° (depending on the observation angle) from below the cut off frequency up to approximately 1.8 Khz. The system is able to maintain acceptable directivity pattern control up to approximately 1.5 Khz.

FIG. 14*b* shows the directivity patterns of a computer model of the two way combination array described above, where a right channel only signal is presented to the array. The array model has been adjusted to achieve a cardioid directivity pattern at low frequencies. The polar curves show the directivity pattern of the monopole element, the dipole element, and the total array.

It can be seen in the directivity patterns of FIGS. 14*a* and *b* that the first prototype array maintains radiation control up to a slightly higher frequency than the second array. The element spacing of the high frequency array transducers in the two way system is actually slightly larger that the element spacing of the first prototype. The spacing chosen for these transducers had other geometrical restrictions not related to SDR performance that required this spacing.

Applications

Stereo systems

An SDR array can be used to generate a single point stereo system. A single array located in the center of a room can be set up to radiate left channel material to the left of the array and right channel material to the right of the array. The left channel information reflects off the left side wall of the listening room and generates a real acoustic sound source located at the left wall. The same is simultaneously achieved for the right channel. Monophonic program information is radiated directly from the location of the array, and difference information is radiated out to both sides, and not directly in front of or behind the array. The system can replace conventional two speaker stereo systems. One possible system could consist of an array that covers the frequency range from 150 Hz on up. A subwoofer can be provided to cover the low frequency range. Other configurations are also possible to obtain full frequency range coverage. An SDR array can also be designed to reproduce full range signals, but only maintain its directivity pattern control down to approximately 150 Hz.

Virtually any of the possible SDR array configurations previously described can be used as a single point stereo system. If an MD-Grad or combination system is used where an L+R signal is generated, this same signal can be used to drive the subwoofer. Subwoofers are commonly driven by the sum signal. A sum signal for low frequencies can easily be generated for use with D-Grad embodiments as well.

Another stereo embodiment uses a stereo pair of SDR arrays together. Mirror image pairs are not required. The exact same signals are applied to each array. One stereo arrangement of SDR arrays is shown in FIG. 24*a*. (Although the array shown is a three element array, any type of SDR array can be used in a stereo configuration like the one shown.) The left array is oriented to radiate left channel signal to the right of the array and right channel signal to the left. The right array has the same orientation. An individual sitting in the middle between the two arrays will hear direct left channel signal from the left array and direct right channel signal from the right array. At the same time, the left array radiates right channel signal out to the left to reflect off the left wall and the right array radiates left channel signal out to the right of the array to reflect off the right wall. These reflected signals arrive after the direct left and right channel arrivals from the left and right arrays. The system, by radiating the opposite channel signals to reflect off the side walls, generates significant lateral reflection energy. This considerably increases the sense of spaciousness generated by the system over what is possible from a conventional stereo pair of loudspeakers. This system configuration may also benefit more from the methods described to increase the frequency range over which directivity pattern control is maintained. Increasing the frequency range over which directivity pattern control is maintained will improve stereo separation while increasing the lateral reflection energy generated.

As a listener moves from being centered between the two arrays toward the left array, the level of right channel signal radiated by the right array will increase and the level of left channel signal radiated by the left array will decrease, due to the directivity patterns generated by the arrays for each channel signal. This behavior provides time intensity trading which acts to keep the stereo image centered between the speaker arrays for off axis listeners. This behavior continues until the listener moves outside the physical location of one of the arrays. This is an improvement over traditional stereo systems where the stereo image collapses to the near loudspeaker as a listener moves off the centerline between the two speakers.

Information that is equally recorded in each channel will be radiated simultaneously by both arrays. There will be a phantom center image created, the same as occurs in standard stereo configurations. Difference signal information will be radiated by each array with a dipole radiation pattern. The two dipoles will be displaced in space. The listener will not be directly on axis to the null in each pattern in the preferred embodiment, but direct sound energy will still be reduced from that radiated out to the sides. This situation improves as the two stereo speakers are mover closer together. The difference signal information will still be radiated in a manner that creates a diffuse field which is desired for this information.

Another possible arrangement of a stereo pair of arrays is shown in FIG. 24*b*. This array configuration will have increased stereo separation as compared to the arrangement of FIG. 24*a*, while still generating a significant level of opposite channel reflected energy. This arrangement would benefit from having the arrays moved outward from the front wall to increase the time delay of the arrival at the listening position of the first reflections of the opposite channel signals off the front wall.

The use of SDR arrays in the configurations described has an another benefit. The direct sound arriving from each array can be radiated with a narrow radiation pattern. The left channel signal is directly radiated from the left array to the listening position, while the left channel signal radiated in other directions from the left array will be reduced from that of a conventional direct radiator loudspeaker. This means that less left channel energy from the left array will reflect off the floor, ceiling, or wall behind the array than would otherwise be reflected off those surfaces. The reduction in level of these early reflections will reduce the coloration of the signal heard. The narrow directional radiation pattern reduces the dependency of the perceived sound quality of the loudspeaker on the characteristics of the listening room. It has been shown in the literature that early reflections affect the perceived timbre of a system and are a primary source of coloration. Reducing the level of the early reflections will reduce the coloration perceived. The reflections that do come from the walls behind the arrays are opposite channel signals. They will be coming from a different direction than will be the direct sound, and if the arrays are moved sufficiently away from the walls behind them, these reflections will arrive late enough that they will have less effect on timbre, and more effect on the sense of spaciousness created.

Home Theater

An SDR array is particularly well suited for use in reproducing sound that accompanies video material due to the way in which audio channels are processed for accompaniment with video. FIG. 19 shows a diagram of the signal processing commonly done to video sound tracks. Sound mixers usually work with a four channel system when the video sound tracks are created. These four channels (Left, Center, Right, and Surround) are then matrixed down to two channels for transmission (on the film print distributed to movie theaters, on the VCR tapes and laser discs of movies made available to the public, and for stereo broadcast). These two channels are shown as Lt and Rt in FIG. 19. As can be seen in the figure, the encoding passes left and right channel signals straight through to the Lt and Rt signals. Center channel signals are reduced by 3 dB and then summed into the Lt and Rt signals. The center channel signal is encoded as a sum signal. The 3 dB attenuation is used to maintain constant signal power. Surround channels are also attenuated by 3 dB and summed into the Lt and Rt channels. However, before being summed, the surround signal is split in two and these signals are phase shifted by + and −90° respectively. One signal is then summed into the Lt signal and the other is summed into the Rt signal. The phase shift acts to encode the surround signal in the difference between the Lt and Rt signals. These are key points. The center channel signal is encoded in the sum signal and the surround signal is encoded in the difference signal.

All prior art systems attempt to split these two stereo signals (Lt and Rt) back out into four independent signals electrically. These signals are decoded by special electronic equipment that attempts to regenerate the four original channels. All of these current decoding systems assume that the loudspeakers used to reproduce the signals behave like monopole sources, and are spaced far enough apart that they do not interact. The relative spacing of different loudspeaker elements is not taken into account in any way. This is a key difference between other prior art systems and the current invention. The current invention, by controlling the interaction in a specific way, creates additional degrees of freedom in the overall system design that can be used improve the decoding of the signals over what prior art systems are capable of.

In prior art home theater systems, the Lt and Rt signals are decoded electrically by equipment designed specifically for this purpose. One common system used is called Dolby Surround. Dolby surround sends the Lt signal to the left speaker of a stereo pair and the Rt signal to the right speaker of a stereo pair. A surround signal is generated by subtracting the Rt signal from the Lt signal. This signal is filtered and delayed by approximately 20 msec. It is then sent to separate surround loudspeakers placed in the back of the listening space. The center channel signal appears as a phantom image spaced between the front left and right speakers. This image only remains centered for a listener that is centered with respect to the left and right speakers. The image shifts to the near speaker as a listener moves off axis. Another version of Dolby Surround sums the Lt and Rt signals together to create a fourth signal, and makes this signal available to a separate speaker which is typically centered between the two front stereo speakers. This is only of marginal help in keeping center channel information centered in the listening space. The information contained in the center channel signal is also present in the left and right speaker signals, and is only 3 dB lower in the left and right speakers than it is in the center channel signal. This is not sufficient to guarantee that center channel information will be localized to the center speaker for off axis listeners. This condition points out a fundamental problem with existing passive electrical decoding schemes. It is only possible to achieve 3 dB of channel separation between adjacent channels using passive electrical decoding means.

This channel separation problem was the reason that a new decoding scheme was introduced into the market by Dolby Laboratories called Dolby Pro Logic. This system uses active steering logic in an attempt to increase the apparent separation between the adjacent channels. The system works by using signal processing to determine a "direction vector" that points in the main direction from which sound should appear to be coming from. The system uses this information to attempt to increase the separation between the main direction channel and its adjacent channels. The system does this by subtracting the main direction channel signal from the channels adjacent to the main direction channel.

An example will illustrate the operation of the system. If the direction vector is pointing to the left channel, for example, then some left channel signal information will be subtracted from the center and surround channels (these are the adjacent channels to the left channel). The increase in apparent separation achieved is a dynamically changing quantity. It varies as the direction vector varies. The increase in adjacent channel separation is not constant. Also, the increase in the adjacent channel separation tends to reduce stereo separation (opposite channel separation is reduced when adjacent channel separation is increased). For example, assume that there is dialog and music in the center channel and the direction vector is pointing at the center channel. This means that center channel signal will be subtracted from the left and right channels. However, the center channel signal contains information that is in both the left and right channels. The subtraction will be adding some inverted right channel signal into the left channel and inverted left channel signal into the right channel. The channel separation between the center channel and its adjacent left and right channels is increased but the stereo separation between the left and right channels is reduced. These active steering logic systems are capable of having only one dominant direction decoded at a time.

The array of the current invention achieves a significant increase in adjacent channel separation without sacrificing stereo (or opposite channel) separation. It also maintains this separation continuously. The separation achieved is not a dynamically varying quantity. Strong images that are located to the left, in the center, and to the right can be maintained simultaneously. Surround information is radiated diffusely and will not generate strong localization cues. This decoding is accomplished with considerably less circuitry and hardware. Only two amplifier channels are required and the signal processing can be implemented using simple linear filtering.

As has been described earlier, the array of the current invention can be set up to radiate left channel signals to the left of the array and right channel signals to the right. It is difficult to quantify the degree of separation actually achieved as it relies on human perception. To first order, for a listener sitting on axis to the array, left channel signals directly radiated will be 6 dB less than left channel signals radiated in the direction of maximum radiation when the radiation pattern of the array is adjusted to be cardioid. There is 6 dB of adjacent channel separation, vs. 3 dB of separation using other passive decoding means. This can be increased further at the expense of radiating some energy in the direction of the opposite channel. A hyper-cardioid pattern has approximately a 9 dB difference between sound radiated at right angles to the array vs. sound radiated in the direction of maximum radiation. Higher order gradient loudspeakers are capable of significantly larger differences between the level of signal radiated in the main radiation direction and the main listening direction (90 degrees off axis to the main radiation direction in this application).

Sum signals are radiated omni-directionally and will be localized to the array physical position for all listening positions throughout the listening space. Dialog information is usually encoded in the sum signal. Therefore, dialog information will be localized to the array location. The array is designed to be placed as close to the video display as possible. It can be incorporated directly in a TV set or it can be placed above or below the TV. Dialog will be localized to the screen location, which is what is desired.

Difference signals will be radiated with a dipole radiation pattern and will have a diffuse image quality. The null of the dipole radiation pattern faces the listening location. The maximum radiation of the dipole is to the sides of the array. This energy will reflect off the side walls of the listening space before arriving at the listening location, thus generating a diffuse and spacious sound field. The surround channel information is encoded in the difference signal and will therefore be radiated diffusely. This is exactly what is desired for the surround channel. It should not be possible to easily localize surround channel signals. The intent of the surround channel is to provide a sense of envelopment and spaciousness without providing localization cues to the source of sound.

The above discussion assumes that the directional loudspeakers used in the SDR array are of the first order gradient type at low frequencies. A home theater system is also possible using other types of directional loudspeakers (wave type for example) as well. The difference between radiation on the main radiation axis of the directional speaker and radiation to the listening area will depend on the exact characteristics of the directional speaker. The behavior of the SDR based home theater system, for sum and difference signals when wave type directional devices are used, will be similar to that described for gradient loudspeakers.

The three element MD-Grad embodiment is particularly well suited to use in Home Theater applications, although any of the SDR embodiments will work acceptably. This configuration operates directly on the sum and difference signals. Sum signals are radiated solely by the center element of the MD-Grad array. The center channel signal in video sound tracks is encoded as a sum signal. There will be no comb filtering effects in the sum signal radiated by the MD-Grad array that could cause coloration of the sum signal. This is important as the center channel (L+R) signal is primarily used for dialog, and the human hearing system is adept at detecting these comb filter effects when superimposed on speech signals. The sum signal will also be radiated with the directivity of the center element of the MD-Grad array. The sum signal will be localized to the physical position of the array. It should be noted that the MD-Grad embodiment will be higher cost than some of the other embodiments described, as it uses three array elements, whereas the D-Grad and combination embodiments can function using only two array elements.

An SDR array, used with some device to generate bass frequencies, is capable of acting as a complete home theater system on its own. All of the relevant signals are decoded and distributed correctly out in space. The only difference between this home theater system and existing state of the art systems is that this system will not be capable of generating sounds that originate behind the listener. However, since the difference signal is readily available (it is directly available in MD-Grad embodiments, and is easily obtained by connecting across the two positive amplifier terminals for D-Grad and combination embodiments) and the surround channel information of video sound tracks is encoded in the difference signal, the difference signal can be sent to additional surround loudspeakers that can be located in the back of the listening space, to provide a rear image for surround channel information.

A separate signal path can be created where the difference signal is filtered and delayed as is current practice for surround signals. This signal can then be fed to a separate amplifier to drive surround speakers placed in the rear of the room. The level of these speakers can be adjusted to give a general feeling of sound coming from behind without being high enough in level so that they are localized on. This separate amplifier configuration is not required, however. The surround speakers can be connected directly to the difference signal supplied to the dipole elements for MD-Grad embodiments, or across the two positive amplifier terminals of D-Grad and combination embodiments to obtain surround sound, while still using only two stereo amplifiers. The only drawback to this is that it will not be possible to add a time delay in the signal path of the surround speakers. This is not of large concern, as the improvements in system performance from adding a time delay are subtle.

The combination of the SDR array in front along with rear surround speakers will be capable of generating rear surround images when necessary to the same extent as existing prior art systems. The combination of the SDR array and rear surround speakers will exceed prior art systems in its ability to generate a sense of spaciousness and envelopment. The SDR array in the front of the listening area also radiates the difference signal which contains surround information. The difference signal is radiated with a dipole radiation pattern with the main radiation directed to reflect off the left and right walls of the listening room. These reflections are a significant source of lateral reflections which have been shown to be correlated with the perceived sense of spaciousness. This additional lateral reflected energy is not present in prior art systems that follow Dolby guidelines. This extra radiation of surround information increases the spaciousness of the overall system.

FIG. 18*a* shows an example Home Theater system setup using an MD-Grad array and a single rear dipole surround loudspeaker, where the rear surround speaker is connected to the output of the difference signal amplifier. Any of the possible SDR embodiments could also work in this application. It should be understood that the use of an MD-Grad array in the diagrams and discussion is one example of many possible configurations using any type of SDR array.

The L−R signal has been equalized with a response at low frequencies that is the magnitude difference between the monopole and dipole outputs of the front SDR array. The equalization is constructed so that the power response of the SDR dipole is flat over the frequency range where radiation pattern control is maintained (this assumes that the output of the monopole is flat over this frequency range, which is generally desirable). The rear surround speaker should be designed with this frequency response in mind. The rear surround speaker should have a power response at low frequencies that is the inverse of the difference channel equalization. One convenient way to do this is to use a rear surround speaker that has a dipole radiation pattern. A rear surround dipole speaker is shown in FIG. 18*a*.

The element spacing of the rear dipole surround speaker can be chosen to be the same as was used for the dipole elements of the SDR array. The equalization applied to the L−R signal will then have the correct response shape to provide a flat acoustic response when connected to the surround speaker. It should be noted that a dipole radiation pattern is a very beneficial characteristic for the rear surround speaker to have. The null of the radiation pattern of the rear dipole speaker is faced into the listening area. The use of a rear surround speaker that is a dipole will generate a much more diffuse sound field than would be generated by the use of conventional direct radiator surround speakers. It is also very convenient, as the required equalization to make a dipole surround speaker with a flat power response is already included in the system. No other additional circuitry is required.

In the system arrangement shown in FIG. 18*a*, the null of the surround speaker radiation pattern is pointing at the listening area, and the main radiation lobes of the surround speaker are pointing at the side walls of the listening room. This orientation is capable of generating a very spacious sound field, as the reflections generated come from the sides of the room and therefore are lateral reflections. The correlation of lateral reflections with the sense of spaciousness has already been discussed. It is also possible to use two surround loudspeakers, both of which are dipoles, located on the sides of the listening room, with the nulls of their radiation patterns pointing toward the listening space. This arrangement is shown in FIG. 18*b*. Again, using the same dipole element spacing in the surround speaker as is used in the SDR array is a very convenient configuration to use. One might also want to invert the polarity of one of the dipole speakers with respect to the other, to increase the diffussness of the sound field generated by the surround speakers.

It should also be noted that an element spacing can be chosen for the rear surround dipole speaker configuration to provide a flat acoustic response when any other form of SDR processing is used (for all variations where the processing is designed for use with an SDR embodiment using gradient directional loudspeakers).

It is also possible to design a direct radiator speaker that has a frequency response that is the inverse of the applied L−R signal equalization, for use as a rear surround speaker. The equalization present in the difference signal will generally have an integrating character. This is a response that increases at the rate of 6 dB per octave as frequency decreases. The direct radiator needs to be constructed to have a response that decreases at the rate of 6 dB per octave over the same frequency range where the difference signal equalization is rising, so that the net result is flat overall response. This can be easily done by using a first order high pass filter crossover. The first order crossover rolls off at 6 dB per octave. The design of direct radiator loudspeakers is know in the prior art and will not be described in any more detail here.

It should be noted that the space controls that have been previously described for use with an SDR array will also have an effect on the surround speakers in the home theater configurations described above. In the MD-Grad and combination arrays, the space control varies the level of the difference signal. This is the same signal used for the surround speakers. The space control will therefore also change the level of the surround speakers as it is changing the radiation pattern of the SDR array. The space control in the D-Grad embodiments, while somewhat more complicated in form, has the same effect on the surround speakers that would be used with it in a home theater system as the MD-Grad and combination embodiment space controls. Individual level controls (not shown in FIGS. 18*a* and *b*) can also be placed in the surround speaker signal paths to give independent control over the amount of difference signal radiated by the SDR array and the amount radiated by the surround speaker(s). The combination of a space control and surround speaker level control allows the user considerable freedom in the setup of an SDR home theater system. Independent control over the surround speaker output can also be obtained if another power amplifier is added to the system to amplify the difference signal for feeding the surround speakers only. This separate amplifier configuration is not shown. It is assumed that someone skilled in the art could implement this given the information contained in this disclosure.

Also note the inclusion of a sub woofer in FIGS. 18*a* and *b*. The sub woofer is shown being driven from the output of the amplifier that amplifies the sum signal. The sub woofer could also have its own amplifier and be driven from the left and right channel signals directly if desired.

Use with Multi Channel Decoding Systems

An SDR array is also compatible with the electronic surround sound decoders described earlier. The system is well suited to work with standard Dolby Surround systems that provide Lt to the left channel, Rt to the right channel, and generate a separate surround signal from the difference between the Lt and Rt signals. The SDR signal processing circuitry can either be fed Lt and Rt signals directly (this is shown in FIG. 18*c*), or the left and right channel output signals from the decoder (not shown, these are essentially the same signals). The surround signal output of the decoder can be sent to rear surround speakers as is done conventionally. A system could consist of an SDR array in front and a rear surround speaker or speakers. As the surround signal is derived from the Dolby decoder rather than the SDR processing, it will not be equalized. This configuration would work well with conventional direct radiator surround speakers. It is also possible to add left and right conventional speakers to this system. In this case, the SDR array becomes, in effect, an enhanced center channel speaker. As the left and right speakers receive the Lt or Rt signals, this configuration would still suffer from dialog leakage into the left and right speakers. It would, however, have a more spacious overall sound as the front SDR array is also reproducing difference signal information. One possible arrangement of an SDR array with a Dolby Surround system in shown in FIG. 18*c*. This figure is representative of how an SDR array could be connected into any passive surround sound decoding system.

The invention can also be configured in multiple ways to work with Dolby Pro Logic systems. One configuration would use the Pro Logic decoder in the phantom center channel mode. This is shown in FIG. 18*d*. In this mode, the center channel signal is summed in with the left and right speaker signals within the Dolby Pro Logic decoder. The signal processing for the SDR array would process the left and right channel decoder outputs and apply them to the SDR array. The left and right Dolby decoder outputs can also be sent to left and right speakers if desired. The Dolby decoding circuitry provides a separate surround channel signal that can be sent to surround loudspeakers placed in the rear of the room. The difference between this configuration and the Dolby surround configuration just discussed is that the SDR array will not reproduce as much surround signal in this setup. The SDR processing could also take its signal directly from the Lt and Rt signals (not shown). The system would then essentially function the same as the Dolby surround system described earlier.

An SDR system can also work with Dolby Pro Logic systems operated in normal mode (in normal mode, the center channel information is decoded into a separate channel, rather than being summed into the left and right channels as is done in the phantom mode). This configuration is shown in FIG. 18*e*. In this embodiment, the Lt and Rt signals are fed to the SDR processing, and subsequently to the SDR array. The SDR array is used as an enhanced center channel speaker. All the rest of the speakers normally used in a Dolby Pro Logic system can then be set up as is normal practice. Left and right speakers receive decoded left and right channel signals, and the surround receives a delayed and filtered difference signal. The overall performance of this system will be improved over a traditional Dolby Pro Logic system, as the enhanced center channel speaker provides left and right channel directional information and additional surround information that is radiated to reflect off the side walls of the listening room. The Pro Logic processing will be working here to keep dialog signals from appearing in the left and right speakers. An enhanced center channel speaker using an SDR array as described can revert to operation as a traditional center channel speaker if the space control is set to minimum. In this instance, the difference signal is set to zero and the array will only radiate sum signals. Sum signals are what center channel signal is typically derived from.

It should be noted that the sub woofer in FIGS. 18*c, d,* and *e* is shown connected to the output of the SDR processing. FIGS. 18*c, d,* and *e* show the use of an MD-Grad SDR array. The processing for this array generates sum and difference signals, and then processes them. The processed sum signal is what is shown being applied to the sub woofer. The sub woofer can be connected into the system in other ways as well. In FIGS. 18*c, d,* and *e,* the sub woofer could be powered by the left and right channel outputs from the Dolby Processor electronics (assuming that amplification is included in the decoder, which is the case in most surround sound receivers). The sub woofer could also be powered by the center channel amplifier when the Pro Logic system is set to normal center mode operation. Many Dolby Pro Logic decoders have sub woofer outputs for direct connection to a subwoofer which could also be used.

Another possible hook up is to combine the left, center, and right decoder outputs back into two signals (where the center signal is added equally to the left and right signals). These two signals are then fed to the SDR processing. The SDR array is also acting as an enhanced center channel here. In this case, its signals are derived after the surround decoded processing, so that the decoder will be able to control the level of the SDR array output. This configuration is shown in FIG. 18*f*.

It can be envisioned that there are other methods in which an SDR array can be combined with surround sound decoding systems and loudspeakers. There also are numerous surround sound decoding systems available in the market that perform functions essentially similar to those of the Dolby decoders. There is no fundamental restriction on the use of an SDR array with any of these systems.

Future Surround Sound Formats

There are some new surround sound formats planned that will cause large changes in the way surround sound is implemented in the future. Wide consumer availability of these formats will occur once HDTV becomes generally available. These formats have multiple discrete audio channels available. They have as many as five discrete channels plus a subwoofer channel. These systems will use three channels for the front (left, center, and right) and two additional channels will be used to provide stereo (L and R) surround signals. The SDR technology is ideally suited to use with these surround sound formats when they do reach the market. These stereo surround channels can be fed to a single SDR array placed in the rear of the room. Left surround channel information can be radiated to the left and right surround channel information can be radiated to the right by a single array. Another SDR array could be used in the front of the room to reproduce the left, center, and right channel signals. The use of one array in front and one in back would greatly simplify the installation of a surround sound system. Many other configurations are also possible based on some of the previously mentioned configuration descriptions.

Television Sets

It is possible to include an SDR array directly in a television set. The preferred embodiment would use an SDR array centered underneath or above the video screen. Any of the SDR embodiments discussed will work in this application. The industrial design of some television sets can make center placement of the array difficult. Most sets have space for the speakers in the lower front comers of the set. These comers are spaced too far apart to be used as full range dipole element locations. The frequency range over which pattern control could be maintained would not be high enough for the system to work acceptably. These locations may be able to be used in other ways, however. Some possibilities are shown in FIGS. 20*a, b,* and *c*. Three element arrays are depicted for convenience in FIGS. 20*a, b,* and *c,* however any SDR array embodiment is applicable here.

FIG. 20*a* shows various placements for a single array. It is possible to locate the array off to one side rather than in the center. This configuration can work very well for smaller sets. Dialog is radiated omni-directionally by the array and will be localized to the array physical position. The illusion that the people on screen are actually speaking can be preserved if the loudspeaker reproducing the dialog is sufficiently close to the screen. This would be the case for small sets, even when the array was located off to one side. The illusion could begin to collapse with larger screen sets where the array is pushed farther off center.

FIG. 20*b* shows various configurations using two separate arrays. The two arrays can be driven from the same signals so that a two amplifier configuration is still possible to implement. This system would function the same as the system using two SDR arrays that was described in the stereo section.

FIG. 20*c* shows a configuration that may also have some value. In this case, there is a centrally placed SDR array along with two higher frequency devices located at the front corners of the TV. This configuration would be useful for the types of embodiments where the SDR processing reverts to left and right signals at higher frequencies. Some of these were discussed in the section that described methods for extending the frequency range over which directivity pattern control is maintained. In the current case, the high frequency devices are not used to maintain a directivity pattern. In this configuration, the high frequency devices are displaced in space to try to achieve some physical channel separation at higher frequencies, above where the SDR array is controlling its directivity. This configuration using additional high frequency devices is not limited to use in television sets. Separate high frequency devices can be used with any of the application of SDR systems.

Most of the configurations shown have the array elements facing forward. This is done primarily because the performance of side firing elements can be affected when the television is set back into an entertainment center. The walls of entertainment centers cause reflections that impair the ability of the array to radiate signals properly. An SDR array with the array elements facing forward can provide strong left/right localization and a broad spacious sound without the need to face speaker elements out to the sides, where they are affected by the walls of entertainment centers.

Sub woofers

This application is different from the rest of the applications discussed. Until now, the job of the SDR array has been to create sound sources displaced in space away from the physical location of the array. The section on psychoacoustic theory stated that the array only needed to work down to approximately 150 Hz to generate realistic sound sources placed outside the array location by controlling the relative level of direct and reflected energy. The sub woofer design described here, however, is not trying to generate sound sources displaced from the location of the woofer. There are other aspects of human perception that are also important that do not directly relate to localization. The intent of using the array technology for low frequencies as described here is to attempt to alter the way in which the low frequency radiator spatially distributes energy throughout the listening room. The system operates using the same principals as discussed earlier. The main difference is that the element spacing is increased, and the signal processing used is adjusted to compensate, to improve the array efficiency at low frequencies.

Conventional sub woofer systems sum the left and right channel signals to mono and reproduce this signal from a single enclosure. It has been demonstrated in the prior art that using a stereo pair of subwoofers separated in space (one for each channel) has audible benefits over the use of a single monophonic subwoofer. There is program information in numerous recordings that has different information in the two stereo channels at low frequencies.

An example can illustrate some of the differences between a single mono subwoofer, a stereo pair of woofers, and an SDR array designed to operate at low frequencies. Assume a simple low frequency sine wave is applied to the left and right channels simultaneously. Further assume that the gains of each channel are modulated to change in opposite directions, but the total power is held constant. As the gain in the left channel is increased, the gain in the right channel is decreased, and vice versa. The effect can be simulated by manually operating a conventional balance control of a stereo system, where the output of a sine wave oscillator is applied to both channel inputs simultaneously. When this signal is summed to mono electrically and then presented to a single subwoofer, the effects of the modulation will no longer be detectable. The sum is held constant and a simple single tone is all that is audible. When this signal is reproduced by a pair of stereo woofers displaced in space, the effects of the modulation will be clearly audible. Each woofer has a different transfer function to every listening position in the room. As the signal is modulated, the low frequency energy will be perceived to be moving back and forth in the room. An SDR array configured to work at low frequencies would radiate signals into space in such a way that the modulation effects would also be perceivable. The SDR array would alternate radiating energy back and forth to the left and right of the array. The energy distribution throughout the room would not be stationary, as it is with a mono subwoofer. The benefit of the SDR configuration over a stereo pair of woofers is that only one enclosure is required.

It has also been reported that the sense of spaciousness of a stereo pair of subwoofers is improved over a single monophonic subwoofer. A stereo pair of subwoofers will generate a lower level of interaural cross-correlation (IACC) than will a single monophonic sub woofer. Using two woofers displaced in space radiating different channel signals will generate signals at a listeners two ears that are less similar to each other than using a single woofer radiating the electrical sum of the two channel signals. Low IACC has been correlated with an increased sense of spaciousness in numerous architectural acoustic studies. Increasing the number of sound sources and providing those sources different program information results in the lower IACC achieved by the stereo subwoofer systems. The IACC will also be lower with the use of an SDR sub woofer system, as the SDR system acts essentially like two separate sources radiating different information in different directions.

There is a further benefit to using an SDR array at low frequencies. The placement of a subwoofer in a room has a significant effect on the frequency response observed at the listening position. That response can vary by as much as ±15 dB with changes in room placement. The variation has do to with the degree of coupling between the woofer and the various room modes. One way this variation in room response can be reduced is to use multiple woofers. The different woofers couple with varying efficiency to the different modes. The net result is that the overall room response can be made smoother than it would otherwise be when multiple sources are used as opposed to a single source. The left and right channel outputs of the SDR array will also couple differently to the room modes, and will tend to generate an overall smoother response throughout the room as well.

Separate figures showing woofer applications of SDR have not been included. There is no fundamental difference from a block diagram perspective between the previous SDR applications and a woofer application. The only real differences are in the frequency range over which it is desired to maintain directivity pattern control.

Multimedia

Multimedia systems can benefit from the use of an SDR array. Most multimedia sound systems consist of a stereo pair of loudspeakers that are located to the left and right of a computer monitor. Some systems are also integrated into the monitor directly. In these systems, the user is located physically close to the array. This can tend to increase the time delay between the reflected energy and the direct sound of an SDR array. However, the user will be located centered with respect to the array which tends to maximize the difference between direct level and reflected level. Strong sound source localization cues coming from side walls should still be operating. Any of the array configurations described can be used with multimedia sound systems.

The basic array can be relatively small. The D-Grad and combination embodiments are good choices here. The arrays can be physically smaller (the required element spacing is less) than MD-Grad embodiments. The size of the enclosure is important for a system that is located on someone's desktop. A separate bass box can be used to provide low frequency information if desired. The spatial control will be very useful here. Different settings of the control may be desirable depending on the distance between the user and the array.

There is also another phenomenon occurring that affects the behavior of gradient type SDR systems in the near field. The gradient type systems have more than one source of sound radiating at the same time. For a left channel only signal, for example, all the array elements will still radiate. However, the magnitude and phase of the signal radiated will be different for each array element. The nature of these signals is such that additional localization cues are created in the direct sound field that cause localization to be shifted to the left of the array (for the left channel signal. Right channel signals are symmetrically shifted to the right.). These near field localization cues coincide with the localization cues generated by the overall system radiation pattern that are experienced in the far field.

Any of the possible SDR embodiments can find use as a multimedia system.

Automotive

One of the major design challenges in automotive sound systems is to develop a system that is capable of maintaining a well balanced stereo image for all passengers in the car simultaneously. Most automotive sound systems place left and right front loudspeakers in the front doors. This results in a very asymmetric arrangement where listeners are much closer to one loudspeaker than they are to the other. This often causes a problem of near side localization where the stereo image is skewed toward the closest speaker. Adjustment of the balance control cannot fix this problem for more than one occupant at a time. Some systems try to take care of this problem by locating speakers down low in the doors or low and forward in the kick panels. This placement tries to equalize the path lengths from each speaker to the listening locations as much as possible. They also try to take advantage of the natural directivity of the transducers used to increase the level of high frequency energy from the far speaker with respect to the near speaker. These locations have a number of problems from a system design standpoint. Output from these locations can be blocked by passengers legs and the frequency response can be distorted considerably. There are often cavities created by the shape of the space where the speakers are located that further degrade the frequency response of the system. These deviations cannot be fully compensated for by the use of equalization.

SDR arrays can be used in a number of ways to address these shortcomings. In one configuration, an SDR array can be located in the middle of the front dash, oriented so that left channel signal is radiated to the left of the array and the right channel signal is radiated to the right of the array for a listener facing the array. The array is capable of generating a balanced stereo perspective with a solid center image in the center of the vehicle for both front seat passengers. The system could also be used with (although they are not required) high frequency devices located in the comers of the front dash of the vehicle. This arrangement is shown in FIGS. 21*a* and *b*. These tweeters would operate above the frequency where the array directivity is no longer controlled to improve the overall stereo image. Having the tweeters may be useful for systems where the array is not located as far forward in the dash as would be desirable. (The system works best for listeners located on the center line of the array. As a listener moves far enough off axis, the perceived location of the near side channel will collapse from the side walls used as reflectors to the array location.) The addition of tweeters will help keep the image wide under these conditions. FIGS. 21*a* and *b* also show an SDR array in the rear package shelf. Its function will be discussed shortly. The use of a rear SDR array is not required when a front SDR array is used. The front SDR array could be used with any configuration of rear speakers. It should also be noted that the reverse is also true; a rear located SDR array could be used with any front loudspeaker configuration.

The configurations shown in FIGS. 21*a* through *d* show the use of three element SDR arrays. It should be noted that any of the possible SDR array embodiments can be used in these applications. Also, the signal processing required for generating the SDR behavior is shown collapsed into a single block. This block will provide whatever signal processing is required for whatever SDR array configuration is used. The required signal processing has been described in detail previously.

Localization problems are also common in the rear seat. The problem can be much worse in the rear due to the common placement of left and right speakers in the rear package shelf, usually directly behind the rear seat passengers heads. It is virtually impossible for a back seat passenger to obtain any kind of stereo image from this configuration. Some systems try to fix this by locating rear speakers in the rear doors. These speaker locations have the same problems as speakers in the front doors in terms of frequency response aberrations and interference from passengers legs. Door located speakers are also more complicated to implement, as well as more costly, due to the doors being wet areas (which implies speakers need to be protected) and the need for a flexible wire harness that enters the door.

An SDR array can be used beneficially for rear seat reproduction. A first application orients the SDR array in the same way as described above for the array located in the front dash board. A single array located in the center of the rear package shelf can generate a balanced stereo perspective with a centered image for rear seat passengers as well as front seat passengers. The system could also be used with (although they are not required) high frequency devices that would operate above the frequency range where the array directivity is no longer controlled to improve the overall stereo image. An SDR array centered in the rear package shelf accompanied by widely spaced left and right rear high frequency devices is shown in FIGS. 21*a* and *b*.

The system in FIG. 21*b* includes additional low frequency devices located to either side of the SDR array in the rear package shelf. These cover the low frequency range up to approximately 150 Hz, above which the SDR arrays take over. The low frequency devices are shown in the rear package shelf but they could be located numerous places within the vehicle.

The acceptability of an SDR array used as described above depends on the location of the passengers with respect to the array. As was mentioned earlier, the near channel signal can collapse to the location of the array when the listener is sufficiently off axis. A listener sufficiently off axis to the left, for example, would hear the left channel signal coming directly from the array, not from the walls on the left side of the vehicle. Although this is a limitation when the system is used as described above, this behavior can actually be exploited when an SDR array is used as a center fill speaker. The center fill application will be discussed shortly.

To overcome some of the problems associated with off axis listening to SDR arrays, two arrays can be used in the front dash, and/or two arrays can be used in the rear package shelf. Each array would be centered with respect to each passenger location. Every passenger would now essentially have his own stereo array. This system configuration is shown in FIG. 21*c*. The arrays can all be identical. Equalization may be desired to compensate for frequency response anomalies that can be caused by the geometry and materials in the passenger compartment. The equalization can be the same for each of the front two arrays, and the same for each of the rear two arrays. In this way, the system will use four total channels of amplification. This is a common configuration in automotive systems, as many car radios have four amplifiers built in. The complete system would also need to produce bass information. Configurations are possible where the same amplifiers are used to power a passive woofer, or a separate amplified woofer can be used. The system is not limited in the method in which low frequency reproduction is accomplished. It is also possible to use a pair of SDR arrays in the front of the vehicle along with some other speaker configuration in the rear, or to use a pair of SDR arrays in the rear with some other loudspeaker configuration in the front of the vehicle. These possibilities are not explicitly shown.

Some system designs use a center fill speaker placed somewhere on the center line of the vehicle to reduce the near side localization problem that was mentioned earlier with respect to front door and kick panel speaker locations. The purpose of the center fill is to solidify the center image of a system using traditional left and right speakers locations. This center speaker is often fed a sum signal (L+R). This is effective in centering the image, but it also reduces stereo separation, which is not desirable. Another system configuration that has been used sends the left channel signal to the left and right speakers and the right channel signal to the center speaker (L−R−L). This succeeds in improving the center image and both passengers will hear stereo. However, the stereo image will be reversed for the passenger seat. This situation has been found to be unacceptable to most automotive manufacturers.

An SDR array can be successfully used in automotive applications as a center fill speaker. A system with this configuration is shown in FIG. 21*d*. FIG. 21*d* also shows SDR arrays in the rear package shelf, but the SDR centerfill application can be used with any system configuration in the rear of the vehicle. It is usually desirable to keep the size of the center channel speaker small, as there is usually not a great deal of room available on the centerline of the car where speakers can be placed. It has been determined in experiments that response down to 500 Hz from the centerfill is sufficient to give a more centered sound stage. A small SDR array can be used successfully here. Element spacing should be reduced to try to extend the frequency range of directivity control and take advantage of the reduced low frequency output requirement. In addition, some of the methods previously described to extend the frequency range of operation can be applied.

In this application, the signal connections to the array should be reversed so that the array radiates right channel signal to the left and left channel signal to the right. The system is combined with traditional left and right channel speakers located on the left and right sides of the vehicle. The SDR array centerfill takes the place of the center fill described earlier that received only the L+R signal. This is a new and novel application. This configuration is capable of generating a compartmentalized stereo system. Each passenger hears stereo, where the left channel comes from the left and the right channel from the right. There is no reversal in the stereo sound stage and no reduction in stereo separation, as is the case with other center fill designs. The following explains how this configuration works.

The system consists of a left channel speaker in the driver side door (or somewhere on the left side of the vehicle), a right channel speaker in the passenger side door (or somewhere on the right side of the vehicle), and an SDR array located in the front of the vehicle somewhere on the center line of the car. The driver is located to the right of the left side speaker and to the left of the SDR array. The driver will hear left channel signal directly from the left side speaker and right channel signal directly from the SDR array. The passenger is located to the left of the right side speaker and to the right of the SDR array. The passenger will hear the right channel signal from the right side speaker and the left channel signal from the SDR array. Each passenger hears stereo with the correct spatial perspective. Also, signals equally recorded in left and right channels will be radiated omni-directionally by the SDR array. The array will behave the same as a traditional center fill speaker fed the L+R signal for monophonically recorded signals. This is a desirable feature.

The SDR array additionally generates delayed lateral reflections of opposite channel signals. The array radiates right channel signal directly to the driver. Simultaneously, the left channel signal is radiated to the right of the array, which reflects off the right side of the vehicle cabin and back to the driver. The same behavior occurs for the right channel signal for the passenger. These reflected signals are delayed with respect to the direct channel arrivals from the near speakers and arrive from the opposite sides of the vehicle. This behavior increases the spaciousness of the total system.

There is a considerable amount of control that can be exerted over the image and spatial performance of an automotive system using an SDR array. The spatial controls that have been previously described for SDR arrays are of value here. In addition, the overall level of the output of the SDR array with respect to other transducers in the system can be adjusted. A further enhancement adds delay to the system. Delay is shown added to the front SDR array of the configuration of FIG. 21*d* in FIG. 21*e*. The signals applied to the SDR array can be delayed with respect to the side speakers, or the side speakers can be delayed with respect to the SDR array (not shown). FIG. 21*e* shows a centerfill application where SDR signal level, directivity pattern and delay adjustments are available. FIG. 21*e* shows the use of an MD-Grad SDR array, but any type of gradient loudspeaker technology could be used here. No controls are explicitly shown for the rear SDR arrays, but they can easily be incorporated if desired.

The controls shown can be made into user controls, or they can be adjusted and set by the system designer. The delay can be adjusted to alter the arrival time of signals from the array with respect to the other system transducers. This can broaden the overall stereo image heard by each occupant of the vehicle. The delay can, in effect, move the right channel signal heard by the driver from the position of the SDR array toward the right door. The amount of delay determines how far the image moves. By delaying all SDR signals equally, the same delay moves the left channel signal heard by the passenger from the SDR array position toward the left door simultaneously. FIG. 21*e* shows delay control available for the front SDR array, where the front system has conventional speakers on the left and right doors, and an SDR centerfill. The system configuration in the rear seat shows two SDR arrays, but any configuration could be used, including a configuration analogous to what is shown in the front of the vehicle where speakers are placed in the left and right rear doors, and a single centerfill SDR array is located in the middle of the rear package shelf.

Portable stereo

Portable stereo units can make use of SDR technology. All of the different SDR array embodiments may be used here. The preferred embodiments will use gradient type directional loudspeakers, as the need for portability precludes the use of wave type devices at low frequencies.

Many possible configurations can be imagined. The portable system could have a central SDR array and detachable side high frequency speakers for example. All the possible combinations of SDR arrays and arrays with traditional speakers will not be discussed, but it should be realized that the invention covered by this disclosure is not limited to only those system options specifically discussed.

Musical instruments

The system also lends itself well to use in electronic instruments. The signal processing for the array can be adjusted to generate different radiation patterns for different sounds created by the instrument. It has applicability in guitar amplifiers, keyboard amplifiers, and other electronic instrument reproduction systems. Most instrument amplifiers tend to be single cabinet systems, and it would be desirable to be able to generate a much broader and more spacious sound from these single cabinet systems.

Final Note

Many possible system configurations can be envisioned that use one or more SDR arrays and any number of conventional speaker systems. These different configurations can be used with conventional stereo signals as well as with various multi-channel signal processors. We will not endeavor to describe all possible combinations of these system components. It should be construed that this disclosure is not limited to the particular combinations of SDR arrays and conventional speaker systems specifically described.

| References | | |
|---|---|---|
| 1 Shivers | 4,837,825 | Passive Ambiance Recovery System for the Reproduction of Sound |
| 2. Hafler | 3,697,692 | Two Channel, Four Component Stereo System |
| 3. Klayman | 4,819,269 | Extended Imaging Split Mode Loudspeaker System |
| 4. Holl, Short | 5,027,403 | Video Sound |
| 5. M. R. Schroeder | | "Computer Models for Concert Hall Acoustics". American Journal of Physics, vol. 41, pp. 461–471, April 1973, |
| 6. Cooper, Duane H. | 5,333,200 | Head Diffraction Compensated Stereo System with Loudspeaker Array |
| 7. Polk | 4,569,074 | Method and Apparatus for Reproducing Sound Having a Realistic Ambient Sound Field and Acoustic Image |
| 8. "Hearing in Three Dimensions: Sound Localization", Frederick L. Wightman, Doris J. Kistler The AES 8th International Conference "The sound of Audio" | | |
| 9. "Gradient Loudspeakers", Harry F. Olsen, Journal of the Audio Engineering Society Loudspeaker Anthology Vol. 1 p. 304 | | |
| Other Related U.S. Pat. Nos. | | |
| 10. Gefvert | 4,888,804 | Sound Reproduction System |
| 11. McShane | 4,847,904 | Ambient Imaging Loudspeaker System |
| 12. Orban | 3,670,106(?) | Stereo Synthesizer |
| Other References | | |
| 13. Beranek, Leo L. | "Acoustics" | 1954, 1986 by the Acoustical Society of America |

Appendix

8/24/95

Use the following definitions:

$\omega = 2\pi f$ $j = \mathrm{sqrt}(-1)$ $U_o$ = source strength
$r$ = distance from the source to the observation point.
$k = \omega/c$ $c$ = speed of sound = 345 m/sec The equation for the pressure response of a simple monopole source can be written as:

$$p(r) := \frac{j \cdot \omega \cdot U_o \cdot \rho_o}{4 \cdot \pi \cdot r} \cdot e^{-j \cdot k \cdot r} \qquad (1)$$

A dynamic moving coil transducer operating in its mass controlled region has a volume velocity that is inversely proportional to frequency. If this type of transducer is used as a source, the pressure response can be rewritten as:

$$p_m(r) := \frac{U_d \cdot \rho_o}{4 \cdot \pi \cdot r} \cdot e^{-j \cdot k \cdot r} \qquad (2) \qquad \text{where} \qquad U_d := \frac{U_o}{j \cdot \omega} \qquad (3)$$

This is the form of the pressure response for a monopole loudspeaker. There is no angular dependence of the pressure. The pressure is constant as a function of frequency for a fixed r.

Doublet

A doublet can be constructed from two monopole loudspeaker sources spaced a distance D apart. If the output of one of the sources is inverted with respect to the other, the two sources will form a dipole. The expression for the pressure output of the doublet as a function of r and θ can be derived as follows.

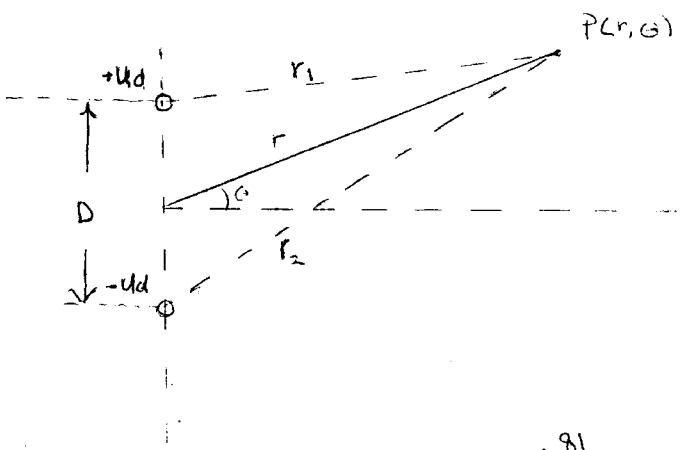

$$p_d(r,\theta) := \frac{\rho_o \cdot U_d}{4\cdot\pi\cdot r_1}\cdot e^{-j\cdot k\cdot r_1} - \frac{\rho_o \cdot U_d}{4\cdot\pi\cdot r_2}\cdot e^{-j\cdot k\cdot r_2} \tag{4}$$

The following approximations are useful here.

$$\frac{e^{-j\cdot k\cdot r_1}}{r_1} := \frac{e^{-j\cdot k\cdot\left(r-\frac{D}{2}\cdot\sin(\theta)\right)}}{r} \tag{5}$$

$$\frac{e^{-j\cdot k\cdot r_2}}{r_2} := \frac{e^{-j\cdot k\cdot\left(r+\frac{D}{2}\cdot\sin(\theta)\right)}}{r} \tag{6}$$

Pd can be rewritten as:

$$p_d(r,\theta) := \frac{\rho_o \cdot U_d}{4\cdot\pi\cdot r}\cdot e^{-j\cdot k\cdot r}\cdot\left(e^{j\cdot k\cdot\frac{D}{2}\cdot\sin(\theta)} - e^{-j\cdot k\cdot\frac{D}{2}\cdot\sin(\theta)}\right) \tag{7}$$

Using the relation that:

$$\sin(\alpha) := \frac{e^{j\cdot\alpha} - e^{-j\cdot\alpha}}{2\cdot j} \tag{8}$$

$$p_d(r,\theta) := \frac{\rho_o \cdot U_d}{4\cdot\pi\cdot r}\cdot e^{-j\cdot k\cdot r}\cdot\left(2\cdot j\cdot\sin\left(\frac{k\cdot D}{2}\cdot\sin(\theta)\right)\right) \tag{9}$$

or:

$$p_d(r,\theta) := p_m(r)\cdot\left(2\cdot j\cdot\sin\left(\frac{k\cdot D}{2}\cdot\sin(\theta)\right)\right) \tag{10}$$

The term in brackets contains magnitude and phase information as well as the directivity characteristics of the dipole. Pm(r) is the pressure response of a single monopole source.

Another approximation that will be useful is what is known as the small angle approximation for the sine function.

$\sin(\alpha) = \alpha$ when $\alpha$ is small.

$\frac{k\cdot D}{2}\cdot\sin(\theta)$ is the argument of the sin function above. This term will be small when the frequency is low (since $k = 2\pi f/c$). Under the low frequency approximation, $Pd(r,\theta)$ can be rewritten as:

$$p_d(r,\theta) := p_m(r)\cdot j\cdot k\cdot D\cdot\sin(\theta) \tag{11}$$

$$p_d(r,\theta) := p_m(r)\cdot\frac{j\cdot\omega\cdot D}{c}\cdot\sin(\theta) \tag{12}$$

Note that Pd is proportional to $j\omega$. Where the low frequency approximation holds, the response of the dipole is not flat as a function of frequency. The proportionality to $j\omega$ gives the dipole a response at low frequencies that approaches an ideal differentiator. This response could be compensated by a filter that approximates an ideal integrator, up to the maximum frequency where the low frequency approximation holds, to give an overall response that was flat as a function of frequency. The maximum frequency is calculated in equation (16).

Also note the $\sin(\theta)$ angular dependence. The sine term describes the directivity pattern of the dipole. The response is zero when $\theta$ is zero or 180 degrees. The response is a maximum when $\theta$ is equal to 90 degrees and is a maximum with inverted polarity when $\theta$ is -90 degrees.

Finally, note that the output at low frequencies is directly proportional to the element spacing D. The larger D is, the higher the output will be. However, as D increases, the frequency range over which the low frequency approximation holds decreases proportionally. The maximum value of Pd can be seen from equation (10) to be twice that of a single monopole element. This makes sense in that the dipole is made from two monopole elements.

The maximum frequency up to which the array of two monopole elements can maintain a radiation pattern that has essentially a dipolar characteristics (no additional lobes in the radiation pattern have formed) can be calculated by finding the first maximum in the expression for Pd. This occurs when:

$$\sin\left(\frac{k\cdot D}{2}\cdot\sin(\theta)\right) = 1 \tag{13}$$

The sin function has its first maximum when the argument is equal to $\pi/2$.

$$\frac{k\cdot D}{2}\cdot\sin(\theta) = \frac{\pi}{2} \tag{14}$$

The frequency where this occurs can be solved for.

$$f = \frac{c}{2\cdot D\cdot\sin(\theta)} \tag{15}$$

The lowest frequency will occur when $\sin(\theta)$ is a maximum.

$$f = \frac{c}{2\cdot D} \tag{16}$$

Note the direct dependence of this frequency on the value of D, the element spacing. The larger the element spacing, the lower the frequency range over which the low frequency approximation holds.

Delay Gradient Loudspeakers

The following system is similar to the analysis of the dipole system except that the output of one monopole loudspekaer element is delayed with respect to the other.

MOH
12/23/99

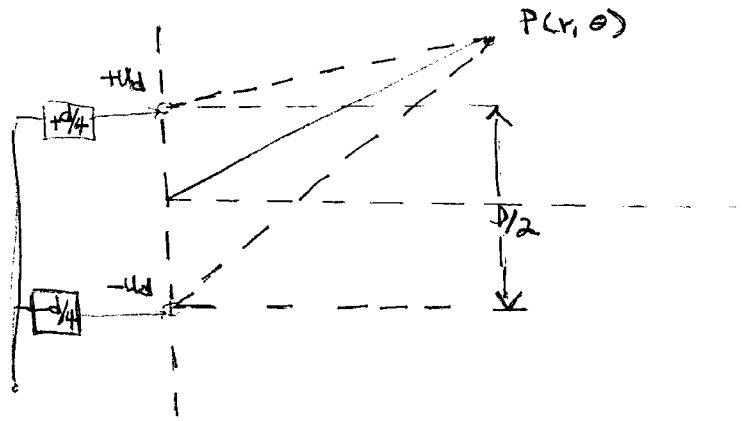

The diagram above shows one element advanced in time by d/4, the other delayed by d/4. This has the same effect as delaying one element by d/2. It is shown with the advance and delay to make the mathematics easier.

$$p_{gd}(r,\theta) := \frac{\rho_o \cdot U_d}{4\cdot\pi}\cdot\left(\frac{e^{-j\cdot k\cdot r_1}\cdot e^{j\cdot k\cdot\frac{d}{4}}}{r_1} - \frac{e^{-j\cdot k\cdot r_2}\cdot e^{-j\cdot k\cdot\frac{d}{4}}}{r_2}\right) \tag{17}$$

$$p_{gd}(r,\theta) := \frac{\rho_o \cdot U_d}{4\cdot\pi}\cdot e^{-j\cdot k\cdot r}\cdot\left(e^{j\left(\frac{k\cdot D}{4}\cdot\sin(\theta)+\frac{k\cdot d}{4}\right)} - e^{-j\left(\frac{k\cdot D}{4}\cdot\sin(\theta)+\frac{k\cdot d}{4}\right)}\right) \tag{18}$$

$$p_{gd}(r,\theta) := \frac{\rho_o \cdot U_d}{4\cdot\pi}\cdot e^{-j\cdot k\cdot r}\cdot\left(2\cdot j\cdot\sin\left(\frac{k\cdot d}{4}+\frac{k\cdot D}{4}\cdot\sin(\theta)\right)\right) \tag{19}$$

$$p_{gda}(r,\theta) := P_m(r)\cdot\left(2\cdot j\cdot\sin\left(\frac{k\cdot d}{4}+\frac{k\cdot D}{4}\cdot\sin(\theta)\right)\right) \tag{20}$$

By examining equation 20, it can be seen that the equation reduces to the pressure response of a dipole with element spacing = D/2 when the delay d goes to zero. As the delay is increased from zero, the directivity pattern becomes unidirectional. The direction of maximum radiation will point from the delayed element to the undelayed (or advanced) element and the maximum occurs for θ=90 degrees. A similar equation can be derived where the delay and element polarities are reversed. This will give an array that has a uni-directional radiation pattern pointing in the opposite direction. In this case :

$$p_{gdb}(r,\theta) := P_m(r)\cdot\left[2\cdot j\cdot\sin\left[\frac{(k\cdot d)}{4} - \frac{k\cdot D}{4}\cdot\sin(\theta)\right]\right] \tag{21}$$

The sign reversal on the sinθ term shows that the radiation pattern is reversed from the previous example.

The same low frequency small angle approximation that was used earlier in the dipole analysis can be used here to give:

$$p_{gda}(r,\theta) := P_m(r)\cdot\left[j\cdot\left(\frac{k\cdot d}{2} + \frac{k\cdot D}{2}\cdot\sin(\theta)\right)\right] \tag{22}$$

$$p_{gda}(r,\theta) := P_m(r)\cdot\left[\frac{j\cdot\omega\cdot d}{2\cdot c}\cdot\left(1 + \frac{D}{d}\cdot\sin(\theta)\right)\right] \tag{23}$$

$$p_{gdb}(r,\theta) := P_m(r)\cdot\left[j\cdot\left[\frac{(k\cdot d)}{2} - \frac{k\cdot D}{2}\cdot\sin(\theta)\right]\right] \tag{24}$$

$$p_{gdb}(r,\theta) := P_m(r)\cdot\left[\frac{j\cdot\omega\cdot d}{2\cdot c}\cdot\left(1 - \frac{D}{d}\cdot\sin(\theta)\right)\right] \tag{25}$$

The first thing to notice is the jω dependence of the pressure response. This has the form of an ideal differentiator. This response can be equalized by a filter that has an integrating response at low frequencies (an integrator has a response of the form 1/jω). The directivity pattern depends on the relationship between d and D. The directivity pattern can be varied by adjusting the delay d.

A useful radiation pattern referred to as cardiod occurs for the case where d = D.

A similar development as was done for the dipole case can be applied to the D-grad case to find a maximum frequency up to which uni-directional behavior can be maintained. By examining equation 20, the first maximum occurs when:

$$\sin\left(\frac{k\cdot d}{4} + \frac{k\cdot D}{4}\cdot\sin(\theta)\right) = 1 \tag{26}$$

The lowest frequency where this equation holds occurs when:

$$\frac{k\cdot d}{4} + \frac{k\cdot D}{4}\cdot\sin(\theta) = \frac{\pi}{2} \tag{27}$$

This can be solved for the frequency f to give:

$$f = \frac{c}{d + D\cdot\sin(\theta)} \tag{28}$$

In the above expression, the frequency depends on both the element spacing D and the delay d. This variation of the maximum frequency with the value of delay causes the overall frequency response of the array to vary as the delay is varied. This variation can be compensated for by using voltage controlled filters where the control voltage is related to the delay setting in an appropriate fashion. In the low frequency approximation, the gain of the array depends on the value of delay. In actual systems, the corner frequency of equalization that transitions from integrating behavior to flat response shape will need to vary as the delay varies.

It is useful to examine the response of a single channel delay gradient array at a few key angles. Look at the response for $\theta = 0$, +90, and -90 degrees. Note that 0 degrees corresponds to the main listening axis of the array as it is intended to be used here.

$$p_{gda}(r,\theta) := P_m(r)\cdot\left(2\cdot j\cdot\sin\left(\frac{k\cdot d}{4}+\frac{k\cdot D}{4}\cdot\sin(\theta)\right)\right) \tag{29}$$

Set $\theta = 0$.

$$p_{gda}(r,0) := P_m(r)\cdot\left(2\cdot j\cdot\sin\left(\frac{k\cdot d}{4}+\frac{k\cdot D}{4}\cdot\sin(0)\right)\right) \tag{30}$$

$$p_{gda}(r,0) := P_m(r)\cdot\left(2\cdot j\cdot\sin\left(\frac{k\cdot d}{4}\right)\right) \tag{31}$$

$$p_{gda}(r,0) := P_m(r)\cdot\left(2\cdot j\cdot\sin\left(\frac{\omega\cdot d}{4\cdot c}\right)\right) \tag{32}$$

If we use the small angle approximation here we get:

$$p_{gda}(r,0) := P_m(r)\cdot\left(\frac{j\cdot\omega\cdot d}{2\cdot c}\right) \tag{33}$$

Set $\theta = 90$.

$$p_{gda}(r,90) := P_m(r)\cdot\left(2\cdot j\cdot\sin\left(\frac{k\cdot d}{4}+\frac{k\cdot D}{4}\cdot\sin(90)\right)\right) \tag{34}$$

$$p_{gda}(r,90) := P_m(r)\cdot\left(2\cdot j\cdot\sin\left(\frac{k\cdot d}{4}+\frac{k\cdot D}{4}\right)\right) \tag{35}$$

If we use the small angle approximation here we get:

$$p_{gda}(r,90) := P_m(r)\cdot\left[2\cdot j\cdot\left(\frac{k\cdot d}{4}+\frac{k\cdot D}{4}\right)\right] \tag{36}$$

$$p_{gda}(r,90) := P_m(r)\cdot\left[\frac{j\cdot\omega}{2\cdot c}\cdot(d-D)\right] \tag{37}$$

$$p_{gda}(r,-90) := P_m(r)\cdot\left(2\cdot j\cdot\sin\left(\frac{k\cdot d}{4}+\frac{k\cdot D}{4}\cdot\sin(-90)\right)\right) \tag{38}$$

$$p_{gda}(r,-90) := P_m(r)\cdot\left(2\cdot j\cdot\sin\left(\frac{k\cdot d}{4}-\frac{k\cdot D}{4}\right)\right) \tag{39}$$

If we use the small angle approximation here we get:

$$p_{gda}(r,-90) := P_m(r)\cdot\left[\frac{j\cdot\omega}{2\cdot c}\cdot(d-D)\right] \tag{40}$$

At low frequencies, the jω dependence of the pressure can be seen. It is also interesting to note the frequency response at high frequencies. Equation 31 and 35 show a response that will have a series of peaks and sharp nulls (commonly referred to as comb filtering) in the response due to the k dependence in the argument of the sine function (where k = ω/c). This deviation from flat response at high frequencies will be a point of differentiation between the D-grad and MD-Grad embodiments.

Finally, we can look at what happens when two oppositely directed uni-directional D-grad arrays that are coincident in space radiate simultaneously. Two cases will be analyzed. The first case will have each array radiating the same signal. This corresponds to a single array being fed a sum signal (L+R signal). The second case looks at what happens when the arrays are fed the same signals except that the polarity of one signal is inverted with respect to the other.

$$p_{gdsum}(r,\theta) := p_{gda}(r,\theta) + p_{gdb}(r,\theta) \tag{41}$$

$$p_{gdsum}(r,\theta) := p_m(r)\cdot\left(2\cdot j\cdot\sin\left(\frac{k\cdot d}{4}+\frac{k\cdot D}{4}\cdot\sin(\theta)\right)+2\cdot j\cdot\sin\left(\frac{k\cdot d}{4}-\frac{k\cdot D}{4}\cdot\sin(\theta)\right)\right) \tag{42a}$$

$$p_{gdsum}(r,\theta) := 4lj\cdot p_m(r)\cdot\left(\sin\left(\frac{k\cdot d}{4}\right)\cdot\cos\left(\frac{k\cdot D}{4}\cdot\sin(\theta)\right)\right) \tag{42b}$$

This can be re-written using the small angle approximation:

$$p_{gdsum}(r,\theta) := p_m(r)\cdot\left(\frac{j\cdot\omega\cdot d}{c}\right) \tag{43}$$

Note that this is the output from a single monopole source except for the jω dependence. There is no θ dependence in this expression. The output level also depends on the delay d at low frequencies. This implies that the level of sum signal will vary as the delay d is varied. Sum signals will be radiated omni-directionally.

The second case where one signal is inverted with respect to the other is derived as follows:

$$p_{gddiff}(r,\theta) := p_{gda}(r,\theta) - p_{gdb}(r,\theta) \tag{44}$$

$$p_{gddiff}(r,\theta) := p_m(r)\cdot\left(2\cdot j\cdot\sin\left(\frac{k\cdot d}{4}+\frac{k\cdot D}{4}\cdot\sin(\theta)\right)-2\cdot j\cdot\sin\left(\frac{k\cdot d}{4}-\frac{k\cdot D}{4}\cdot\sin(\theta)\right)\right) \tag{45a}$$

$$p_{gdiff}(r,\theta) := 4lj\cdot p_m(r)\cdot\left(\cos\left(\frac{k\cdot d}{4}\right)\cdot\sin\left(\frac{k\cdot D}{4}\cdot\sin(\theta)\right)\right) \tag{45b}$$

This can be re-written using the small angle approximation:

$$p_{gddiff}(r,\theta) := p_m(r)\cdot\left(\frac{j\cdot\omega\cdot D}{c}\right)\cdot\sin(\theta) \tag{46}$$

Note that equation 46 is the pressure response of a dipole source. The output level depends on the element spacing D at low frequencies. Difference signals will be radiated with a dipole radiation pattern. There is no dependence on d in this expression. This implies that the level of difference signal will be unaffected as the delay d is varied.

It should be noted that all of the pressure responses derived for the d-grad system, (individual channel, sum, and difference signals) all show a $j\omega$ dependence at low frequencies. This response can easily be equalized to be flat as a function of frequency if desired by inserting a filter with an integrating response in the signal paths of each element.

Lets look at what angles, from a single channel array, a null in the radiation pattern is obtained. This can be determined from setting equation 20 equal to zero and solving for $\theta$.

$$0 := Pm(r)\cdot\left(2\cdot j\cdot\sin\left(\frac{k\cdot d}{4}+\frac{k\cdot D}{4}\cdot\sin(\theta)\right)\right) \tag{47}$$

This occurs when:

$$\sin\left(\frac{k\cdot d}{4}+\frac{k\cdot D}{4}\cdot\sin(\theta)\right) := 0 \tag{48}$$

or:

$$\frac{k\cdot d}{4}+\frac{k\cdot D}{4}\cdot\sin(\theta) := n\cdot\pi \tag{49}$$

Where n is ...-2, -1, 0, 1 2, ...

This can be solved for $\theta$ to obtain the following:

$$\theta := \operatorname{asin}\left[\frac{4}{k\cdot D}\cdot\left(n\cdot\pi-\frac{k\cdot d}{4}\right)\right] \tag{50}$$

We are only interested in the low frequency approximation region which occurs when n = 0.

$$\theta := \operatorname{asin}\left(-\frac{d}{D}\right) \tag{51}$$

88

The angle where a null occurs in the output of the D-grad loudspeaker array depends on the relationship between the element spacing and the delay d. When d = D which is the cardiod case, θ = -90, 270 degrees which are equal so that there is only one null in the radiation pattern.

Two other measures can be derived which will also be useful in understanding the function of the array. The pressure response of the array was calculated for θ = 0, +90, and -90 degrees. These expressions can then be used to form ratios between the direct sound and sound radiated in the +90 degree direction and between sound radiated in the +90 and -90 degree directions.

Use the small angle approximation equations for radiation at +90, 0, and -90 degrees (equations 37, 33, and 40).

$$\frac{\mathrm{Pgda}(90)}{\mathrm{Pgda}(0)} := 1 + \frac{D}{d} \tag{52}$$

$$\frac{\mathrm{Pgda}(90)}{\mathrm{Pgda}(-90)} := \frac{d + D}{d - D} \tag{53}$$

The above relationships show how the sound radiated in the direction of the main radiation lobe of the array compare to sounds radiated into the listening area. As one example, assume d = D. In this case, the radiation in the 90 degree direction will be twice that radiated in the zero degree direction and will be infinitely greater than that radiated in the -90 degree direction. In some instances, the 6dB difference (the factor of 2 above) may not be sufficient to shift localization away from the location of the direct arrival from the array to the location of the reflections from the radiation at 90 degrees. The system can be adjusted to increase this difference by varying the delay.

Another case to examine is where d = 1/2*D. In this case, the difference between radiation in the +90 degree direction and the 0 degree direction is a factor of 3 or 9.54 dB. This is also the difference between the signal radiated in the +90 degree direction and the -90 degree direction (notice that there is a change in polarity for radiation in the -90 direction here). Also notice here that the angles where nulls occur in the radiation pattern are shifted to -30 and +210 degrees.

This altering in relative levels radiated in different directions can be used by the listener to adjust the system to compensate for different room geometries. For example, if the side walls are close together (which happens with a narrow room), there is less time delay between the direct arrival and the arrival of reflected energy. It will therefore require less level difference between the reflected and direct sounds to cause localization to shift to the location of the reflection than it would in a wider room where the time delay is larger. The spatial control allows for this situation to be compensated so that in each case, the proper amount of energy is perceived to be coming from the sides of the listening environment.

Monopole/Dipole Combination Gradient Loudspeakers

It is also possible to create a gradient loudspeaker by combining the outputs of monopole and dipole sources with proper equalization. The analysis of MD-grad systems follows.

$$p_{mdga}(r,\theta) := p_m(r) + p_d(r,\theta) \tag{54}$$

$$p_{mdga}(r,\theta) := p_m(r) + p_m(r)\cdot\left(2\cdot j\cdot\sin\left(\frac{k\cdot D}{2}\cdot\sin(\theta)\right)\right) \tag{55}$$

$$p_{mdga}(r,\theta) := p_m(r)\cdot\left(1 + 2\cdot j\cdot\sin\left(\frac{k\cdot D}{2}\cdot\sin(\theta)\right)\right) \tag{56}$$

This can be re-written using the small angle approximation:

$$p_{mdga}(r,\theta) := p_m(r)\cdot\left(1 + \frac{j\cdot\omega\cdot D}{c}\cdot\sin(\theta)\right) \tag{57}$$

Uni-directional behavior occurs with an equation of the form $A[1+B\sin(\theta)]$ where B is real. Expression 57 has a $j\omega$ dependence on the sine term. This comes from the behavior of the dipole. If this $j\omega$ dependence were equalized out by placing a filter in the signal path of the dipole, then uni-directional behavior could be achieved.

The following analysis assumes a filter of the form $A/j\omega$ is placed in the dipole element path. The analysis also uses the small angle assumption for operation at low frequencies.

$$p_{mdga}(r,\theta) := p_m(r) + p_d(r,\theta) \tag{58}$$

$$p_d(r,\theta) := \frac{A}{j\cdot\omega}\cdot p_m(r)\cdot\frac{j\cdot\omega\cdot D}{c}\cdot\sin(\theta) \tag{59}$$

$$p_{mdga}(r,\theta) := p_m(r) + A\cdot p_m(r)\cdot\frac{D}{c}\cdot\sin(\theta) \tag{60}$$

$$p_{mdga}(r,\theta) := p_m(r)\cdot\left(1 + A\cdot\frac{D}{c}\cdot\sin(\theta)\right) \tag{61a}$$

Equation 61 now has the correct form for uni-directional radiation behavior. Note here that there is no frequency dependence in the expression. The monopole source has a flat response as a function of frequency and the response of the dipole was equalized to have a flat response as a function of frequency (for low frequencies). The combination of the monopole and equalized dipole does not show any frequency dependence. Note that the gain of the dipole A affects the radiation pattern and total output of the array. The gain A does not have any effect on the overall frequency response of the array. The frequency range over which the low frequency approximation holds is also not affected by the gain A of the dipole. This is in contrast to the effect of delay d in the D-grad case.

The differences between how A affects the MD-grad system and d affects the D-grad system are important in that varying each of these quantities can be used to implement a spatial control. The behavior of A is generally easier to deal with from a system design standpoint. A can be varied without having to change equalization in order to maintain a flat response.

The complete expression for the system with equalization applied can be shown to be the following:

$$p_{mdga}(r,\theta) := p_m(r)\cdot\left(1+\frac{2A}{\omega}\cdot\sin\left(k\cdot\frac{D}{2}\cdot\sin(\theta)\right)\right) \tag{61b}$$

A similar analysis can be carried out for an array that exhibits unidirectional behavior with the direction of maximum radiation opposite from the above case.

$$p_{mdgb}(r) := p_m(r) - p_d(r,\theta) \tag{62}$$

$$p_{mdgb}(r,\theta) := p_m(r)\cdot\left(1-2\cdot j\cdot\sin\left(\frac{k\cdot D}{2}\cdot\sin(\theta)\right)\right) \tag{63}$$

Using the small angle approximation:

$$p_{mdgb}(r,\theta) := p_m(r)\cdot\left(1-\frac{j\cdot\omega\cdot D}{c}\cdot\sin(\theta)\right) \tag{64}$$

If equalization is used in the dipole elements as was done earlier in equation 59.

$$p_{mdgb}(r,\theta) := p_m(r) - A\cdot p_m(r)\cdot\frac{D}{c}\cdot\sin(\theta) \tag{65}$$

$$p_{mdgb}(r,\theta) := p_m(r)\cdot\left(1-A\cdot\frac{D}{c}\cdot\sin(\theta)\right) \tag{66a}$$

It can easily be seen that the radiation pattern in this case will be flipped 180 degrees with respect to the previous case. The maximum output of the array will occur for $\theta = -90$ degrees in this case as opposed to 90 degrees in the previous case.

The complete expression for the equalized output can be shown to be:

$$p_{mdga}(r,\theta) := p_m(r)\cdot\left(1-\frac{2A}{\omega}\cdot\sin\left(k\cdot\frac{D}{2}\cdot\sin(\theta)\right)\right) \tag{66b}$$

The maximum frequency up to which the array directivity pattern is maintained can be calculated. It will be the same as what was calculated before for a dipole array.

$$f := \frac{c}{2\cdot D\cdot\sin(\theta)} \tag{67}$$

This frequency is a minimum when θ = +- 90 degrees.

$$f := \frac{c}{2 \cdot D} \quad \text{f depends on the element spacing.} \tag{68}$$

It is of interest to look at the system response for the case where θ = 0, +90, and -90 degrees.

$$p_{mdga}(r,0) := p_m(r) \cdot \left(1 + 2 \cdot j \cdot \sin\left(\frac{k \cdot D}{2} \cdot \sin(0)\right)\right) \tag{69}$$

$$p_{mdga}(r,0) := p_m(r) \tag{70}$$

The output is that of the single monopole source at all frequencies. For θ = 0 degrees, the dipole output will always be zero (output from the two elements is out of phase and arrives at the same time so complete cancellation occurs). Note that this is not a low frequency approximation. Also note the absence of any comb filter effects here. This is opposed to the behavior of the D-grad array where comb filtering occurred at higher frequencies.

The output for radiation at +90 and -90 degrees assuming low frequency conditions can be calculated from equation (61a).

$$Pmdga(r,90) := Pm(r) \cdot \left(1 + A \cdot \frac{D}{c} \cdot \sin(90)\right) \tag{71}$$

$$Pmgda(r,90) := Pm(r) \cdot (1 + B) \tag{72}$$

B is a new constant that incorporates A, D, and c, where B = AD/c.

$$Pmgda(r,-90) := Pm(r) \cdot \left(1 + A \cdot \frac{D}{c} \cdot \sin(-90)\right) \tag{73}$$

$$Pmgda(r,-90) := Pm(r) \cdot (1 - B) \tag{74}$$

The following ratios can be formed.

$$\frac{Pgda(90)}{Pgda(0)} := 1 + B \tag{75}$$

$$\frac{Pgda(90)}{Pgda(-90)} := \frac{1 + B}{1 - B} \tag{76}$$

The above analysis assumes the element spacing is fixed. B is directly proportional to the gain A of the dipole.

If A = c/D, B = 1 and the array will have a cardiod response. The radiation at +90 degrees will be twice (or 6 dB higher than) that at 0 degrees. There is a single null in the radiation pattern at -90 degrees. The radiation in the +90 degree direction is infinitely greater than radiation in the -90 degree direction.

Varying the gain of the dipole will affect the radiation pattern of the array. If A = 2c/D for example, B = 2. The radiation in the +90 degree direction will be three times (or 9.54 dB greater than) that in the 0 degree direction. It will also be three times the radiation in the -90 degree direction. Note that the radiation in the -90 degree direction has a sign change here. Also, there are now two nulls in the directivity pattern that occur at -30 and +210 degrees.

Varying the gain of the dipole element has essentially the same effect on array directivity as varying the delay had in the D-Grad case. There are some differences, however. As the gain of the dipole is varied, the maximum array output level can change whereas this is not possible when only delay is varied. Varying the delay changes the frequency range over which the low frequency approximations hold whereas varying the level of the dipole element does not.

Finally, we can look at what happens when two oppositely directed uni-directional MD-grad arrays that are coincident in space radiate simultaneously. Two cases will be analyzed. The first case will have each array radiating the same signal. This corresponds to a single array being fed a sum signal (L+R signal). The second case looks at what happens when the arrays are fed the same signals except that the polarity of one signal is inverted with respect to the other. This corresponds to the array being fed a difference signal.

$$p_{mdgsum}(r,\theta) := p_{mdga}(r,\theta) + p_{mdgb}(r,\theta) \tag{77}$$

$$p_{mdgsum}(r,\theta) := p_m(r)\cdot\left(1 + 2\cdot j\cdot\sin\left(\frac{k\cdot D}{2}\cdot\sin(\theta)\right)\right) + p_m(r)\cdot\left(1 - 2\cdot j\cdot\sin\left(\frac{k\cdot D}{2}\cdot\sin(\theta)\right)\right) \tag{78}$$

$$p_{mdgsum}(r,\theta) := 2\cdot p_m(r) \tag{79}$$

This analysis shows that sum signals will be radiated omni directionally. Note that this analysis did not use the low frequency approximation. It is valid over the entire operating range of the array. The pressure output is twice that of a single monopole element. There is no θ dependence. The array will have the frequency response of a monopole element. Equalization and gain settings of the dipole have no effect on the radiation of sum signals.

This occurs because equal but opposite signals are fed to each dipole element. These signals cancel and only the monopole element radiates. There is no high frequency comb filtering occurring here. This is opposed to the behavior of the D-grad array where sum signals suffered from comb filtering at high frequencies.

The derivation for the case where equal but opposite signals are applied to the array follows.

$$p_{mdgdiff}(r,\theta) := p_{mdga}(r,\theta) - p_{mdgb}(r,\theta) \tag{80}$$

$$p_{mdgdiff}(r,\theta) := p_m(r)\cdot\left(1 + 2\cdot j\cdot\sin\left(\frac{k\cdot D}{2}\cdot\sin(\theta)\right)\right) - p_m(r)\cdot\left(1 - 2\cdot j\cdot\sin\left(\frac{k\cdot D}{2}\cdot\sin(\theta)\right)\right) \tag{81}$$

$$p_{mdgdiff}(r,\theta) = 2\cdot p_m(r)\cdot\left(2\cdot j\cdot\sin\left(\frac{k\cdot D}{2}\cdot\sin(\theta)\right)\right) \tag{82a}$$

If equalization of the form A/jω is applied, equation 82a becomes:

$$p_{mdgdiff}(r,\theta) := 4\cdot p_m(r)\cdot\frac{A}{\omega}\cdot\sin\left(\frac{k\cdot D}{2}\cdot\sin(\theta)\right) \tag{82b}$$

Using the small angle approximation to equation 82a gives:

$$p_{mdgdiff}(r,\theta) := 2\cdot p_m(r)\cdot\left(\frac{j\cdot\omega\cdot D}{c}\cdot\sin(\theta)\right) \tag{83a}$$

Using the small angle approximation to equation 82b gives:

$$p_{mdgdiff}(r,\theta) := 2\cdot p_m(r)\cdot\left(\frac{A\cdot D}{c}\cdot\sin(\theta)\right) \tag{83b}$$

This is just twice the output of a doublet. The difference signal will be radiated by the array with a doublet radiation pattern, which is a dipole at low frequencies. Note the jω dependence in equation 83a and the lack of jω dependence in equation 83b.

Only the dipole elements radiate when difference signals are presented to the array. The monopole element is fed equal but opposite signals and therefore does not radiate.

Other useful relationships.

It was mentioned in the text that it may be possible to use the level of the delayed signal in a D-grad array as a spatial control. The analysis of this system follows.

$$p_{gd}(r,\theta) := \frac{\rho_o\cdot U_d}{4\cdot\pi}\cdot\left(\frac{e^{-j\cdot k\cdot r_1}\cdot e^{j\cdot k\cdot\frac{d}{4}}}{r_1} - A\cdot\frac{e^{-j\cdot k\cdot r_2}\cdot e^{-j\cdot k\cdot\frac{d}{4}}}{r_2}\right) \tag{84}$$

$$p_{gd}(r,\theta) := \frac{\rho_o\cdot U_d}{4\cdot\pi}\cdot e^{-j\cdot k\cdot r}\cdot\left(e^{j\left(\frac{k\cdot D}{4}\cdot\sin(\theta)+\frac{k\cdot d}{4}\right)} - A\cdot e^{-j\left(\frac{k\cdot D}{4}\cdot\sin(\theta)+\frac{k\cdot d}{4}\right)}\right) \tag{85}$$

$$p_{gd}(r,\theta) := \left(p_{m.}(r)\right)\cdot\left(e^{j\left(\frac{k\cdot D}{4}\cdot\sin(\theta)+\frac{k\cdot d}{4}\right)} - A\cdot e^{-j\left(\frac{k\cdot D}{4}\cdot\sin(\theta)+\frac{k\cdot d}{4}\right)}\right) \tag{86}$$

$$p_{gd}(r,\theta) = p_{m.}(r)\cdot\left[\left(\cos\left(\frac{k\cdot D}{4}\cdot\sin(\theta)+\frac{k\cdot d}{4}\right)+j\cdot\sin\left(\frac{k\cdot D}{4}\cdot\sin(\theta)+\frac{k\cdot d}{4}\right)\right) - A\cdot\cos\left[-\left(\frac{k\cdot D}{4}\cdot\sin(\theta)+\frac{k\cdot d}{4}\right)\right]\right]$$
$$-P_m(r)\cdot A\cdot j\cdot\sin\left[-\left(\frac{k\cdot D}{4}\cdot\sin(\theta)+\frac{k\cdot d}{4}\right)\right] \tag{87}$$

Using the relations :
cos(-a) = cos(a) and sin(-a) = -sin(a),
The above equation can be rewritten as:

$$p_{gd}(r,\theta) := p_{m.}(r)\cdot\left[(1-A)\cdot\cos\left(\frac{k\cdot D}{4}\cdot\sin(\theta)+\frac{k\cdot d}{4}\right)+(1+A)\cdot j\cdot\sin\left(\frac{k\cdot D}{4}\cdot\sin(\theta)+\frac{k\cdot d}{4}\right)\right] \tag{88}$$

This expression does not easily simplify further. Note that if A equals 1, this expression reduces to that of the D-grad array derived earlier. Also note as A goes to zero, this becomes the output of a simple monopole source. The actual directivity patterns generated for various values of delay d and gain A can be evaluated numerically if needed.

What is claimed is:

1. A sound reproduction system that accepts as input a stereo pair of electrical signals and outputs in response acoustical signals, the system comprising:

input means for accepting a stereo pair of electrical input signals, first and second amplification means for amplifying said pair of signals, first and second loudspeaker means for outputting a pair of acoustical signals, and first and second wave type directional devices for modifying the radiation pattern of said output acoustical signals, wherein the first input signal of the stereo pair of signals is amplified by said first amplification means, and wherein the output of said first amplification means is applied to said first loudspeaker means which gives rise to a first acoustic signal which is modified by said first wave type directional device so that it is radiated with a directional radiation pattern over at least the majority of the frequency range where interaural time difference (ITD) cues dominate localization in the human auditory system, said range covering frequencies from approximately 150 Hz to 1500 Hz, in which the directional radiation pattern has a main radiation lobe which is pointed in a first direction; and wherein the second input signal of the stereo pair of signals is amplified by said second amplification means, and wherein the output of said second amplification means is applied to said second loudspeaker means which gives rise to a second acoustic signal which is modified by said second wave type directional device so that it is radiated with a directional radiation pattern over at least the majority of said frequency range, in which the directional radiation pattern has a main radiation lobe which is pointed in a second direction which is different from said first direction.

2. A sound reproduction system that accepts as input a stereo pair of electrical signals and outputs in response acoustical signals, the system comprising:

input means for accepting a stereo pair of electrical input signals, signal processing means for altering characteristics of accepted input signals, and acoustic source means for outputting first and second acoustical signals, wherein the first input signal of the stereo pair of signals is processed by said signal processing means, wherein the resulting output of said signal processing means is applied to said acoustic source means which gives rise to a first acoustic signal which is radiated with a directional radiation pattern having a first order gradient characteristic over at least the majority of the frequency range where interaural time difference (ITD) cues dominate localization in the human auditory system, said range covering frequencies approximately from 150 Hz to 1500 Hz, in which the directional radiation pattern has a main radiation lobe which is pointed in a first direction; and wherein the second input signal of the stereo pair of signals is processed by said signal processing means, wherein the resulting output of said signal processing means is applied to said acoustic source means which gives rise to a second acoustic signal which is radiated with a directional radiation pattern having a first order gradient characteristic over at least the majority of said frequency range, in which the directional radiation pattern has a main radiation lobe which is pointed in a second direction, which is different from said first direction.

3. The system of claim 2, in which both input signals are radiated with first order gradient radiation patterns which have an apparent origin in space from which sound appears to emanate, wherein the apparent origins for the first and second radiated signals are located in close proximity to each other, so that they appear approximately coincident over said frequency range.

4. The system of claim 2, in which said acoustic source means includes at least one monopole acoustic source and at least one dipole acoustic source, wherein said first order gradient directional patterns are formed by combining the outputs of said monopole acoustic source and said dipole acoustic source.

5. The system of claim 4 in which said signal processing means includes means for altering the signals applied to the monopole and dipole acoustic sources so that the shape of the magnitude frequency response of the dipole acoustic source output for the first input signal substantially matches the shape of the magnitude frequency response of the monopole acoustic source output for the first input signal, and the shape of the magnitude frequency response of the dipole acoustic source output for the second input signal substantially matches the shape of the magnitude frequency response of the monopole acoustic source output for the second input signal, and wherein said means for altering the signals applied to the monopole and dipole acoustic sources also alters the phase relationship between the dipole and monopole acoustic source outputs, so that the phase frequency responses of the monopole and dipole acoustic source outputs, for the first and second input signals, are either approximately in phase or approximately 180 degrees out of phase, over said frequency range.

6. The system of claim 4 in which said dipole acoustic source includes a loudspeaker, wherein the loudspeaker includes transducer means, wherein said transducer means has front and back sides which both radiate sound simultaneously; and enclosure means, wherein said transducer is mounted in said enclosure means so that both the front and back sides are exposed to free air.

7. The system of claim 4 in which said dipole acoustic source includes a loudspeaker, wherein the loudspeaker includes a pair of transducer means, wherein said transducer means each have front and back sides which both radiate sound simultaneously; and enclosure means, wherein said transducer means are both mounted in said enclosure means to separate radiation from the front of said transducer means from radiation from the back of said transducer means, wherein both said transducer means are mounted in close proximity to each other, and wherein the signals radiated by the front sides of said two transducer means have inverted relative polarity.

8. The system of claim 5, wherein said signal processing means processes the signals applied to said monopole and dipole sources differently, wherein the difference approximates an integration function over said frequency range, said integration function having a magnitude frequency response that decreases 20 dB per decade as frequency increases, and a phase frequency response that has a constant 90 degrees of phase shift, wherein the approximate integration function is performed on the signal that is applied to the dipole acoustic source but is not applied to the signal that is applied to the monopole acoustic source.

9. The system of claim 8, further including high pass filter means in the dipole acoustic source signal path to reduce the low frequency boost applied by said signal processing means which approximates an integration function, below said frequency range; and all pass filter means in the monopole acoustic source signal path, wherein said all pass filter means is constrained to have the same phase frequency response as that of said high pass filter means added in the dipole acoustic source signal path.

10. The system of claim 9 wherein said high pass filter means is critically damped and has second order, and wherein said all pass filter means is first order, and the corner frequencies of the high pass filter means and the all pass filter means are identical.

11. The system of claim 4, including first and second monopole acoustic sources and first and second dipole acoustic sources, wherein the outputs of the first monopole source and first dipole source are combined to radiate the first signal of the stereo pair of electrical input signals with a first order gradient directional pattern, and wherein the output of the second monopole source is combined with the output of the second dipole source to radiate the second signal of the stereo pair of electrical input signals with a first order gradient directional pattern.

12. The system of claim 4, including first and second monopole acoustic sources, and a dipole acoustic source, wherein the outputs of the first monopole source and said dipole source are combined to radiate the first signal of the stereo pair of electrical input signals with a first order gradient directional pattern, and wherein the output of the second monopole source is combined with the output of the dipole source to radiate the second signal of the stereo pair of electrical input signals with a first order gradient directional pattern.

13. The system of claim 4, including a monopole acoustic source and first and second dipole acoustic sources, wherein the outputs of the monopole source and first dipole source are combined to radiate the first signal of the stereo pair of electrical input signals with a first order gradient directional pattern, and wherein the output of the monopole source is combined with the output of the second dipole source to radiate the second signal of the stereo pair of electrical input signals with a first order gradient directional pattern.

14. The system of claim 4, including a monopole acoustic source and a dipole acoustic source, wherein the outputs of the monopole source and dipole source are combined to radiate the first signal of the stereo pair of electrical input signals with a first order gradient directional pattern, and wherein the output of the monopole source is combined with the output of the dipole source to also simultaneously radiate the second signal of the stereo pair of electrical input signals with a first order gradient directional pattern.

15. The system of claim 4, including a pair of monopole acoustic sources, wherein each said source acts as a monopole, and simultaneously both said sources are combined to form a dipole, wherein the dipole is formed by applying the same signal simultaneously to both monopole sources with inverted relative polarity, and wherein the output of the first monopole is combined with the output of the dipole formed by the pair of monopoles to radiate the first signal of the stereo pair of electrical input signals with a first order gradient directional pattern, and wherein the output of the second monopole source is simultaneously combined with the output of the dipole source formed from the two monopole sources to radiate the second signal of the stereo pair of electrical input signals with a first order gradient directional pattern.

16. The system of claim 4, including a pair of monopole acoustic sources, wherein both said sources combine to function as a single monopole, wherein the single monopole is formed by applying the same signal simultaneously to both monopole acoustic sources, and simultaneously both monopole acoustic sources are combined to form a dipole, wherein the dipole is formed by applying the same signal simultaneously to both monopole sources with inverted relative polarity, wherein the output of the single monopole formed by the pair of monopole acoustic sources is combined with the output of the dipole formed by the pair of monopoles acoustic sources to radiate the first signal of the stereo pair of electrical input signals with a first order gradient directional pattern, and wherein the output of the single monopole formed from the two monopole acoustic sources simultaneously is combined with the output of the dipole source formed from the two monopole acoustic sources to radiate the second signal of the stereo pair of electrical input signals with a first order gradient directional pattern.

17. The system of claim 2, in which said acoustic source means includes at least two monopole acoustic sources, and wherein a first order gradient directional pattern is formed by combining the outputs of at least two monopole acoustic sources, wherein the signal applied to one monopole source is delayed and inverted in polarity by said signal processing means with respect to the signal applied to the second monopole source.

18. The system of claim 17 in which said signal processing means further includes means for equalizing said first and second input electrical signals over said frequency range, in which said means for equalizing has a magnitude frequency response that approximates that of an ideal integration, wherein said ideal integration has a magnitude frequency response that is a linear function of frequency which decreases 20 dB per decade as frequency increases for all frequencies, to alter the magnitude frequency response of said first and second input electrical signals radiated by said acoustic sources to have an approximately flat magnitude frequency response over said frequency range.

19. The system of claim 17, in which said signal processing means processes signals that are input to said acoustic source means, wherein said acoustic source means includes first, second, third, and fourth monopole acoustic sources, wherein the outputs of the first and second monopole sources are combined to radiate the first signal of the stereo pair of electrical input signals with a first order gradient directional pattern, and wherein the output of the third and fourth monopole sources are combined to radiate the second signal of the stereo pair of electrical input signals with a first order gradient directional pattern, wherein said signal processing means delays and inverts the signals applied to the second and fourth monopole sources with respect to the signals applied to the first and third monopole sources.

20. The system of claim 17, in which said signal processing means processes signals that are input to said acoustic source means, wherein said acoustic source means includes first, second, and third monopole acoustic sources, wherein the outputs of the first and second monopole sources are combined to radiate the first signal of the stereo pair of electrical input signals with a first order gradient directional pattern, and wherein the outputs of the second and third monopole sources are combined to radiate the second signal of the stereo pair of electrical input signals with a first order gradient directional pattern, wherein said signal processing means delays and inverts the signals applied to the second monopole source with respect to the signals applied to the first and third monopole sources.

21. The system of claim 17, in which said signal processing means processes signals that are input to said acoustic source means, wherein said acoustic source means includes first, second, and third monopole acoustic sources, wherein the outputs of the first and second monopole sources are combined to radiate the first signal of the stereo pair of electrical input signals with a first order gradient directional pattern, and wherein the outputs of the second and third monopole sources are combined to radiate the second signal of the stereo pair of electrical input signals with a first order gradient directional pattern, wherein said signal processing means delays and inverts the signals applied to the first and third monopole sources with respect to the signals applied to the second monopole source.

22. The system of claim 17, in which said signal processing means processes signals that are input to said acoustic source means, wherein said acoustic source means includes first and second monopole acoustic sources, wherein the outputs of the first and second monopole sources are combined to radiate the first signal of the stereo pair of electrical input signals with a first order gradient directional pattern, and wherein the output of the first and second monopole sources are also simultaneously combined to radiate the second signal of the stereo pair of electrical input signals with a first order gradient directional pattern, wherein the portion of the first input signal applied to the second monopole source is delayed and inverted by said signal processing means with respect to the portion of the first input signal applied to the first monopole source, and wherein the portion of the second input signal applied to the first monopole source is delayed and inverted by said signal processing means with respect to the portion of the second input signal applied to the second monopole source.

23. The system of claim 1, further including signal processing means and user adjustable spatial control means, wherein said signal processing means forms first and second signals that represent the sum and difference respectively of the two input electrical signals, wherein said user adjustable spatial control means adjusts the relative level of the difference signal with respect to the sum signal, and wherein said signal processing means forms additional third and fourth signals that represent the sum and difference respectively of said first and second signals formed by said signal processing means that have been adjusted by said user adjustable spatial control means.

24. The system of claim 2, further including a user adjustable spatial control, for adjusting the shape of the first order gradient directional radiation patterns, wherein said user adjustable spatial control simultaneously adjusts the first and second directional patterns.

25. The system of claim 4, wherein said signal processing means includes level adjustment means for varying the relative level of signal applied to said dipole acoustic source means with respect to the signal level applied to said monopole acoustic source means, and further including a user adjustable spatial control, for adjusting the shape of the first order gradient directional radiation patterns, wherein said user adjustable spatial control simultaneously adjusts the first and second directional radiation patterns, and wherein the directional radiation patterns are adjusted by adjusting said level adjustment means.

26. The system of claim 17, wherein said signal processing means includes time delay adjustment means for varying the relative amount of time delay applied to the signal input to second monopole source means with respect to the signal input to first monopole acoustic source means, and further including user adjustable spatial control means which adjusts said time delay adjustment means to simultaneously adjust the shape of the first order gradient directional radiation patterns.

27. The system of claim 26, wherein said signal processing means further includes signal level adjustment means for adjusting the signal level of the time delayed signal applied to said second monopole source means relative to the signal level of the signal applied to said first monopole source means, and further including second user adjustable spatial control means which adjusts said signal level adjustment means, to simultaneously adjust the shape of the first order gradient directional radiation patterns.

28. The system of claim 26, in which said signal processing means includes a time delay, and further including voltage controlled first order filter means which has a corner frequency and a magnitude frequency response above the corner frequency which is flat, and a magnitude frequency response below the corner frequency which approximates an ideal integrator over said frequency range, further including means for applying a control voltage to said filter means to adjust said corner frequency to track the amount of time delay in the signal processing means, wherein said filter means substantially maintains a flat magnitude frequency response over the entire frequency range where first order gradient directional patterns are radiated for a particular time delay.

29. The system of claim 4 further including dynamic gain reduction means located in the dipole acoustic source signal path, wherein said dynamic gain reduction means includes voltage controlled amplifier means and control voltage generator means, wherein said control voltage generator means senses the level of signal present in the dipole acoustic source signal path, generates a control voltage that is a function of that signal level, and applies that voltage to said voltage controlled amplifier means to change its gain, for dynamically adjusting the level of the signal applied to the dipole acoustic source.

30. The system of claim 29, wherein said first and second input electrical signals have a signal to noise ratio, wherein said signal processing means further includes a second input to said control voltage generator means that is responsive to said signal to noise ratio, wherein said control voltage generator means has an internal threshold function, and wherein the control voltage generator means generates a control voltage that reduces the gain in the dipole signal path when said signal to noise ratio drops below said internal threshold, to perform a mono blend function.

31. The system of claim 29 further including dynamic gain reduction means located in the monopole source signal path, wherein said dynamic gain reduction means includes voltage controlled amplifier means and control voltage generator means, wherein said control voltage generator means senses the level of the signal present in the monopole acoustic source signal path, generates a control voltage that is a function of that signal level, and applies that voltage to said voltage controlled amplifier means to change its gain, for dynamically adjusting the level of the signal applied to the monopole source.

32. The system of claim 1 further including dynamic gain reduction means located in the acoustic source signal path, wherein said dynamic gain reduction means includes voltage controlled amplifier means and control voltage generator means, wherein said control voltage generator means senses the level of signal present in the acoustic source signal path, generates a control voltage that is a function of that signal level, and applies that voltage said voltage controlled amplifier means to change its gain, for dynamically adjusting the level of the signal applied to the acoustic sources.

33. The system of claim 2 further including dynamic gain reduction means located in the acoustic source signal path, wherein said dynamic gain reduction means includes voltage controlled amplifier means and control voltage generator means, wherein said control voltage generator means senses the level of signal present in the acoustic source signal path, generates a control voltage that is a function of that signal level, and applies that voltage to said voltage controlled amplifier means to change its gain, for dynamically adjusting the level of the signal applied to the acoustic sources.

34. The system of claim 4, wherein said signal processing means incorporates first dynamic filter means located in the dipole acoustic source signal path, and second dynamic filter means located in the monopole acoustic source signal path, wherein each dynamic filter means includes a voltage controlled high pass filter means which has a corner frequency, wherein said signal processing further includes control voltage generator means, where the control voltage generator means senses the level of signal present in the dipole acoustic source signal path, generates a control voltage that is a function of that signal level, and applies that voltage to each voltage controlled high pass filter means to change their respective corner frequencies in an identical manner, so as not to change the relative magnitude and phase frequency responses of the signals present in the monopole and dipole acoustic source signal paths, where the control function acts to increase the corner frequencies when the signal level sensed by the control voltage generator means increases, to dynamically adjust the level of low frequency signal applied to the acoustic sources.

35. The system of claim 4, wherein said signal processing means incorporates first dynamic filter means located in the dipole acoustic source signal path, and second dynamic filter means located in the monopole acoustic source signal path, wherein the dynamic filter means in the dipole acoustic source signal path includes voltage controlled high pass filter means which has a corner frequency, and the dynamic filter means in the monopole acoustic source signal path includes voltage controlled all pass filter means which has a corner frequency, wherein said signal processing further includes control voltage generator means, wherein the control voltage generator means senses the level of signal present in the dipole acoustic source signal path, generates a control voltage that is a function of that signal level, and applies that voltage to each dynamic filter means to change their respective corner frequencies, wherein the control voltage generator means increases the corner frequencies of each dynamic filter means when the signal level sensed by said control voltage generator means increases, to dynamically adjust the level of low frequency signal applied to said acoustic sources, and wherein the orders of the high pass filter means and all pass filter means are chosen so that the shape of the phase frequency response of the voltage controlled all pass filter means is substantially similar to the shape of the phase frequency response shape of the voltage controlled high pass filter means.

36. The system of claim 2, wherein acoustic source means that radiates the first input electrical signal with a first order gradient directional radiation pattern includes at least two loudspeaker means, wherein each loudspeaker means includes transducer means and enclosure means, wherein transducer means are mounted in enclosure means, and wherein enclosure means includes port means, wherein the transducer means and port means included in the loudspeaker means that form the acoustic source means are mounted such that the transducer means are spaced physically closer to each other than the associated port means of the enclosures in which the transducers means are mounted, and wherein acoustic source means that radiate the second input electrical signal with a first order gradient directional radiation pattern includes at least two loudspeaker means, wherein said loudspeaker means may or may not be the same loudspeaker means that form the first acoustic source means, wherein each loudspeaker means includes transducer means and enclosure means, wherein transducer means are mounted in enclosure means, and wherein enclosure means includes port means, wherein the transducer means and port means included in the loudspeaker means that form the acoustic source means are mounted such that the transducer means are spaced physically closer to each other than the associated port means of the enclosures in which the transducers means are mounted.

37. The system of claim 4, wherein acoustic source means that radiates the first input electrical signal with a first order gradient directional radiation pattern includes at least two loudspeaker means, wherein each loudspeaker means includes transducer means and enclosure means, wherein transducer means are mounted in enclosure means, and wherein enclosure means includes port means, wherein the transducer means and port means included in the loudspeaker means that form the acoustic source means are mounted such that the transducer means are spaced physically closer to each other than the associated port means of the enclosures in which the transducers means are mounted, and wherein acoustic source means that radiate the second input electrical signal with a first order gradient directional radiation pattern includes at least two loudspeaker means, wherein said loudspeaker means may or may not be the same loudspeaker means that form the first acoustic source means, wherein each loudspeaker means includes transducer means and enclosure means, wherein transducer means are mounted in enclosure means, and wherein enclosure means includes port means, wherein the transducer means and port means included in the loudspeaker means that form the acoustic source means are mounted such that the transducer means are spaced physically closer to each other than the associated port means of the enclosures in which the transducers means are mounted.

38. The system of claim 17, wherein acoustic source means that radiates the first input electrical signal with a first order gradient directional radiation pattern includes at least two loudspeaker means, wherein each loudspeaker means includes transducer means and enclosure means, wherein transducer means are mounted in enclosure means, and wherein enclosure means includes port means, wherein the transducer means and port means included in the loudspeaker means that form the acoustic source means are mounted such that the transducer means are spaced physically closer to each other than the associated port means of the enclosures in which the transducers means are mounted, and wherein acoustic source means that radiate the second input electrical signal with a first order gradient directional radiation pattern includes at least two loudspeaker means, wherein said loudspeaker means may or may not be the same loudspeaker means that form the first acoustic source means, wherein each loudspeaker means includes transducer means and enclosure means, wherein transducer means are mounted in enclosure means, and wherein enclosure means includes port means, wherein the transducer means and port means included in the loudspeaker means that form the acoustic source means are mounted such that the transducer means are spaced physically closer to each other than the associated port means of the enclosures in which the transducers means are mounted.

39. The system of claim 3, wherein the resulting first order gradient radiation patterns of the first and second input electrical signals radiated are formed by combining the outputs of first and second acoustic source means, wherein said first acoustic source means has a first order gradient radiation pattern with a main radiation lobe pointed in a first direction, and said second acoustic source means has a dipole radiation pattern with a main radiation lobe pointed in a direction that is rotated 90 degrees with respect to the main radiation lobe direction of the first acoustic source means, wherein said signal processing means equalizes the signals applied to said first and second acoustic source means so that the outputs of said first and second acoustic sources have substantially identical magnitude frequency response shapes over said frequency range, and said first and second acoustic sources have substantially identical phase frequency response shapes over said frequency range.

40. The system of claim 39, wherein said signal processing means further includes level control means for adjusting the relative level of the signals applied to first and second acoustic source means, which can be adjusted by the user to adjust the radiation pattern shape and main radiation lobe direction of the radiated first and second electrical input signals.

41. The system of claim 39, further including a user control means to vary the shape of the radiation pattern of the first acoustic source output, to adjust the radiation pattern shape and main radiation lobe direction of the radiated first and second electrical input signals.

42. The system of claim 40, further including a user control means to vary the shape of the radiation pattern of the first order gradient acoustic source output, to adjust the radiation pattern shape and main radiation lobe direction of the radiated first and second electrical input signals.

43. The system of claim 39, wherein said first acoustic source means is formed by combining the output of a monopole acoustic source with the output of dipole acoustic source, wherein said signal processing means includes means for altering the signals applied to said monopole and dipole sources that form the first acoustic source means, so that the shape of the magnitude frequency response of the dipole acoustic source output substantially matches the shape of the magnitude frequency response of the monopole acoustic source output for the first and second input electrical signals, and wherein said signal processing also alters the phase relationship between the dipole and monopole acoustic source outputs, so that the phase frequency responses of the monopole and dipole acoustic source outputs are either approximately in phase or approximately 180 degrees out of phase, for the first and second input electrical signals, over said frequency range.

44. The system of claim 43, further including a user adjustable control for varying the relative level of the signal applied to the dipole acoustic source with respect to the level of signal applied to the monopole acoustic source that form said first acoustic source means, to allow the user to adjust the shape of the radiation patterns of the radiated first and second input electrical signals without altering the main radiation directions of the radiated pair of input electrical signals.

45. The system of claim 43, further including a user adjustable control for varying the relative level of the signal applied to the dipole acoustic source that forms part of said first acoustic source means with respect to the level of signal applied to the dipole acoustic source that forms said second acoustic source, wherein the relative levels vary with a sin/cos relationship, to allow the user to rotate the main radiation directions of the radiated first and second input electrical signals without altering the shapes of their associated radiation patterns.

46. The system of claim 4, wherein said acoustic source means that radiates the first input electrical signal with a first order gradient directional radiation pattern is formed from at least two loudspeaker means, wherein each loudspeaker means includes low frequency transducer means for reproducing low frequencies and high frequency transducer means for reproducing high frequencies, and enclosure means, wherein each transducer means are mounted said enclosure means, wherein the transducer means included in loudspeaker means that form said acoustic source means are mounted such that said high frequency transducer means are spaced physically closer to each other than said low frequency transducer means, and wherein said acoustic source means that radiates the second input electrical signal with a first order gradient directional radiation pattern is formed from at least two loudspeaker means, wherein each loudspeaker means includes low frequency transducer means for reproducing low frequencies and high frequency transducer means for reproducing high frequencies, and enclosure means, wherein each transducer means are mounted said enclosure means, wherein the transducer means included in loudspeaker means that form said acoustic source means are mounted such that said high frequency transducer means are spaced physically closer to each other than said low frequency transducer means, and wherein said signal processing includes crossover means for splitting the input signals to each loudspeaker means into a low frequency signal and a high frequency signal, wherein the low frequency signal is applied to said low frequency transducer means and the high frequency signal is input to said high frequency transducer means.

47. A sound reproduction system that accepts as input a stereo pair of electrical signals and outputs in response acoustical signals, the system comprising:

input means for accepting a stereo pair of electrical input signals, signal processing means for altering characteristics of accepted input signals, and first and second acoustic source means for outputting first and second acoustical signals, wherein said first acoustical source has a monopole radiation pattern and said second acoustical source has a dipole radiation pattern over at least the majority of the frequency range where interaural time difference cues (ITD) dominate localization in the human auditory system, and wherein the origins in space of the monopole acoustic source and dipole acoustic source radiation patterns appear substantially coincident, over said frequency range, and wherein said signal processing means creates a first signal that is the sum of the pair of electrical input signals and creates a second signal that is the difference between the pair of electrical input signals, wherein said signal processing further includes means for altering the sum and difference signals so that the shape of the magnitude frequency response of the dipole acoustic source output for the first electrical input signal substantially matches the shape of the magnitude frequency response of the monopole acoustic source output for the first input signal, over said frequency range, and wherein the shape of the magnitude frequency response of the dipole acoustic source output for the second electrical input signal substantially matches the shape of the magnitude frequency response of the monopole acoustic source output for the second input signal, over said frequency range, when the altered sum signal is input to the monopole acoustic source and the altered difference signal is input to the dipole acoustical source, and wherein said means for altering said sum and difference signals which are applied to the monopole and dipole acoustic sources respectively, also alters the phase relationship between the dipole and monopole acoustic source outputs, so that the phase frequency responses of the monopole and dipole acoustic source outputs, for the first and second input signals, are either approximately in phase or approximately 180 degrees out of phase, over said frequency range.

48. A sound reproduction system that accepts as input a stereo pair of electrical signals and outputs in response acoustical signals, the system comprising:

input means for accepting a stereo pair of electrical input signals, signal processing means for altering characteristics of accepted input signals, and first and second acoustic source means for outputting first and second acoustical signals, wherein said first acoustical source has a monopole radiation pattern and said second acoustical source has a monopole radiation pattern, and wherein said signal processing means creates a first signal that is the sum of the pair of electrical input signals and creates a second signal that is the difference between the pair of electrical input signals, wherein said signal processing further includes means for altering the sum and difference signals, wherein the altered sum signal is simultaneously input to both monopole acoustic sources with identical polarity to form a combined monopole source, and the altered difference signal is simultaneously applied to both monopole acoustic sources with inverted relative polarity to form a combined dipole acoustic source, wherein the origins in space of the combined monopole acoustic source and combined dipole acoustic source radiation patterns appear substantially coincident, over at least the majority of the frequency range where interaural time difference cues (ITD) dominate localization in the human auditory system, and wherein said signal processing means alters said sum and difference signals so that the shape of the magnitude frequency response of the combined dipole acoustic source output for the first electrical input signal substantially matches the shape of the magnitude frequency response of the combined monopole acoustic source output for the first electrical input signal, over said frequency range, and wherein the shape of the magnitude frequency response of the combined dipole acoustic source output for the second electrical input signal substantially matches the shape of the magnitude frequency response of the combined monopole acoustic source output for the second electrical input signal, over said frequency range, and wherein said means for altering said sum and difference signals also alters the phase relationship between the combined dipole acoustic source output and the combined monopole acoustic source output, so that the phase frequency responses of the combined monopole and combined dipole acoustic source outputs, for the first and second input signals, are either approximately in phase or approximately 180 degrees out of phase, over said frequency range.

49. A sound reproduction system that accepts as input a stereo pair of electrical signals and outputs in response acoustical signals, the system comprising:

input means for accepting a stereo pair of electrical input signals, signal processing means for altering characteristics of accepted input signals, and first and second acoustic source means for outputting first and second acoustical signals, wherein said first and second acoustical sources have monopole radiation patterns, and wherein said signal processing means creates a signal that is the difference between the pair of electrical input signals, wherein said signal processing further includes means for altering the electrical input signals and said difference signal, wherein the altered first electrical input signal is input to the first monopole source and the altered second input electrical signal is input to the second monopole acoustic source, and the altered difference signal is simultaneously applied to both monopole acoustic sources with inverted relative polarity to form a combined dipole acoustic source, wherein the origins in space of the monopole acoustic sources and the combined dipole acoustic source radiation patterns appear substantially coincident, over at least the majority of the frequency range where interaural time difference cues (ITD) dominate localization in the human auditory system, and wherein said signal processing means alters said electrical input signals and said difference signal so that the shape of the magnitude frequency response of the combined dipole acoustic source output for the first electrical input signal substantially matches the shape of the magnitude frequency response of the first monopole acoustic source output for the altered first electrical input signal, over said frequency range, and wherein the shape of the magnitude frequency response of the combined dipole acoustic source output for the second electrical input signal substantially matches the shape of the magnitude frequency response of the second monopole acoustic source output for the second electrical input signal, over said frequency range, and wherein said means for altering said electrical input signals and said difference signal also alters the phase relationship between the combined dipole acoustic source output and each monopole acoustic source output, so that the phase frequency responses of each monopole and combined dipole acoustic source outputs, for the first and second input signals, are either approximately in phase or approximately 180 degrees out of phase, over said frequency range.

* * * * *